US006580223B2

(12) United States Patent
Konishi et al.

(10) Patent No.: US 6,580,223 B2
(45) Date of Patent: Jun. 17, 2003

(54) FLAT-TYPE DISPLAY

(75) Inventors: Morikazu Konishi, Kanagawa (JP); Koichi Iida, Kanagawa (JP)

(73) Assignee: Sony Corporation (JP)

( * ) Notice: Subject to any disclaimer, the term of this patent is extended or adjusted under 35 U.S.C. 154(b) by 83 days.

(21) Appl. No.: 09/802,131

(22) Filed: Mar. 9, 2001

(65) Prior Publication Data

US 2002/0011777 A1 Jan. 31, 2002

(30) Foreign Application Priority Data

Mar. 10, 2000 (JP) ..... 2000-067641
Jun. 12, 2000 (JP) ..... 2000-175011
Oct. 31, 2000 (JP) ..... 2000-332522

(51) Int. Cl.[7] ..... G09G 3/10; H01J 1/62
(52) U.S. Cl. ..... 315/169.3; 313/497
(58) Field of Search ..... 315/169.1, 169.2, 315/169.3; 313/422, 495, 496, 497

(56) References Cited

U.S. PATENT DOCUMENTS 5,550,066 A * 8/1996 Tang et al. ..... 148/DIG. 150
5,821,622 A * 10/1998 Tsuji et al. ..... 257/72
6,103,558 A * 8/2000 Yamanaka et al. ..... 349/161
6,114,183 A * 9/2000 Hamada et al. ..... 313/504
6,195,196 B1 * 2/2001 Kimura et al. ..... 349/64
6,246,179 B1 * 6/2001 Yamada ..... 313/498
6,372,558 B1 * 4/2002 Yamanaka et al. ..... 349/42
6,420,758 B1 * 7/2002 Nakajima ..... 257/350

* cited by examiner

*Primary Examiner*—Haissa Philogene
*Assistant Examiner*—Minh D A
(74) *Attorney, Agent, or Firm*—Radar, Fishman & Grauer PLLC; Ronald P. Kananen, Esq.

(57) ABSTRACT

A flat-type display comprising a first panel having electron-emitting portions; a second panel having an electron irradiation surface; and an electron-emitting-portion driving circuit for driving the electron-emitting portions, wherein an electron-emitting-portion cutoff circuit is provided between the electron-emitting portions and the electron-emitting-portion driving circuit for preventing a discharge between the electron-emitting portions and the electron irradiation surface.

26 Claims, 85 Drawing Sheets

[STEP-100]

[STEP-110]

[STEP-120]

[STEP-120] CONTINUED

[STEP-200]

[STEP-210]

[STEP-220]

[STEP-230]

[STEP-240]

[STEP-240]

[STEP-300]

[STEP-310]

[STEP-330]

[STEP-400]

[STEP-410]

[STEP-410] CONTINUED

[STEP-520]

[STEP-530]

[STEP-530] CONTINUED

[STEP-540]

[STEP-600]

[STEP-620]

[STEP-630]

[STEP-800]

[STEP-810]

[STEP-820]

[STEP-840]

[STEP-850]

[STEP-900]

[STEP-910]

[STEP-920]

[STEP-1000]

[STEP-1010]

[STEP-1020]

[STEP-1120]

[STEP-1130]

[STEP-1140]

[STEP-1150]

[STEP-1200]

[STEP-1210]

[STEP-1220]

[STEP-1300]

[STEP-1310]

[STEP-1320]

[STEP-1330]

[STEP-1330] CONTINUED

[STEP-1340]

Fig. 64A SELECTION RATIO TO RESIST : SMALL
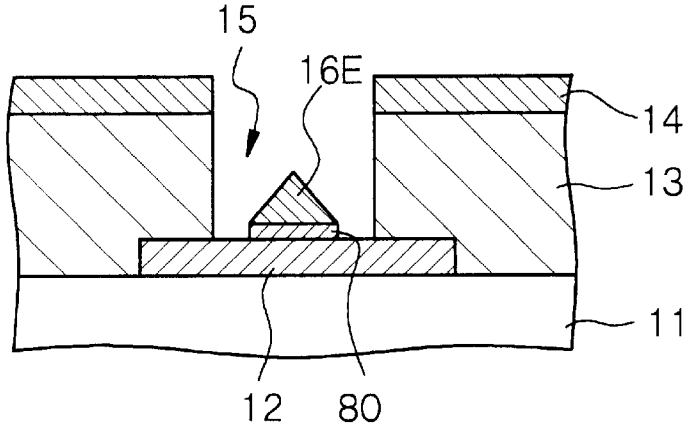
Fig. 64B SELECTION RATIO TO RESIST : INTERMEDIATE
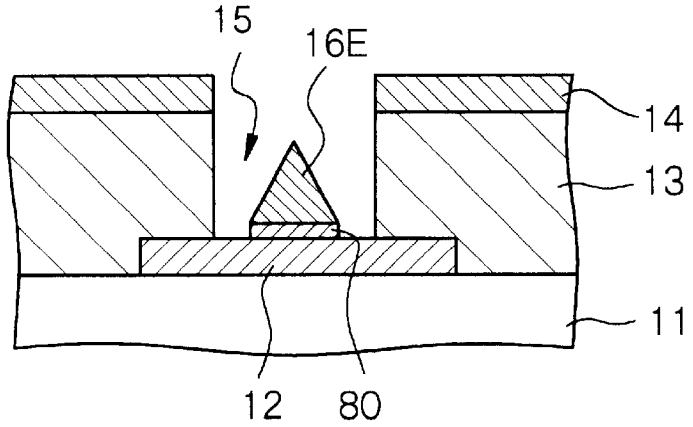
Fig. 64C SELECTION RATIO TO RESIST : LARGE
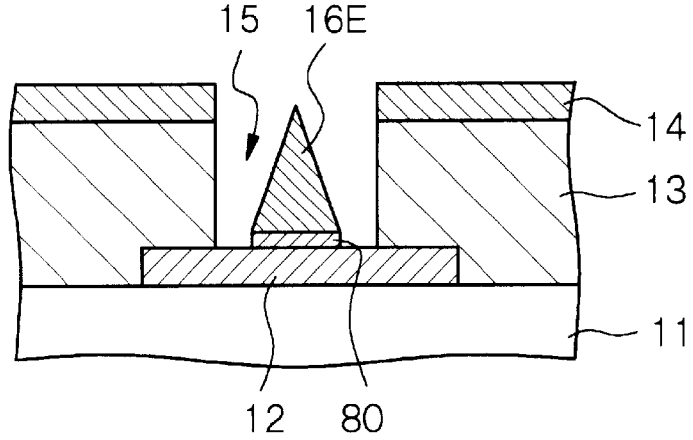

[STEP-1400]

[STEP-1410]

[STEP-1420]

[STEP-1430]

[STEP-1440]

[STEP-1450]

[STEP-1500]

[STEP-1510]

[STEP-1520]

[STEP-1600]

[STEP-1600] CONTINUED

[STEP-1610]

[STEP-1620]

[STEP-1620] CONTINUED

[STEP-1630]

[STEP-1700]

[STEP-1710]

[STEP-1720]

[STEP-1730]

[STEP-1800]

POTENTIAL CHANGE OF GATE ELECTRODE DUE TO DISCHARGE

FLAT-TYPE DISPLAY

BACKGROUND OF THE INVENTION AND RELATED ART STATEMENT

The present invention relates to a flat-type display such as a cold cathode field emission display.

As an image display device that can be substituted for a currently mainstream cathode ray tube (CRT), flat-screen (flat-panel) displays are studied in various ways. Such flat-panel displays include a liquid crystal display (LCD), an electroluminescence display (ELD) and a plasma display (PDP). There has been also proposed a cold cathode field emission display capable of emitting electrons into a vacuum from a solid without relying on thermal excitation, a so-called a field emission display (FED), and it attracts attention from the viewpoint of the brightness of a display screen and low power consumption.

FIG. 82 shows a typical constitution of the cold cathode field emission display (to be sometimes abbreviated as "display" hereinafter), and FIG. 83 shows a schematic exploded view of some portions of a first panel 10 and a second panel 20. In this display, the first panel (cathode panel) 10 and the second panel (anode panel) 20 are arranged to face each other and bonded to each other in their circumferential portions through a frame (not shown), so that a closed space between these two panels 10 and 20 constitutes a vacuum space. The first panel 10 has cold cathode field emission devices (to be sometimes referred to as "field emission device" hereinafter) as electron-emitting elements. FIG. 82 shows, as one example, so-called Spindt-type field emission devices each of which has electron-emitting portion 16 constituted of a conical electron emission electrode 16A. The Spindt-type field emission device comprises a stripe-shaped cathode electrode 12 formed on a support member 11, an insulating layer 13, a stripe-shaped gate electrode 14 formed on the insulating layer 13, and the conical electron emission electrode 16A formed in an opening portion 15 formed in the gate electrode 14 and the insulating layer 13. Generally, a predetermined number of such electron emission electrodes 16A having a predetermined arrangement are formed to correspond to one of phosphor layers 22 to be described later. A relatively negative voltage (scanning signal) is applied to the electron emission electrode 16A from a cathode-electrode driving circuit 34 through the cathode electrode 12, and a relatively positive voltage (video signal) is applied to the gate electrode 14 from a gate-electrode driving circuit 31. Depending upon an electric field generated by the application of these voltages, electrons are emitted from the top end of the electron emission electrode 16A on the basis of a quantum tunnel effect. The electron emission device shall not be limited to the above Spindt-type field emission device, and field emission devices of other types such as edge-type, flat-type, etc., are used in some cases.

The second panel 20 comprises a plurality of phosphor layers 22 (phosphor layers 22R, 22G and 22B) formed on a substrate 21 made, for example, of glass, the phosphor layers 22 having the form of a matrix or a stripe, a black matrix 23 filled between one phosphor layer 22 and another phosphor layer 22, and an anode electrode 24 formed on the entire surface of the phosphor layers 22 and the black matrix 23. A positive voltage higher than the positive voltage applied to the gate electrode 14 is applied to the anode electrode 24 from an anode-electrode driving circuit 37, and the anode electrode 24 works to guide electrons emitted to the vacuum space from the electron emission electrode 16A toward the phosphor layer 22. Further, the anode electrode 24 also works to protect the phosphor particles constituting the phosphor layer 22 from sputtering by particles such as ions and works to reflect light emitted by the phosphor layers 22 on the basis of electron excitation to the side of the substrate 21 to improve the brightness of a display screen observed from an outside of the substrate 21. The anode electrode 24 is made, for example, of a thin aluminum film.

Generally, the cathode electrode 12 and the gate electrode 14 are formed in the form of a stripe each in directions in which the projection images of these two electrodes 12 and 14 cross each other at right angles, and generally, a plurality of the field emission devices are arranged in an overlap region of the projection images of these two electrodes 12 and 14 (the overlap region corresponding to a region for one pixel in a monochromatic display or a region for one sub-pixel of three sub-pixels constituting one pixel in a color display). Further, such overlap regions are arranged in an effective field (region which works as an actual display screen) of the first panel 10 in the form of a two-dimensional matrix. Each pixel is constituted of a group of a predetermined number of the field emission devices arranged in the overlap region of the cathode electrode 12 and the gate electrode 14 on the first panel side and the phosphor layer 22 which is on the second panel side and faces the group of these field emission devices. The above pixels are arranged in the effective field, for example, on the order of several hundred thousands to several millions.

The first panel 10 and the second panel 20 are approximately 0.1 mm to 1 mm apart from each other. A high voltage (for example, 5 kV) is applied to the anode electrode 24 of the second panel 20. In this display, discharges sometimes take place between the gate electrode 14 formed in the first panel 10 and the anode electrode 24 formed in the second panel 20 and may impair the quality of displayed images to a great extent. The occurrence of discharges in the vacuum is considered to have the following mechanism. First, electrons or ions emitted from the electron emission electrode 16A under an intense electric field work as a trigger, the temperature of the anode electrode 24 locally increases due to the supply of energy to the anode electrode 24 from the anode-electrode driving circuit 37, an occluded gas inside the anode electrode 24 is released or a material constituting the anode electrode 24 is evaporated, and such releasing or evaporation grows to be large-scale discharges (for example, spark discharges).

For displaying an image on the display, a positive voltage $V_{G\text{-}SL}$ (for example, 160 volts) is applied to a gate electrode (to be referred to as "selected gate electrode" hereinafter) constituting a pixel that is to emit lit. On the other hand, a voltage $V_{G\text{-}NSL}$ (for example, 0 volt) is applied to a gate electrode (to be referred to as "non-selected gate electrode" hereinafter) constituting a pixel that is not to emit light. Further, a voltage $V_{C\text{-}SL}$ (for example, a voltage of at least 0 volt but less than 30 volts depending upon brightness) is applied to a cathode electrode (to be referred to as "selected cathode electrode" hereinafter) constituting the pixel that is to emit light. On the other hand, a voltage $V_{C\text{-}NSL}$ (for example, 30 volts) is applied to a cathode electrode (to be referred to as "non-selected cathode electrode" hereinafter) constituting the pixel that is not to emit light. Therefore, in a pixel that emits light in the highest brightness, there is a voltage difference of 160 volts between the cathode electrode 12 and the anode electrode 14, and in a darkest pixel, there is a voltage difference of 130 volts between the cathode electrode 12 and the gate electrode 14. FIG. 84A schematically shows the above state. A voltage to be applied to the gate electrode 14 is shown as "$V_g$", and a voltage to be applied to the cathode electrode 12 is shown as "$V_C$". The voltage in the anode electrode 24 is maintained at 5 kV. FIG. 85A shows potentials of the selected gate electrode and the selected cathode electrode in the above state. In FIGS. 85A, 85B and 86, a blank triangle shows one example of potential of a cathode electrode, a blank circle, a solid circle and a blank square show examples of potentials of a gate electrode, and a solid triangle shows one example of an anode electrode.

When it is now supposed that a discharge starts to take place between the anode electrode 24 and the gate electrode 14, the potential of the gate electrode 14 increases with the elapse of time and ultimately increases up to a voltage $V''_G$ close to the potential of the anode electrode 24. The potential of the gate electrode 14 is readily transmitted to the gate-electrode driving circuit 31 and may possibly damage the gate-electrode driving circuit 31. Further, as a result of an increase in the potential of the gate electrode 14 with the elapse of time, a voltage difference between the cathode electrode 12 and the gate electrode 14 increases, an excess current of emitted-electrons flows from the electron emission electrode 16A, and a discharge also takes place between the electron emission electrode 16A and the gate electrode 14 or between the electron emission electrode 16A and the anode electrode 24, which causes permanent damage on the gate electrode 14 and/or the electron emission electrode 16A. Further, when a discharge takes place between the gate electrode 14 having an increased potential and the electron emission electrode 16A, the potential of the cathode electrode 12 increases, and such a potential $V''_c$ is readily transmitted to the cathode-electrode driving circuit 34 and may possibly damage the cathode-electrode driving circuit 34. FIG. 84B schematically shows the above state. Further, FIG. 85B schematically shows potentials of the selected gate electrode and the selected cathode electrode in the above state, and FIG. 86 schematically shows a change in potential in the selected gate electrode. In FIG. 85B and 86, $t_0$ shows a time period (approximately 2 microseconds) that passes from the start of a discharge to the start of an increase of potential of the gate electrode, $t_1$ shows a time period (approximately 3 microseconds) that passes from the start of the discharge to a time when the potential of the gate electrode comes to be approximately 170 volts, and $t_2$ shows a time period (approximately 5 microseconds) from the start of the discharge to a time when the potential of the gate electrode comes to be approximately 2 kV.

For inhibiting a discharge between the anode electrode 24 and the gate electrode 14, it is effective to inhibit the emission of electrons and ions that work as a trigger of the discharge, and for that purpose, it is required to control particles strictly. It involves high technical difficulties to carry out the above particle control in the process for producing the first panel or a display having the first panel.

OBJECT AND SUMMARY OF THE INVENTION

It is therefore an object of the present invention to provide a flat-type display that permits reliable inhibition of discharges between the first panel and the second panel, so that display images on a screen are free from degradation.

According to a first aspect of the present invention, the above object is achieved by a flat-type display comprising a first panel having electron-emitting portions; a second panel having an electron irradiation surface; and an electron-emitting-portion driving circuit for driving the electron-emitting portions, wherein an electron-emitting-portion cutoff circuit is provided between the electron-emitting portions and the electron-emitting-portion driving circuit for preventing a discharge between the electron-emitting portions and the electron irradiation surface. In the flat-type display of the present invention, a closed space between the first panel and the second panel constitutes a vacuum space. The first panel and the second panel are bonded to each other in their circumferential portions through a frame or without any frame.

In the flat-type display according to the first aspect of the present invention, preferably, a first predetermined voltage $V_{PD1}$ is applied to the electron-emitting-portion cutoff circuit, and when the potential of an electron-emitting portion connected to the electron-emitting-portion cutoff circuit comes to be a second predetermined voltage $V_{PD2}$ due to a discharge between the electron-emitting portion and the electron irradiation surface, the electron-emitting-portion cutoff circuit operates on the basis of a voltage difference ($V_{PD2}-V_{PD1}$) between the first predetermined voltage and the second predetermined voltage. In this case, desirably, in view of preventing the breakdown of the electron-emitting-portion driving circuit, $|V_{OUT\text{-}MAX}-V_{PD1}|<V_{COLAPSE}$ is satisfied in which $V_{COLAPSE}$ is a breakdown voltage of the electron-emitting-portion driving circuit and $V_{OUT\text{-}MAX}$ is a maximum value of an output voltage of the electron-emitting-portion driving circuit. Otherwise, desirably, in view of preventing the breakdown of the electron-emitting-portion driving circuit, $|V_{OUT\text{-}MAX}-V_{PD1}|<R_{EMISSION}\cdot I_{COLAPSE}$ is satisfied in which $I_{COLAPSE}$ is a breakdown current of the electron-emitting-portion driving circuit and $R_{EMISSION}$ is a resistance value between the electron-emitting-portion driving circuit and the electron-emitting portion.

In the flat-type display according to the first aspect of the present invention, preferably, the second panel comprises a substrate, phosphor layers and an anode electrode. In this case, further, it is preferred to employ a constitution in which an anode-electrode driving circuit is further provided and an anode-electrode cutoff circuit is provided between the anode electrode and the anode-electrode driving circuit for preventing a discharge between the electron-emitting portion and the electron irradiation surface. The constitution of the anode-electrode cutoff circuit can be the same as that of an anode-electrode cutoff circuit in a flat-type display according to a second aspect of the present invention.

According to a second aspect of the present invention, the above object is achieved by a flat-type display comprising a first panel having electron-emitting portions; a second panel having an electron irradiation surface composed of phosphor layers and an anode electrode; and an anode-electrode driving circuit for driving the anode electrode, wherein an anode-electrode cutoff circuit is provided between the anode electrode and the anode-electrode driving circuit for preventing a discharge between the electron-emitting portions and the electron irradiation surface.

In the flat-type display according to the second aspect of the present invention, preferably, when no discharge takes place between the electron-emitting portion and the electron irradiation surface, the anode-electrode cutoff circuit is in a non-operated state, and when a discharge takes place between the electron-emitting portion and the electron irradiation surface, the anode-electrode cutoff circuit operates. Further, preferably, the anode-electrode cutoff circuit operates on the basis of an electric current that flows between the anode electrode and the anode-electrode driving circuit due to a discharge between the electron-emitting portion and the electron irradiation surface.

The anode electrode may have a constitution in which an effective field is covered with an electrically conductive material having the form of one sheet or may have a constitution in which the anode electrode is constituted of anode electrode units that correspond individually to one or a plurality of electron-emitting portions or correspond individually to one or a plurality of pixels. When the anode electrode has the former constitution, it is sufficient to provide one anode-electrode cutoff circuit. When the anode electrode has the latter constitution, it is sufficient to provide the anode-electrode cutoff circuits in a number equal to the number of the units, or it is sufficient to employ a constitution in which the anode electrode units are connected through one wiring and one anode-electrode cutoff circuit is connected to the wiring.

According to a third aspect of the present invention, the above object is achieved by a flat-type display comprising a first panel having electron-emitting portions; a second panel having an electron irradiation surface; an electron-emitting-portion driving circuit for driving the electron-emitting portions; a shield member disposed between the electron-emitting portions and the electron irradiation surface; and a shield-member voltage-applying means for applying a voltage to the shield member, wherein a shield-member cutoff circuit is provided between the shield member and the shield-member voltage-applying means for preventing a discharge between the shield member and the electron irradiation surface.

In the flat-type display according to the third aspect of the present invention, the shield member may be provided with a function as a so-called focus electrode. The shield member may have a constitution in which an effective field is covered with an electrically conductive material having the form of one sheet or may have a constitution in which the shield member is constituted of shield member units that correspond individually to one or a plurality of electron-emitting portions or correspond individually to one or a plurality of pixels. When the shield member has the former constitution, it is sufficient to provide one shield-member cutoff circuit. When the shield member has the latter constitution, it is sufficient to provide the shield-member cutoff circuits in a number equal to the number of units, or there may be employed a constitution in which the units are connected through one wiring and the shield-member cutoff circuit is connected to the wiring. The focus electrode refers to an electrode for converging the paths of electrons emitted from the electron-emitting portions toward the electron irradiation surface of the second panel so that brightness may be improved and that an optical crosstalk between neighboring pixels may be prevented. For allowing the shield member to work as a focus electrode, a relatively negative voltage is applied to the shield member from the shield-member voltage-applying means. The shield member may be provided integrally with the electron-emitting portions, or it may be provided separately from the electron-emitting portions. The shield member is required to have opening portions formed in advance for passing electrons emitted from the electron-emitting portions. Such opening portions may have a constitution in which one opening portion corresponds to one electron-emitting portion or one opening portion corresponds to a plurality of the electron-emitting portions.

In the flat-type display according to the third aspect of the present invention, preferably, the second panel comprises a substrate, phosphor layers and an anode electrode. In this case, it is preferred to employ a constitution in which an anode-electrode driving circuit is further provided and an anode-electrode cutoff circuit is provided between the anode electrode and the anode-electrode driving circuit for preventing a discharge between the shield member and the electron irradiation surface. The constitution of the anode-electrode cutoff circuit can be the same as that of the anode-electrode cutoff circuit of the flat-type display according to the second aspect of the present invention. Otherwise, the electron-emitting-portion cutoff circuit in the flat-type display according to the first aspect of the present invention may be incorporated into the flat-type display according to the third aspect of the present invention.

The flat-type display according to any one of the first to third aspects of the present invention (these flat-type displays will be sometimes generally referred to as "flat-type display of the present invention" hereinafter) may have a constitution in which a stripe-shaped gate electrode and a stripe-shaped cathode electrode extending in a direction different from the extending direction of the stripe-shaped gate electrode are provided, the electron-emitting portion is formed in an overlap region where a projection image of the stripe-shaped gate electrode and a projection image of the stripe-shaped cathode electrode overlap, the electron-emitting-portion driving circuit comprises a first driving circuit connected to the gate electrode and a second driving circuit connected to the cathode electrode, and the first driving circuit is connected to the gate electrode through the electron-emitting-portion cutoff circuit. The flat-type display having the above constitution will be referred to as "flat-type display according to the first constitution of the present invention" for convenience.

Alternatively, the flat-type display of the present invention may have a constitution in which a stripe-shaped gate electrode and a stripe-shaped cathode electrode extending in a direction different from the extending direction of the stripe-shaped gate electrode are provided, the electron-emitting portion is formed in an overlap region where a projection image of the stripe-shaped gate electrode and the stripe-shaped cathode electrode overlap, the electron-emitting-portion driving circuit comprises a first driving circuit connected to the gate electrode and a second driving circuit connected to the cathode electrode, and the second driving circuit is connected to the cathode electrode through the electron-emitting-portion cutoff circuit. The flat-type display having the above constitution will be referred to as "flat-type display according to the second constitution of the present invention" for convenience.

In the flat-type display according to the first or second constitution of the present invention, preferably, when no discharge takes place between the electron-emitting portion and the electron irradiation surface, the electron-emitting-portion cutoff circuit is in a non-operated state, and when a discharge takes place between the electron-emitting portion and the electron irradiation surface, the electron-emitting-portion cutoff circuit operates.

The flat-type display of the present invention may have a constitution in which a stripe-shaped gate electrode and a stripe-shaped cathode electrode extending in a direction different from the extending direction of the stripe-shaped gate electrode are provided, the electron-emitting portion is formed in an overlap region where a projection image of the stripe-shaped gate electrode and a projection image of the stripe-shaped cathode electrode overlap, the electron-emitting-portion driving circuit comprises a first driving circuit connected to the gate electrode and a second driving circuit connected to the cathode, and the electron-emitting-portion cutoff circuit comprises a first cutoff circuit provided between the gate electrode and the first driving circuit and a second cutoff circuit provided between the cathode electrode and the second driving circuit. The flat-type display having the above constitution will be referred to as "flat-type display according to the third constitution of the present invention" for convenience.

In the flat-type display according to the third constitution of the present invention, preferably, when no discharge takes place between the electron-emitting portion and the electron irradiation surface, the first and second cutoff circuits are in a non-operated state, and when a discharge takes place between the electron-emitting portion and the electron irradiation surface, the first cutoff circuit operates, and the second cutoff circuit operates on the basis of operation of the first cutoff circuit.

The flat-type display according to the first, second or third constitution of the present invention may have a structure in which the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, (e) an opening portion formed through the gate electrode and the insulating layer, and (f) an electron emission electrode formed on a portion of the cathode electrode which portion is positioned in the bottom portion of the opening portion, and the electron emission electrode exposed in the bottom portion of the opening portion corresponds to the electron-emitting portion.

The cold cathode field emission device having the above structure will be referred to as "cold cathode field emission device having the first structure" for convenience. The above cold cathode field emission device includes a Spindt-type (cold cathode field emission device in which a conical electron emission electrode is formed on a portion of the cathode electrode which portion is positioned in the bottom portion of the opening portion), a crown-type (cold cathode field emission device in which a crown-shaped electron emission electrode is formed on a portion of the cathode electrode which portion is positioned in the bottom portion of the opening portion) and a plane-type (cold cathode field emission device in which a nearly flat-surface electron emission electrode is formed on a portion of the cathode electrode which portion is positioned in the bottom portion of the opening portion).

Alternatively, the flat-type display according to the first, second or third constitution of the present invention may have a structure in which the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, and (e) an opening portion that is formed through the gate electrode and the insulating layer and has a bottom portion where the cathode electrode is exposed, and a portion of the cathode electrode which portion is exposed in the bottom portion of the opening portion corresponds to the electron-emitting portion.

The cold cathode field emission device having the above structure will be referred to as "cold cathode field emission device having the second structure" for convenience. The above cold cathode field emission device includes a flat-type cold cathode field emission device that emits electrons from the flat surface of the cathode electrode, and a crater-type cold cathode field emission device that emits electrons from a convex portion of the surface of the cathode electrode having a convexo-concave shape.

Further, the flat-type display according to the first, second or third constitution of the present invention may have a structure in which the first panel has a plurality of cold cathode field emission devices, each cold cathode field emission device comprises;

(a) a support member, (b) a cathode electrode which is formed on or above the support member and has an edge portion, (c) an insulating layer formed at least on the cathode electrode, (d) a gate electrode formed on the insulating layer, and (e) an opening portion formed through at least the gate electrode and the insulating layer, and the edge portion of the cathode electrode which edge portion is exposed on the bottom portion or the side wall of the opening portion corresponds to the electron-emitting portion.

The cold cathode field emission device having the above structure will be referred to as a cold cathode field emission device having the third structure or an edge-type cold cathode field emission device.

Further, the flat-type display according to the first, second or third constitution of the present invention may have a structure in which the first panel has a plurality of cold cathode field emission devices, each cold cathode field emission device comprises;

(a) a stripe-shaped spacer made of an insulating material and formed on a support member, (b) a gate electrode made of a stripe-shaped material layer having a plurality of opening portions, and (c) an electron-emitting portion, and the stripe-shaped material layer is arranged to come in contact with the top surface of the spacer and to position the opening portion above the electron-emitting portion.

The cold cathode field emission device having the above structure will be referred to as "cold cathode field emission device having the fourth structure" for convenience. The electron emission electrode or the electron-emitting portion in the cold cathode field emission device having any one of the first to third structures can be applied to the electron-emitting portion of the cold cathode field emission device having the fourth structure.

The electron-emitting-portion driving circuit, the first driving circuit and the second driving circuit for driving the electron-emitting portion can be circuits having known constitutions. Further, the anode-electrode driving circuit and the shield-member voltage-applying means can be circuits having known constitutions.

The electron-emitting-portion cutoff circuit, the first cutoff circuit and the second cutoff circuit in the flat-type display according to the first aspect of the present invention and the shield-member cutoff circuit in the flat-type display according to the third aspect of the present invention can be any one, for example, of MOS-type FET (field-effect transistor), a combination of MOS-type FET and a diode, a combination of n-channel MOS-type and p-channel MOS-type FET, a combination of n-channel MOS-type, p-channel MOS-type FET and a diode, TFT (thin film transistor), a combination of TFT and a diode, a combination of n-channel type TFT and p-channel type TFT, a combination of n-channel type TFT, p-channel type TFT and a diode, and a combination of these with a resistance element. The TFT includes a bottom gate type and a top gate type.

Alternatively, the electron-emitting-portion cutoff circuit, the first cutoff circuit and the second cutoff circuit in the flat-type display according to the first aspect of the present invention and the shield-member cutoff circuit in the flat-type display according to the third aspect of the present invention include a discharge tube and a Zener diode. For preventing a malfunction, preferably, the voltage difference for bringing the discharge tube or the Zener diode into continuity is greater than a voltage difference between a maximum value of output voltage of the driving circuit to which the discharge tube or the Zener diode is connected and the first predetermined voltage $V_{PD1}$ and is greater than a voltage difference between a minimum value of output voltage of the driving circuit to which the discharge tube or the Zener diode is connected and the first predetermined voltage $V_{PD1}$.

In the flat-type display according to the second aspect of the present invention, the anode-electrode cutoff circuit includes a combination of MOS-type FET and a resistance element.

The electron-emitting-portion cutoff circuit, the first cutoff circuit, the second cutoff circuit or the shield-member cutoff circuit may be incorporated, for example, into the first panel, or may be incorporated into the electron-emitting-portion driving circuit, the first driving circuit, the second driving circuit or the shield-member voltage-applying means. When the electron-emitting-portion cutoff circuit, the first cutoff circuit, the second cutoff circuit or the shield-member cutoff circuit is incorporated into the first panel, each may be disposed in an ineffective field (field which is outside the effective field that works as an actual display screen and which is inside the vacuum space), or each may be disposed outside the frame.

The anode-electrode cutoff circuit or the shield-member cutoff circuit may be incorporated, for example, into the second panel, or the anode-electrode cutoff circuit may be incorporated into the anode-electrode driving circuit. When the anode-electrode cutoff circuit is incorporated into the second panel, it may be disposed in the ineffective field or outside the frame.

In the flat-type display of the present invention, the electron-emitting-portion cutoff circuit, the first cutoff circuit, the second cutoff circuit, the anode-electrode cutoff circuit or the shield-member cutoff circuit may be provided with a kind of a timer for continuing its operation for a predetermined period of time once it starts its operation. The timer includes a multi-vibrator.

The material for constituting the cold cathode field emission device having the first, second or third structure or the material for constituting the shield member includes at least one metal selected from the group consisting of tungsten (W), niobium (Nb), tantalum (Ta), titanium (Ti), molybdenum (Mo), chromium (Cr), aluminum (Al), copper (Cu), gold (Au), silver (Ag), nickel (Ni), cobalt (Co), zirconium (Zr), iron (Fe), platinum (Pt) and zinc (Zn); alloys or compounds containing these metal elements (for example, nitrides such as TiN and silicides such as $WSi_2$, $MoSi_2$, $TiSi_2$, $TaSi_2$, etc.); a semiconductor material such as silicon (Si); and electrically conductive metal oxides such as ITO (indium tin oxide), indium oxide and zinc oxide. When the gate electrode is formed, a thin film made of the above material is formed on the insulating layer by a known thin film forming method such as a CVD method, a sputtering method, a vapor deposition method, an ion plating method, an electrolytic plating method, an electroless plating method, a screen printing method, a laser abrasion method or a sol-gel method. When the thin film is formed on the entire surface of the insulating layer, the thin film is patterned by a known patterning method, to form the stripe-shaped gate electrode. The opening portion may be formed in the gate electrode after the formation of the stripe-shaped gate electrode, or the opening portion may be formed in the gate electrode concurrently with the formation of the stripe-shaped gate electrode. Further, if a patterned resist is formed on the insulating layer before the formation of the electrically conductive material layer for the gate electrode, the gate electrode can be formed by a lift-off method. Further, if vapor deposition is carried out using a mask having an opening having the form corresponding to the form of the gate electrode, or if screen printing is carried out with a screen having such an opening, the patterning after the formation of the thin film is no longer necessary. Further, the gate electrode may be formed by preparing a stripe-shaped material layer having an opening portion in advance and fixing such a stripe-shaped material layer on the spacer, whereby the cold cathode field emission device having the fourth structure can be obtained.

In the cold cathode field emission device having the first structure which device is a Spindt-type cold cathode field emission device, the material for the electron emission electrode includes tungsten, tungsten alloy, molybdenum, molybdenum alloy, titanium, titanium alloy, niobium, niobium alloy, tantalum, tantalum alloy, chromium, chromium alloy and silicon containing an impurity (polysilicon and amorphous silicon). These materials may be used alone or in combination.

In the cold cathode field emission device having the first structure which device is a crown-type field emission device, the material for the electron emission electrode includes electrically conductive particles and a combination of electrically conductive particles with a binder. The material of the electrically conductive particles includes carbon-containing materials such as graphite; refractory metals such as tungsten (W), niobium (Nb), tantalum (Ta), titanium (Ti), molybdenum (Mo) and chromium (Cr); and transparent electrically conductive materials such as ITO (indium tin oxide). The binder includes glass such as water glass and general purpose resins. Examples of the general purpose resins include thermoplastic resins such as a vinyl chloride resin, a polyolefin resin, a polyamide resin, a cellulose ester resin and a fluorine resin, and thermosetting resins such as an epoxy resin, an acrylic resin and a polyester resin. For improving electron emission efficiency, preferably, the particle size of the electrically conductive particles is sufficiently small as compared with dimensions of the electron-emitting portion. Although not specially limited, the form of the electrically conductive particles is spherical, polyhedral, plate-like, acicular, columnar or amorphous. Preferably, the electrically conductive particles have such a form that exposed portions formed by the particles form acute projections. Electrically conductive particles having different dimensions and different forms may be used as a mixture.

In the cold cathode field emission device having the first structure which device is a plane-type field emission device, preferably, the electron emission electrode is composed of a material having a smaller work function Φ than a material for the cathode electrode. The material for the electron emission electrode can be selected on the basis of the work function of a material for the cathode electrode, a voltage difference between the gate electrode and the cathode electrode, a required current density of emitted electrons, and the like. Typical examples of the material for the cathode electrode of the cold cathode field emission device include tungsten (Φ=4.55 eV), niobium (Φ=4.02–4.87 eV), molybdenum (Φ=4.53–4.95 eV), aluminum (Φ=4.28 eV), copper (Φ=4.6 eV), tantalum (Φ=4.3 eV), chromium (Φ=4.5 eV) and silicon (Φ=4.9 eV). The material for the electron emission electrode preferably has a smaller work function Φ than these materials, and the value of the work function thereof is preferably approximately 3 eV or smaller. Examples of such a material include carbon (Φ<1 eV), cesium (Φ=2.14 eV), $LaB_6$ (Φ=2.66–2.76 eV), BaO (Φ=1.6–2.7 eV), SrO (Φ=1.25–1.6 eV), $Y_2O_3$ (Φ=2.0 eV), CaO (Φ=1.6–1.86 eV), BaS (Φ=2.05 eV), TiN (Φ=2.92 eV) and ZrN (Φ=2.92 eV). More preferably, the electron emission electrode is formed of a material having a work function Φ of 2 eV or lower. The material for the electron emission electrode is not necessarily required to have electric conductivity.

As a material for the electron-emitting portion, particularly, carbon is preferred. More specifically, diamond is preferred, and above all, amorphous diamond is preferred. When the electron emission electrode is formed of amorphous diamond, an emitted electron current density necessary for a flat-panel display can be obtained at an electric field intensity of $5\times10^7$ V/m or lower. Further, since amorphous diamond is an electric resister, emitted electron currents obtained from the electron emission electrodes can be brought into uniform currents, and the fluctuation of brightness can be therefore suppressed when such field emission devices are incorporated into a flat-panel display. Further, since the amorphous diamond exhibits remarkably high durability against sputtering by ions of residual gas in the flat-panel display, cold cathode field emission devices having a longer lifetime can be attained.

Otherwise, in the cold cathode field emission device having the first structure which device is a plane-type cold cathode field emission device, the material for the electron emission electrode can be selected from materials which have a secondary electron gain δ greater than the secondary electron gain δ which the electrically conductive material for the cathode electrode has. That is, the above material can be properly selected from metals such as silver (Ag), aluminum (Al), gold (Au), cobalt (Co), copper (Cu), molybdenum (Mo), niobium (Nb), nickel (Ni), platinum (Pt), tantalum (Ta), tungsten (W) and zirconium (Zr); semiconductors such as silicon (Si) and germanium (Ge); inorganic simple substances such as carbon and diamond; and compounds such as aluminum oxide ($Al_2O_3$), barium oxide (BaO), beryllium oxide (Beo), calcium oxide (CaO), magnesium oxide (MgO), tin oxide ($SnO_2$), barium fluoride ($BaF_2$) and calcium fluoride ($CaF_2$). The material for the electron emission electrode is not necessarily required to have electric conductivity.

In the cold cathode field emission device having the second structure (flat-type cold cathode field emission device or crater-type cold cathode field emission device) or the cold cathode field emission device having the third structure (edge-type cold cathode field emission device), the material for the cathode electrode corresponding to the electron-emitting portion can be selected from metals such as tungsten (W), tantalum (Ta), niobium (Nb), titanium (Ti), molybdenum (Mo), chromium (Cr), aluminum (Al), copper (Cu), gold (Au) and silver (Ag); alloys and compounds of these metals (for example, nitrides such as TiN and silicides such as $WSi_2$, $MoSi_2$, $TiSi_2$ and $TaSi_2$); semiconductors such as diamond; and a thin carbon film. Although not specially limited, the thickness of the above cathode electrode is in the range of from approximately 0.05 to 0.5 μm, preferably 0.1 to 0.3 μm. The method for forming the cathode electrode includes deposition methods such as an electron beam deposition method and a hot filament deposition method, a sputtering method, a combination of a CVD method or an ion plating method with an etching method, a screen-printing method and a plating method. When a screen-printing method or a plating method is employed, the cathode electrodes in the form of stripes can be directly formed.

Otherwise, in the cold cathode field emission device having the second structure (flat-type cold cathode field emission device or crater-type cold cathode field emission device), the cold cathode field emission device having the third structure (edge-type cold cathode field emission device) or the cold cathode field emission device having the first structure which device is a plane-type cold cathode field emission device, the cathode electrode or the electron emission electrode can be formed from an electrically conductive paste prepared by dispersing electrically conductive fine particles. Examples of the electrically conductive fine particles include a graphite powder; a graphite powder mixed with at least one of a barium oxide powder, a strontium oxide powder or a metal powder; diamond particles or a diamond-like carbon powder containing an impurity such as nitrogen, phosphorus, boron or triazole; a carbon-nano-tube powder; an (Sr, Ba, Ca)$CO_3$ powder; and a silicon carbide powder. It is particularly preferred to select a graphite powder as electrically conductive fine particles in view of a decrease in threshold electric field and an improvement in durability of the electron-emitting portion. The electrically conductive fine particles may have the form of spheres or scales, or they may have a fixed or amorphous form. The particle diameter of the electrically conductive fine particles is not critical so long as it is equal to, or less than, the thickness or the pattern width of the cathode electrode or the electron emission electrode. With a decrease in the above particle diameter, the number of electrons emitted per unit area can be increased. When the above particle diameter is too small, however, the cathode electrode or the electron emission electrode may deteriorate in electric conductivity. The above particle diameter is therefore preferably in the range of from approximately 0.01 to 4.0 μm. Such electrically conductive fine particles are mixed with a glass component or other proper binder to prepare an electrically conductive paste, a desired pattern of the electrically conductive paste is formed by a screen-printing method and the pattern is calcined, whereby the cathode electrode which works as an electron-emitting portion or the electron emission electrode can be formed. Otherwise, the cathode electrode which works as an electron-emitting portion or the electron emission electrode can be formed by a combination of a spin coating method with an etching method or by a lift-off method.

In the cold cathode field emission device having the first structure which device is a Spindt-type field emission device or a crown-type field emission device, the material for the cathode electrode can be selected from metals such as tungsten (W), niobium (Nb), tantalum (Ta), molybdenum (Mo), chromium (Cr), aluminum (Al) and copper (Cu); alloys and compounds of these metals (for example, nitrides such as TiN and silicides such as $WSi_2$, $MoSi_2$, $TiSi_2$ and $TaSi_2$); semiconductors such as silicon (Si); and ITO (indium-tin oxide). The method for forming the cathode electrode includes deposition methods such as an electron beam deposition method and a hot filament deposition method, a sputtering method, a combination of a CVD method or an ion plating method with an etching method, a screen-printing method, a plating method and a lift-off method. When a screen-printing method or a plating method is employed, the cathode electrodes in the form of stripes can be directly formed.

In the flat-type display of the present invention including the flat-type display according to any one of the first to third constitutions or the flat-type display having the cold cathode field emission device having any one of the first to third structures, preferably, the second panel comprises a substrate, phosphor layers and an anode electrode. The electron irradiation surface is formed of phosphor layers or an anode electrode depending upon the structure of the second panel.

The material for the anode electrode can be selected depending upon the constitution of the flat-type display. That is, when the flat-type display is a transmission type (the second panel corresponds to a display screen) and when the anode electrode and the phosphor layer are stacked on the substrate in this order, not only the substrate but also the anode electrode itself are required to be transparent, and a transparent electrically conductive material such as ITO (indium-tin oxide) is used. When the flat-type display is a reflection type (the first panel corresponds to a display screen), or when the cold cathode field emission is a transmission type but when the phosphor layer and the anode electrode are stacked on the substrate in this order, not only ITO can be used, but also the material can be selected from those materials which are discussed with regard to the cathode electrode and the gate electrode.

The phosphor material for the phosphor layer can be selected from a fast-electron-excitation type phosphor material or a slow-electron-excitation type phosphor material. When the flat-type display is a monochrome display, it is not required to pattern the phosphor layer. When the flat-type display is a color display, preferably, the phosphor layers corresponding to three primary colors of red (R), green (G) and blue (B) patterned in the form of stripes or dots are alternately arranged. A black matrix may be filled in a gap between one patterned phosphor layer and another phosphor layer for improving a display screen in contrast.

Examples of the constitution of the anode electrode and the phosphor layer include (1) a constitution in which the anode electrode is formed on the substrate and the phosphor layer is formed on the anode electrode and (2) a constitution in which the phosphor layer is formed on the substrate and the anode electrode is formed on the phosphor layer. In the above constitution (1), a so-called metal back film electrically connected to the anode electrode may be formed on the phosphor layer. In the above constitution (2), the metal back layer may be formed on the anode electrode.

Preferably, the projection image of the stripe-shaped gate electrode and the projection image of the stripe-shaped cathode electrode extend in directions so as to cross each other at right angles, since the flat-type display can be structurally simplified. The electron-emitting portion (one or a plurality of cold cathode field emission devices) is formed in an overlap region where the projection images of stripe-shaped cathode electrode and the stripe-shaped gate electrode overlap (the region corresponding to a region for one pixel or a region for one sub-pixel). Generally, such overlap regions are arranged in the form of a two-dimensional matrix in the effective field of the first panel (region which works as an actual display screen).

In the cold cathode field emission device having any one of the first to third structures, the opening portion (form obtained by cutting the opening portion with an imaginary plane in parallel with the surface of the support member) may have any arbitrary form such as a circle, an ellipse, a rectangular or square form, a polygon, a roundish rectangular or square form or a roundish polygon. The opening portion can be formed, for example, by an isotropic etching method or a combination of anisotropic and isotropic etching methods. There may be employed a constitution in which one opening portion is formed in the gate electrode, one opening portion communicating with the one opening portion formed in the gate electrode is formed in the insulating layer and one or a plurality of the electron emission electrodes are formed in the opening portion formed in the insulating layer. Otherwise, there may be also employed a constitution in which a plurality of the opening portions are formed in the gate electrode, one opening portion communicating with such opening portions is formed in the insulating layer and one or a plurality of the electron emission electrode are formed in the opening portion formed in the insulating layer.

The material for the insulating layer includes $SiO_2$, SiN, SiON, SOG (spin on glass), a low-melting glass and a glass paste. These materials may be used alone or in combination as required. The insulating layer can be formed by a known method such as a CVD method, an application method, a sputtering method or a printing method.

The insulating layer may be formed in the form of a separation wall. In this case, the insulating layer in the form of a separation wall is formed in a region between one stripe-shaped cathode electrode and another stripe-shaped cathode electrode which are adjacent to each other, or when a plurality of the cathode electrodes are taken as one group, the insulating layer can be formed in a region between one group and another group which are adjacent to each other. The material for the insulating layer in the form of a separation wall can be selected from known electrically insulating materials. For example, a material prepared by mixing a generally used low-melting glass with a metal oxide such as alumina can be used. The insulating layer in the form of a separation wall can be formed, for example, by a screen-printing method, a sandblasting method, a dry film method or a photosensitive method. The dry film method refers to a method in which a photosensitive film is laminated on the support member, the photosensitive film in portions where the insulating layer in the form of a separation wall are to be formed is removed by exposure and development, an insulating layer material is filled in opening portions formed by the removal of the photosensitive film, and calcining of the insulating layer material is carried out. The photosensitive film is combusted and removed by the calcining, and the insulating layer material which is filled in the opening portions remains to form the insulating layer in the form of a separation wall. The photosensitive method refers to a method in which a photosensitive insulating layer material for forming a separation wall is formed on the support member, the insulating layer material is patterned by exposure and development, and then calcining or sintering of the insulating layer material is carried out. The stripe-shaped spacer made of an insulating material in the cold cathode field emission device having the fourth structure can be also formed by the same method as the above.

A resistance layer may be formed between the cathode electrode and the electron emission electrode. Otherwise, when the surface of the cathode electrode or the edge portion of the cathode electrode corresponds to the electron-emitting portion, the cathode electrode may have a three-layered structure constituted of an electrically conductive material layer, a resistance layer and an electron-emitting layer corresponding to the electron-emitting portion. The resistance layer can stabilize performances of the cold cathode field emission device and can attain uniform electron-emitting properties. The material for the resistance layer includes carbon-containing materials such as silicon carbide (SiC); SiN; semiconductor materials such as amorphous silicon and the like; and refractory metal oxides such as ruthenium oxide ($RuO_2$), tantalum oxide and tantalum nitride. The resistance layer can be formed by a sputtering method, a CVD method or a screen-printing method. The resistance value of the resistance layer is approximately $1\times10^5$ to $1\times10^7$ Ω, preferably several MΩ.

The support member for constituting the first panel or the substrate for constituting the second panel may be any member or substrate so long as its surface is formed of an electrically insulating material. Examples thereof include a glass substrate, a glass substrate having a surface on which an insulating film is formed, a quartz substrate, a quartz substrate having a surface on which an insulating film is formed, and a semiconductor substrate having a surface on which an insulating film is formed.

When the first panel and the second panel are bonded to each other in their circumferential portions, they may be bonded with an adhesive layer or with a combination of a frame made of an insulating rigid material such as glass or ceramic with an adhesive layer. When the frame and the adhesive layer are used in combination, the facing distance between the first panel and the second panel can be adjusted to be larger by properly determining the height of the frame than that obtained when the adhesive layer alone is used. While a frit glass is generally used as a material for the adhesive layer, a so-called low-melting metal material having a melting point of approximately 120 to 400° C. may be used. The low-melting metal material includes In (indium; melting point 157° C.); an indium-gold low-melting alloy; tin (Sn)-containing high-temperature solders such as $Sn_{80}Ag_{20}$ (melting point 220 to 370° C.) and $Sn_{95}Cug_5$ (melting point 227 to 370° C.); lead (Pb)-containing high-temperature solders such as $Pb_{97.5}Ag_{2.5}$ (melting point 304° C.), $Pb_{94.5}Ag_{5.5}$ (melting point 304–365° C.) and $Pb_{97.5}Ag_{1.5}Sn_{1.0}$ (melting point 309° C.); zinc (Zn)-containing high-temperature solders such as $Zn_{95}Al_5$ (melting point 380° C.); tin-lead-containing standard solders such as $Sn_5PB_{95}$ (melting point 300–314° C.) and $Sn_2PB_{98}$ (melting point 316–322° C.); and brazing materials such as $Au_{88}Ga_{12}$ (melting point 381° C.) (all of the above subscript values show atomic %).

When three members of the first panel, the second panel and the frame are bonded, these three members may be bonded at the same time, or one of the first panel and the second panel may be bonded to the frame at a first stage and then the other of the first panel and the second panel may be bonded to the frame at a second stage. When bonding of the three members or bonding at the second stage is carried out in a high-vacuum atmosphere, a space surrounded by the first panel, the second panel, the frame and the adhesive layer comes to be a vacuum space upon bonding. Otherwise, after the three members are bonded, the space surrounded by the first panel, the second panel, the frame and the adhesive layer may be vacuumed to obtain a vacuum space. When the vacuuming is carried out after the bonding, the pressure in an atmosphere during the bonding may be any one of atmospheric pressure and reduced pressure, and the gas constituting the atmosphere may be ambient atmosphere or an inert gas containing nitrogen gas or a gas (for example, Ar gas) coming under the group O of the periodic table.

When the vacuuming is carried out after the bonding, the vacuuming can be carried out through a tip tube pre-connected to the first panel and/or the second panel. Typically, the tip tube is formed of a glass tube and is bonded to a circumference of a through hole formed in an ineffective field of the first panel and/or the second panel with a frit glass or the above low-melting metal material. After the space reaches a predetermined vacuum degree, the tip tube is sealed by thermal fusion. It is preferred to heat and then temperature-decrease the flat-type display as a whole before the sealing, since residual gas can be released into the space and can be removed out of the space by vacuuming.

In the flat-type display according to the first aspect of the present invention, the electron-emitting-portion cutoff circuit is provided between the electron-emitting portion and the electron-emitting-portion driving circuit for preventing a discharge between the electron-emitting portion and the electron irradiation surface. Even if a discharge takes place, therefore, the electron-emitting-portion cutoff circuit readily cuts off the electric connection between the electron-emitting portion and the electron-emitting-portion driving circuit. In the flat-type display according to the second aspect of the present invention, the anode-electrode cutoff circuit is provided between the anode electrode and the anode-electrode driving circuit for preventing a discharge between the electron-emitting portion and the electron irradiation surface. Even if a discharge takes place, therefore, the anode-electrode cutoff circuit readily cuts off the electric connection between the anode electrode and the anode-electrode driving circuit. In the flat-type display according to the third aspect of the present invention, the shield-member cutoff circuit is provided between the shield member and the shield-member voltage-applying means for preventing a discharge between the shield member and the electron irradiation surface. Even if a discharge takes place, therefore, the shield-member cutoff circuit readily cuts off the electric connection between the shield member and the shield-member voltage-applying means, so that no detrimental effect is caused on the shield-member voltage-applying means and further that no detrimental effect is caused on the electron-emitting portion and the electron-emitting-portion driving circuit.

BRIEF DESCRIPTION OF THE DRAWINGS

The present invention will be explained on the basis of Examples and with reference to drawings.

Brief Description of Drawings

Figure 1:
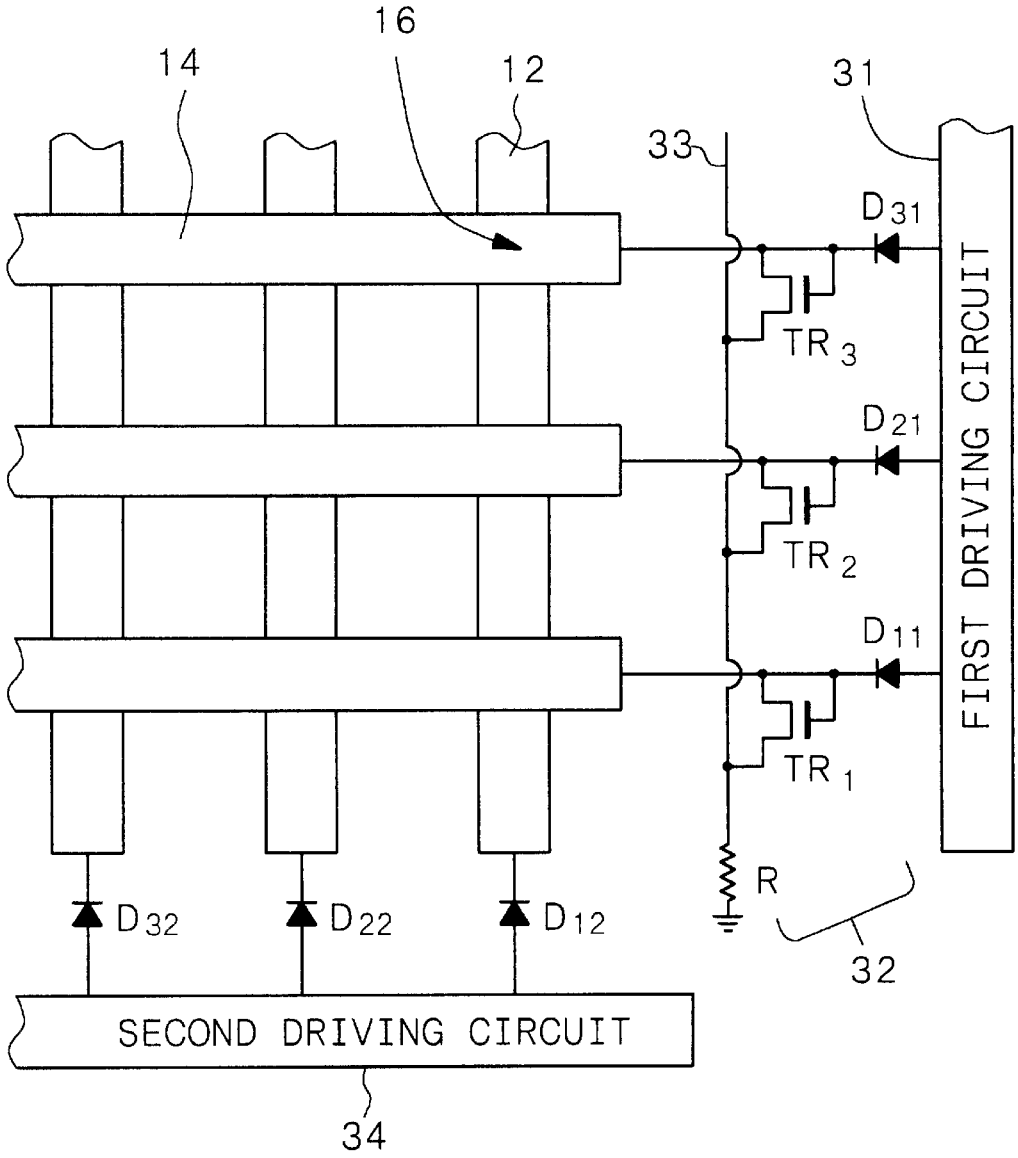

FIG. 1 is a conceptual drawing of a flat-type display having the first constitution in Example 1.

Figure 2A:
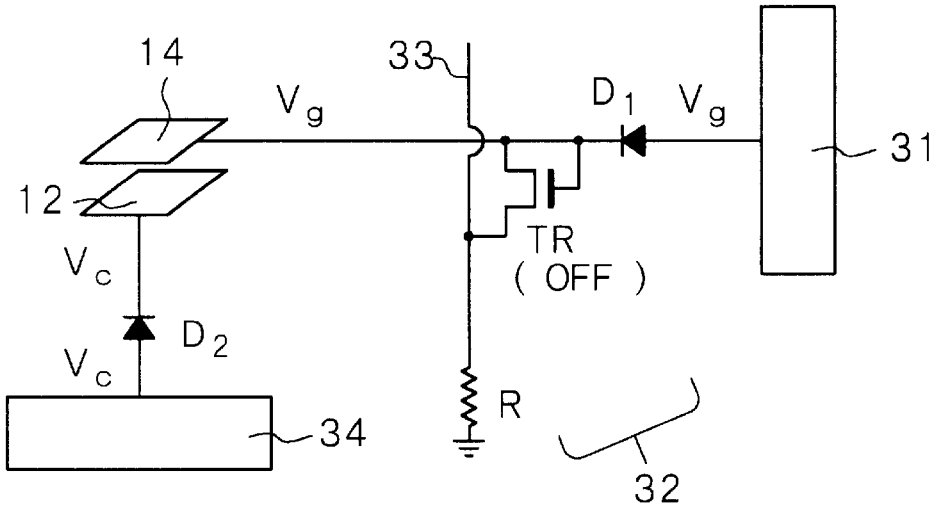
Figure 2B:
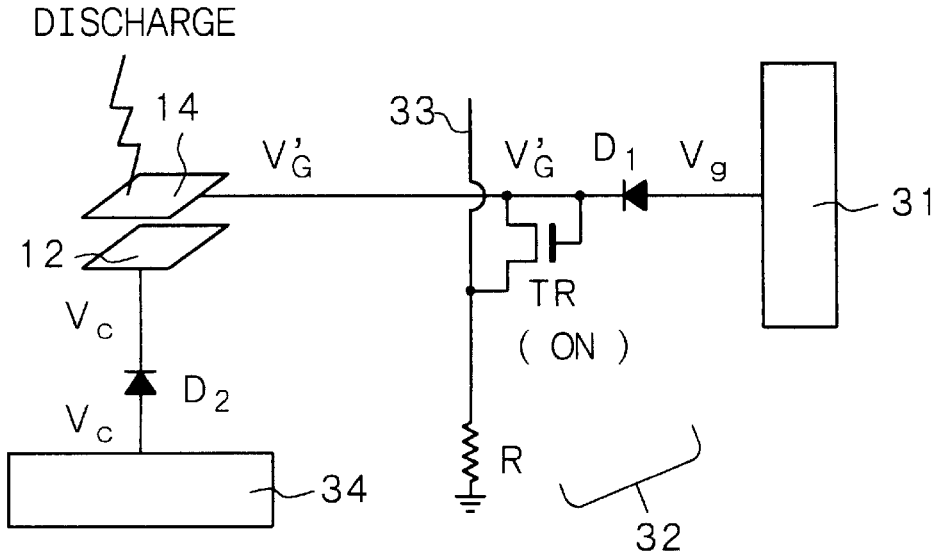

FIGS. 2A and 2B are schematic drawings of changes in potentials of a gate electrode and a cathode electrode and an operation state of an electron-emitting-portion cutoff circuit in Example 1.

Figure 3:
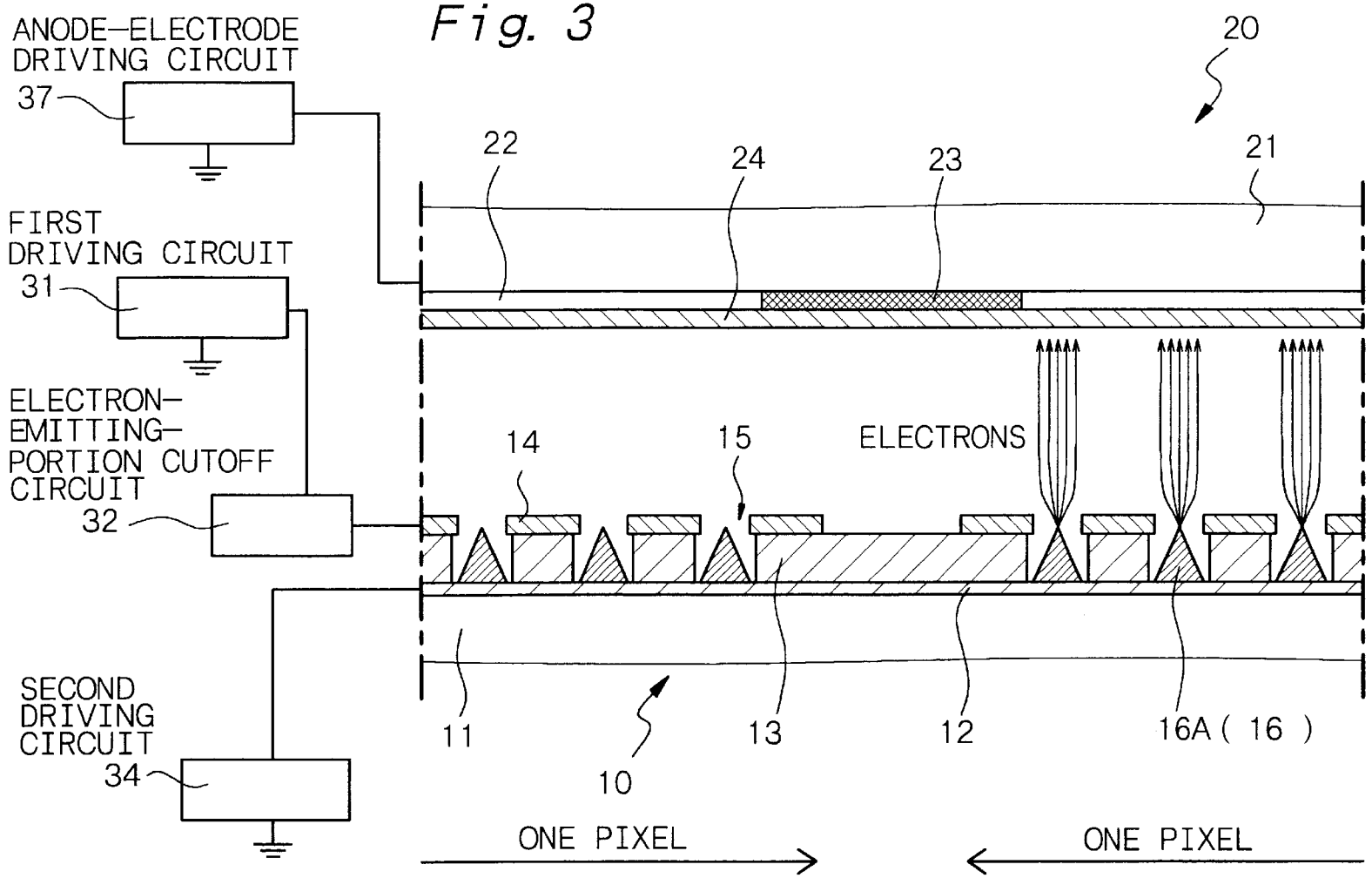
Figure 4:
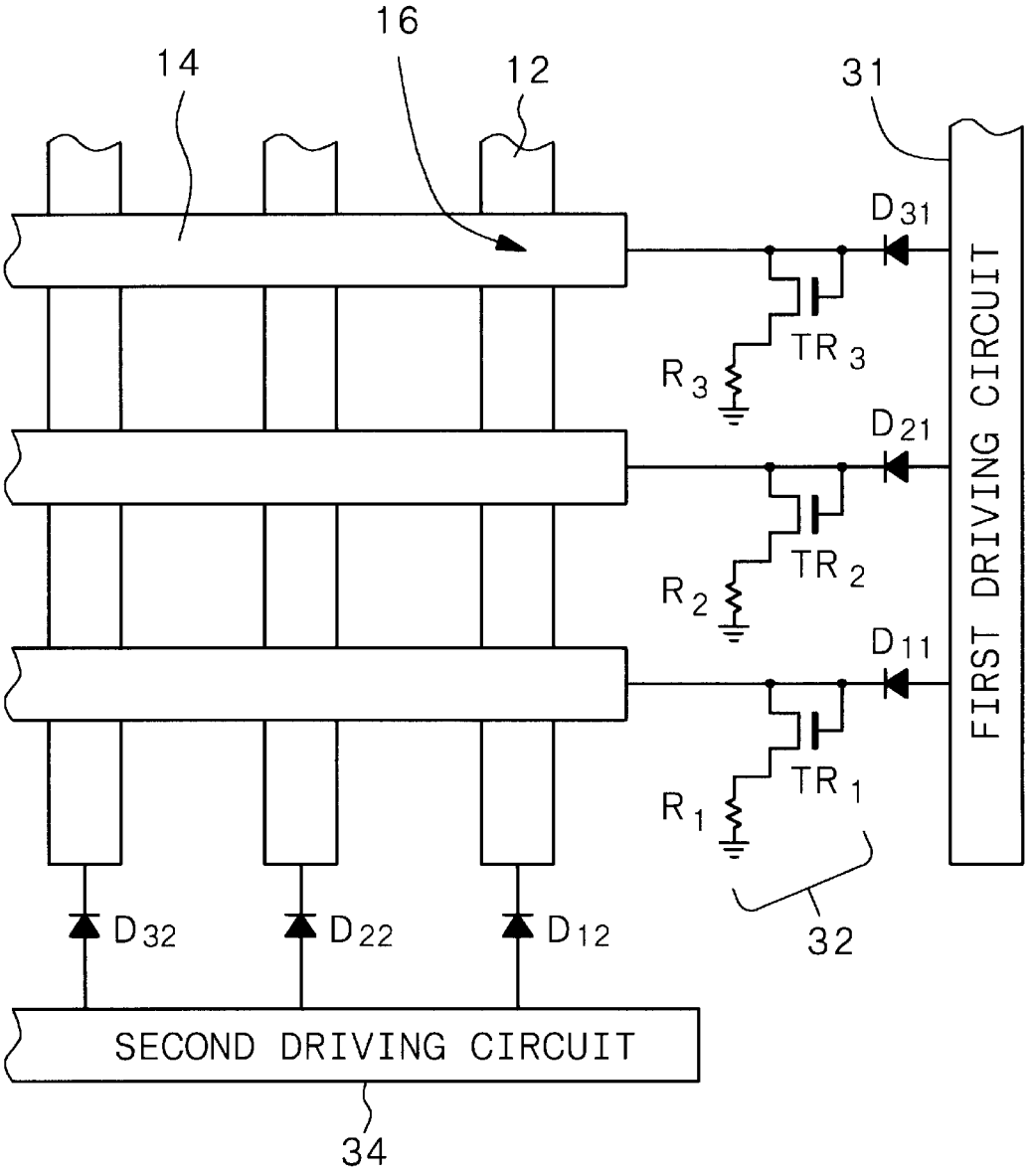

FIG. 3 is a schematic partial end view of the flat-type display having the first structure in Example FIG. 4 is a conceptual drawing of a variant of the flat-type display having the first constitution in Example 1.

Figure 5:
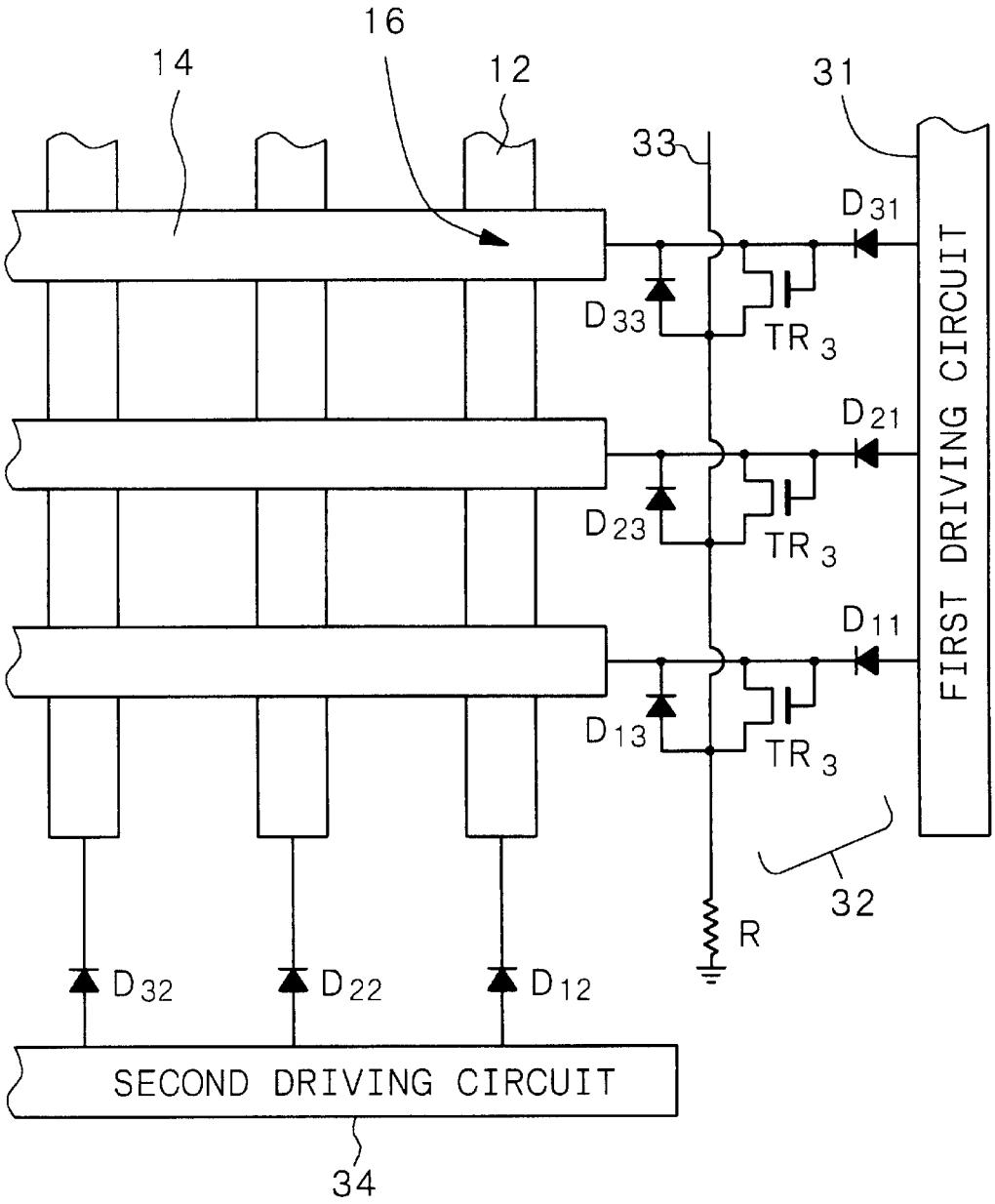

FIG. 5 is a conceptual drawing of another variant of the flat-type display having the first constitution in Example 1.

Figure 6:
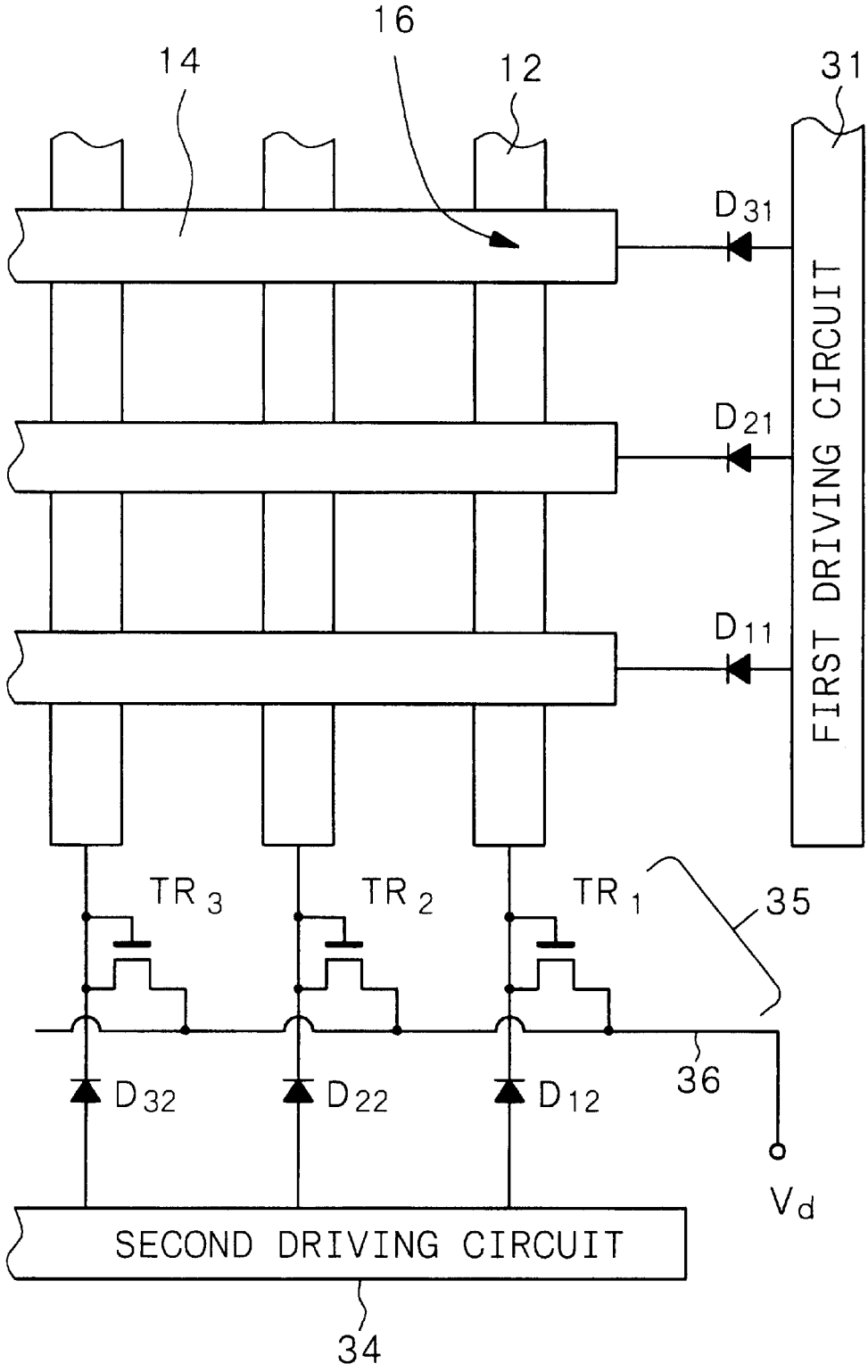

FIG. 6 is a conceptual drawing of a flat-type display having the second constitution in Example 2.

Figure 7A:
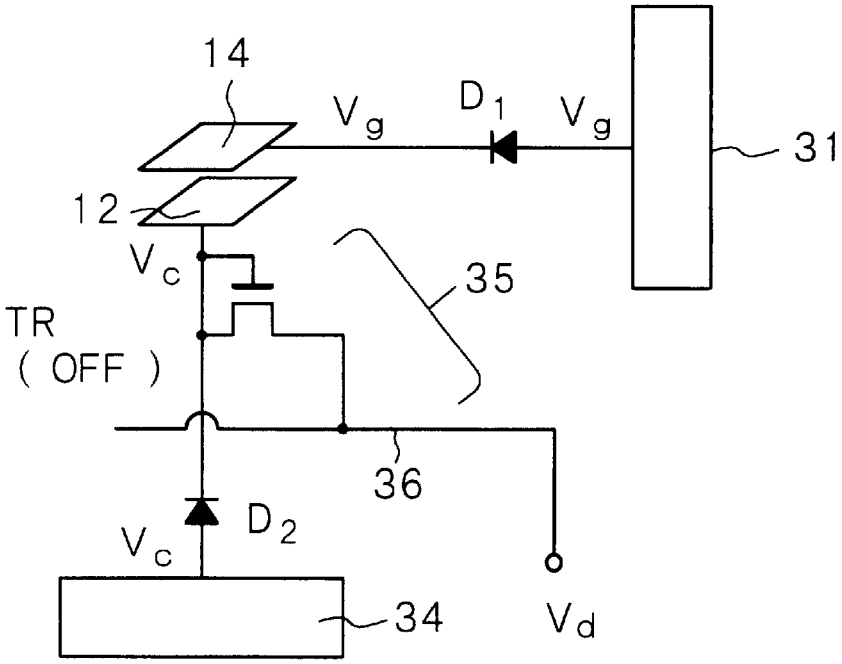
Figure 7B:
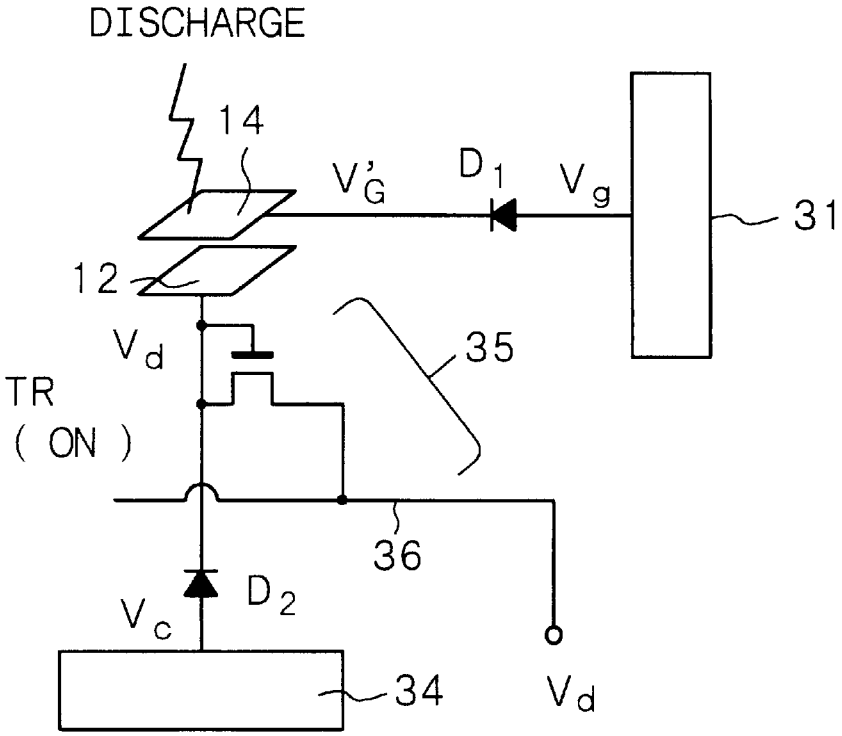

FIGS. 7A and 7B are schematic drawings of changes in potentials of a gate electrode and a cathode electrode and an operation state of an electron-emitting-portion cutoff circuit in Example 2.

Figure 8:
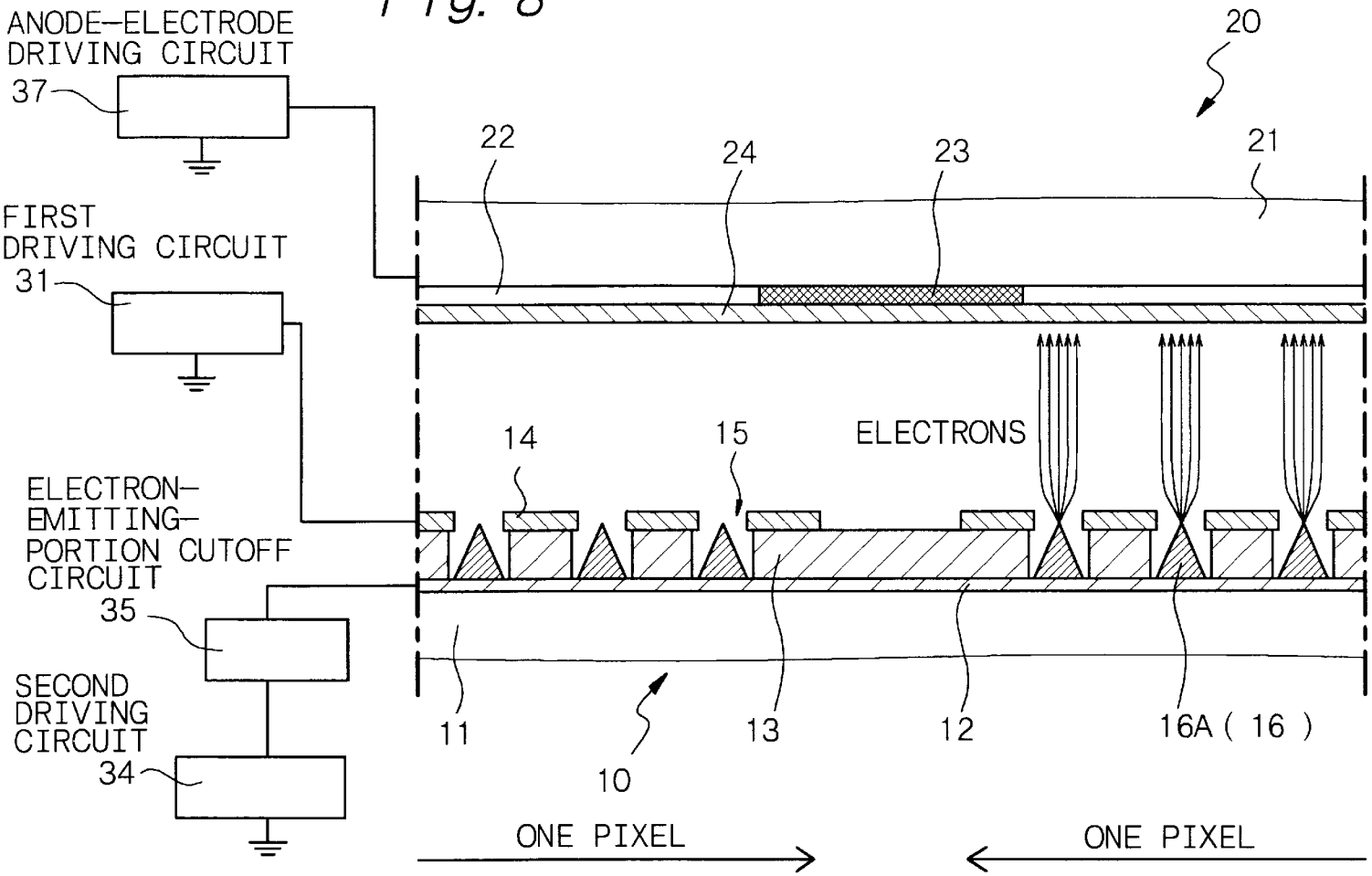

FIG. 8 is a schematic partial end view of the flat-type display having the first structure in Example 2.

Figure 9:
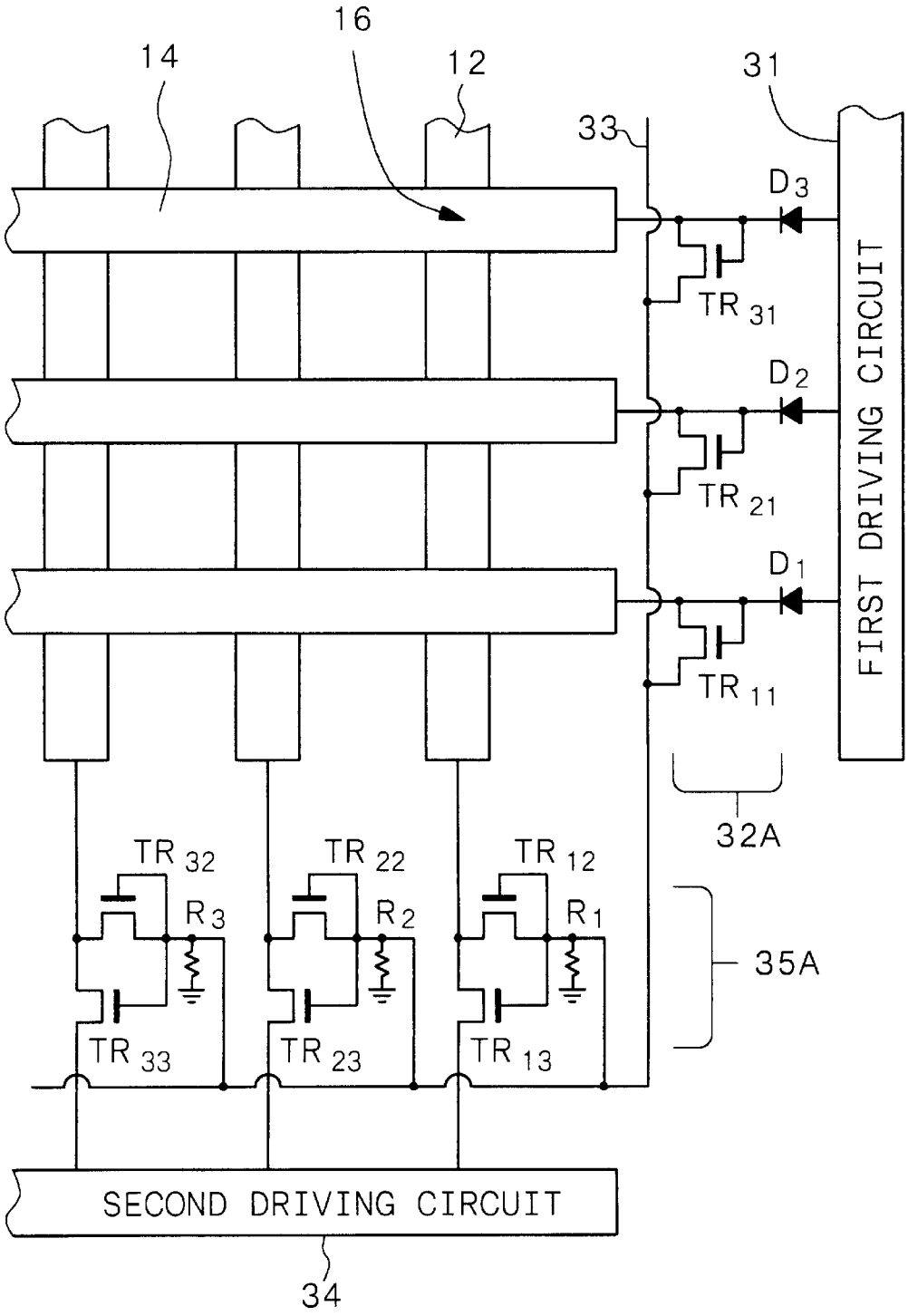

FIG. 9 is a conceptual drawing of a flat-type display having the third constitution in Example 3.

Figure 10A:
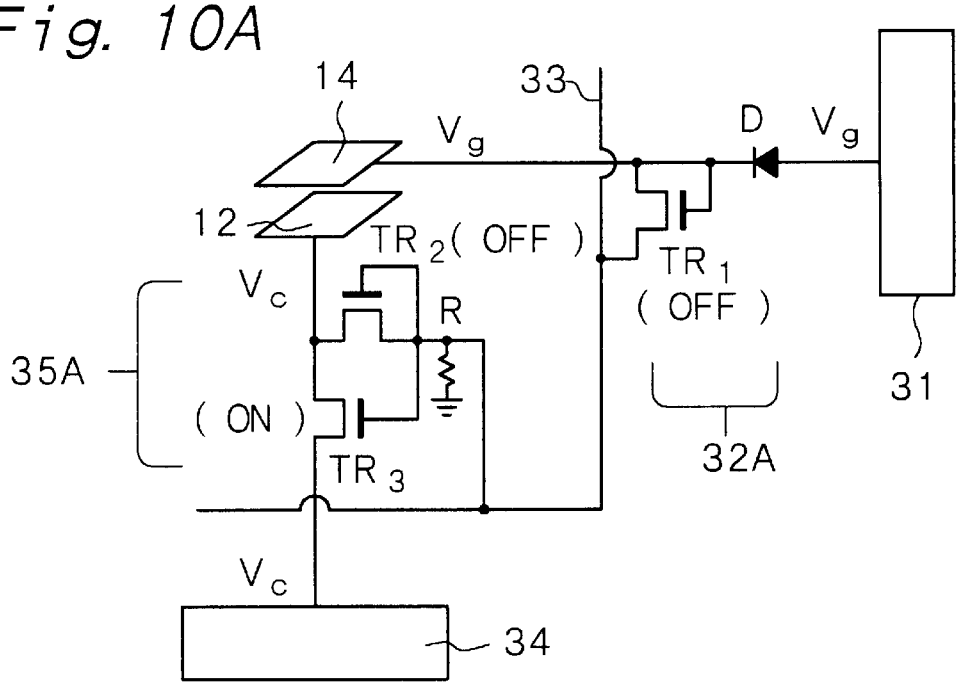
Figure 10B:
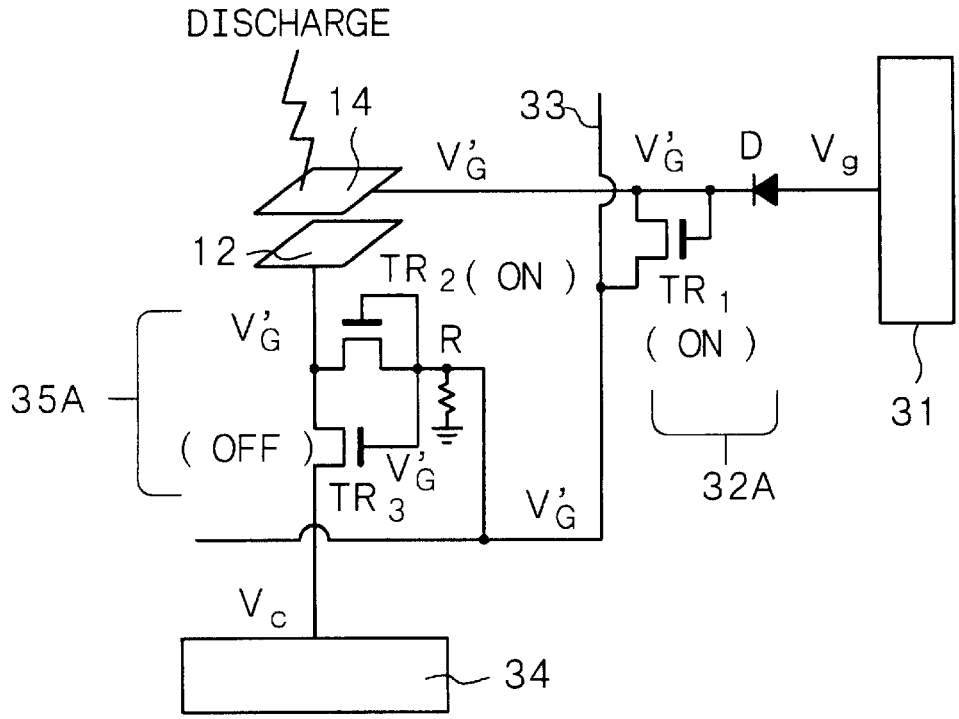

FIGS. 10A and 10B are schematic drawings of changes in potentials of a gate electrode and a cathode electrode and an operation state of an electron-emitting-portion cutoff circuit in Example 3.

Figure 11:
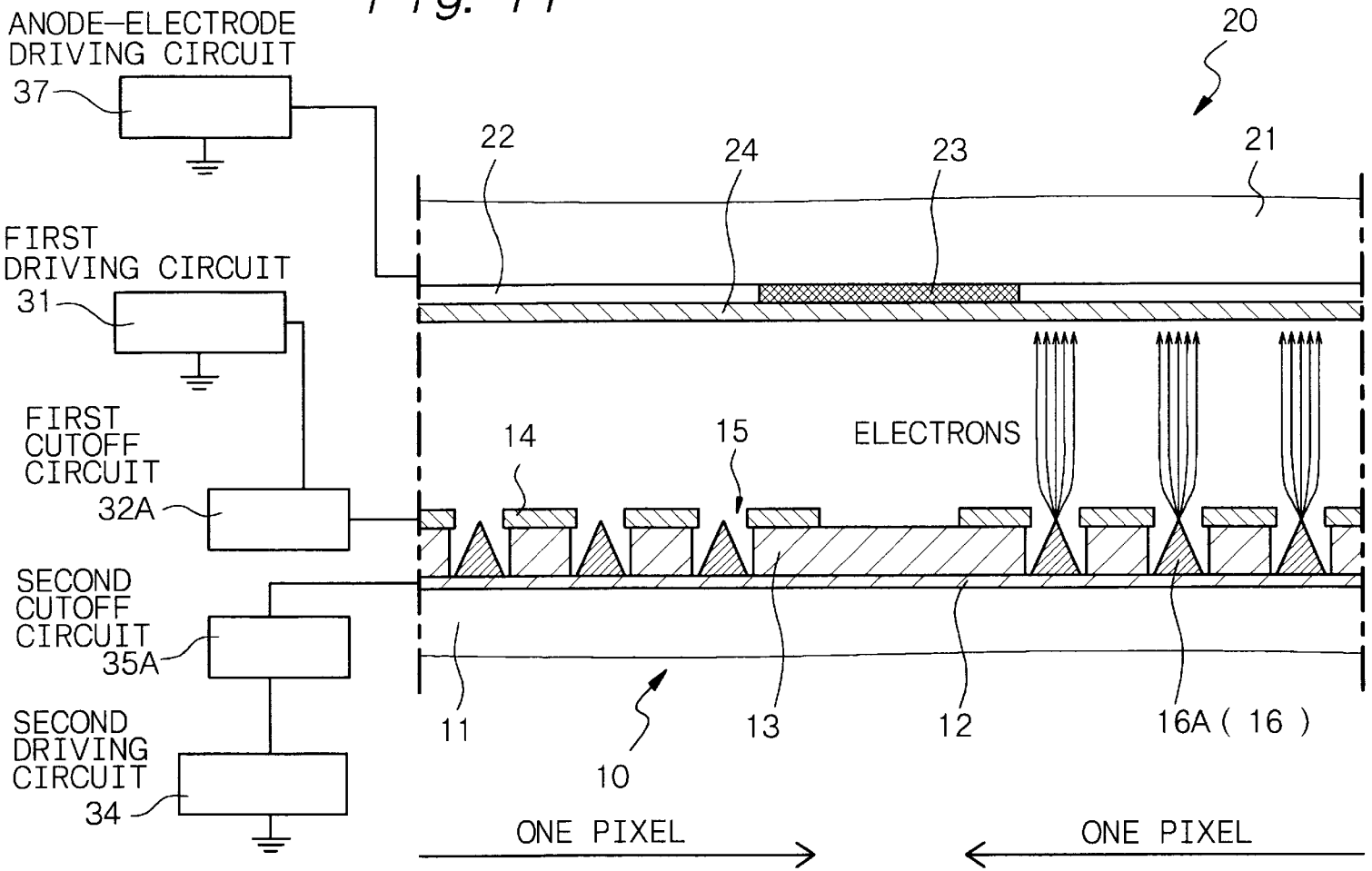

FIG. 11 is a schematic partial end view of the flat-type display having the first structure in Example 3.

Figure 12:
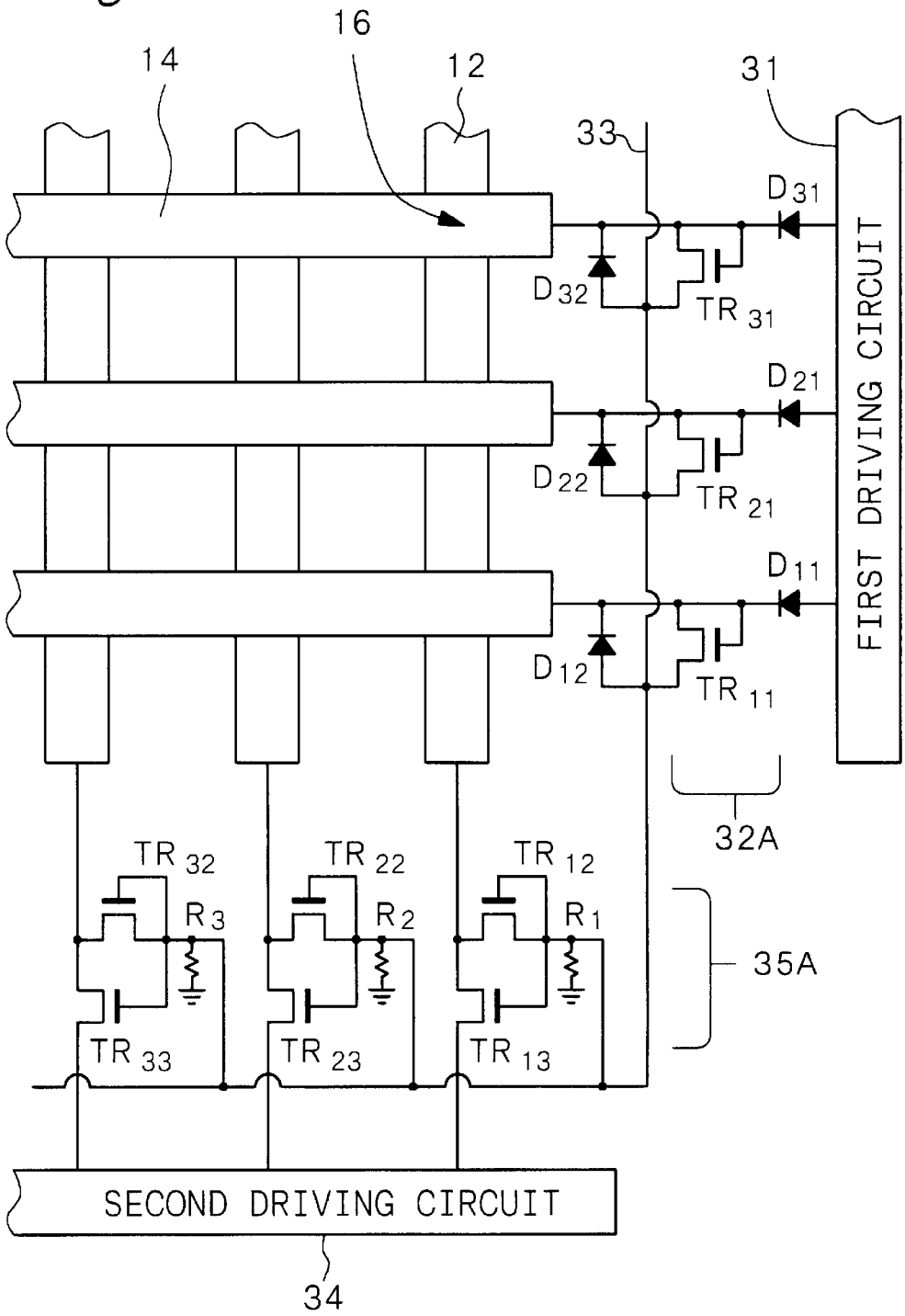

FIG. 12 is a conceptual drawing of a variant of the flat-type display having the third constitution in Example 3.

Figure 13:
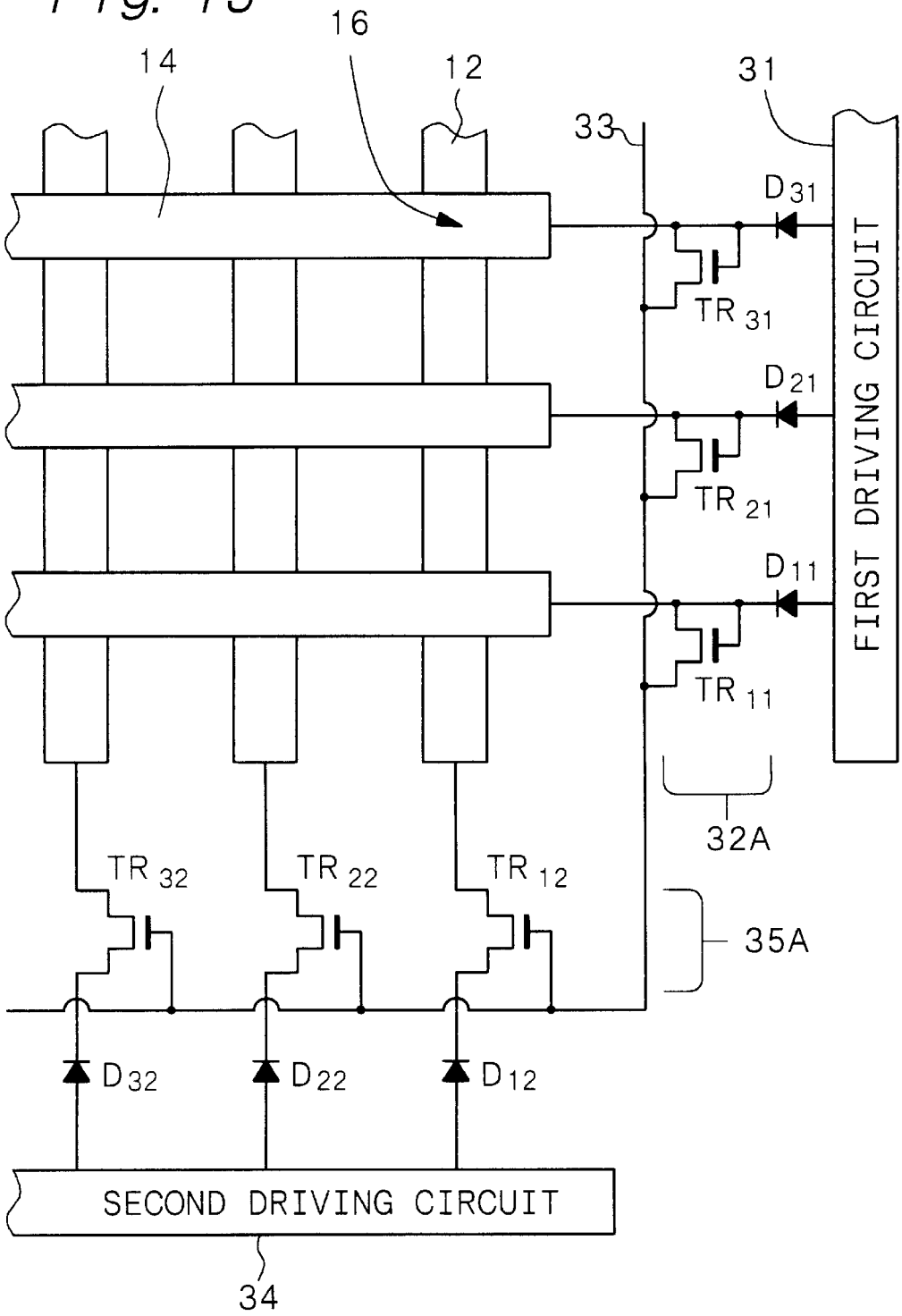

FIG. 13 is a conceptual drawing of another variant of the flat-type display having the third constitution in Example 3.

Figure 14:
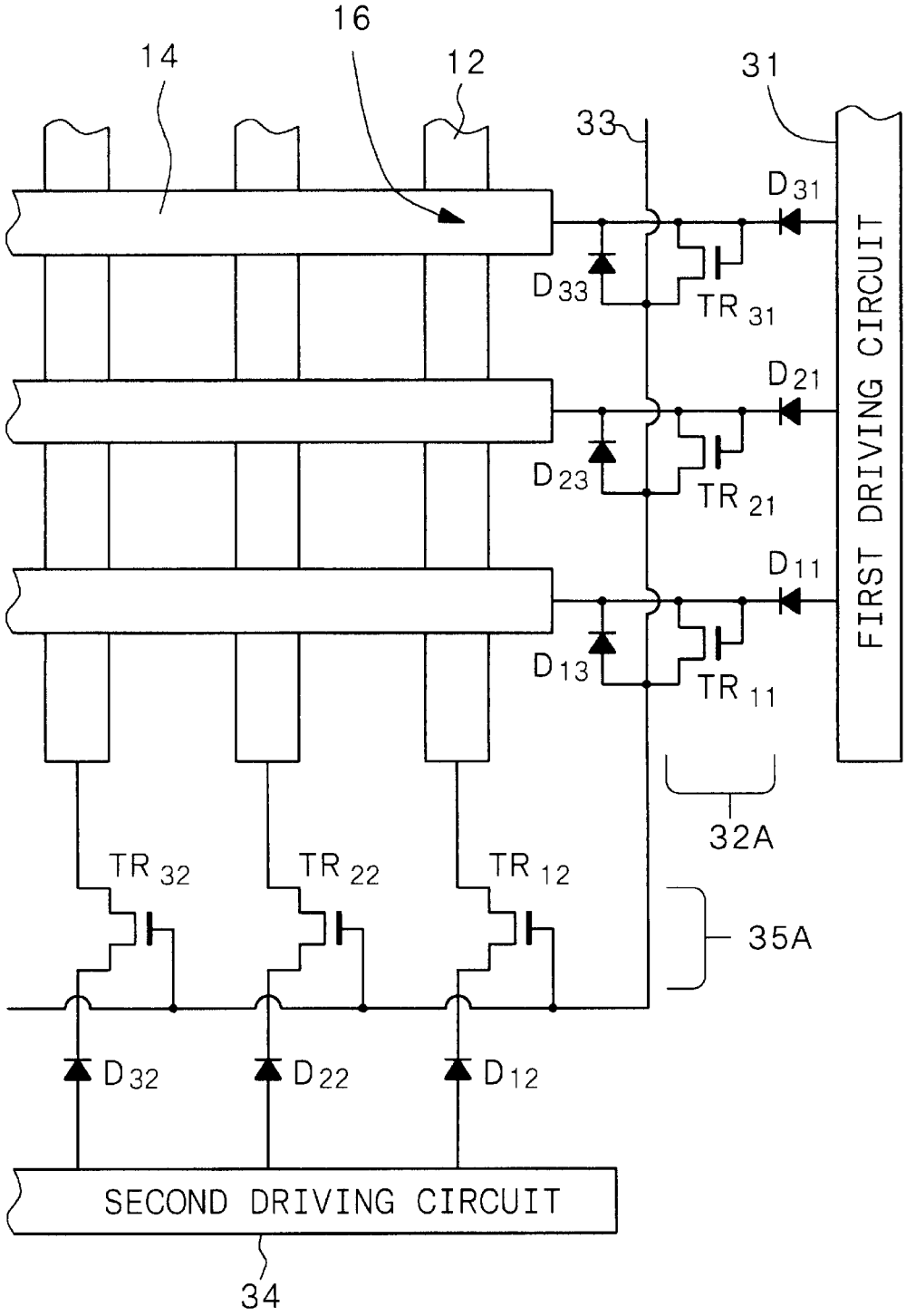

FIG. 14 is a conceptual drawing of still another variant of the flat-type display having the third constitution in Example 3.

Figure 15:
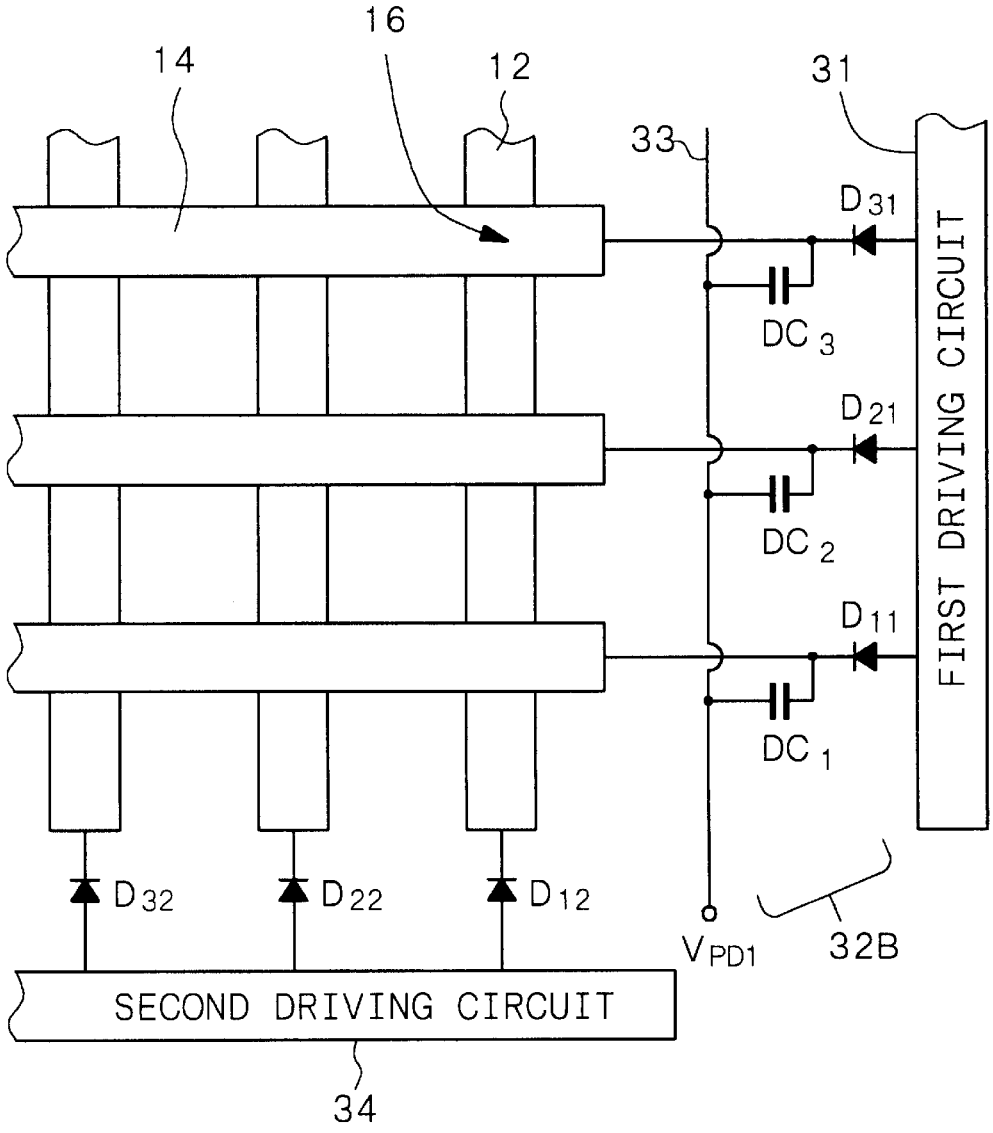

FIG. 15 is a conceptual drawing of a flat-type display having the first constitution in Example 4.

Figure 16:
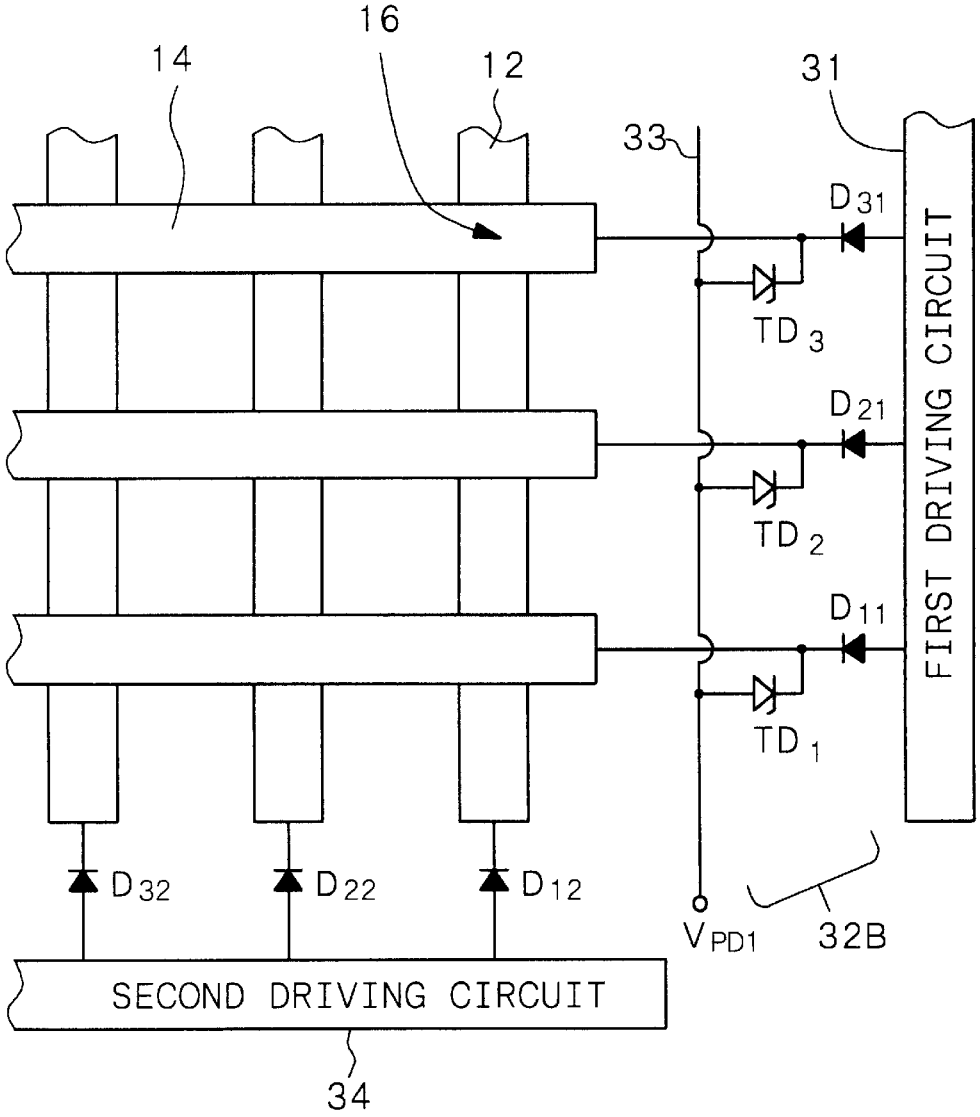

FIG. 16 is a conceptual drawing of a variant of the flat-type display having the first constitution in Example 4.

Figure 17:
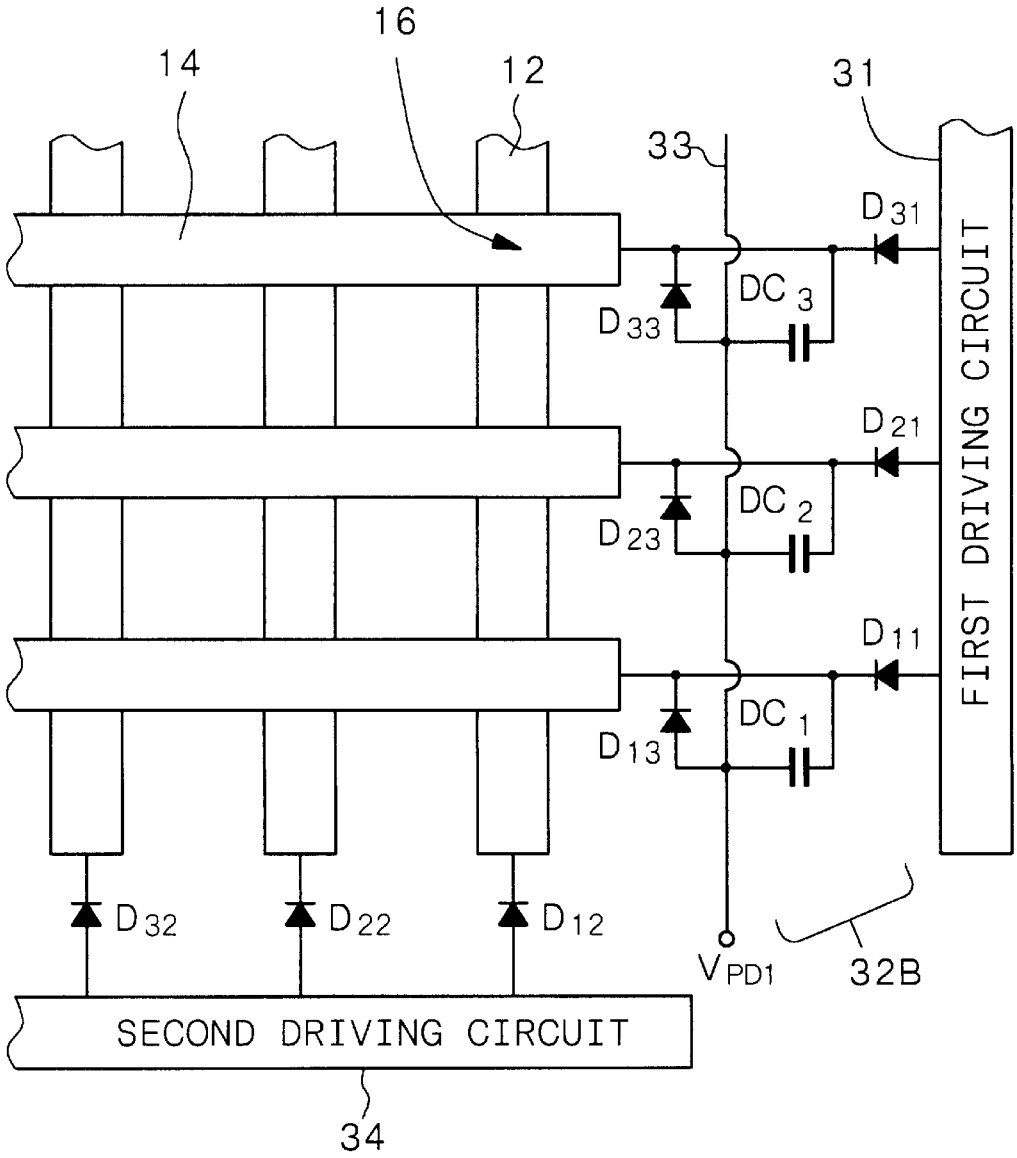

FIG. 17 is a conceptual drawing of another variant of the flat-type display having the first constitution in Example 4.

Figure 18:
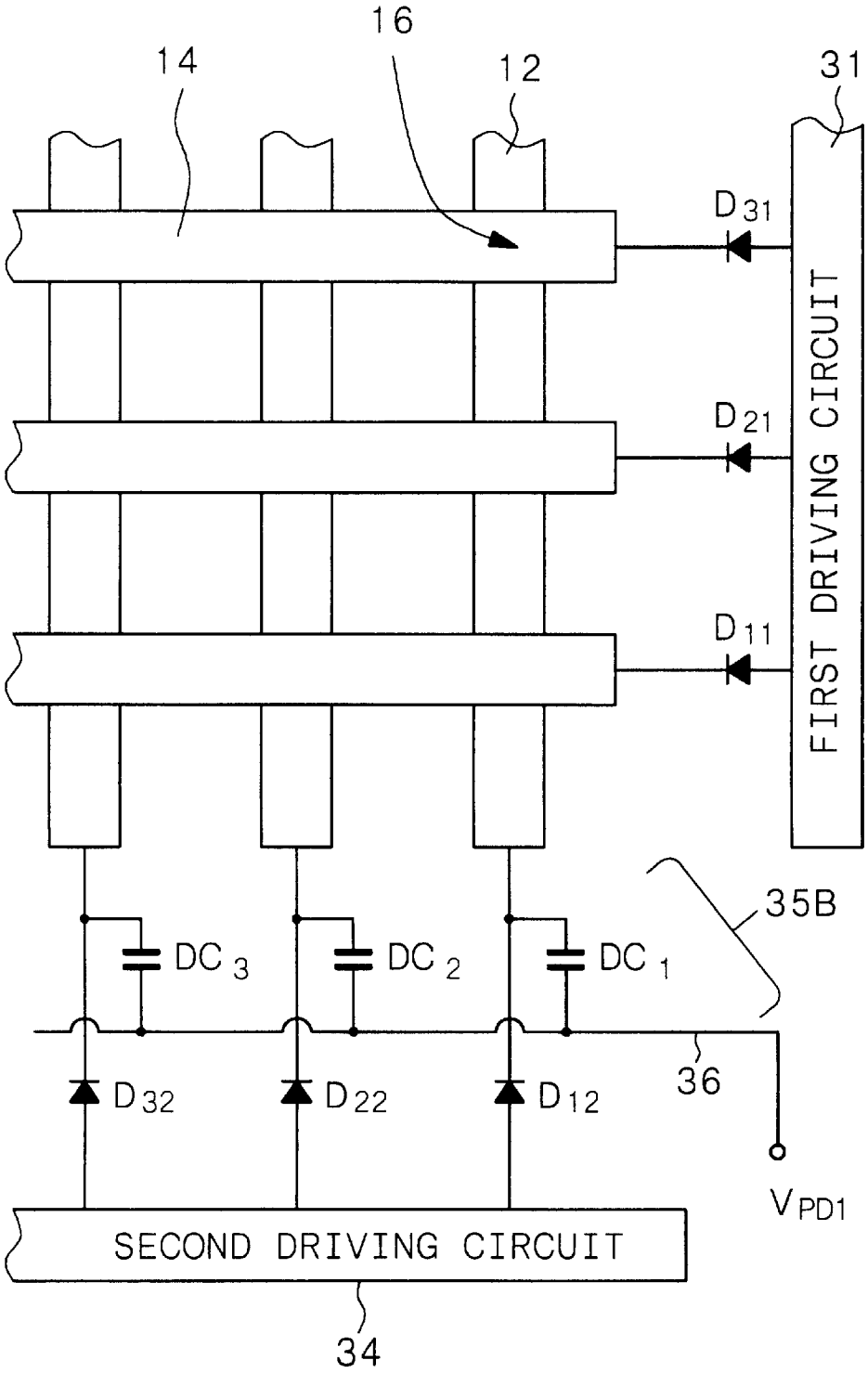

FIG. 18 is a conceptual drawing of a flat-type display having the second constitution in Example 5.

Figure 19:
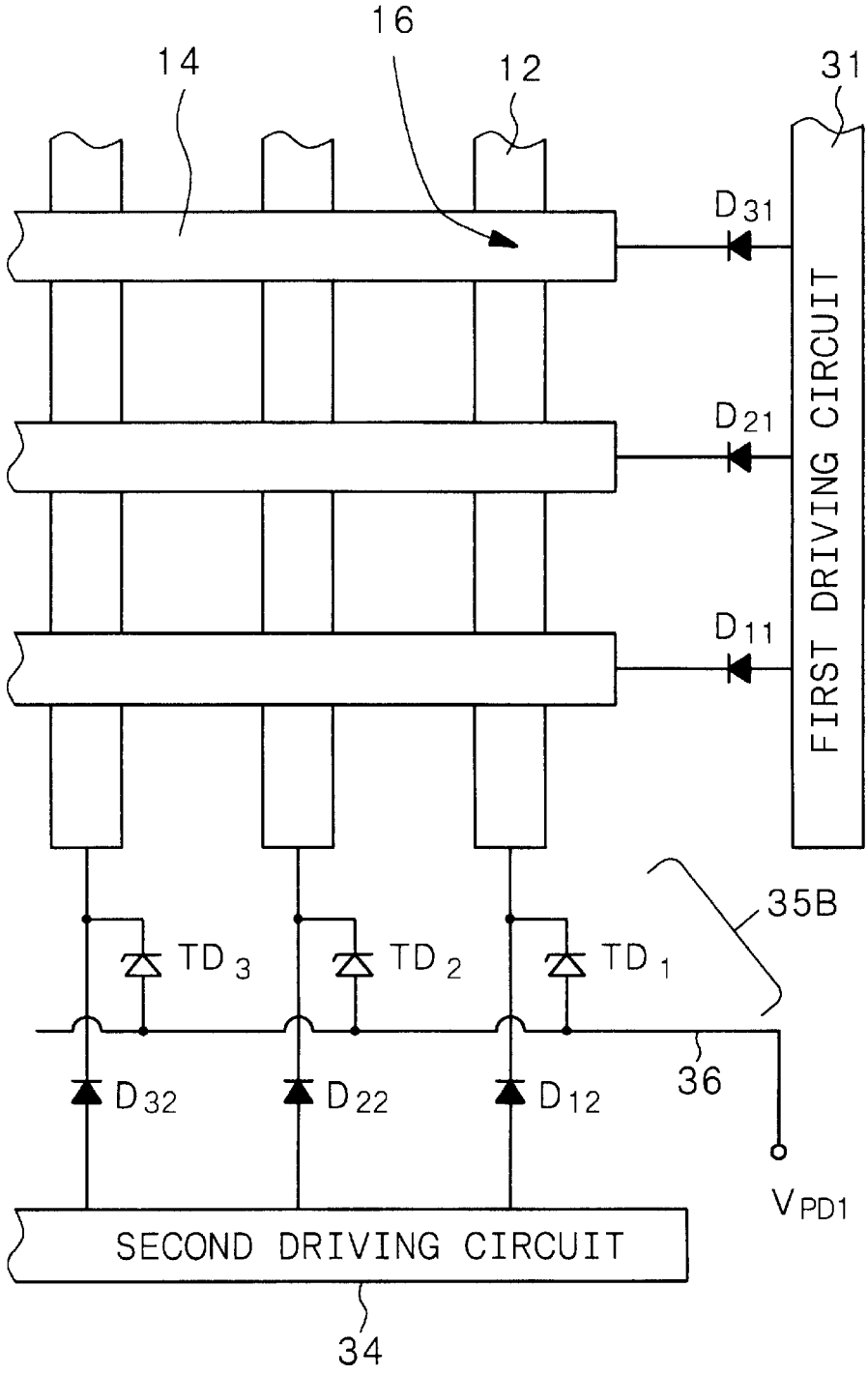

FIG. 19 is a conceptual drawing of a variant of the flat-type display having the second constitution in Example 5.

Figure 20:
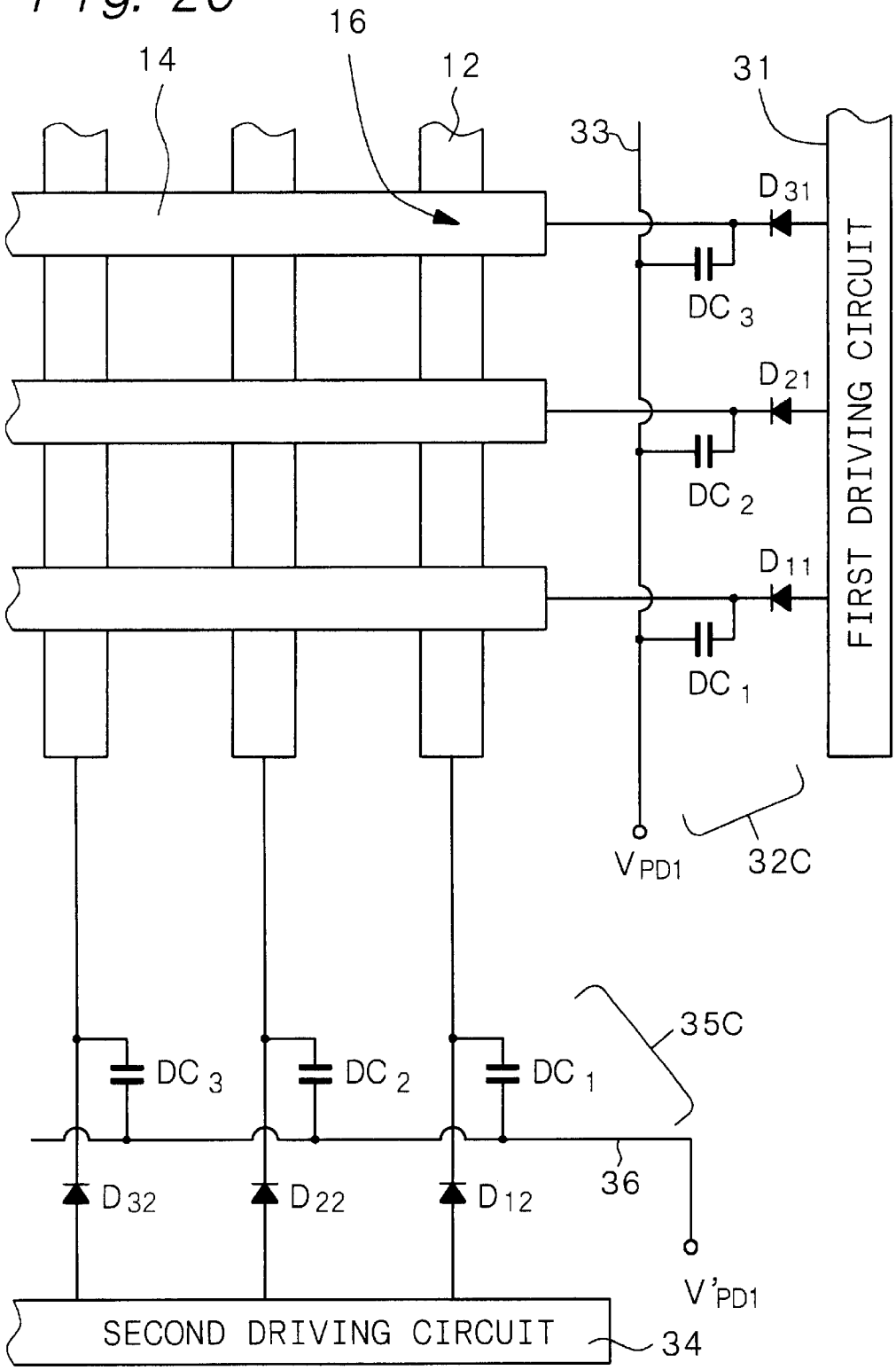

FIG. 20 is a conceptual drawing of a flat-type display having the third constitution in Example 6.

Figure 21:
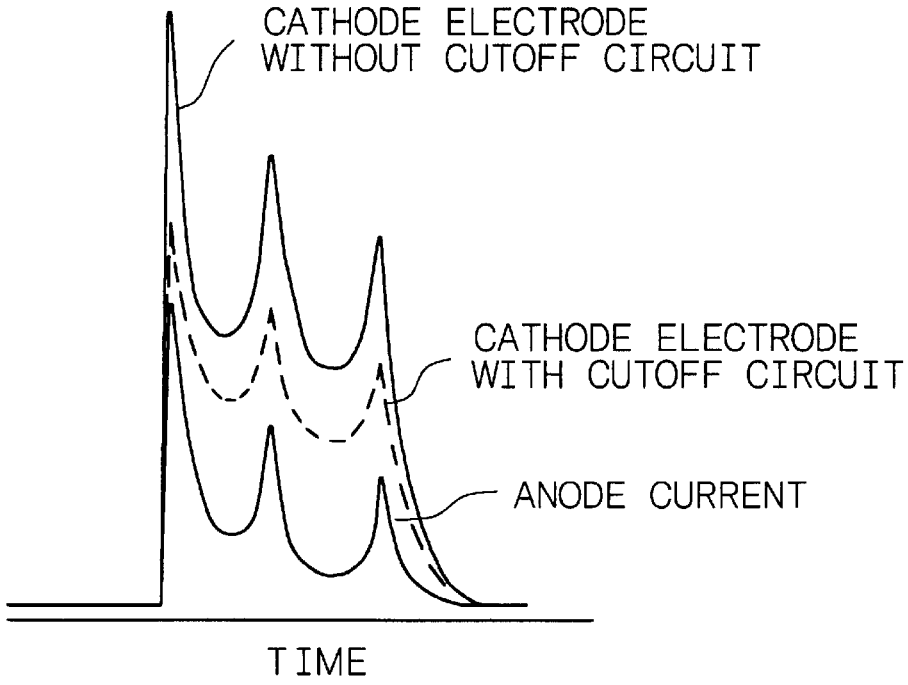

FIG. 21 is a schematic drawing of changes in anode current and cathode current when a discharge takes place.

Figure 22:
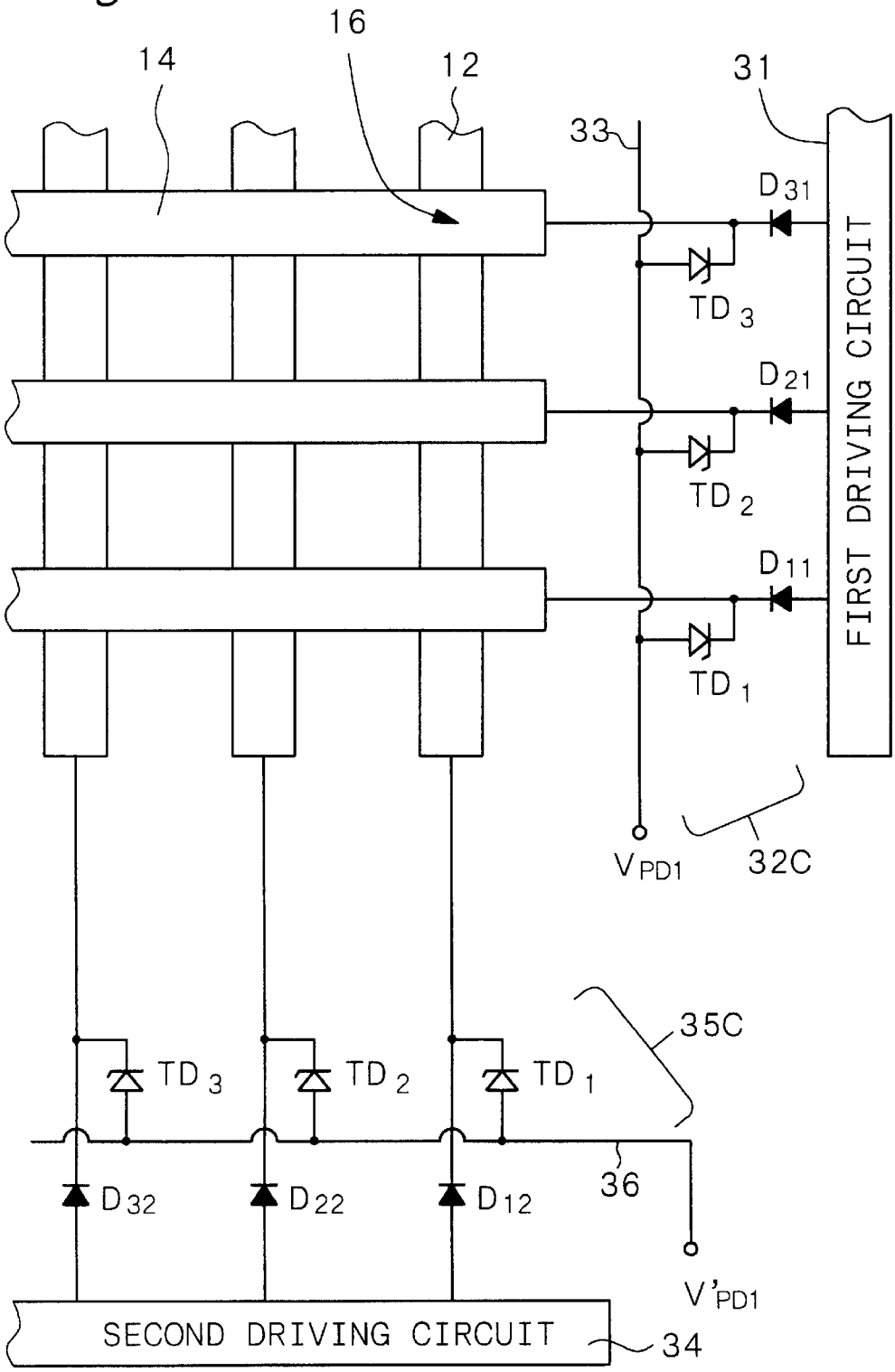

FIG. 22 is a conceptual drawing of a variant of the flat-type display having the third constitution in Example 6.

Figure 23:
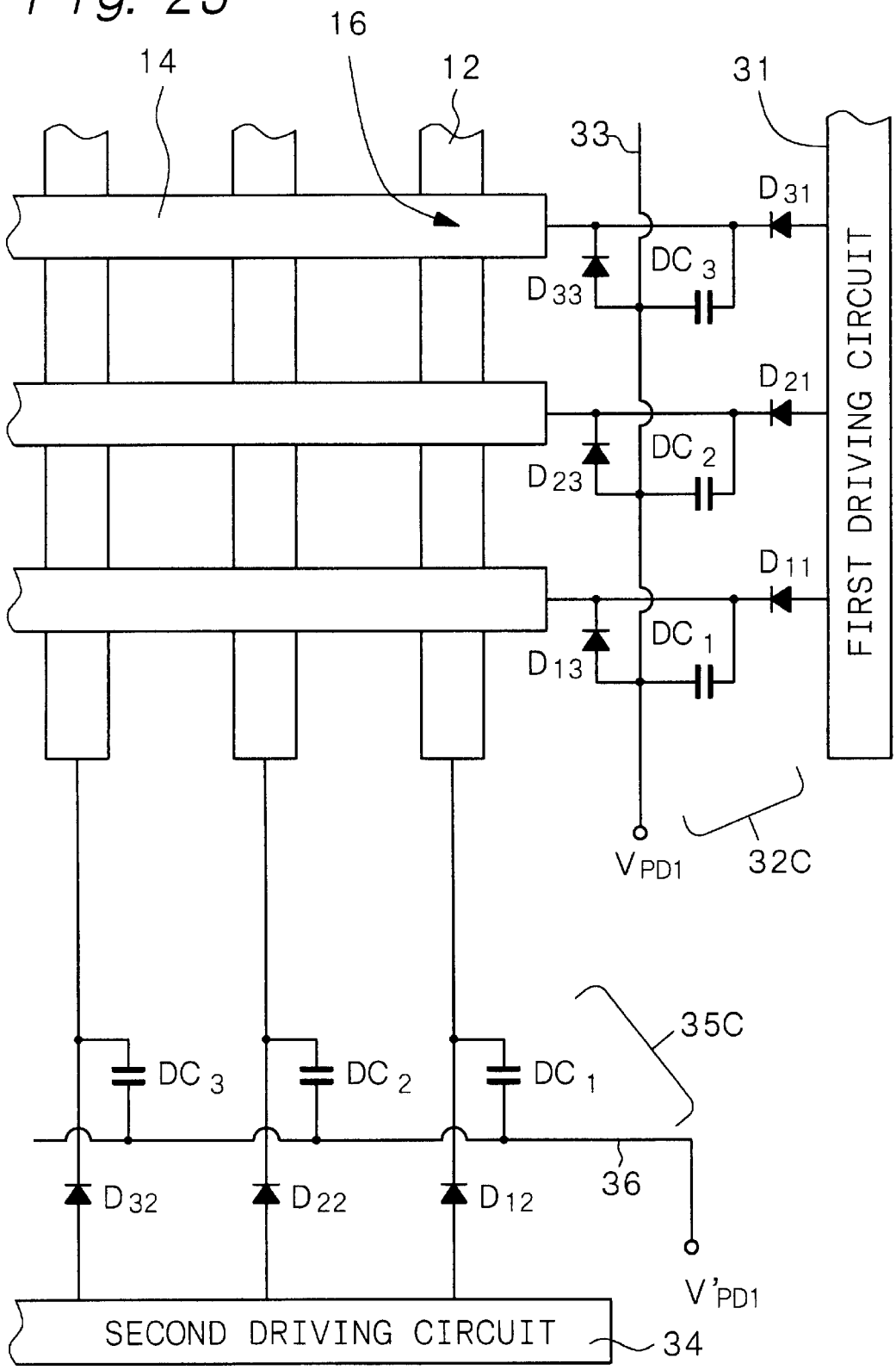

FIG. 23 is a conceptual drawing of another variant of the flat-type display having the third constitution in Example 6.

Figure 24:
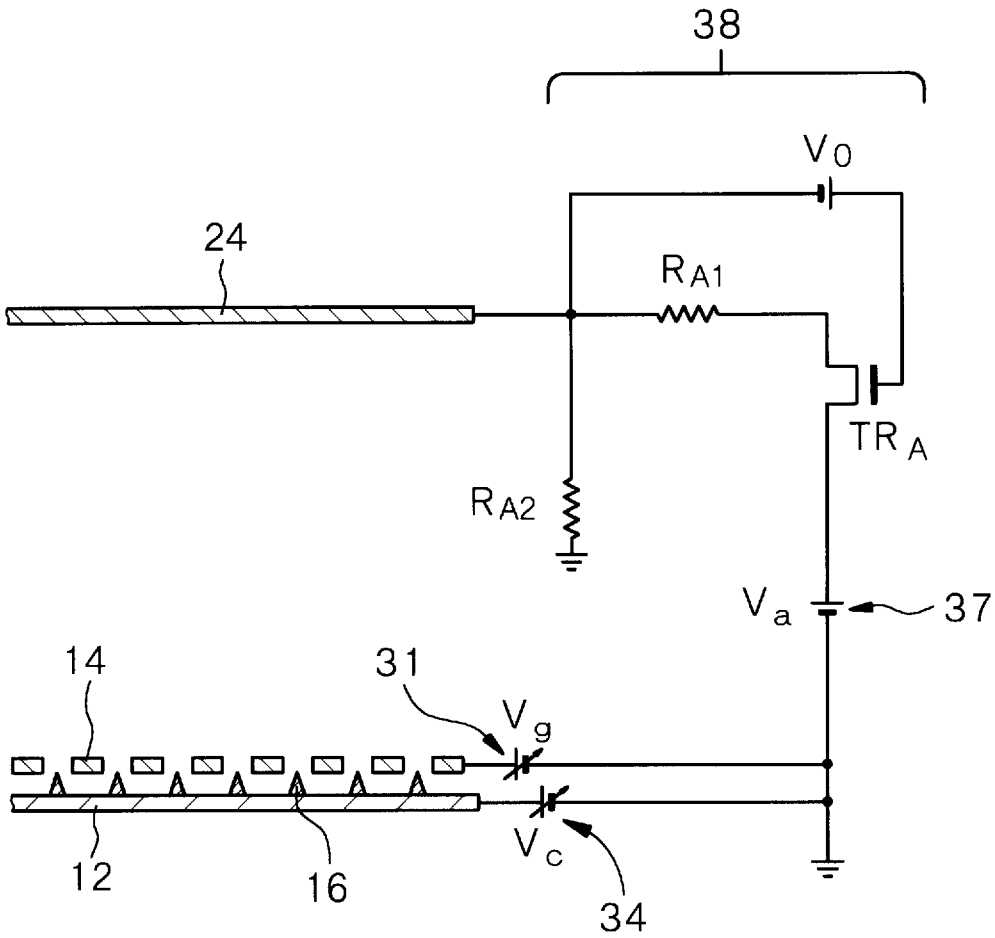

FIG. 24 is a conceptual drawing of a flat-type display of Example 7.

Figure 25:
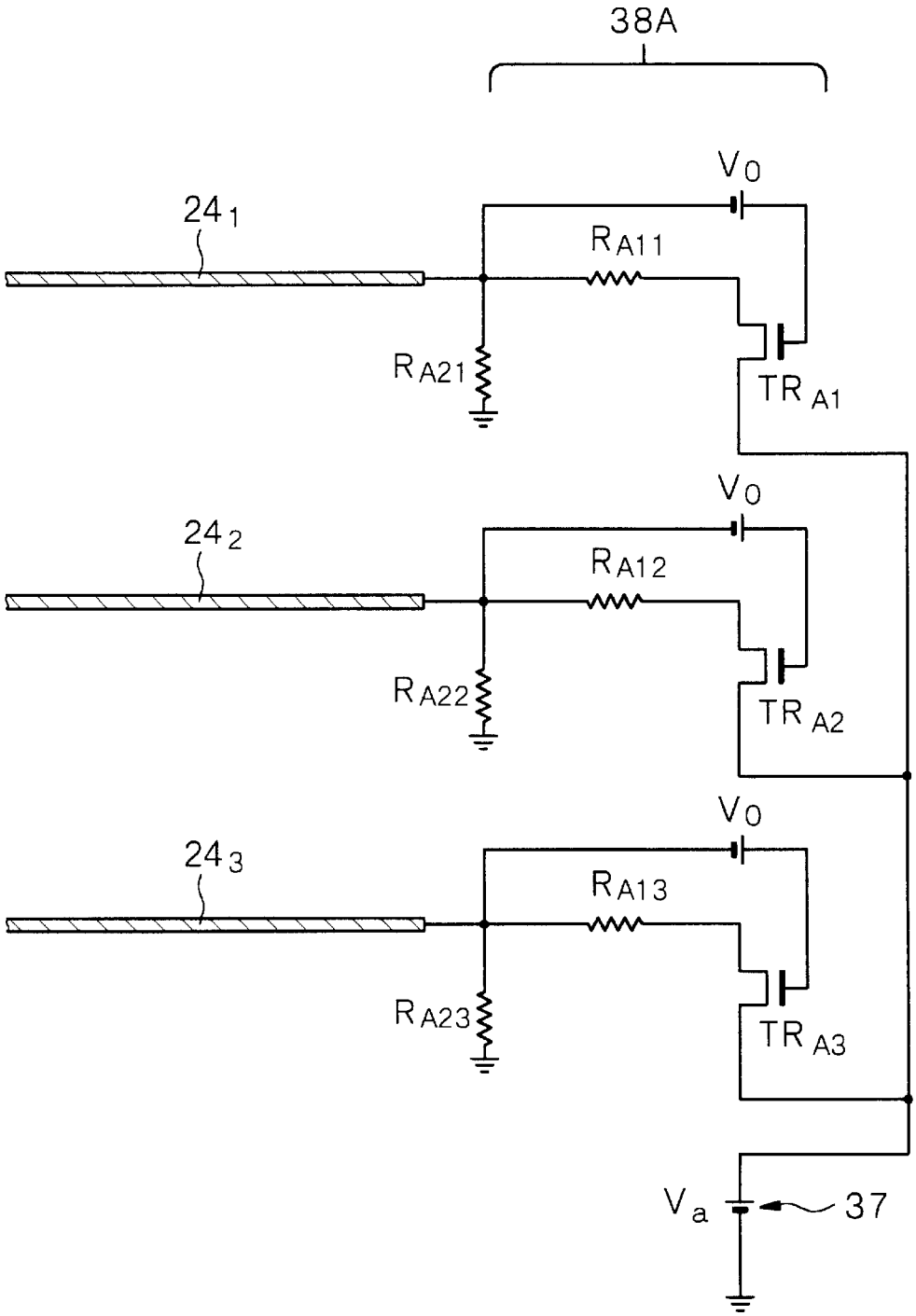

FIG. 25 is a conceptual drawing of a variant of the flat-type display of Example 7.

Figure 26:
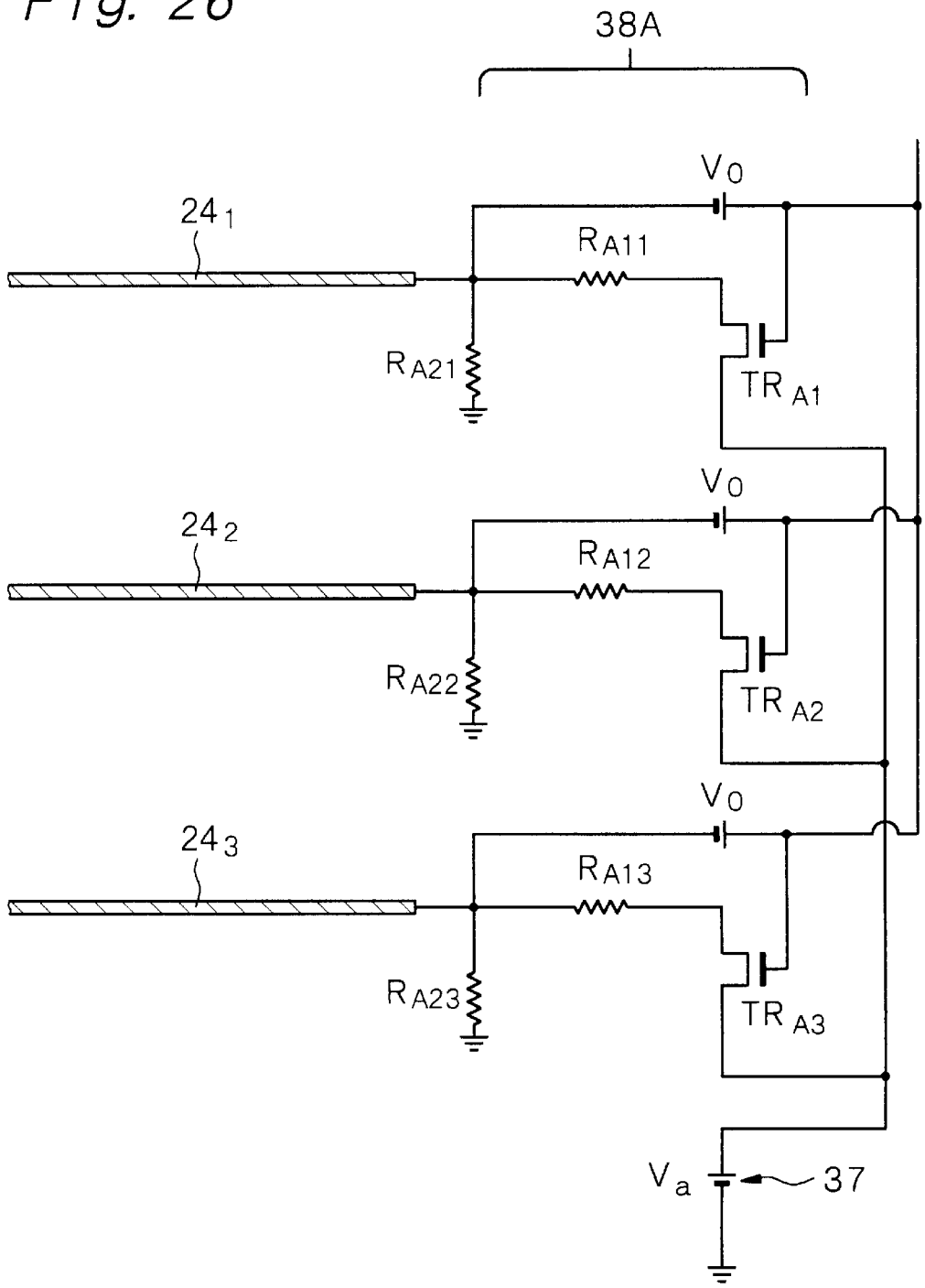

FIG. 26 is a conceptual drawing of another variant of the flat-type display of Example 7.

Figure 27:
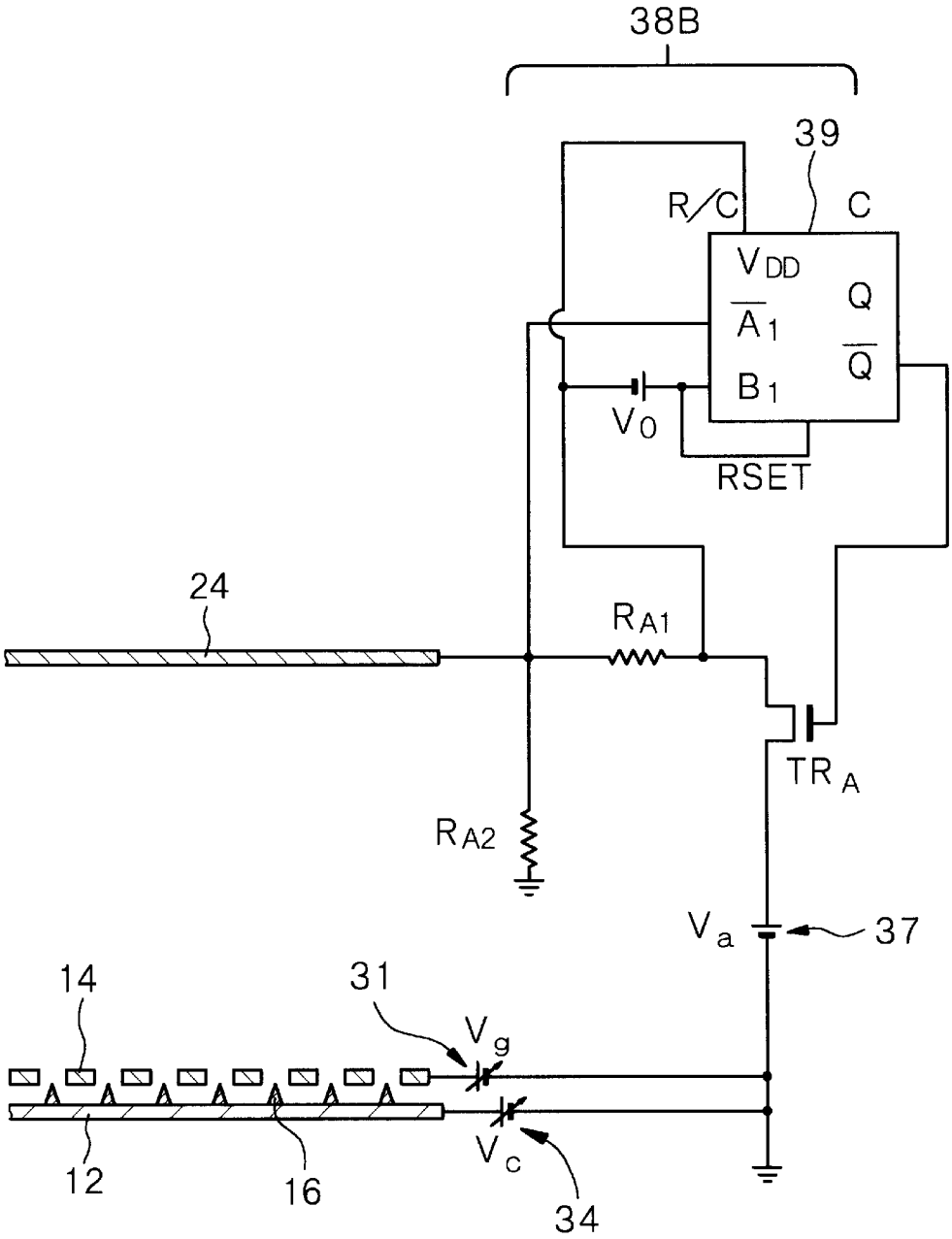

FIG. 27 is a conceptual drawing of still another variant of the flat-type display of Example 7.

Figure 28A:
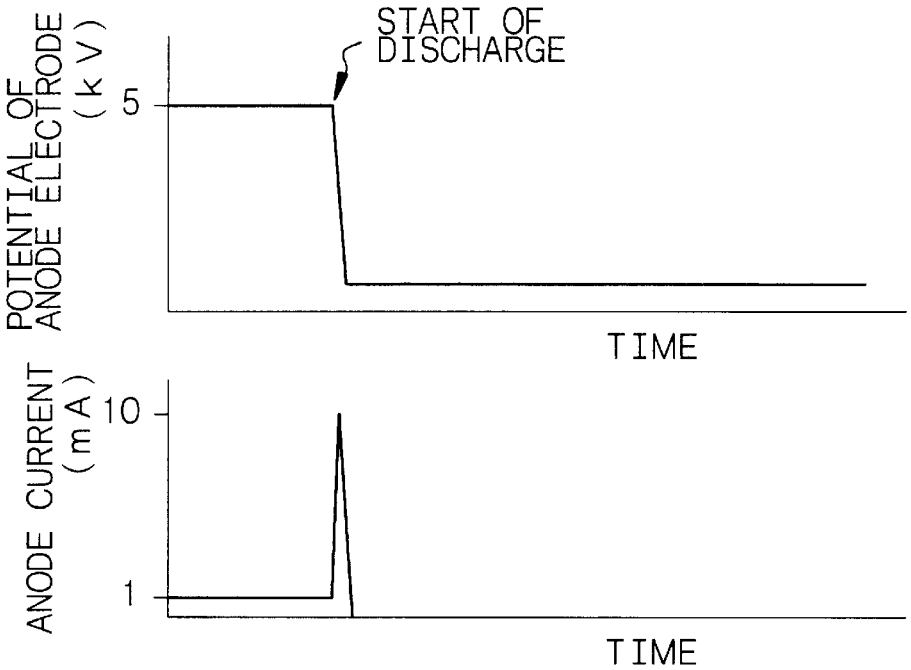
Figure 28B:
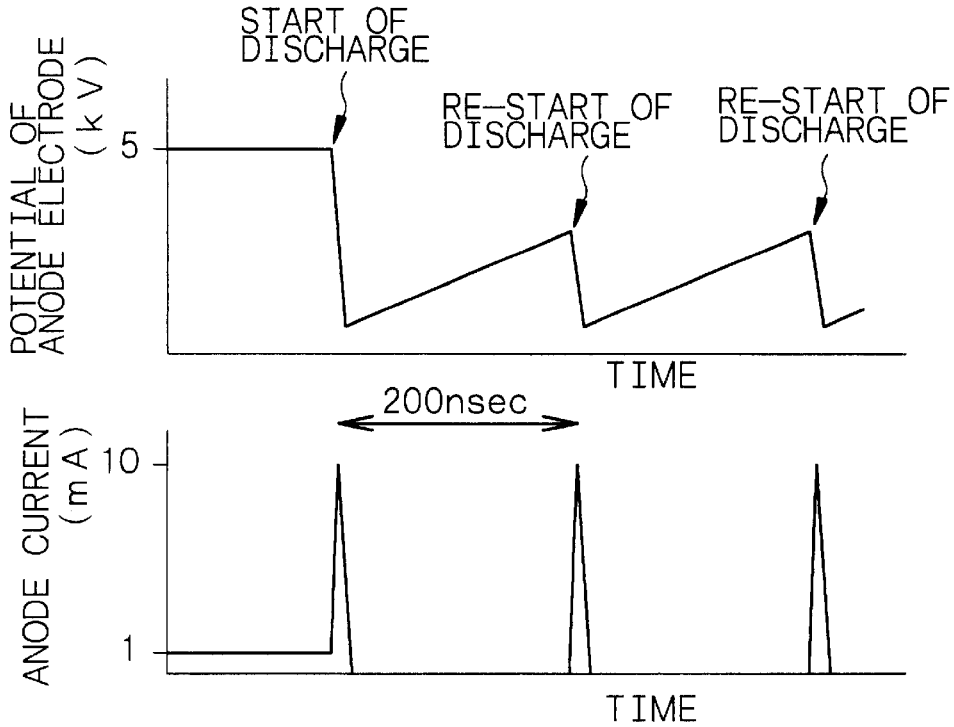

FIGS. 28A and 28B are schematic drawings of changes in anode electrode potential and anode current when the flat-type display of Example 7 has a timer or has no timer.

Figure 29:
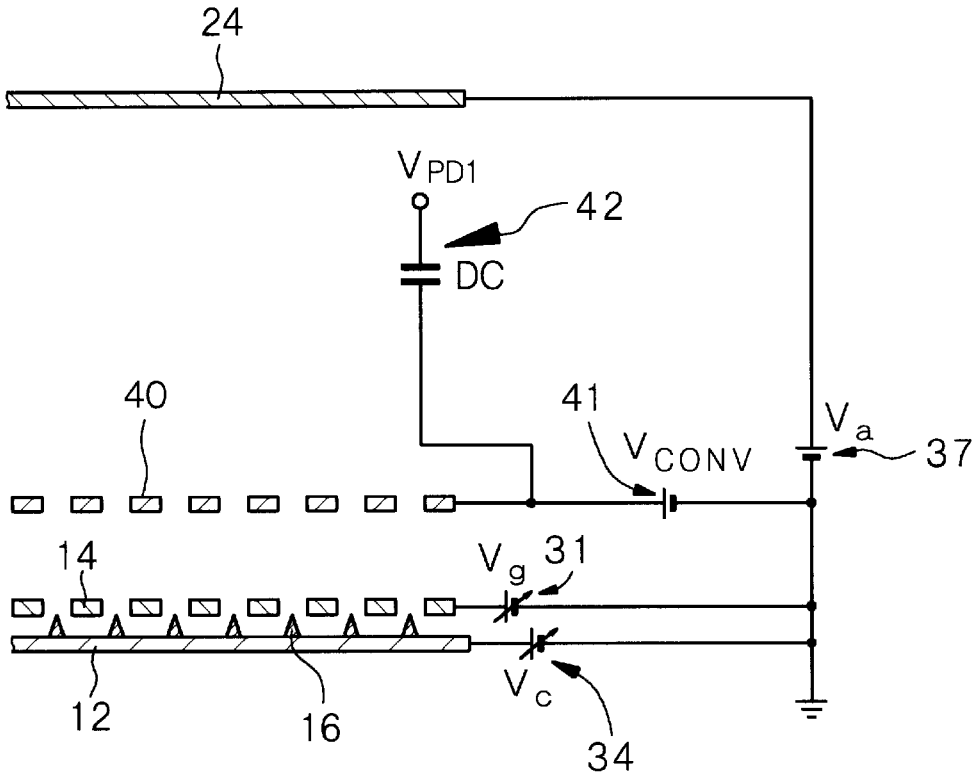

FIG. 29 is a conceptual drawing of a flat-type display of Example 8.

Figure 30:
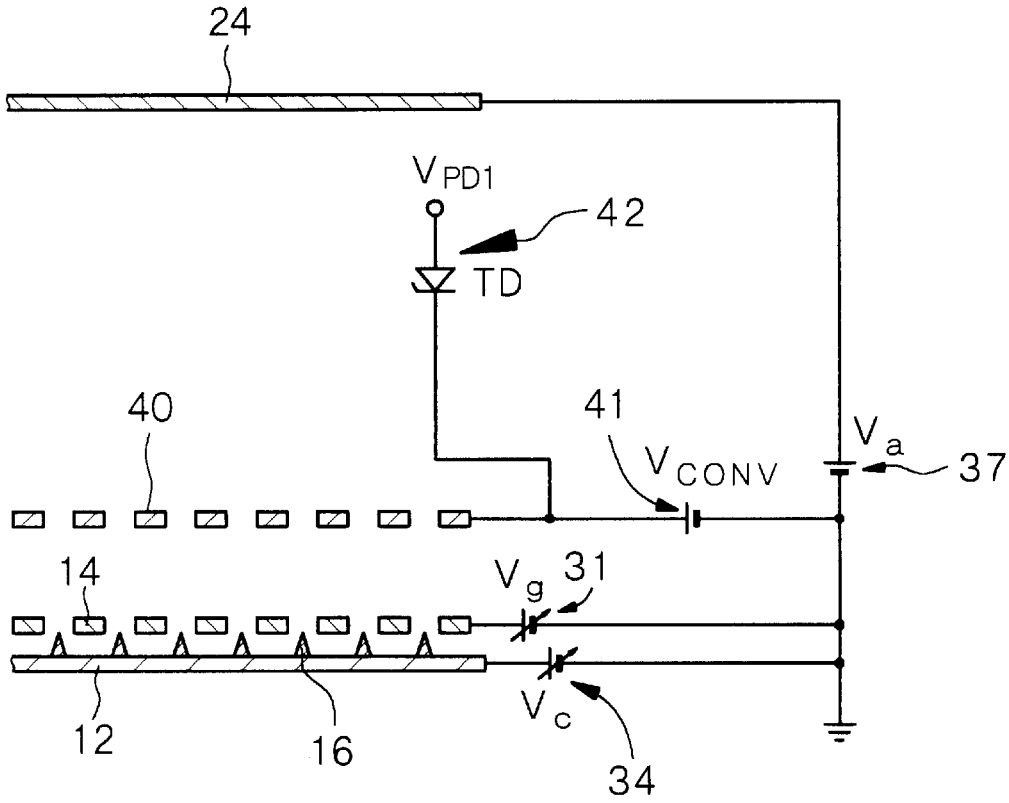

FIG. 30 is a conceptual drawing of a variant of the flat-type display of Example 8.

Figure 31:
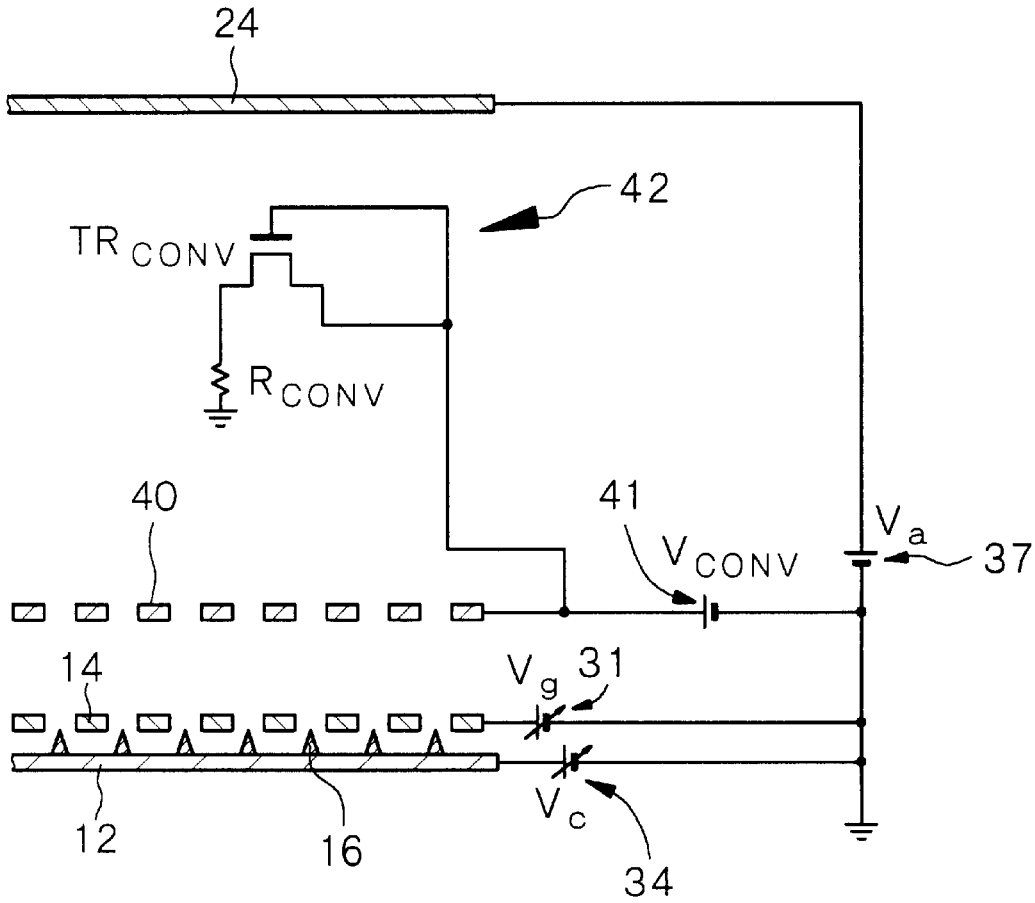

FIG. 31 is a conceptual drawing of another variant of the flat-type display of Example 8.

Figure 32:
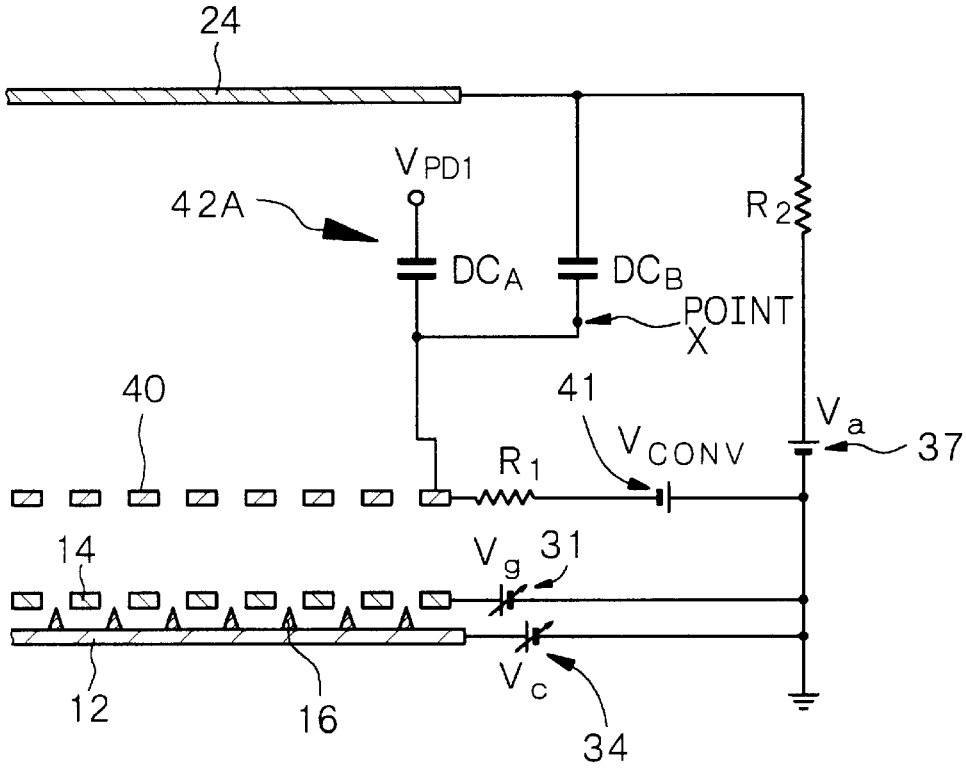

FIG. 32 is a conceptual drawing of a flat-type display of Example 9.

Figure 33:
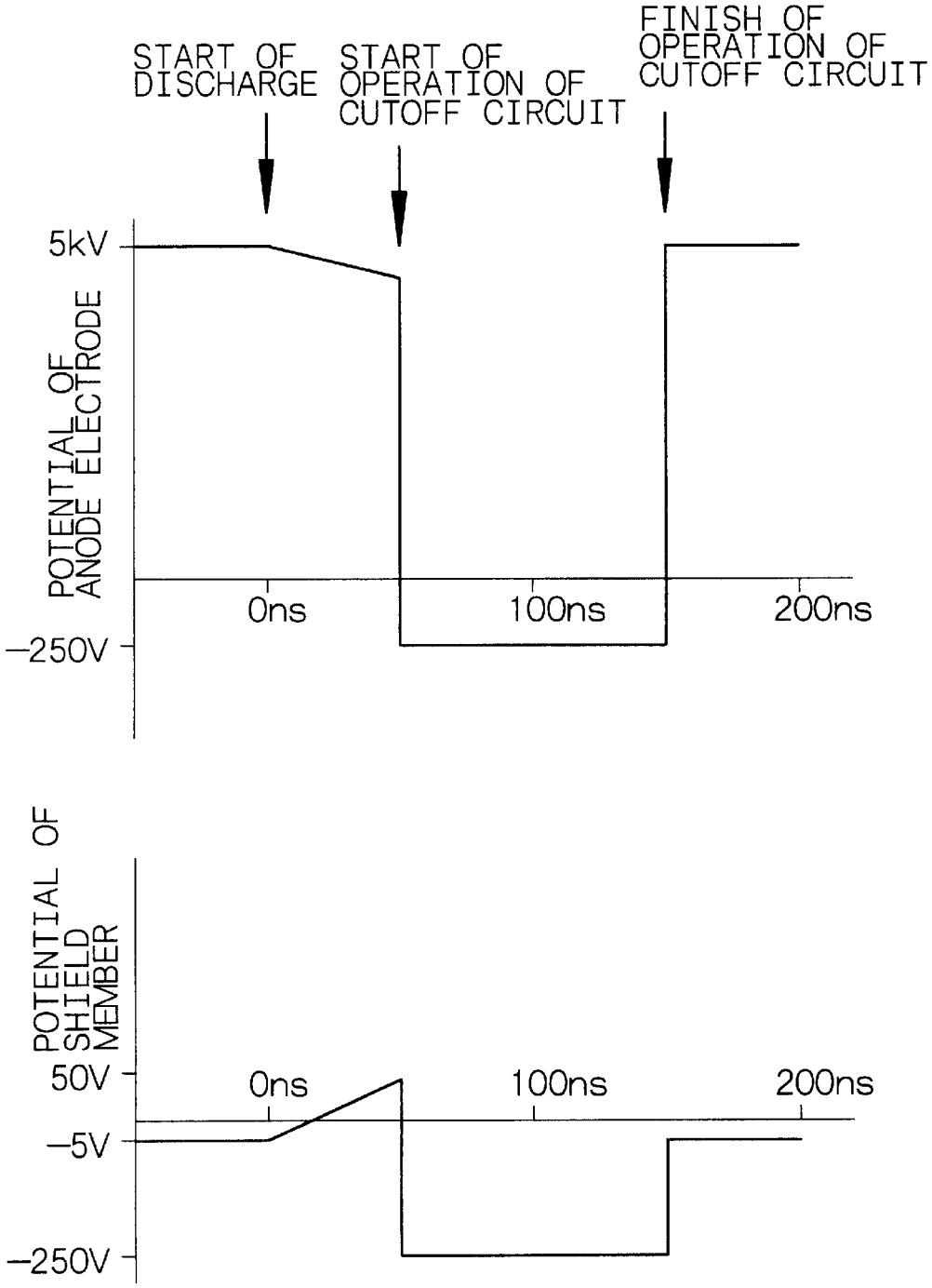

FIG. 33 is a schematic drawing of changes in potential of portions on the basis of the occurrence of a discharge in the flat-type display of Example 9.

Figure 34:
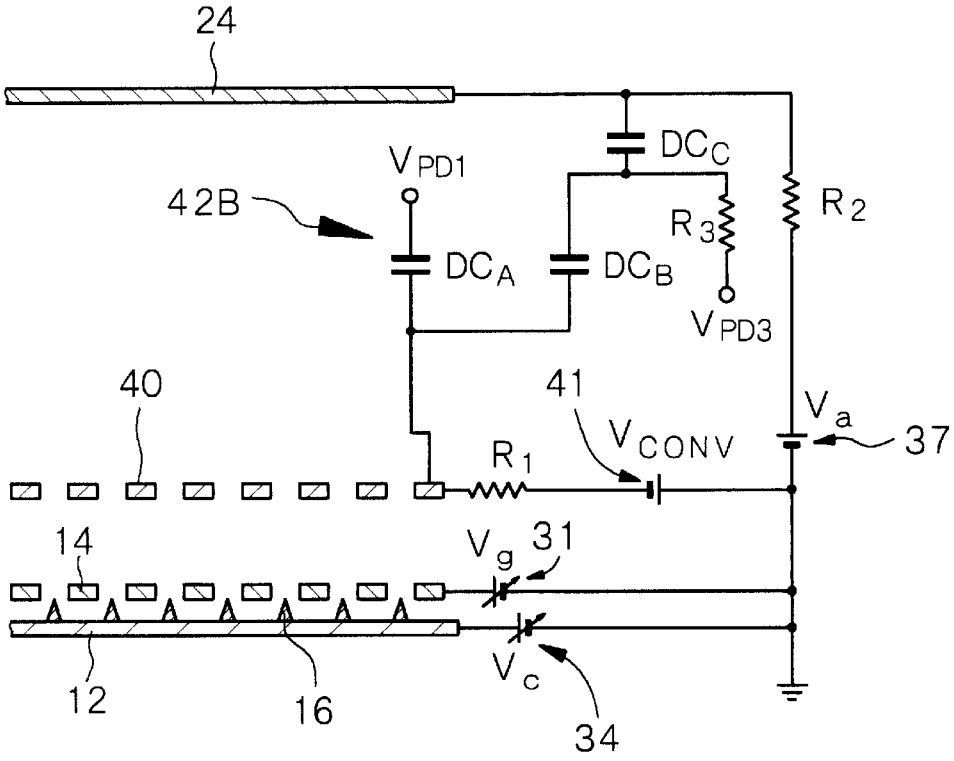

FIG. 34 is a conceptual drawing of a variant of the flat-type display of Example 9.

Figure 35:
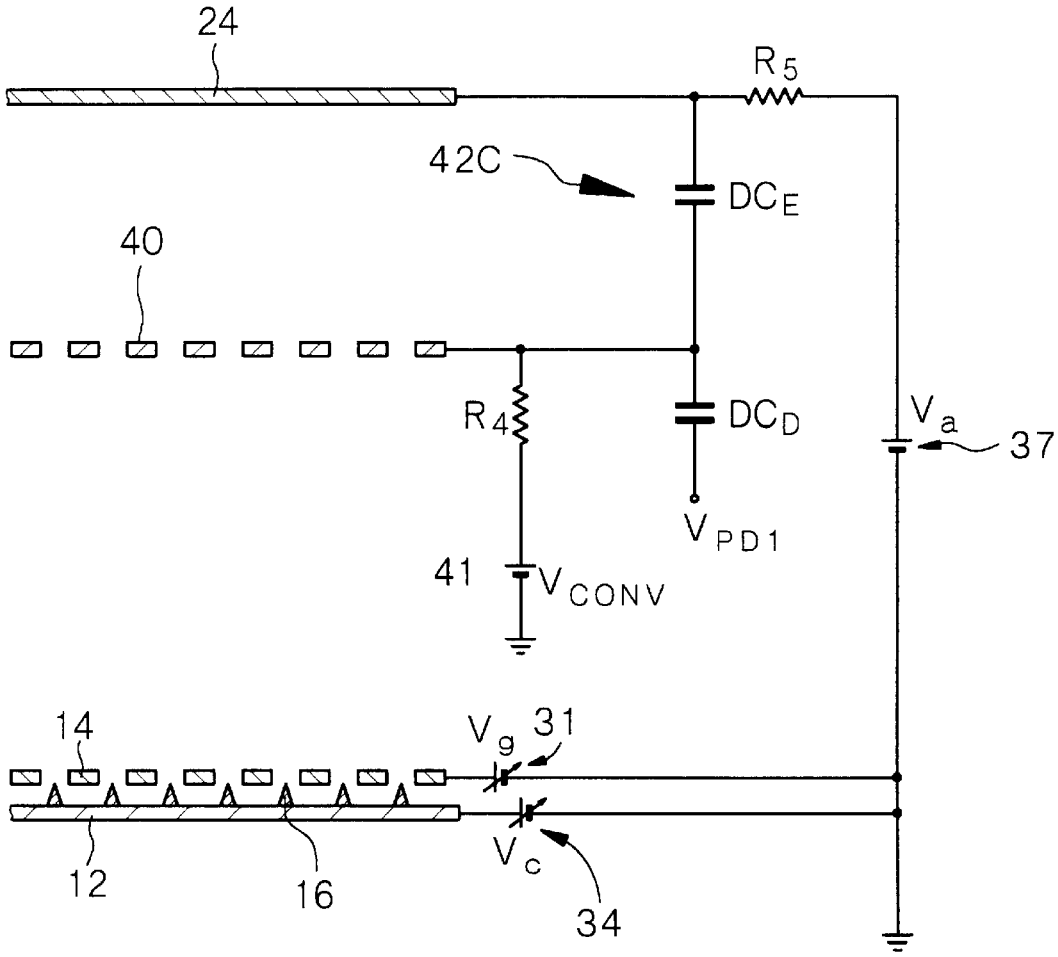

FIG. 35 is a conceptual drawing of another variant of the flat-type display of Example 9.

Figure 36A:
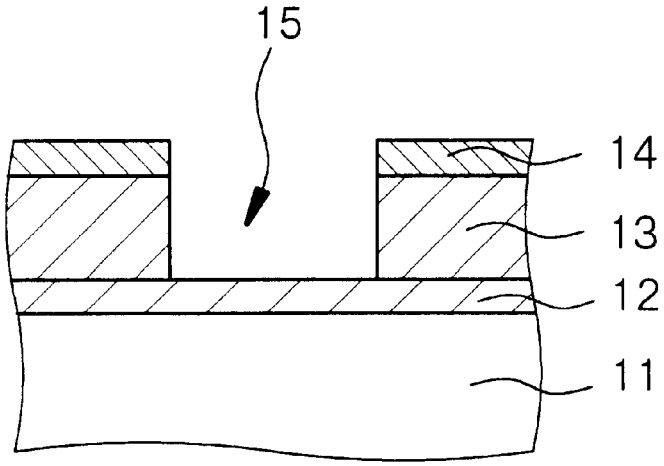
Figure 36B:
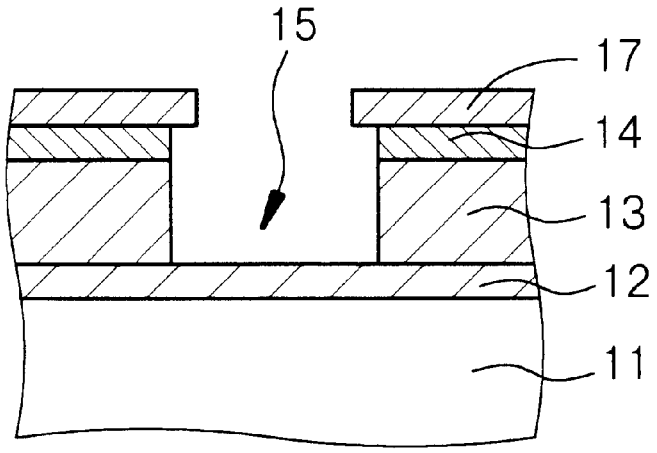

FIGS. 36A and 36B are schematic partial end views of a support member, etc., for explaining the method for producing a cold cathode field emission device having the first structure, which device is a Spindt-type cold cathode field emission device.

Figure 37A:
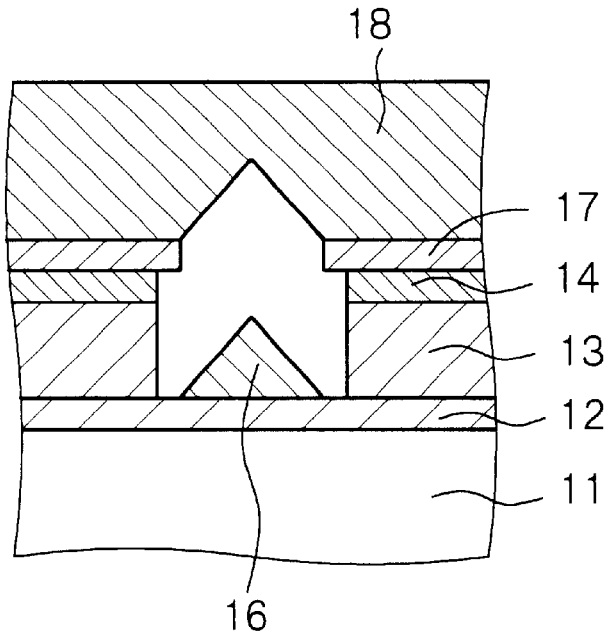
Figure 37B:
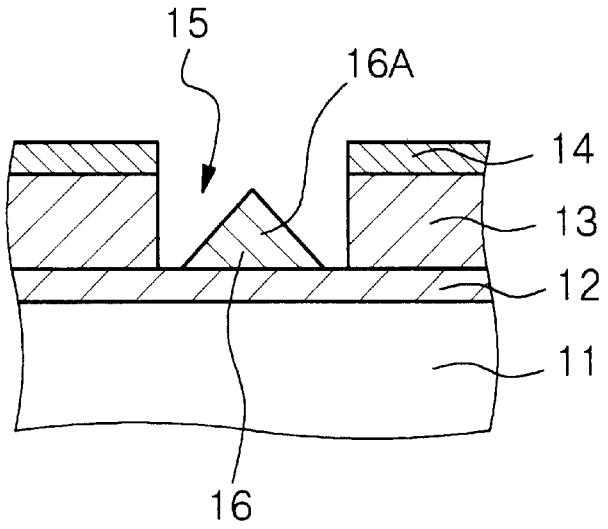
Figure 38A:
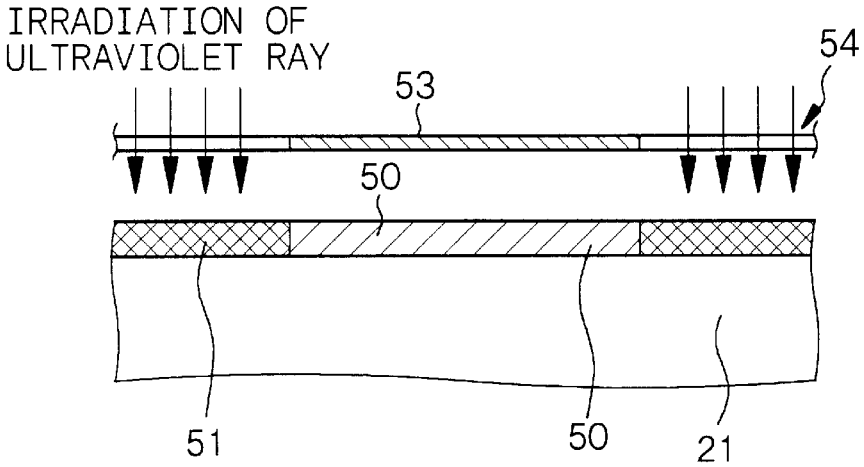
Figure 38B:
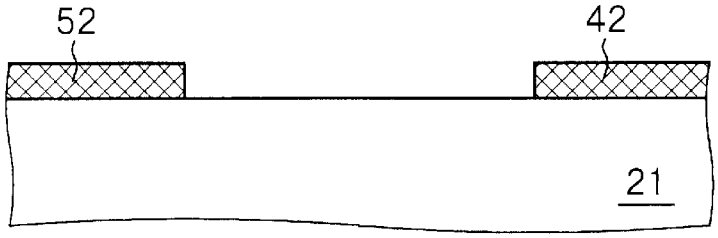
Figure 38C:
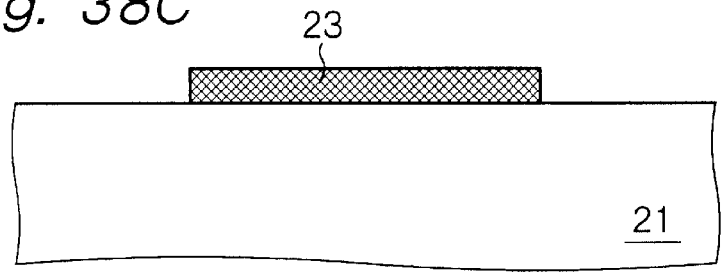
Figure 38D:
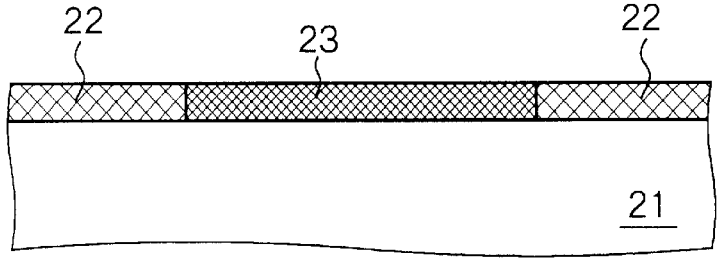

FIGS. 37A and 37B, following FIG. 36B, are schematic partial end views of the support member, etc., for explaining the method for producing the cold cathode field emission device having the first structure, which device is a Spindt-type cold cathode field emission device.

FIGS. 38A to 38D are schematic partial end views of a substrate, etc., for explaining the method for producing a second panel (anode panel).

Figure 39A:
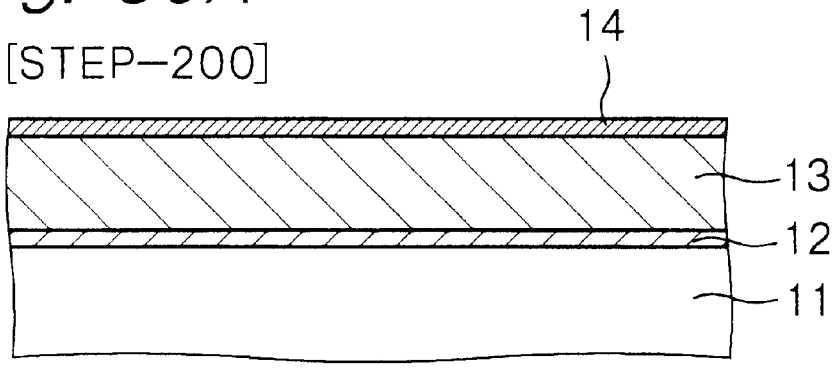
Figure 39B:
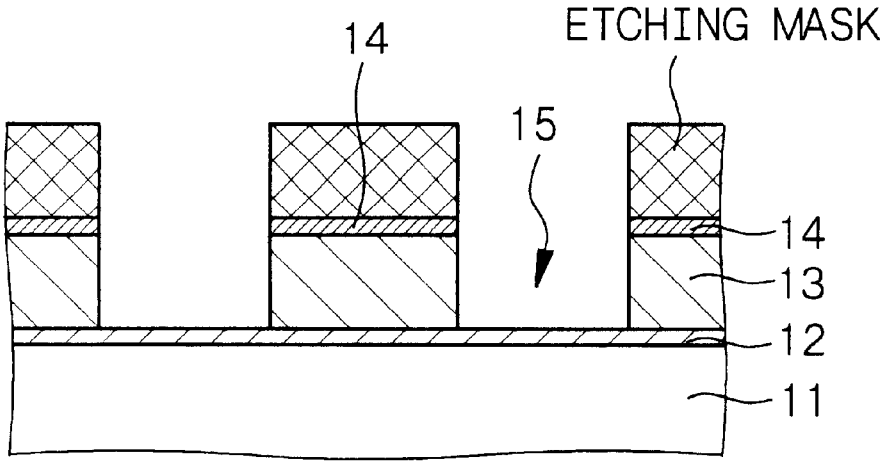

FIGS. 39A and 39B are schematic partial end views of a support member, etc., for explaining the method for producing a cold cathode field emission device having the first structure, which device is a crown-type cold cathode field emission device.

Figure 40A:
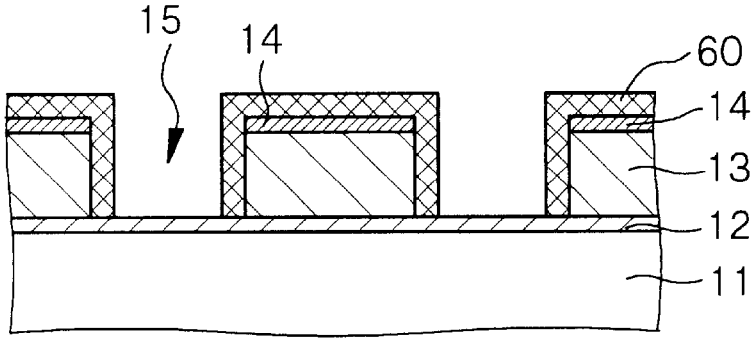
Figure 40B:
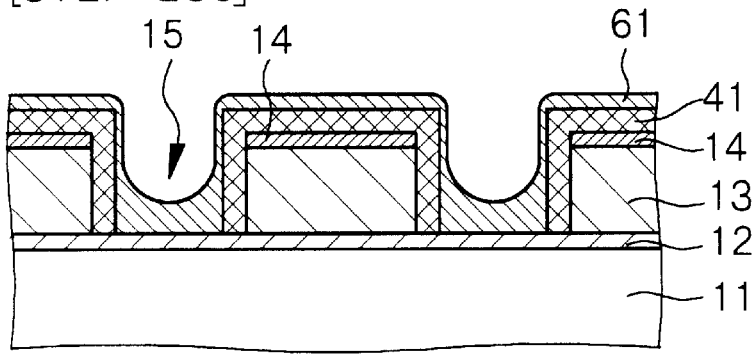
Figure 40C:
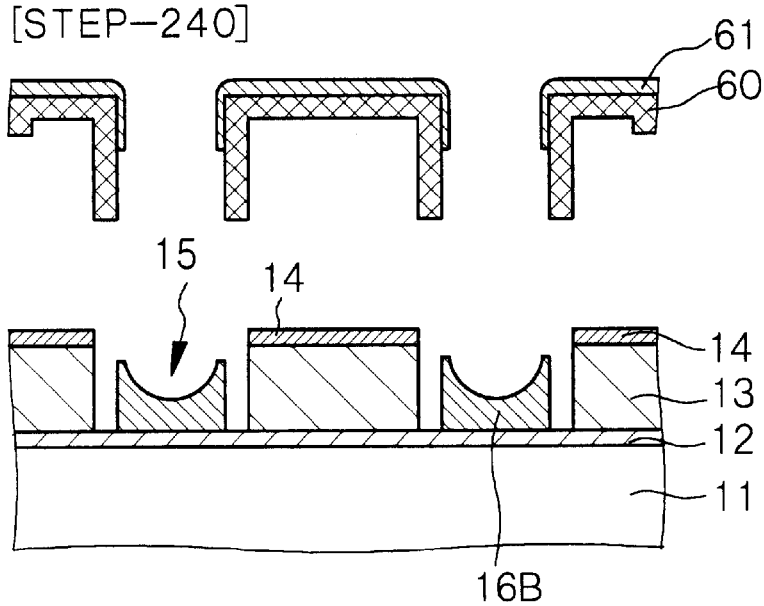

FIGS. 40A to 40C, following FIG. 39B, are schematic partial end views of the support member, etc., for explaining the method for producing the cold cathode field emission device having the first structure, which device is a crown-type cold cathode field emission device.

Figure 41A:
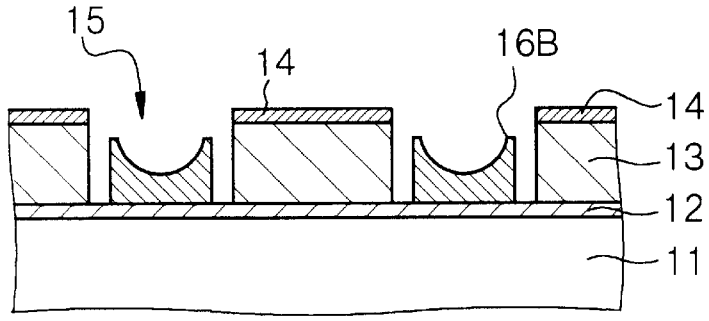
Figure 41B:
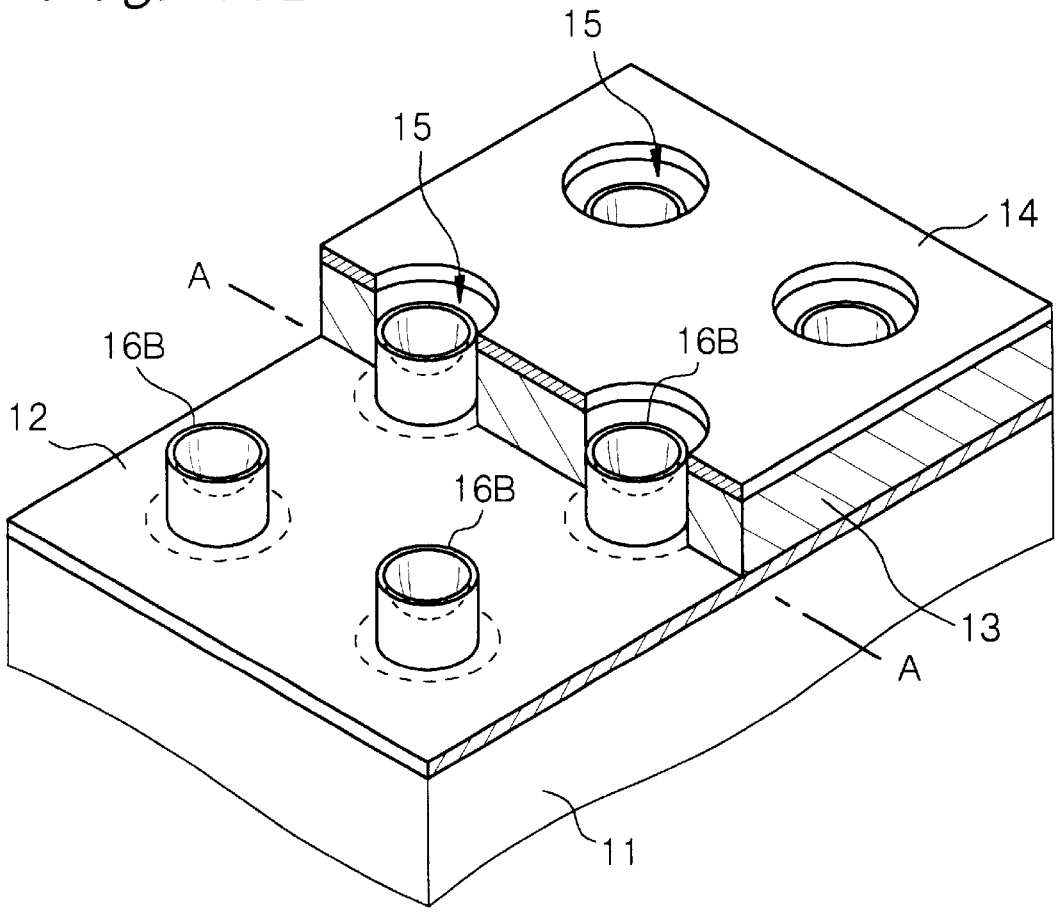

FIGS. 41A and 41B, following FIG. 40C, are a schematic partial end view and a schematic perspective view of the support member, etc., for explaining the method for producing the cold cathode field emission device having the first structure, which device is a crown-type cold cathode field emission device.

Figure 42A:
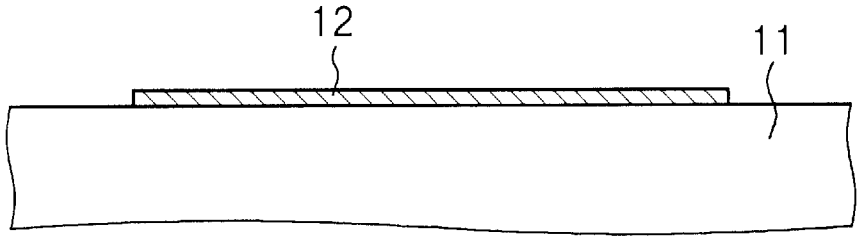
Figure 42B:
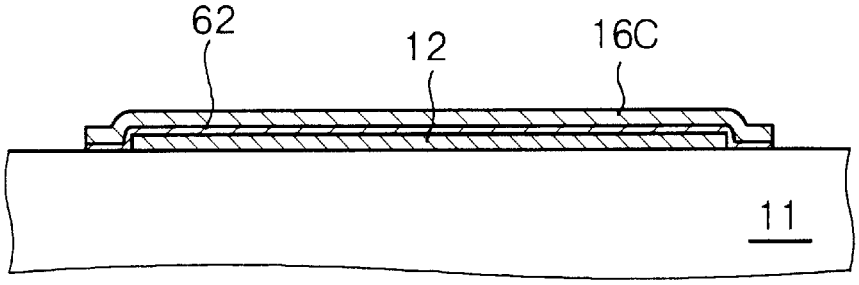
Figure 42C:
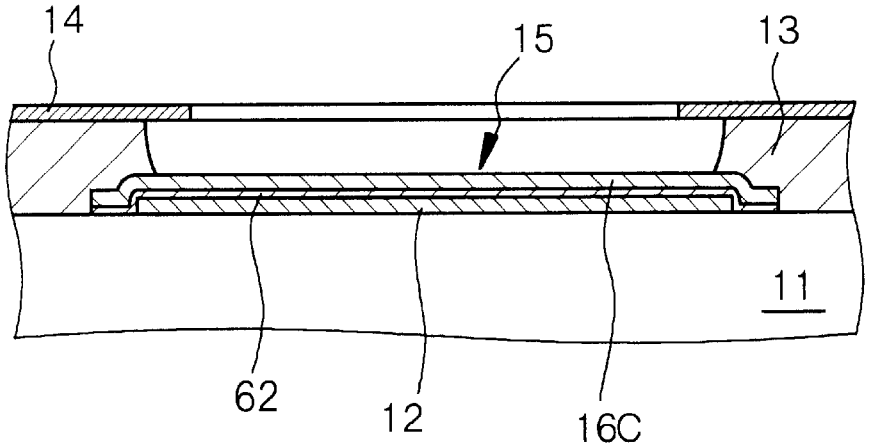

FIGS. 42A to 42C are schematic partial end views of a support member, etc., for explaining the method for producing a cold cathode field emission device having the first structure, which device is a plane-type cold cathode field emission device.

Figure 43A:
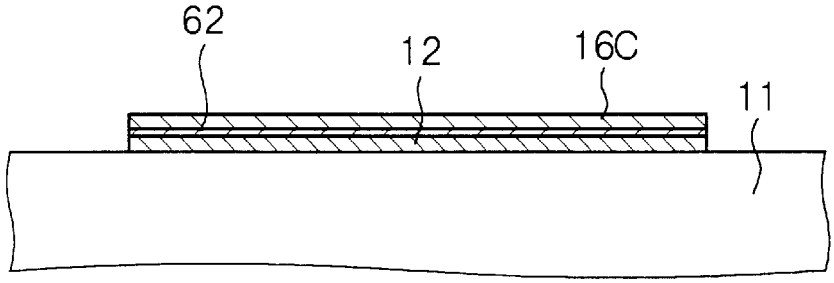
Figure 43B:
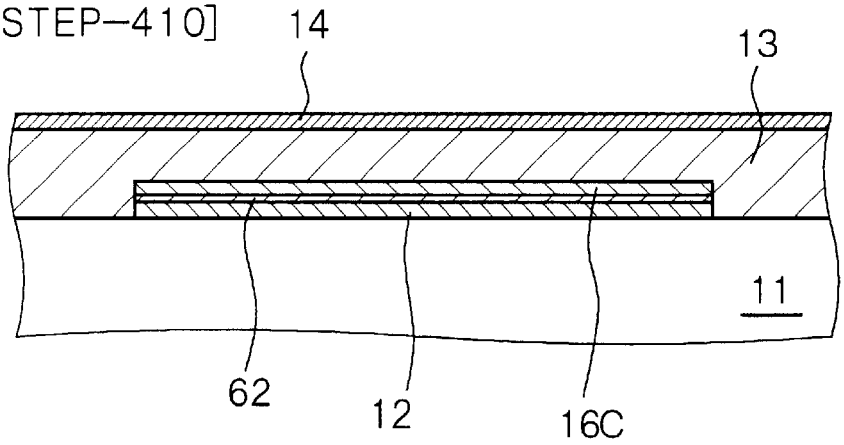
Figure 43C:
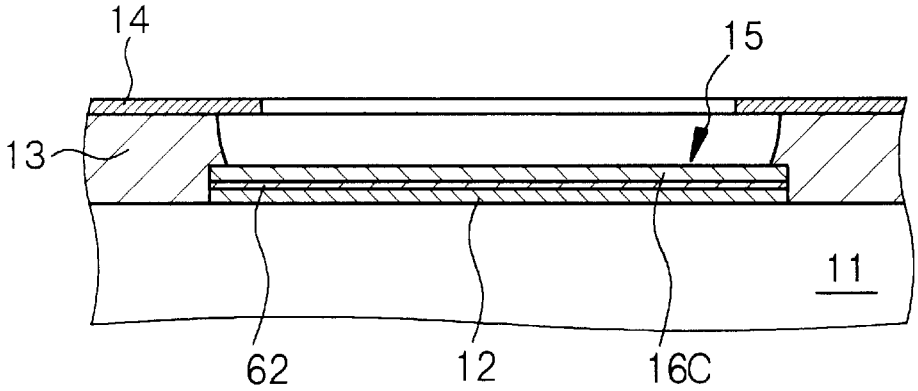

FIGS. 43A to 43C are schematic partial end views of a support member, etc., for explaining the method for producing a variant of the cold cathode field emission device having the first structure, which device is a plane-type cold cathode field emission device.

Figure 44A:
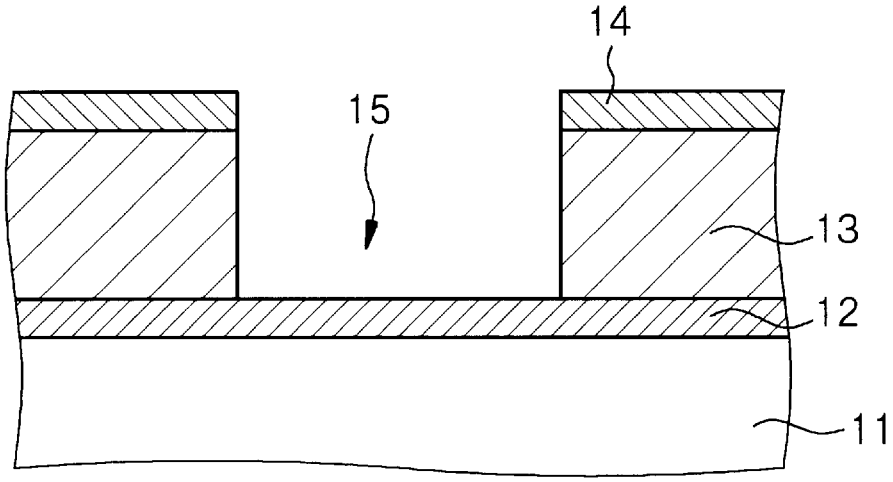
Figure 44B:
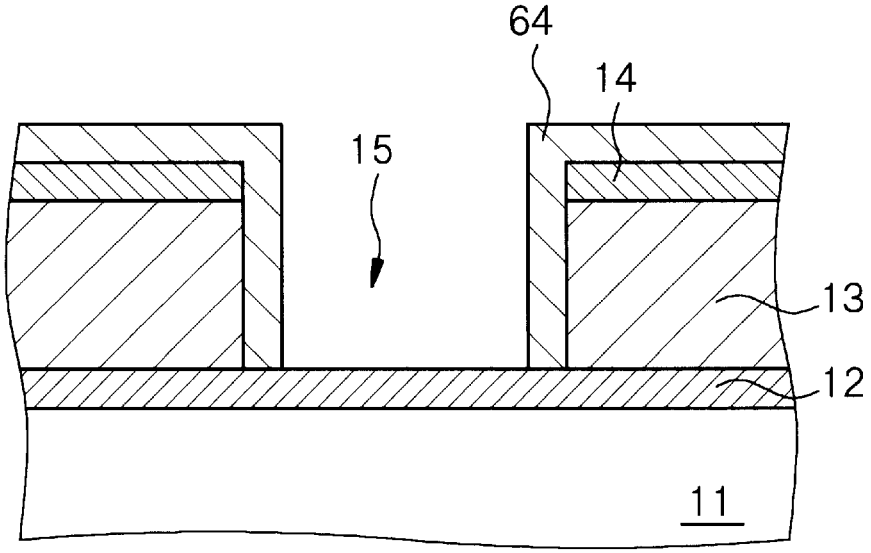

FIGS. 44A and 44B are schematic partial end views of a support member, etc., for explaining the method for producing another variant of the cold cathode field emission device having the first structure, which device is a plane-type cold cathode field emission device.

Figure 45A:
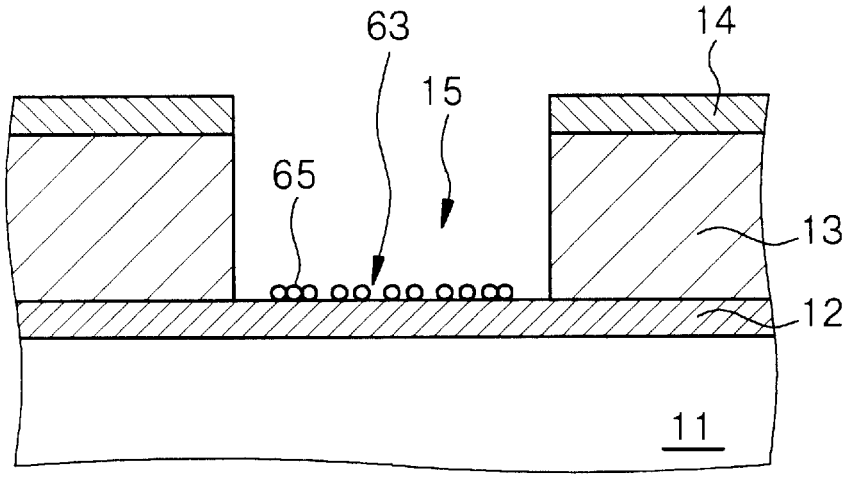
Figure 45B:
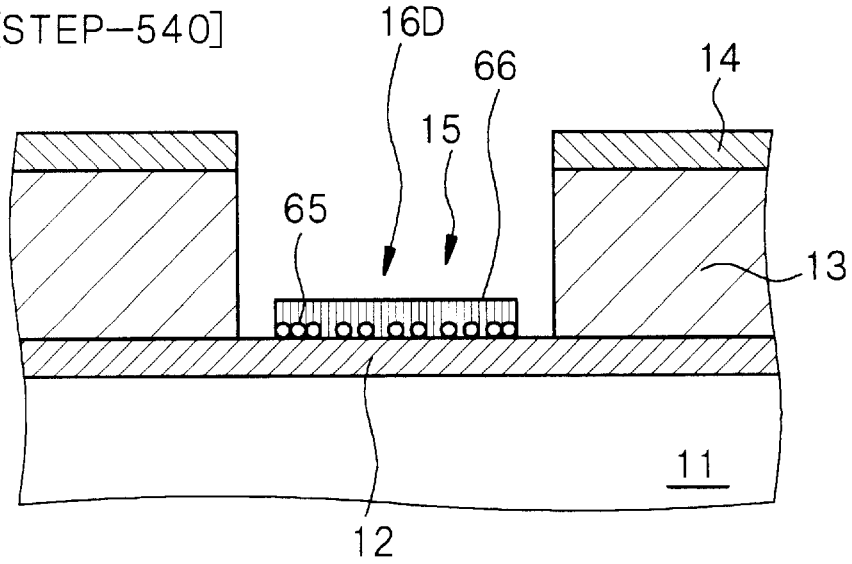

FIGS. 45A and 45B, following FIG. 44B, are schematic partial end views of the support member, etc., for explaining the method for producing the variant of the cold cathode field emission device having the first structure, which device is a plane-type cold cathode field emission device.

Figure 46A:
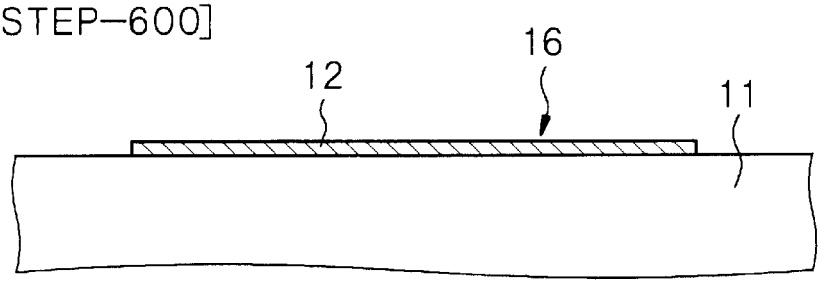
Figure 46B:
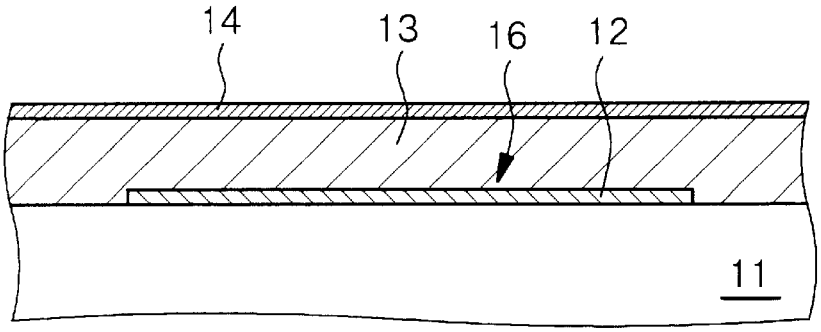
Figure 46C:
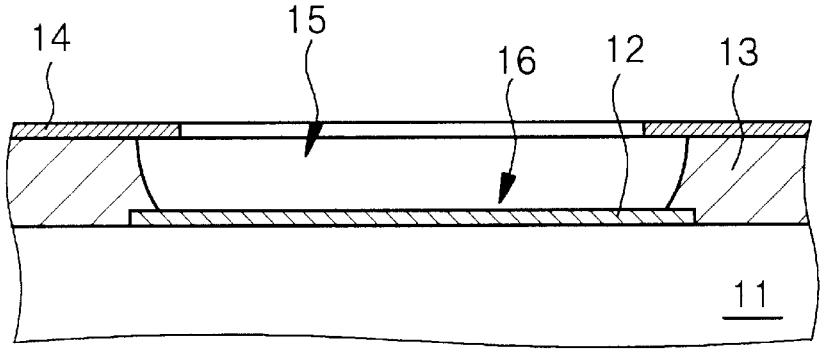

FIGS. 46A to 46C are schematic partial cross-sectional views of a support member, etc., for explaining the method for producing a cold cathode field emission device having the second structure, which device is a flat-type cold cathode field emission device.

Figure 47A:
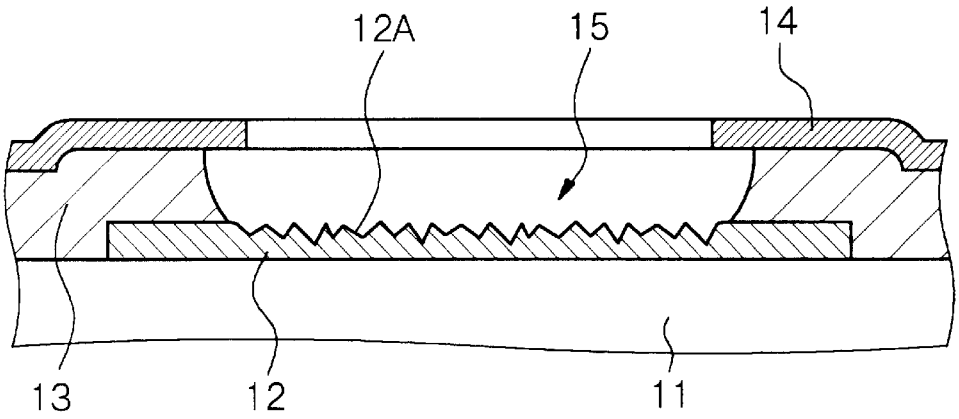
Figure 47B:
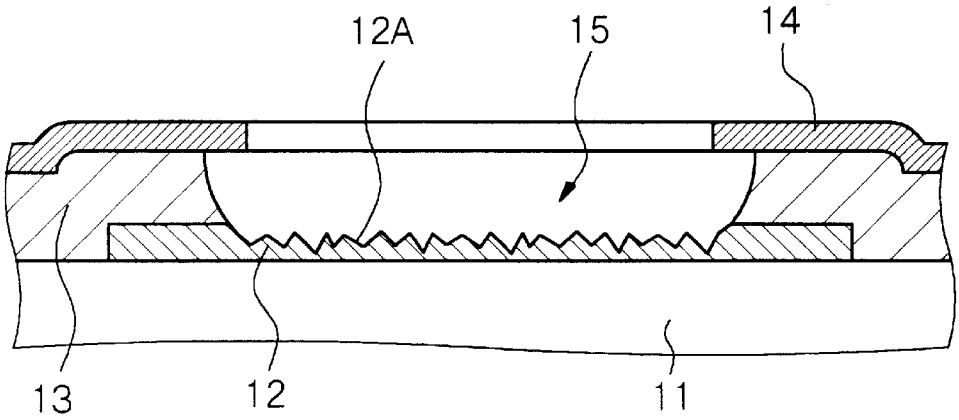

FIGS. 47A and 47B are schematic partial cross-sectional views of variants of the cold cathode field emission device having the second structure, which device is a flat-type cold cathode field emission device.

Figure 48:
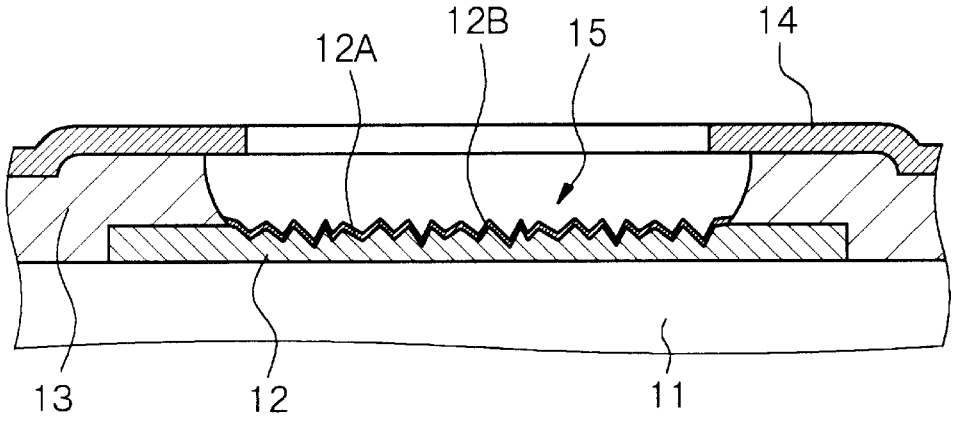

FIG. 48 is a schematic partial cross-sectional view of a variant of the cold cathode field emission device having the second structure, which device is a flat-type cold cathode field emission device.

Figure 49A:
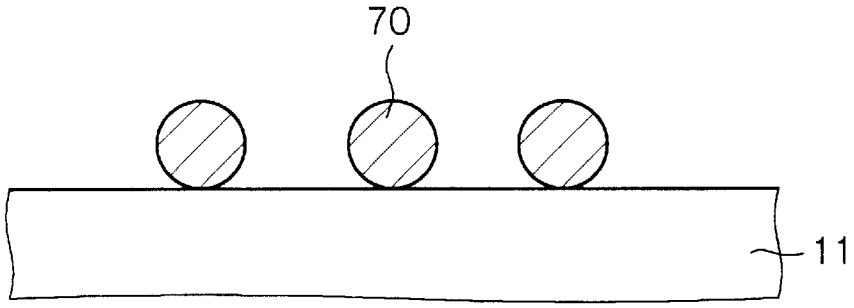
Figure 49B:
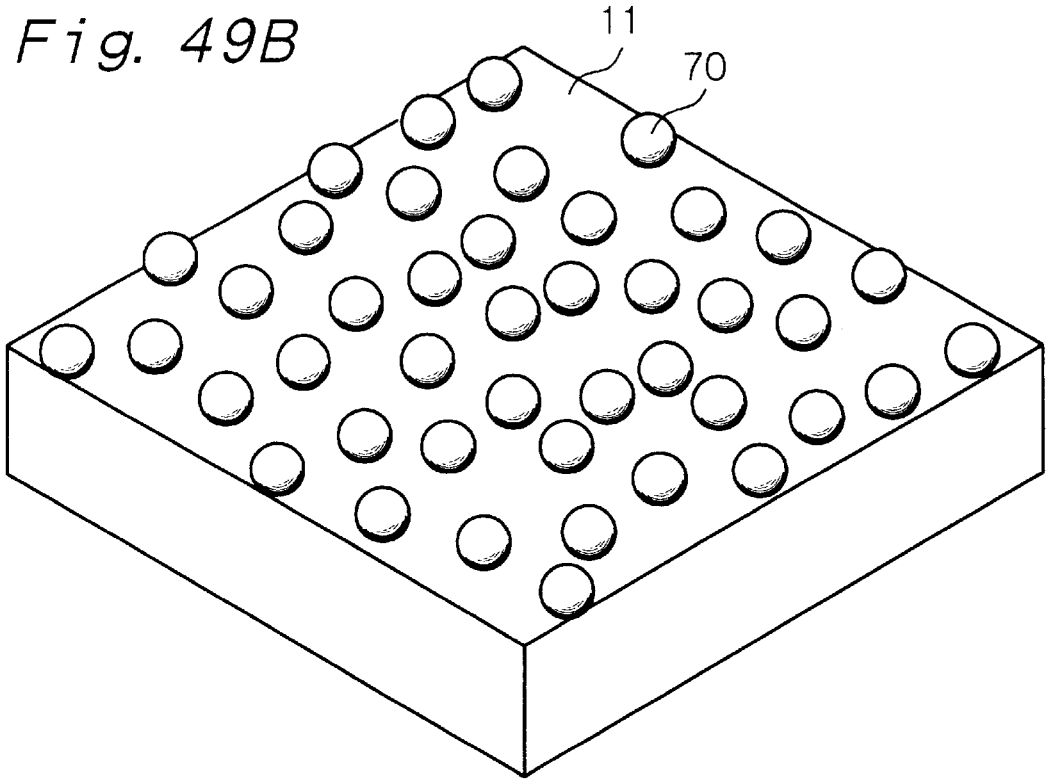

FIGS. 49A and 49B are a schematic partial end view and a partial perspective view of a support member, etc., for explaining the method for producing a variant of the cold cathode field emission device having the second structure, which device is a flat-type cold cathode field emission device.

Figure 50A:
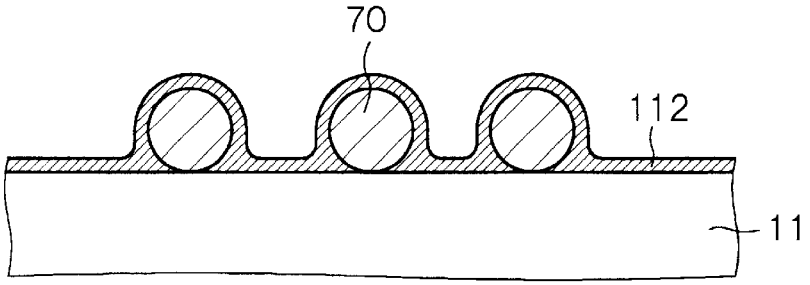
Figure 50B:
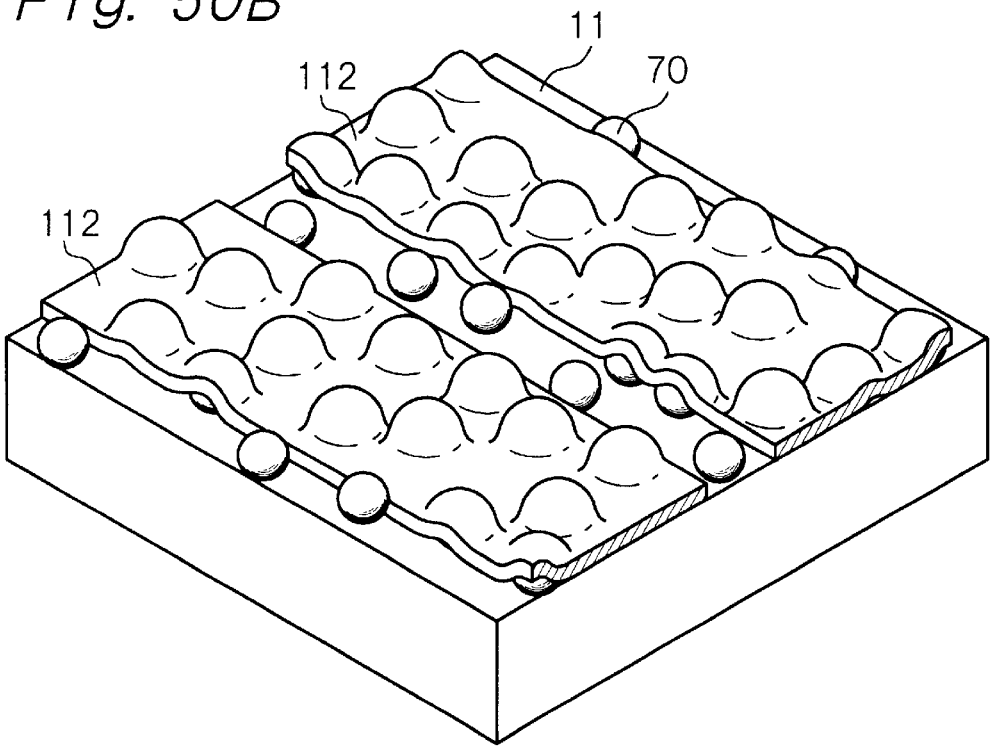

FIGS. 50A and 50B, following FIGS. 49A and 49B, are a schematic partial end view and a partial perspective view of a support member, etc., for explaining the method for producing another variant of the cold cathode field emission device having the second structure, which device is a flat-type cold cathode field emission device.

Figure 51A:
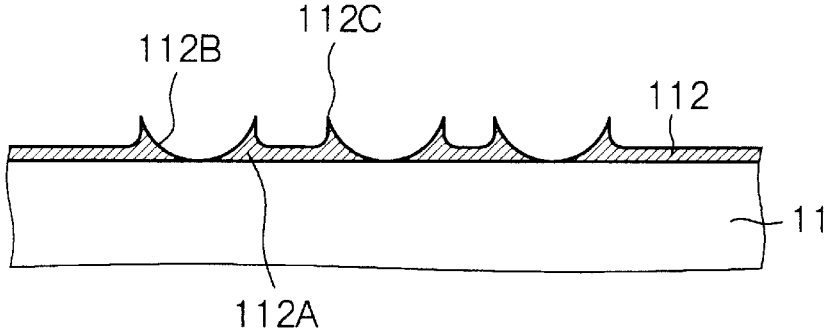
Figure 51B:
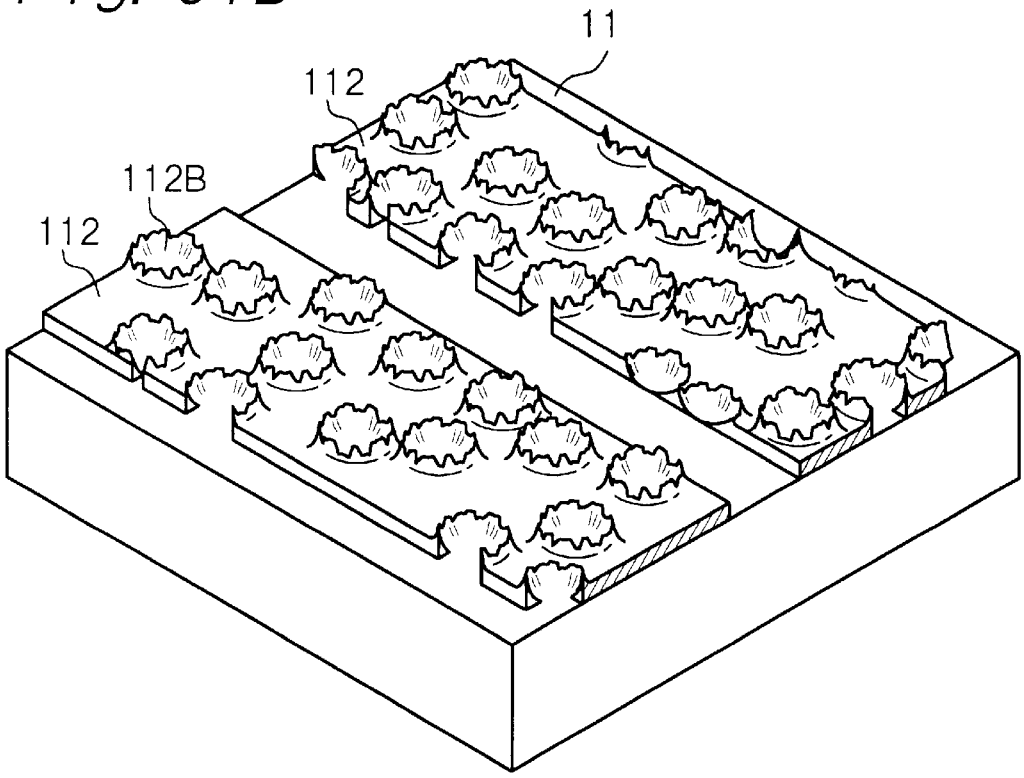

FIGS. 51A and 51B, following FIGS. 50A and 50B, are a schematic partial end view and a partial perspective view of the support member, etc., for explaining the method for producing the variant of the cold cathode field emission device having the second structure, which device is a flat-type cold cathode field emission device.

Figure 52A:
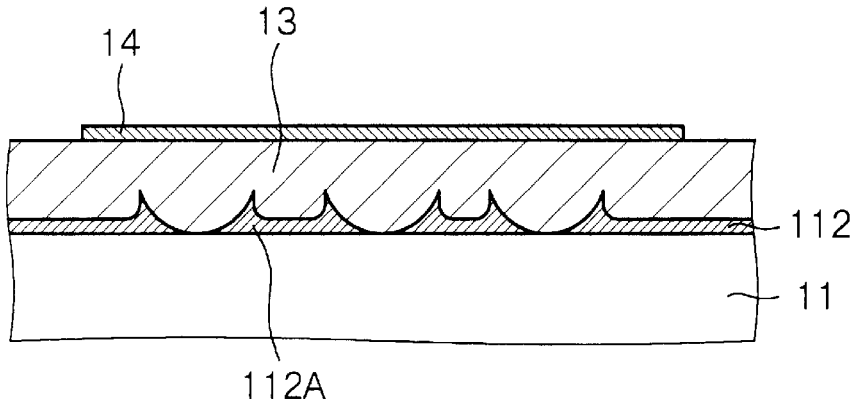
Figure 52B:
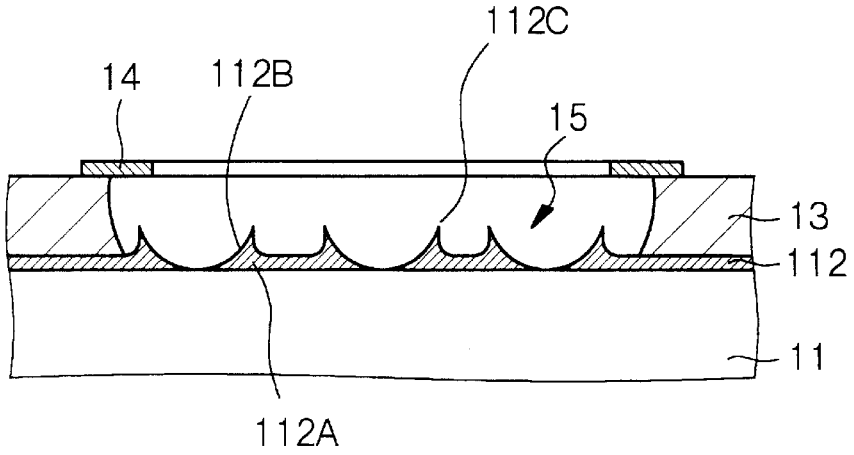

FIGS. 52A and 52B, following FIGS. 51A and 51B, are schematic partial end views of the support member, etc., for explaining the method for producing the variant of the cold cathode field emission device having the second structure, which device is a flat-type cold cathode field emission device.

Figure 53A:
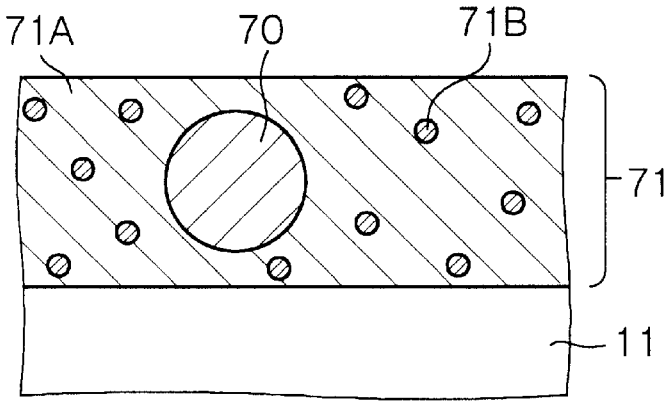
Figure 53B:
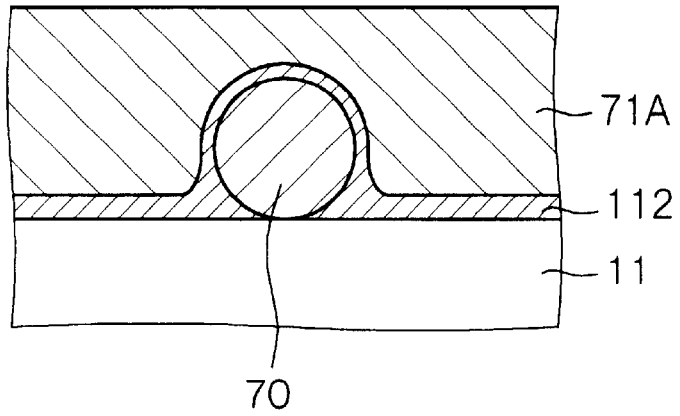
Figure 53C:
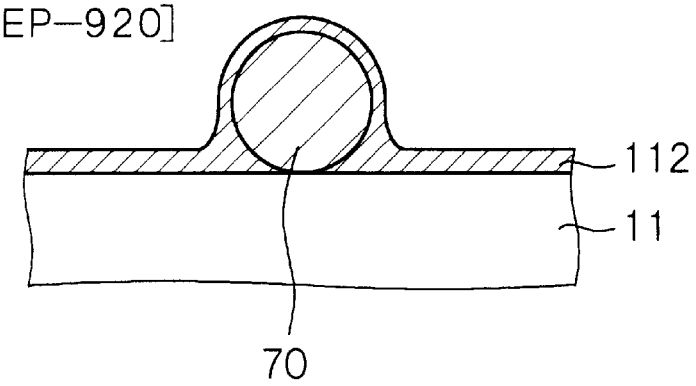

FIGS. 53A to 53C are schematic partial end views of a support member, etc., for explaining the method for producing another variant of the cold cathode field emission device having the second structure, which device is a flat-type cold cathode field emission device.

Figure 54A:
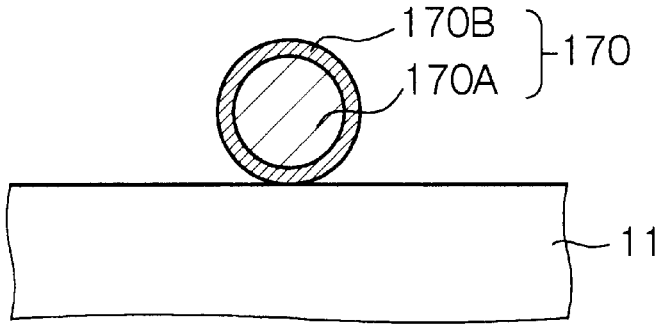
Figure 54B:
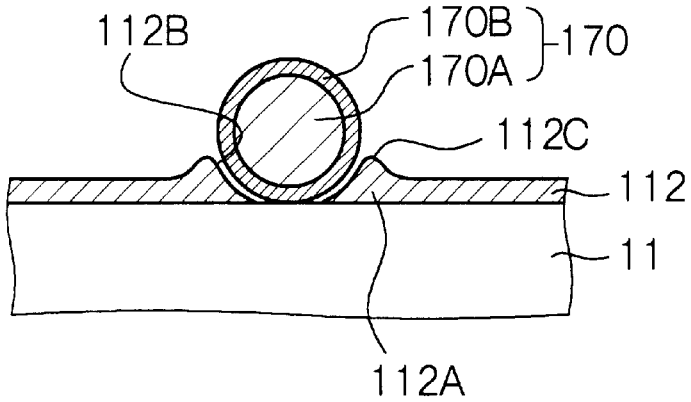
Figure 54C:
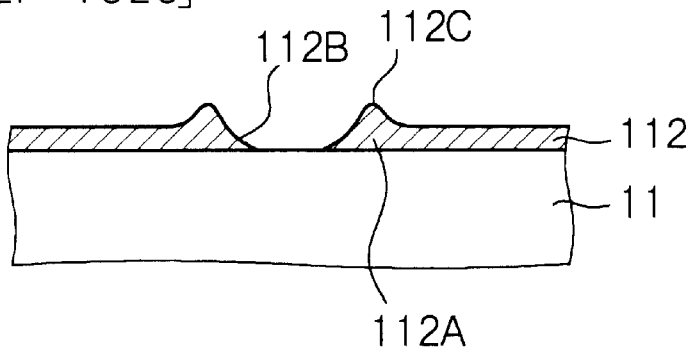

FIGS. 54A to 54C are schematic partial end views of a support member, etc., for explaining the method for producing still another variant of the cold cathode field emission device having the second structure, which device is a flat-type cold cathode field emission device.

Figure 55A:
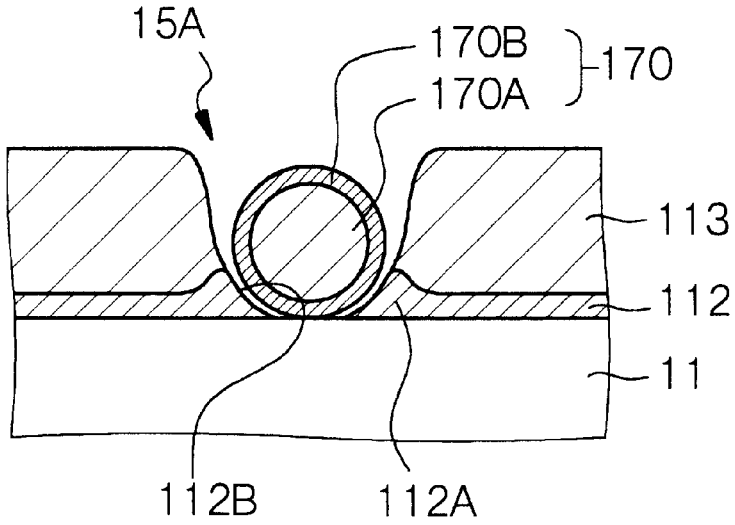
Figure 55B:
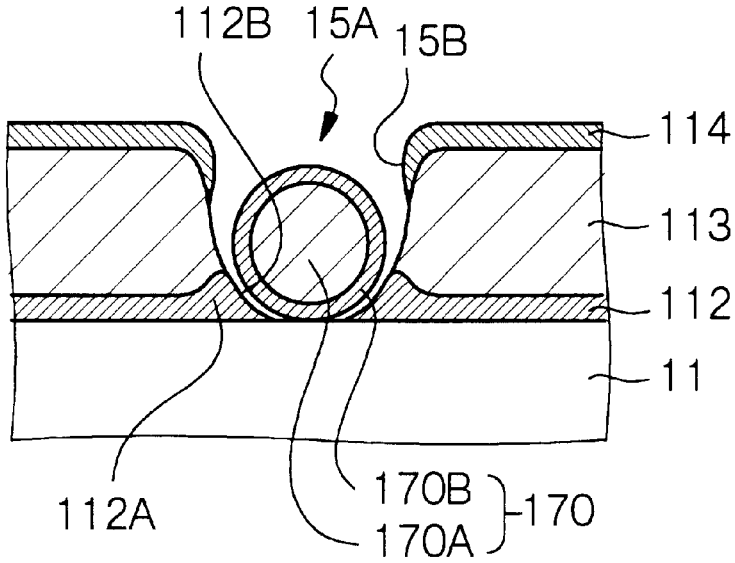

FIGS. 55A and 55B are schematic partial end views of a support member, etc., for explaining the method for producing still another variant of the cold cathode field emission device having the second structure, which device is a flat-type cold cathode field emission device.

Figure 56A:
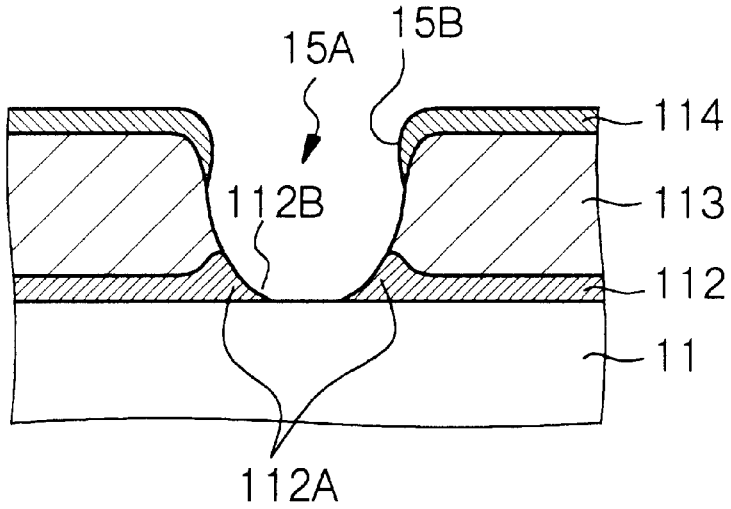
Figure 56B:
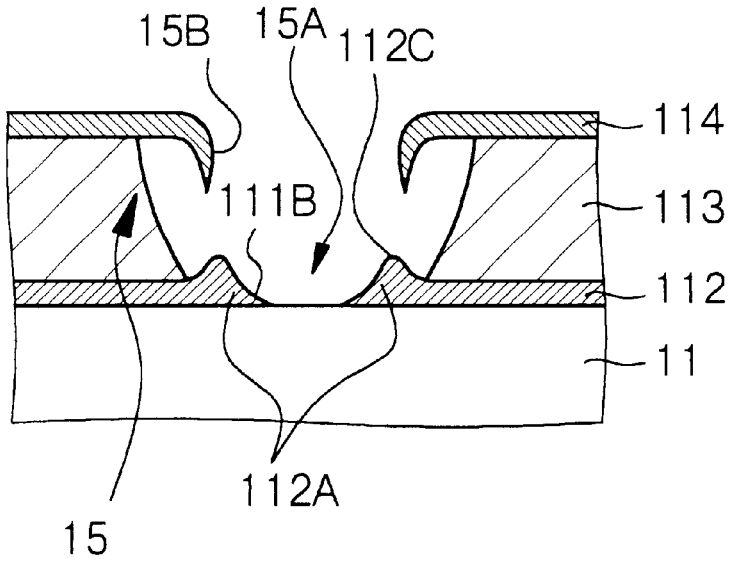

FIGS. 56A and 56B, following FIG. 55B, are schematic partial end views of the support member, etc., for explaining the method for producing the variant of the cold cathode field emission device having the second structure, which device is a flat-type cold cathode field emission device.

Figure 57A:
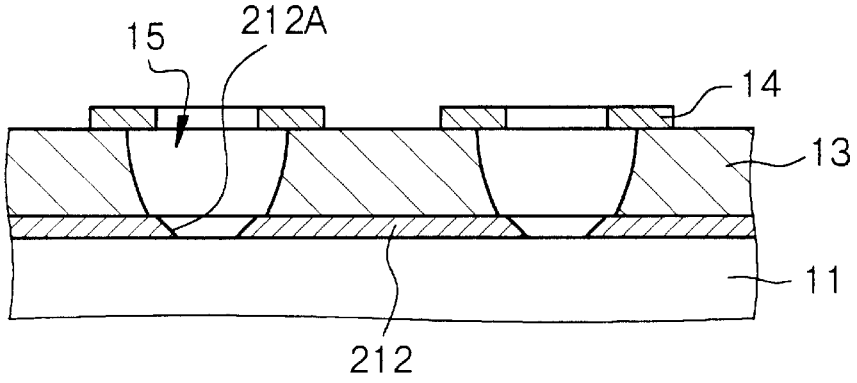
Figure 57B:
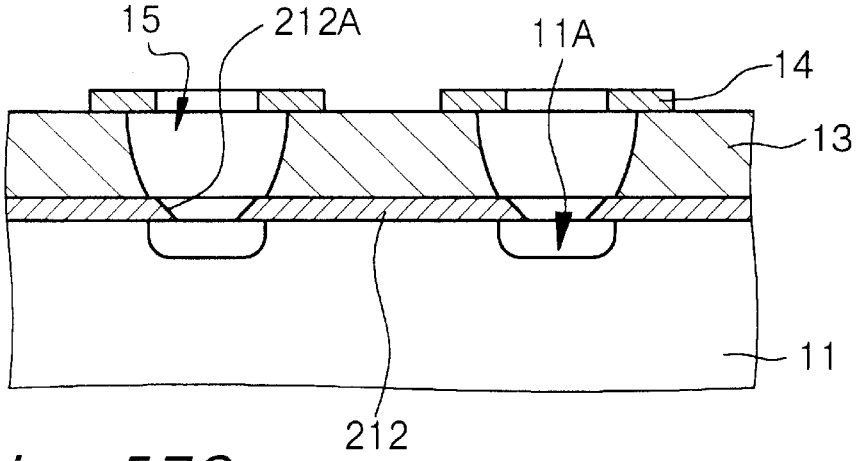
Figure 57C:
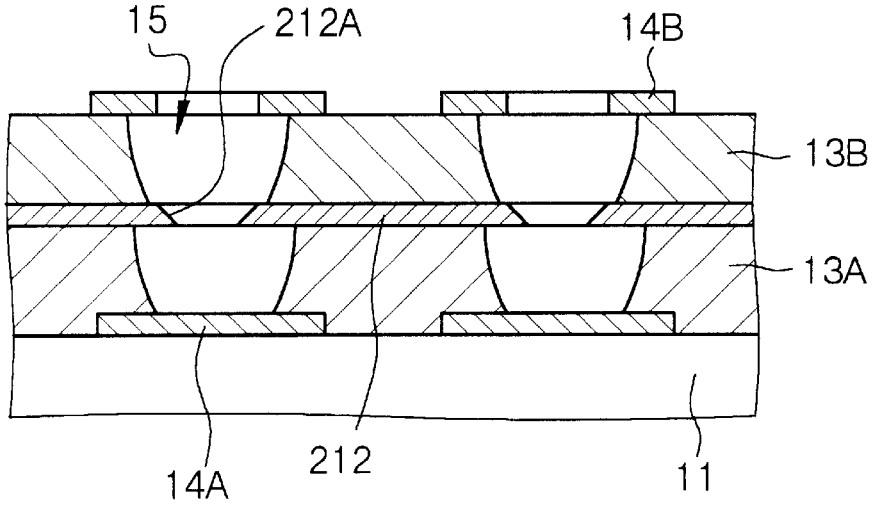

FIGS. 57A to 57C are schematic partial cross-sectional views of the cold cathode field emission devices having a third structure, which devices are edge-type cold cathode field emission devices.

Figure 58A:
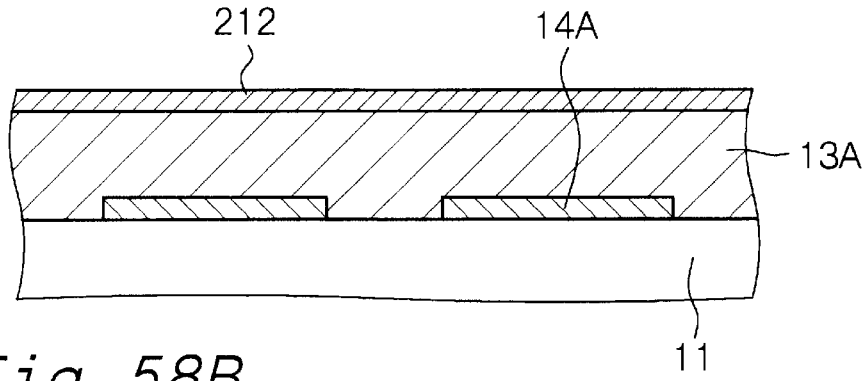
Figure 58B:
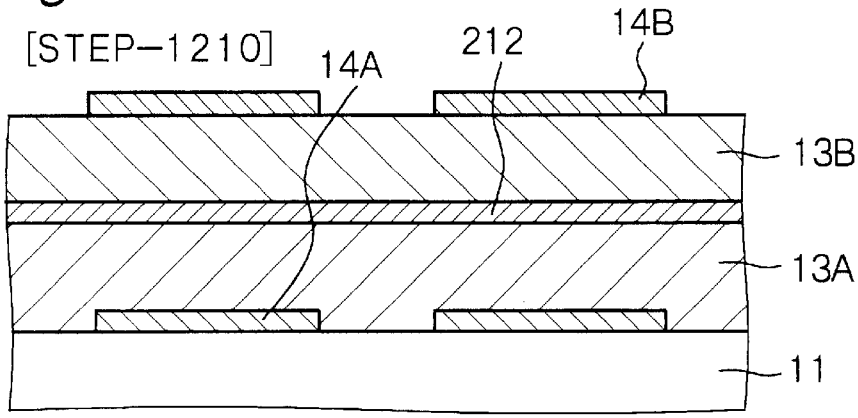
Figure 58C:
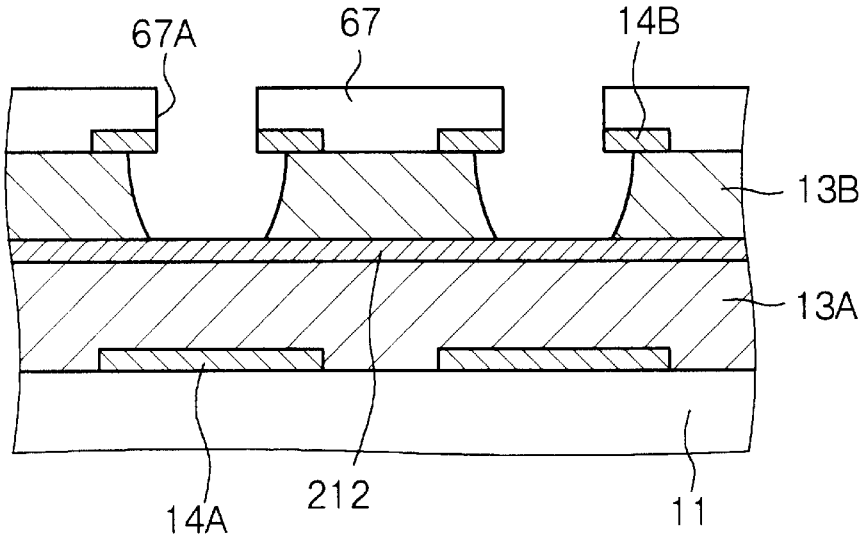

FIGS. 58A to 58C are schematic partial end views of a support member, etc., for explaining the method for producing one example of the cold cathode field emission device having the third structure, which device is an edge-type cold cathode field emission device.

Figure 59A:
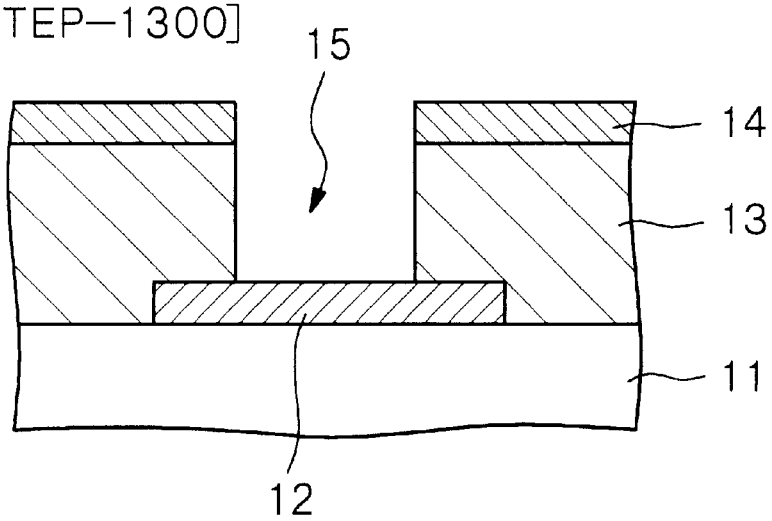
Figure 59B:
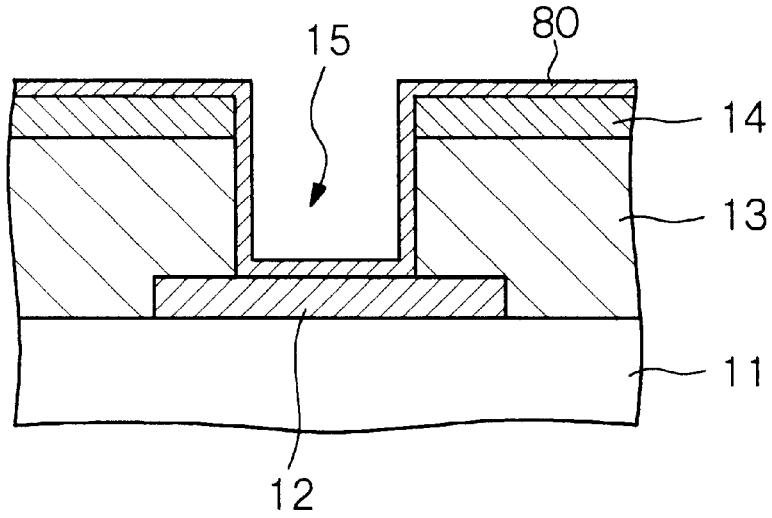
Figure 62:
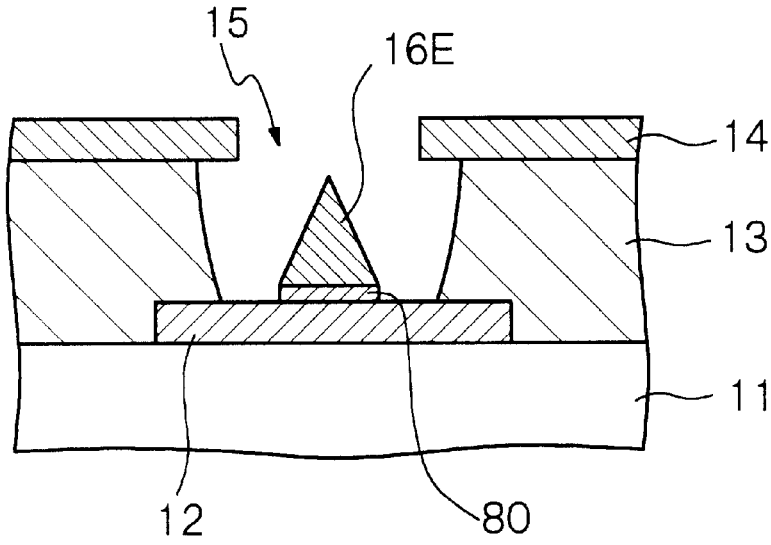

FIGS. 59A and 59B are schematic partial end views of a support member, etc., for explaining [Spindt-type field emission device: variant-1 of production method] for producing a Spindt-type cold cathode field emission device shown in FIG. 62.

Figure 60A:
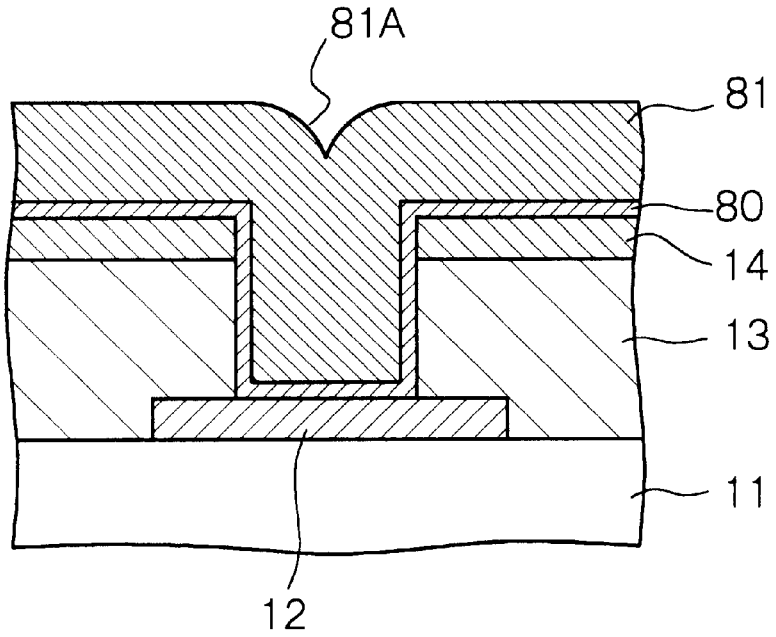
Figure 60B:
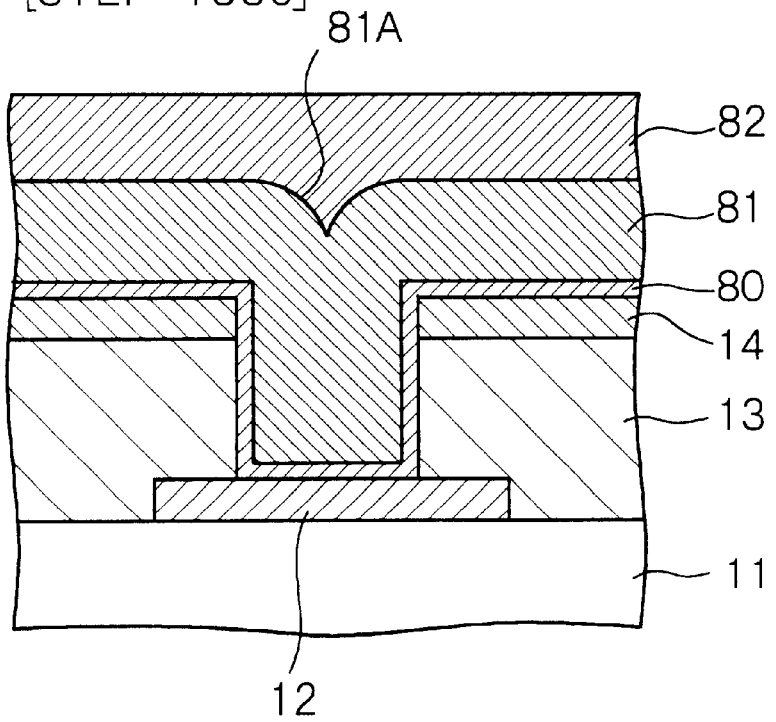

FIGS. 60A and 60B, following FIG. 59B, are schematic partial end views of the support member, etc., for explaining [Spindt-type field emission device: variant-1 of production method] for producing the Spindt-type cold cathode field emission device shown in FIG. 62.

Figure 61A:
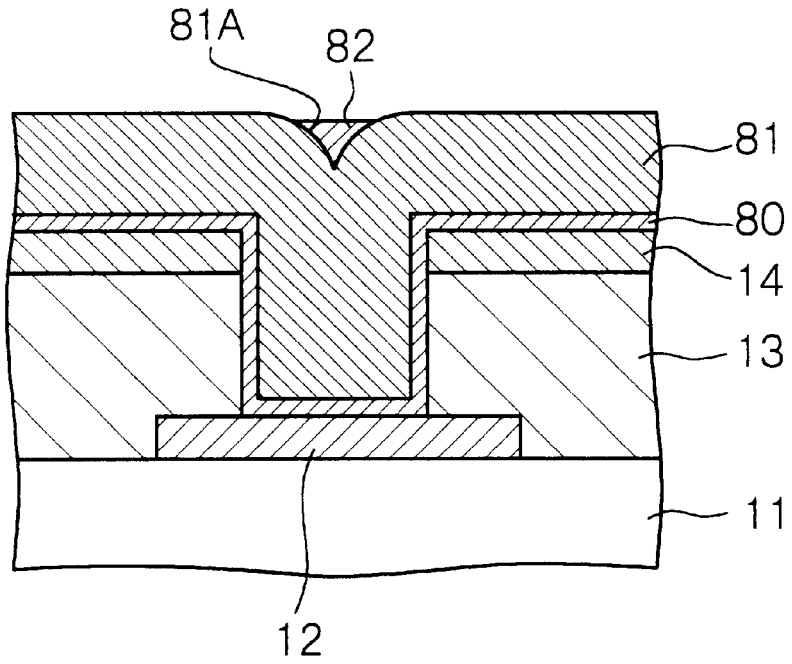
Figure 61B:
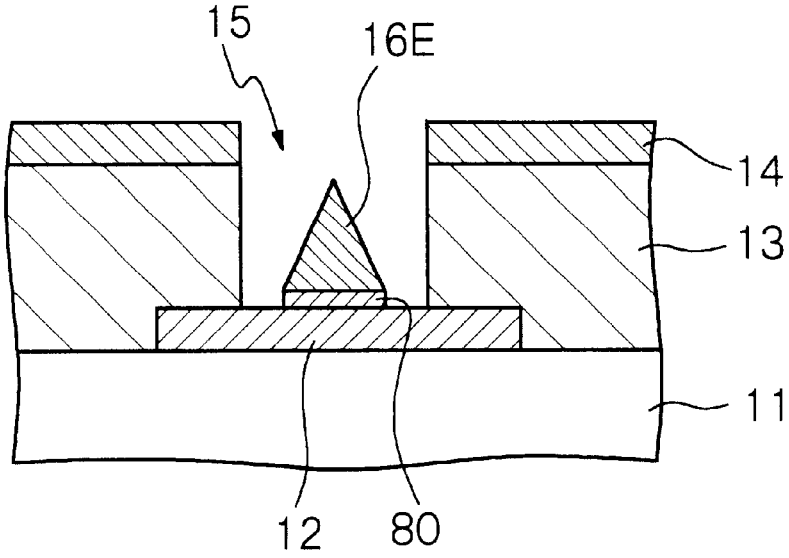

FIGS. 61A and 61B, following FIG. 60B, are schematic partial end views of the support member, etc., for explaining [Spindt-type field emission device: variant-1 of production method] for producing the Spindt-type cold cathode field emission device shown in FIG. 62.

FIG. 62 is a schematic partial end view of the Spindt-type cold cathode field emission device obtained in [Spindt-type field emission device: variant-1 of production method].

Figure 63A:
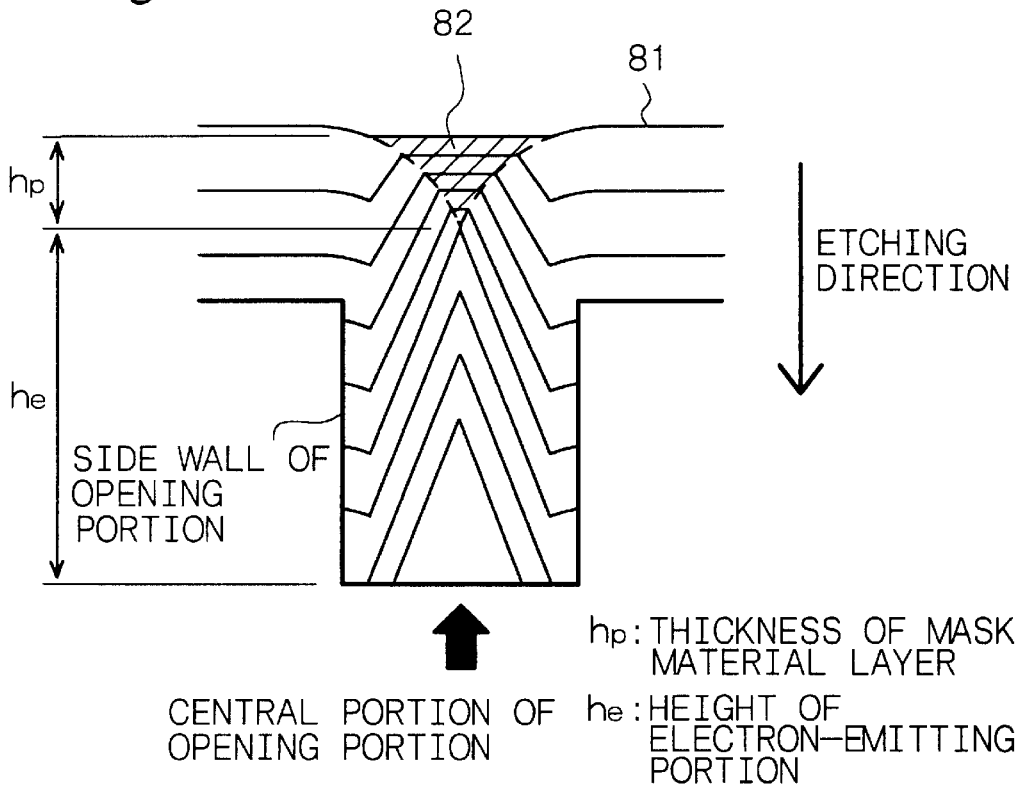
Figure 63B:
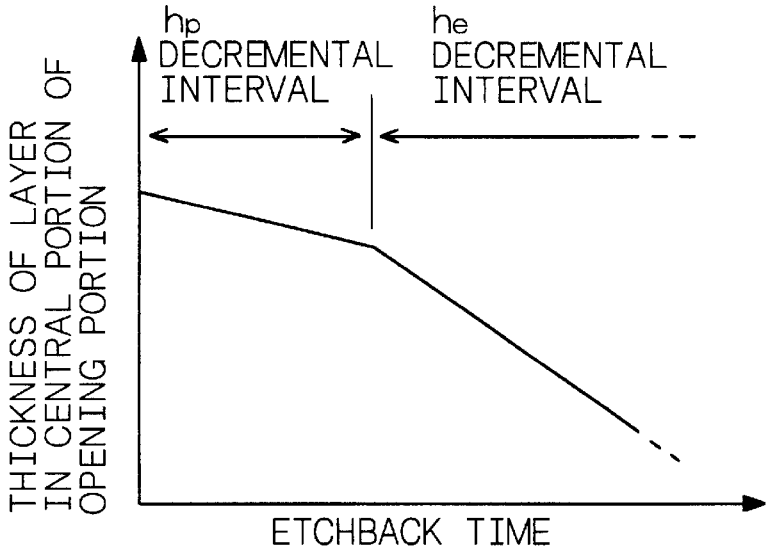

FIGS. 63A and 63B are drawings for showing how a conical electron-emitting portion is formed.

FIGS. 64A to 64C are schematic drawings for showing relationships of resist selection ratios and the height and form of an electron-emitting portion.

Figure 65A:
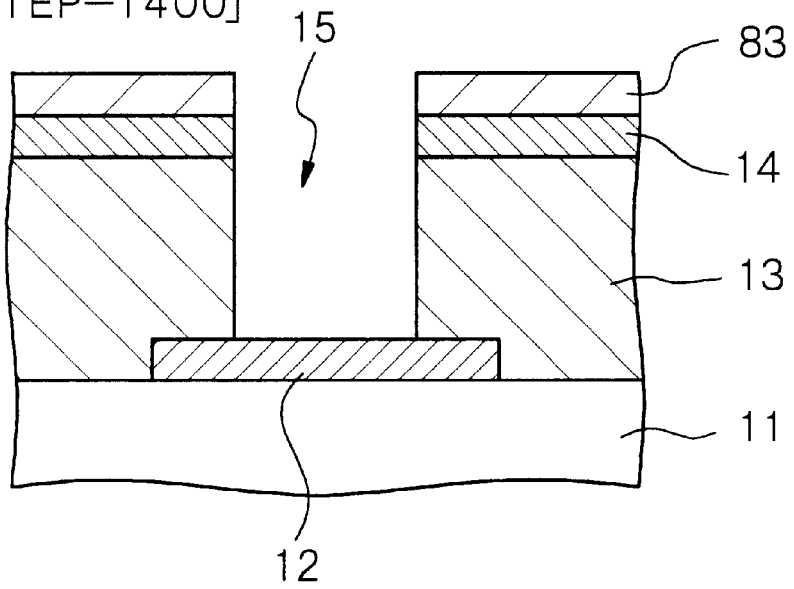
Figure 65B:
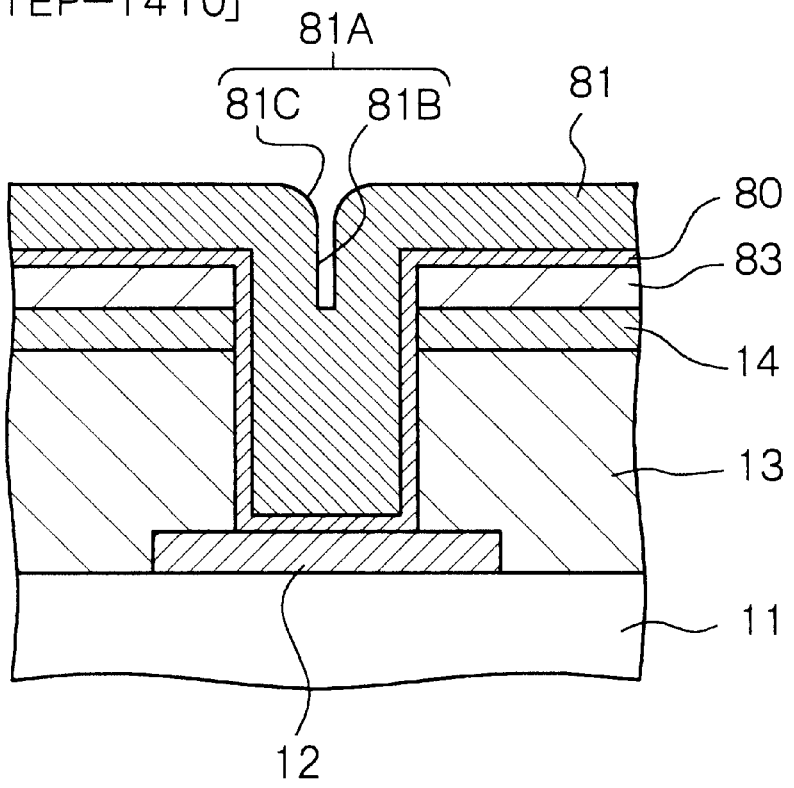

FIGS. 65A and 65B are schematic partial end views of a support member, etc., for explaining [Spindt-type field emission device: variant-2 of production method].

Figure 66A:
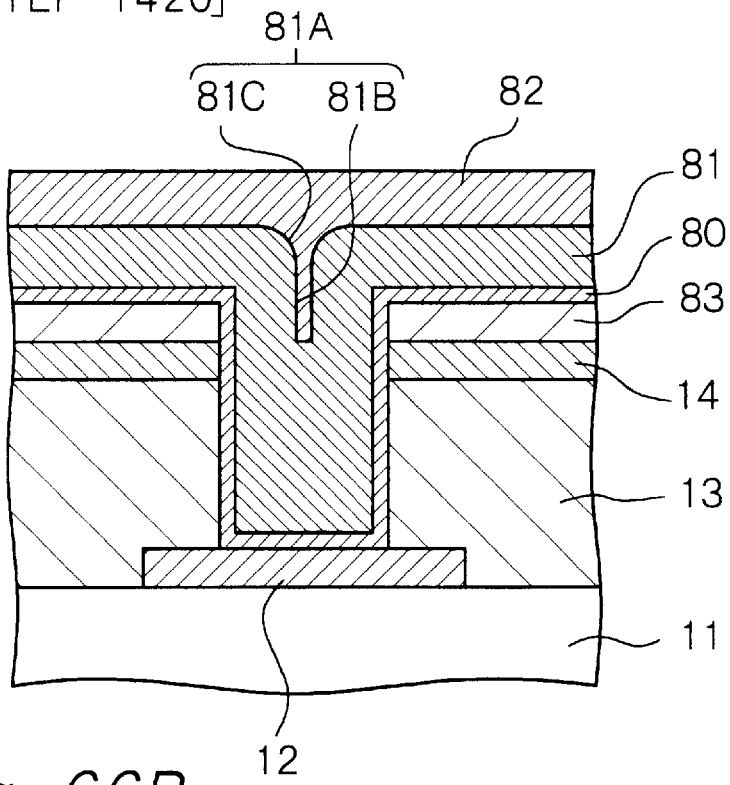
Figure 66B:
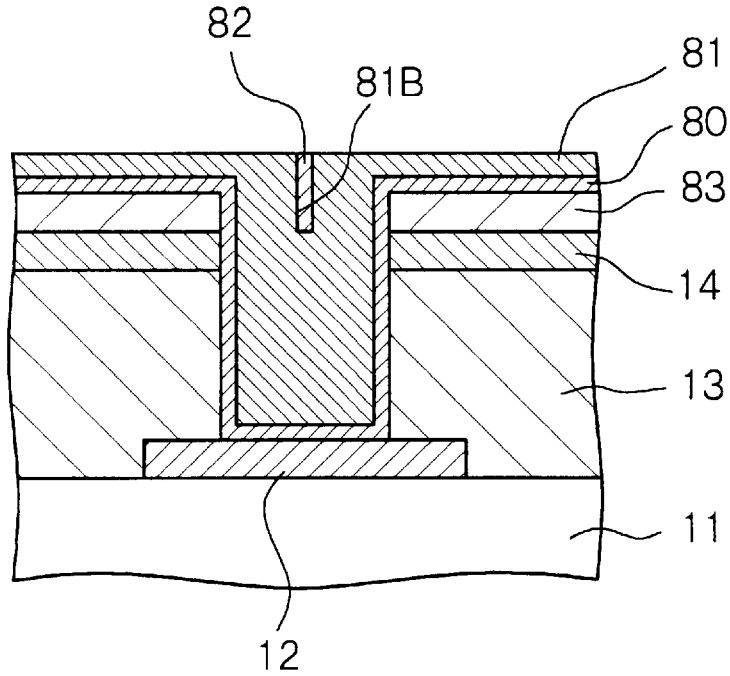

FIGS. 66A and 66B, following FIG. 65B, are schematic partial end views of the support member, etc., for explaining [Spindt-type field emission device: variant-2 of production method].

Figure 67A:
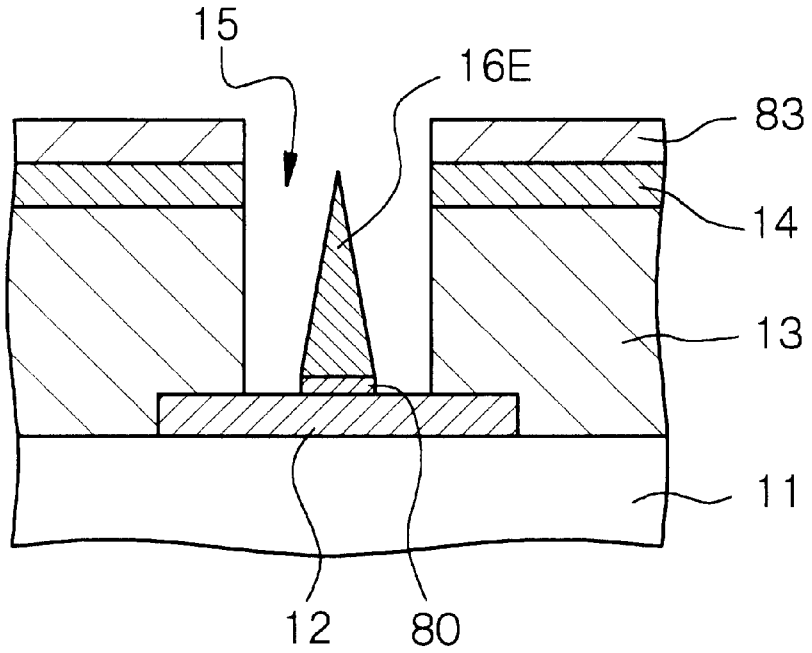
Figure 67B:
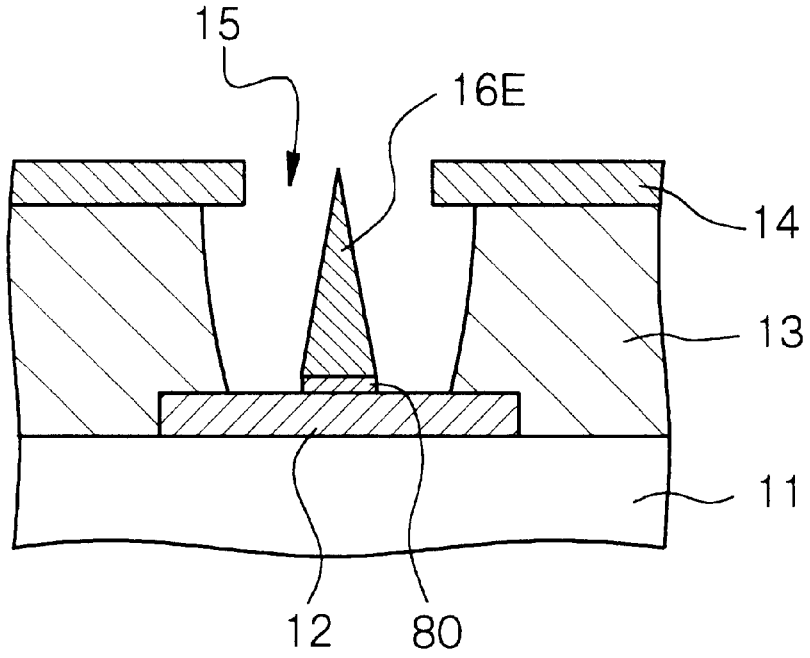

FIGS. 67A and 67B, following FIG. 66B, are schematic partial end views of the support member, etc., for explaining [Spindt-type field emission device: variant-2 of production method].

Figure 68A:
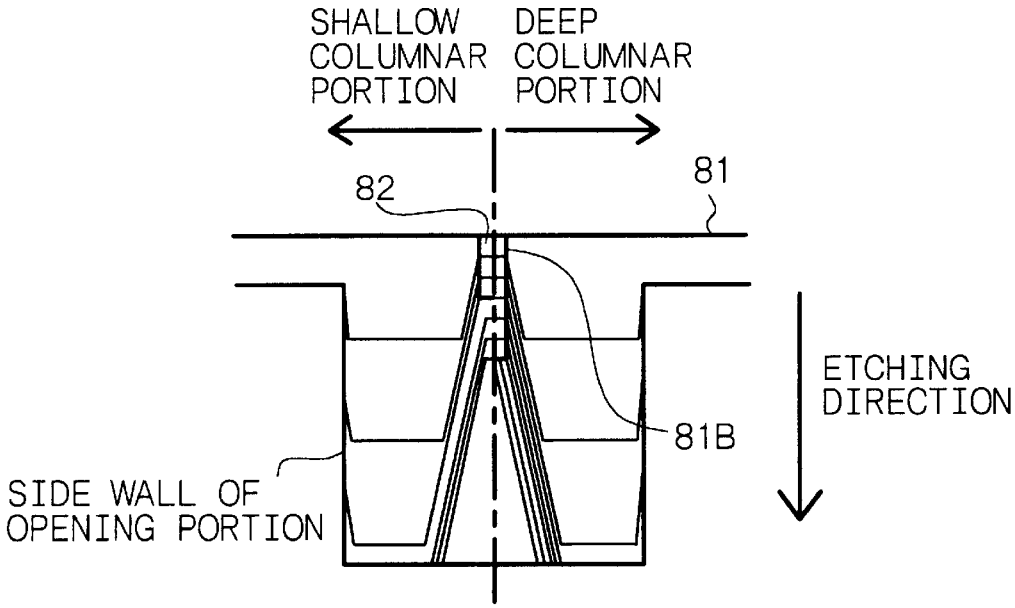
Figure 68B:
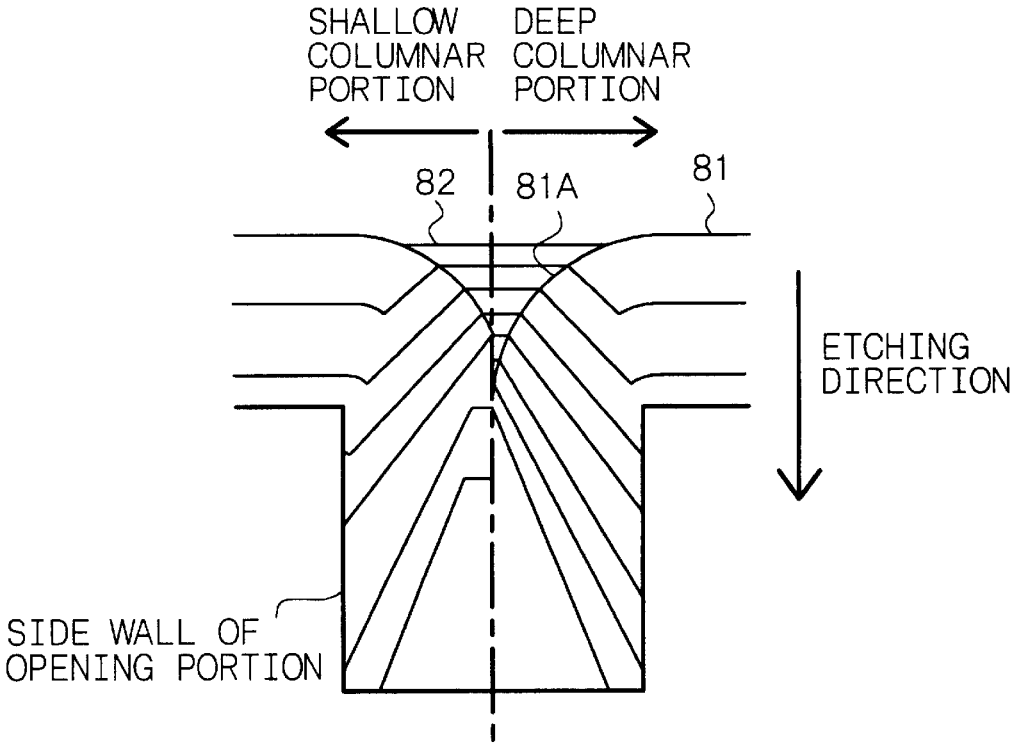

FIGS. 68A and 68B are drawings for showing how the surface profile of a material being etched changes at constant intervals of time.

Figure 69A:
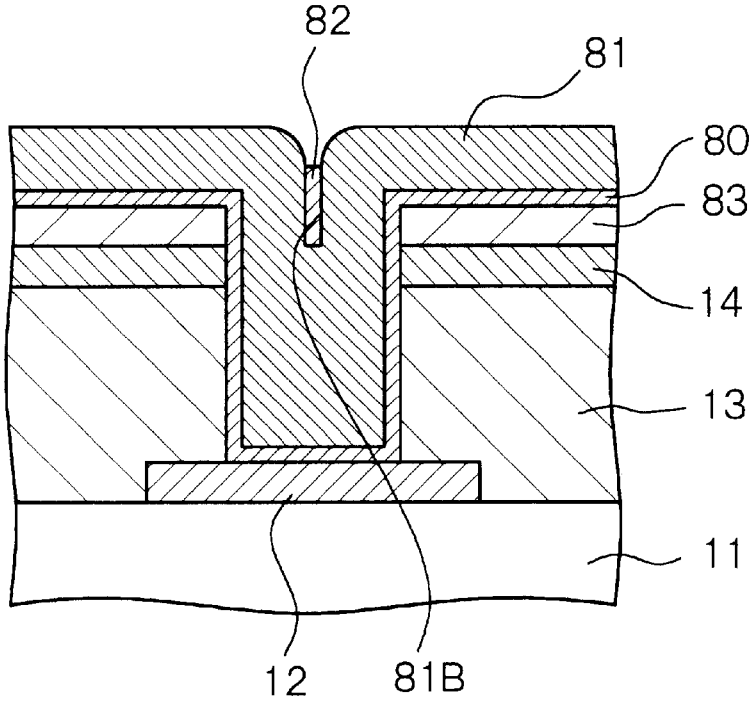
Figure 69B:
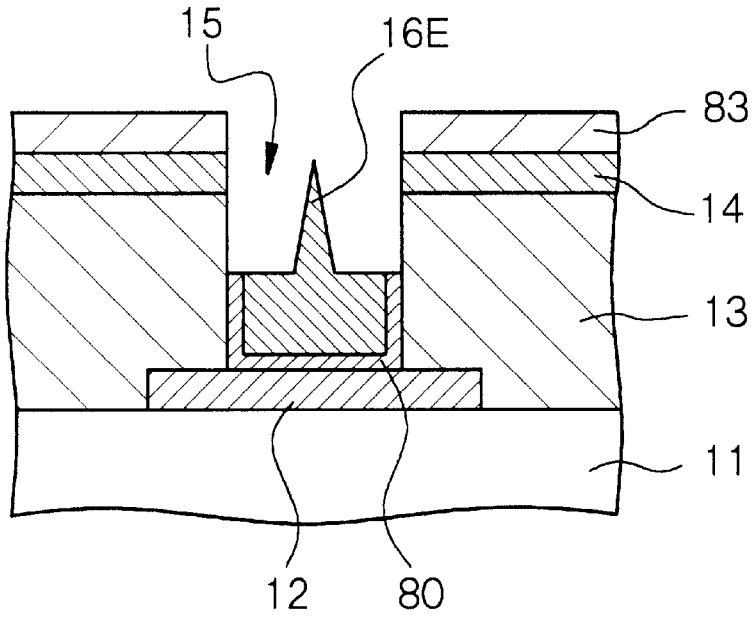

FIGS. 69A and 69B are schematic partial end views of a support member, etc., for explaining [Spindt-type field emission device: variant-3 of production method].

Figure 70:
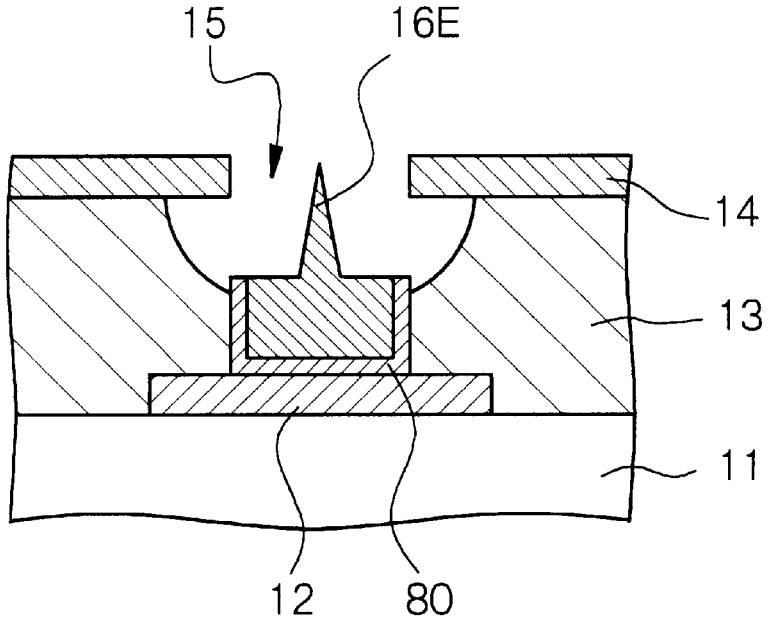

FIG. 70, following FIG. 69B, is a schematic partial end view of the support member, etc., for explaining [Spindt-type field emission device: variant-3 of production method].

Figure 71:
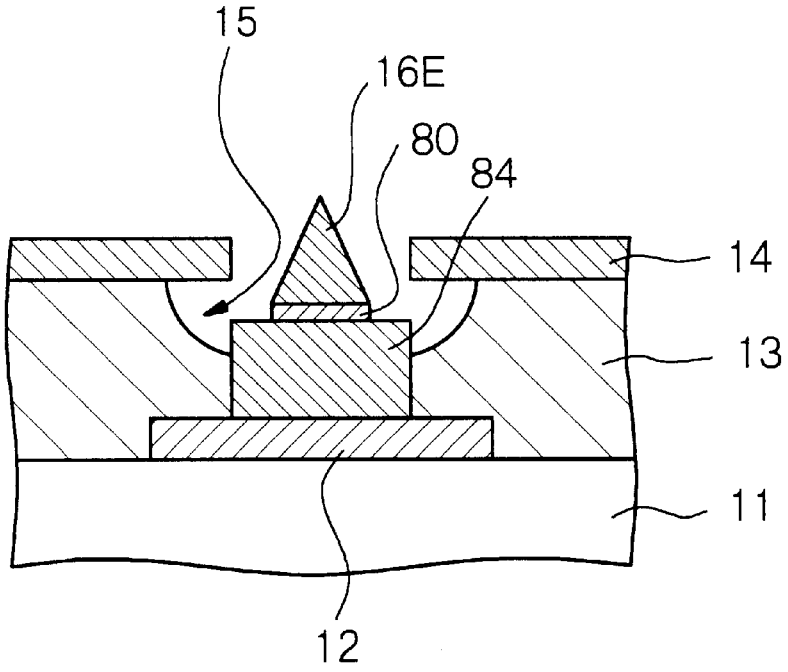

FIG. 71 is a schematic partial end view of a Spindt-type cold cathode field emission device produced in [Spindt-type field emission device: variant-4 of production method].

Figure 72A:
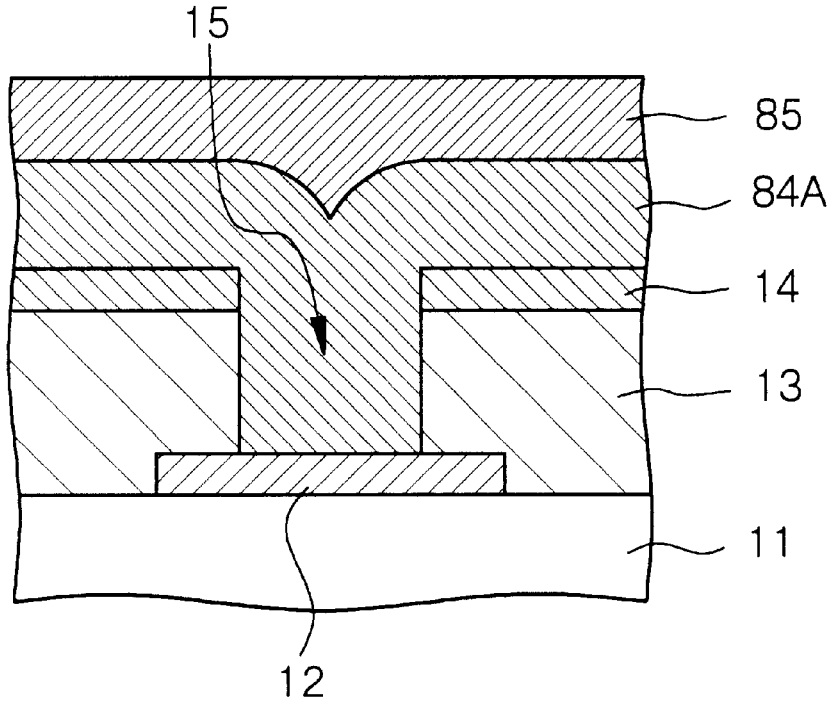
Figure 72B:
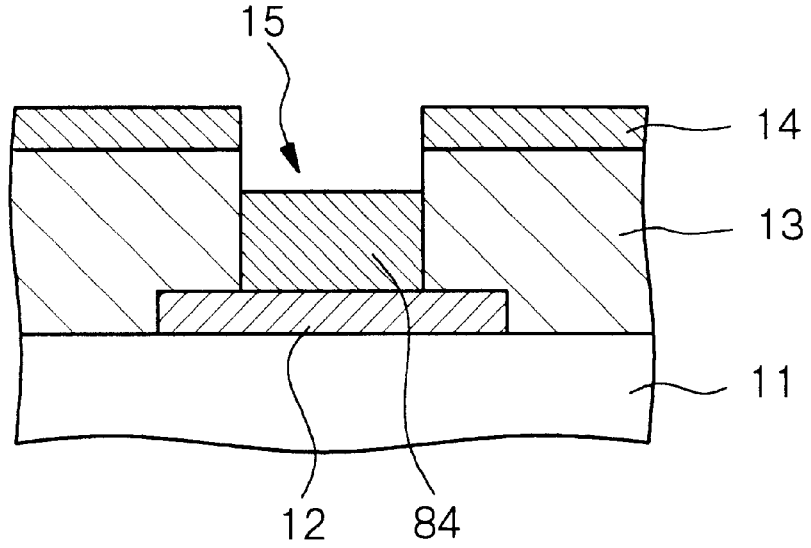

FIGS. 72A and 72B are schematic partial end views of a support member, etc., for explaining [Spindt-type field emission device: variant-4 of production method].

Figure 73A:
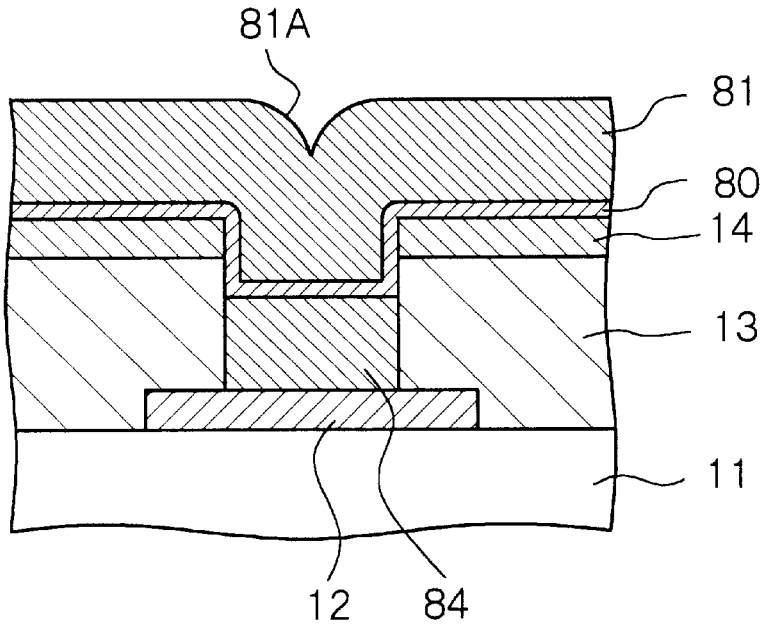
Figure 73B:
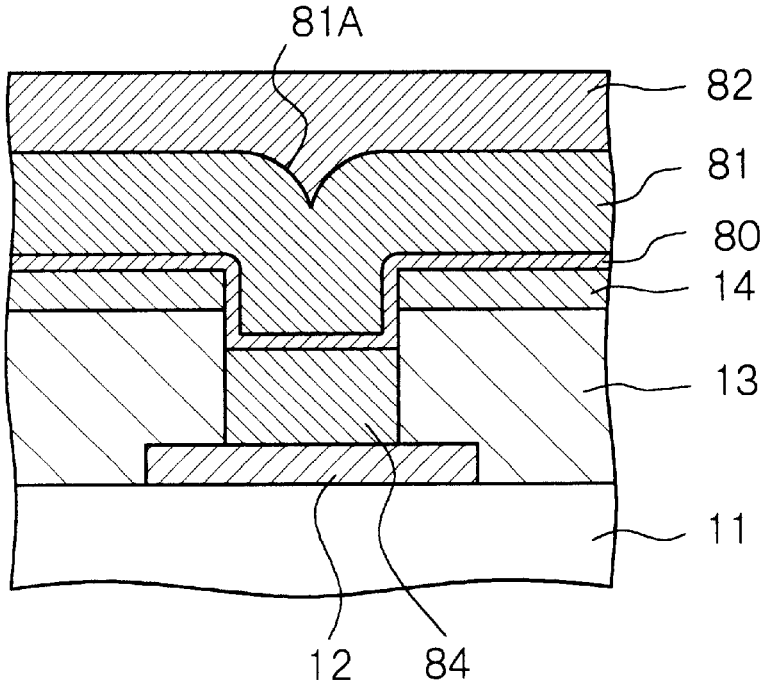

FIGS. 73A and 73B, following FIG. 72B, are schematic partial end views of the support member, etc., for explaining [Spindt-type field emission device: variant-4 of production method].

Figure 74A:
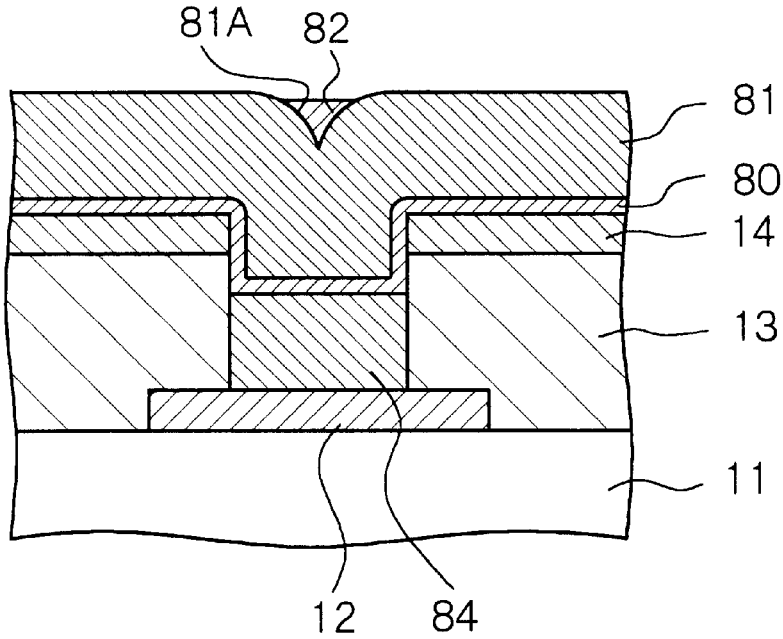
Figure 74B:
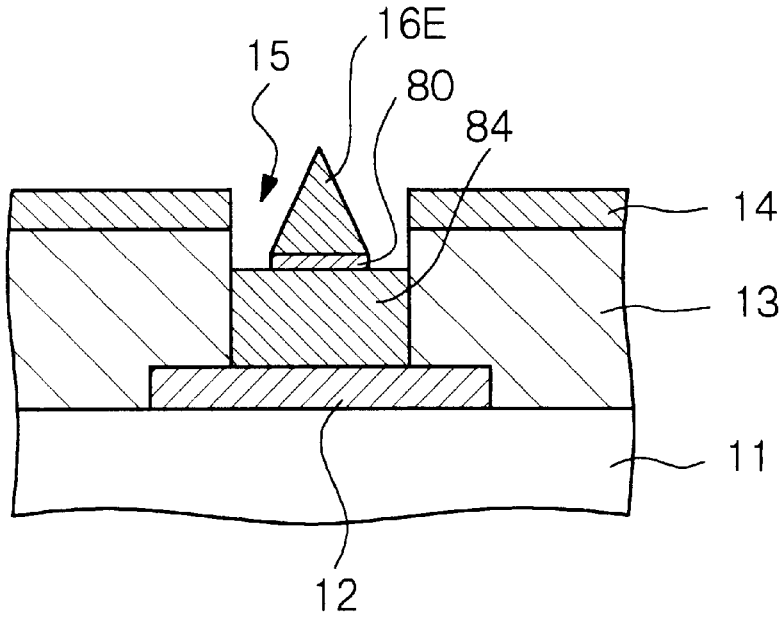

FIGS. 74A and 74B, following FIG. 73B, are schematic partial end views of the support member, etc., for explaining [Spindt-type field emission device: variant-4 of production method].

Figure 75A:
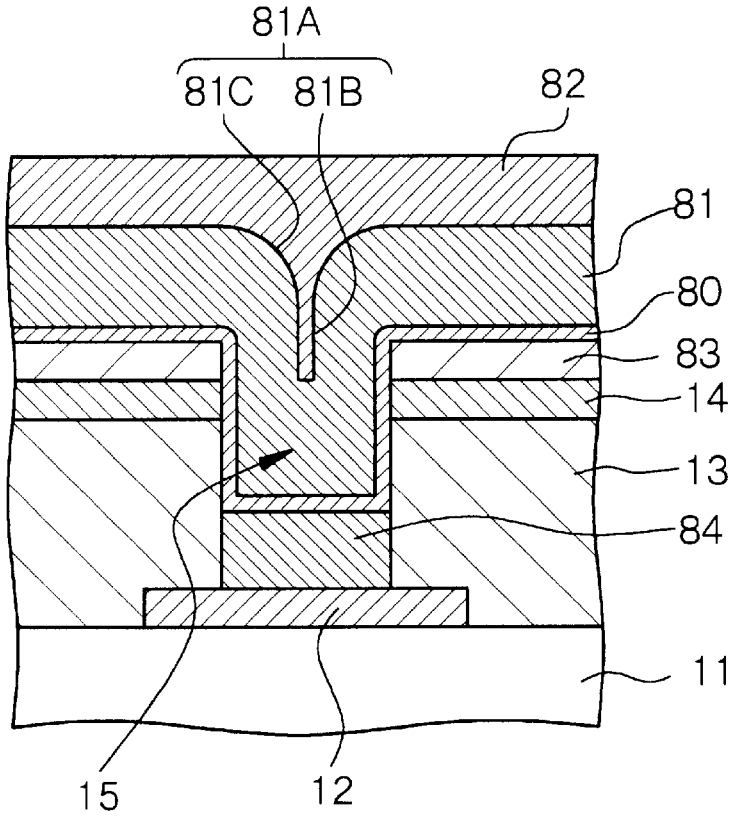
Figure 75B:
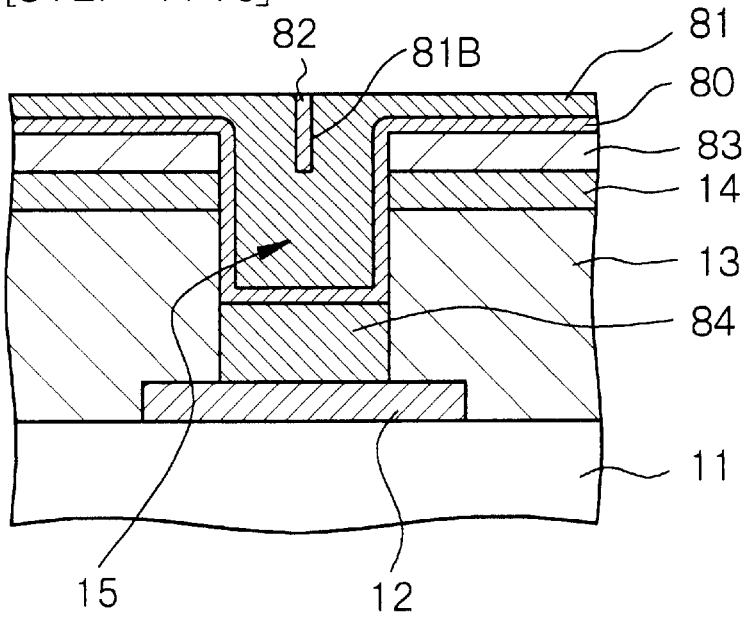

FIGS. 75A and 75B are schematic partial end views of a support member, etc., for explaining [Spindt-type field emission device: variant-5 of production method].

Figure 76A:
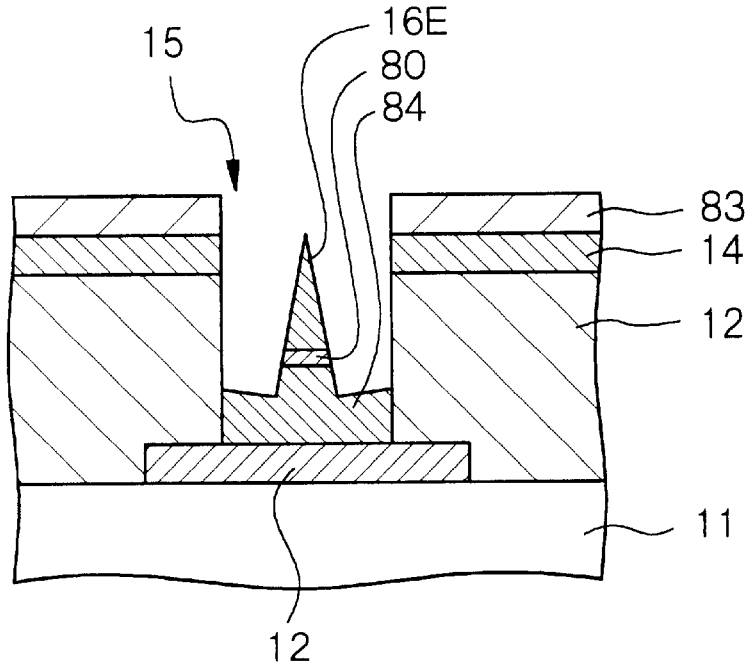
Figure 76B:
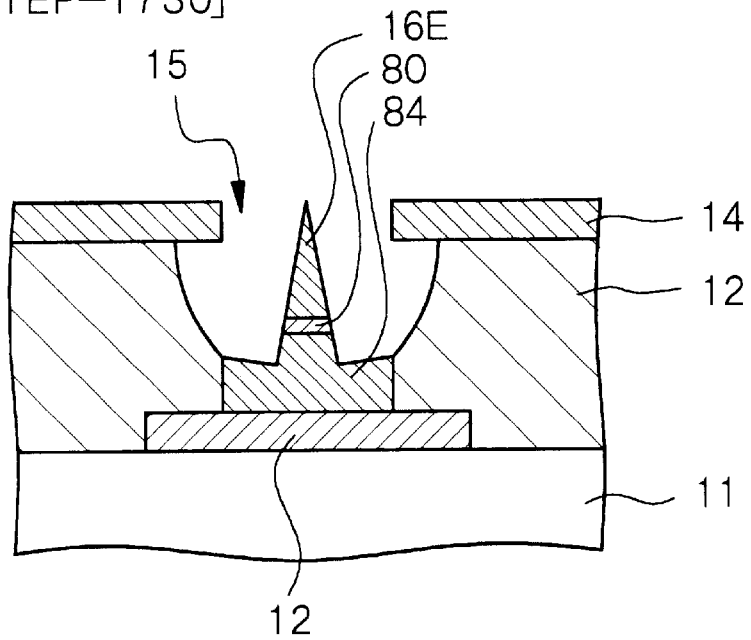

FIGS. 76A and 76B, following FIG. 75B, are schematic partial end views of the support member, etc., for explaining [Spindt-type field emission device: variant-5 of production method].

Figure 77:
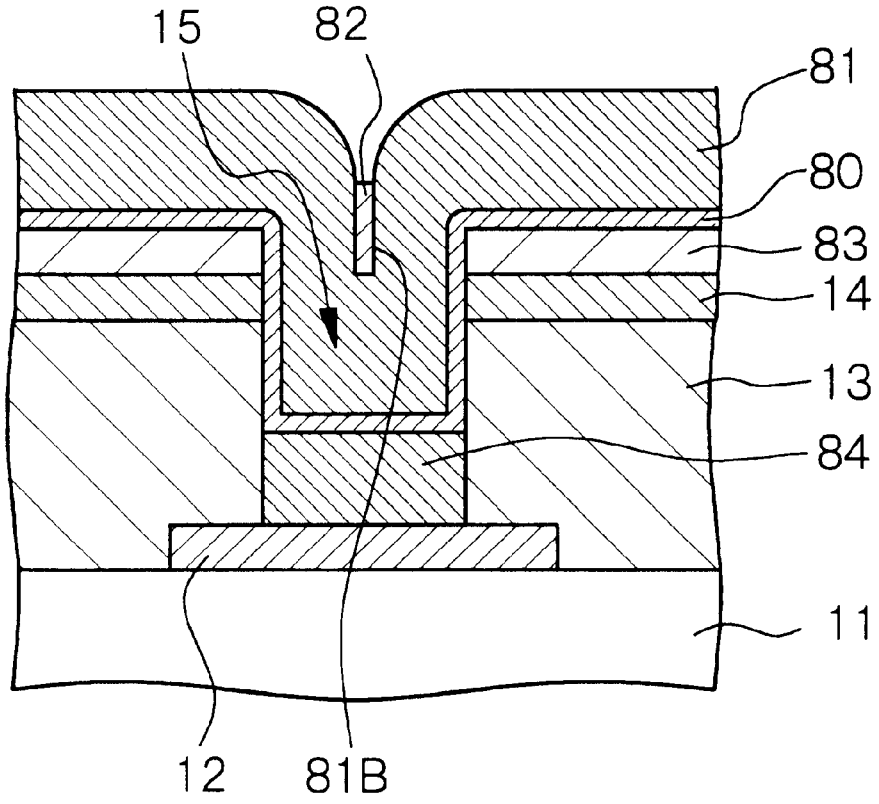

FIG. 77 is schematic partial end view of a support member, etc., for explaining [Spindt-type field emission device: variant-6 of production method].

Figure 78:
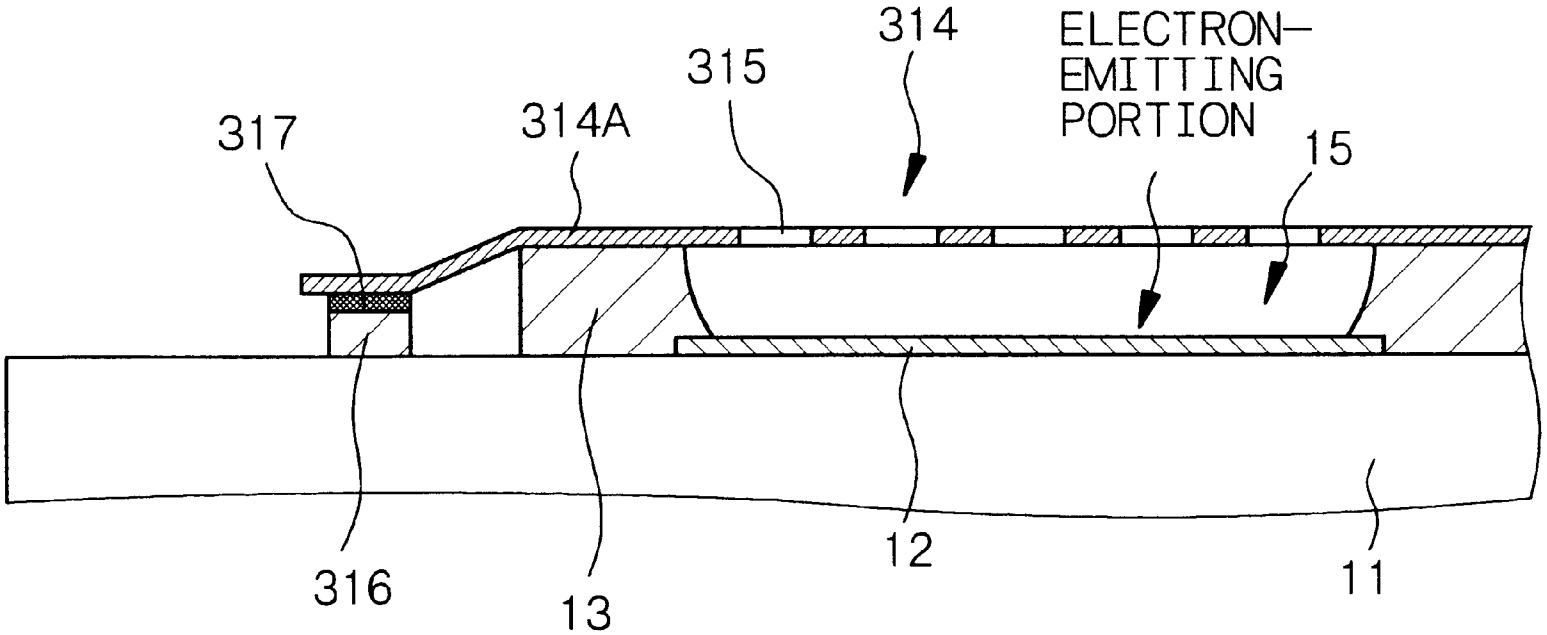

FIG. 78 is a schematic partial end view of [Flat-type field emission device (No. 3)].

Figure 79A:
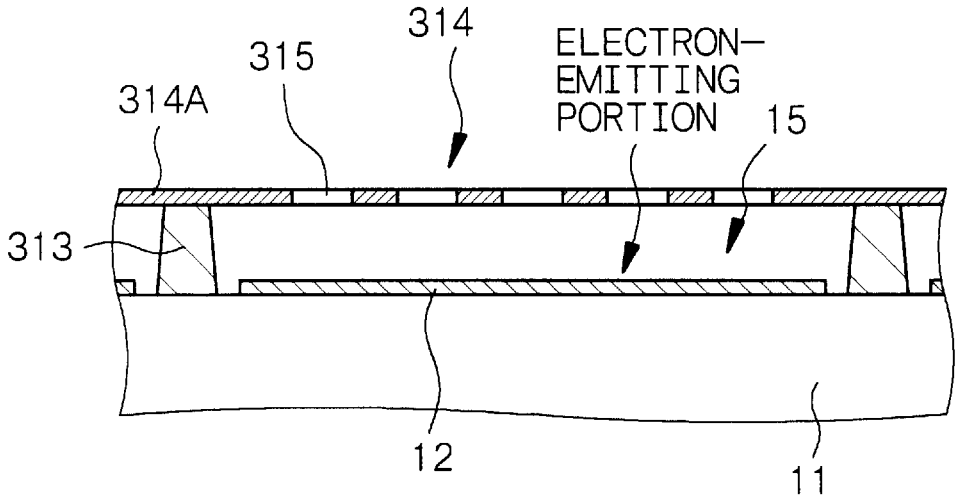
Figure 79B:
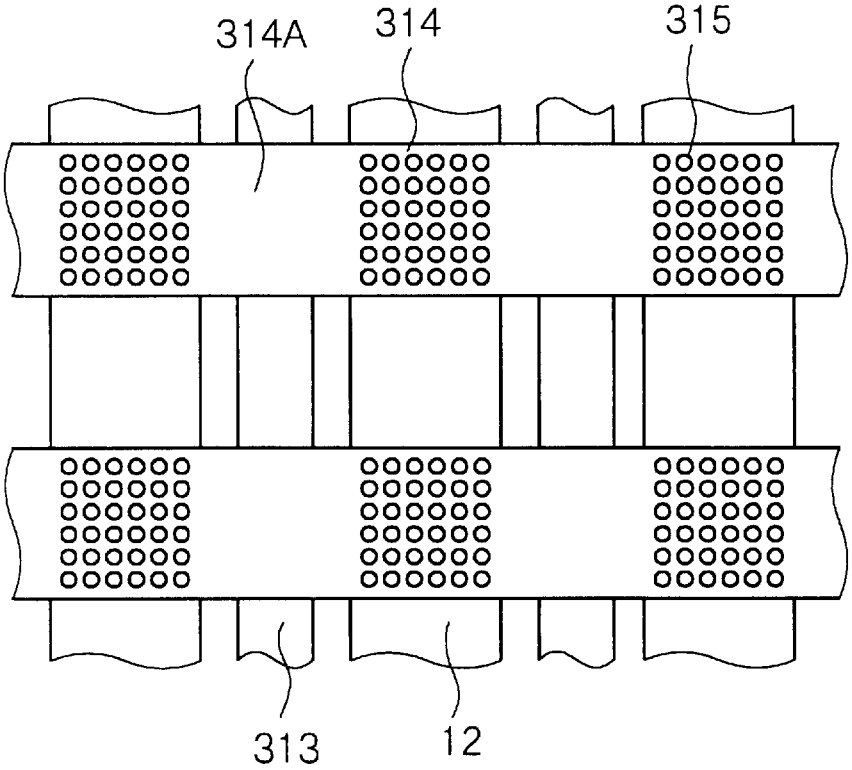
Figure 80A:
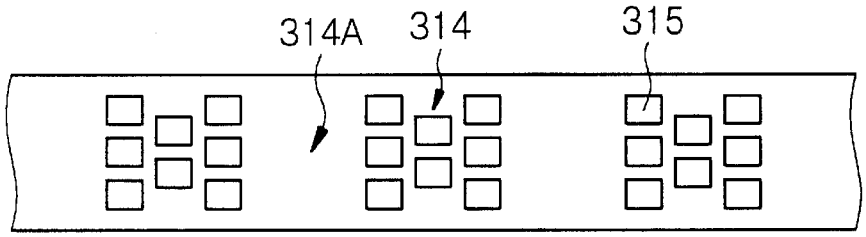
Figure 80B:
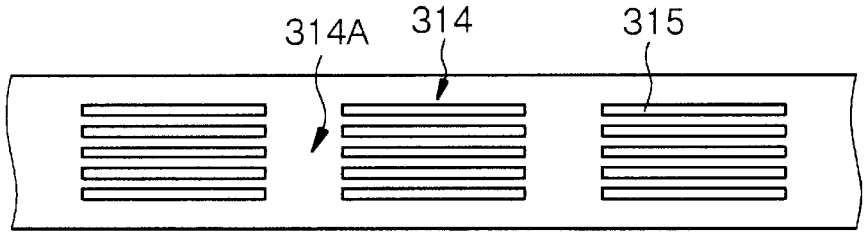
Figure 80C:
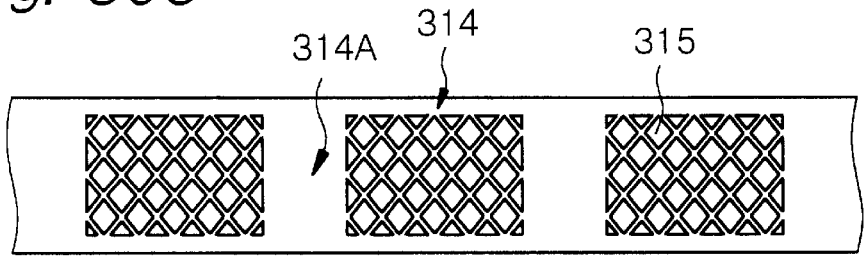
Figure 80D:
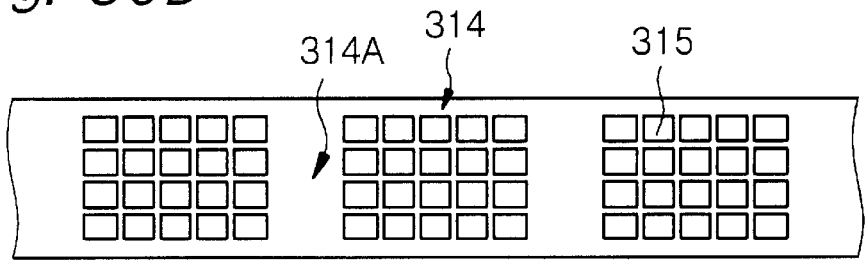

FIGS. 79A and 79B are a schematic partial cross-sectional view and a plan view of [Flat-type field emission device (No. 4)].

FIGS. 80A to 80D are schematic plan views showing a plurality of opening portions of a gate electrode.

Figure 81:
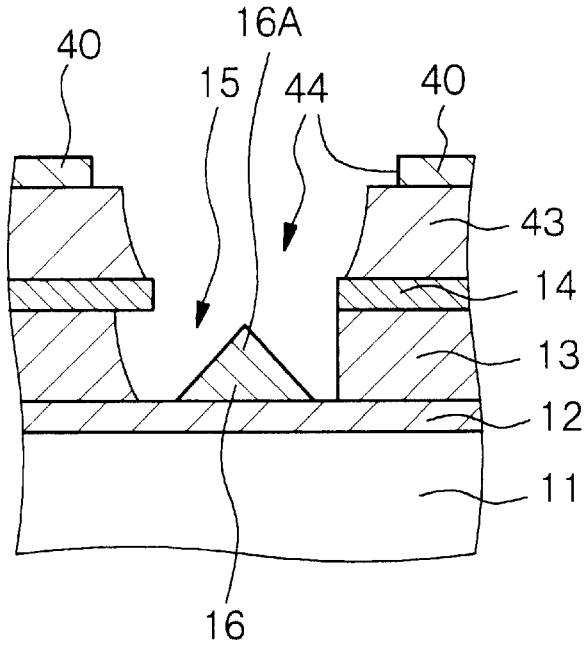

FIG. 81 is a schematic partial end view of an electron-emitting portion and a shield member in the flat-type display according to the third aspect of the present invention.

Figure 82:
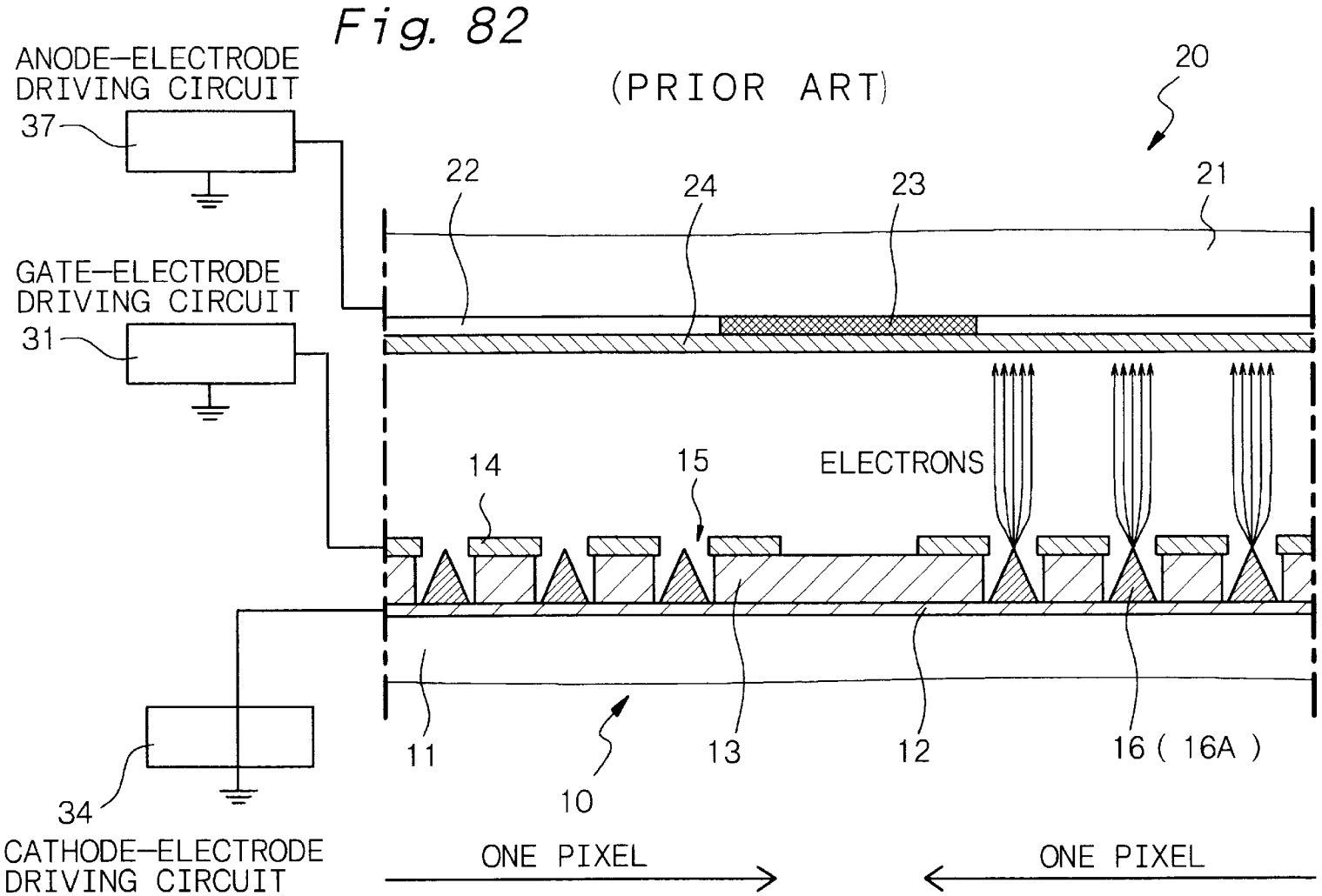
Fig. 82 (PRIOR ART)

FIG. 82 is a drawing for showing a typical constitution example of a conventional cold cathode field emission display.

Figure 83:
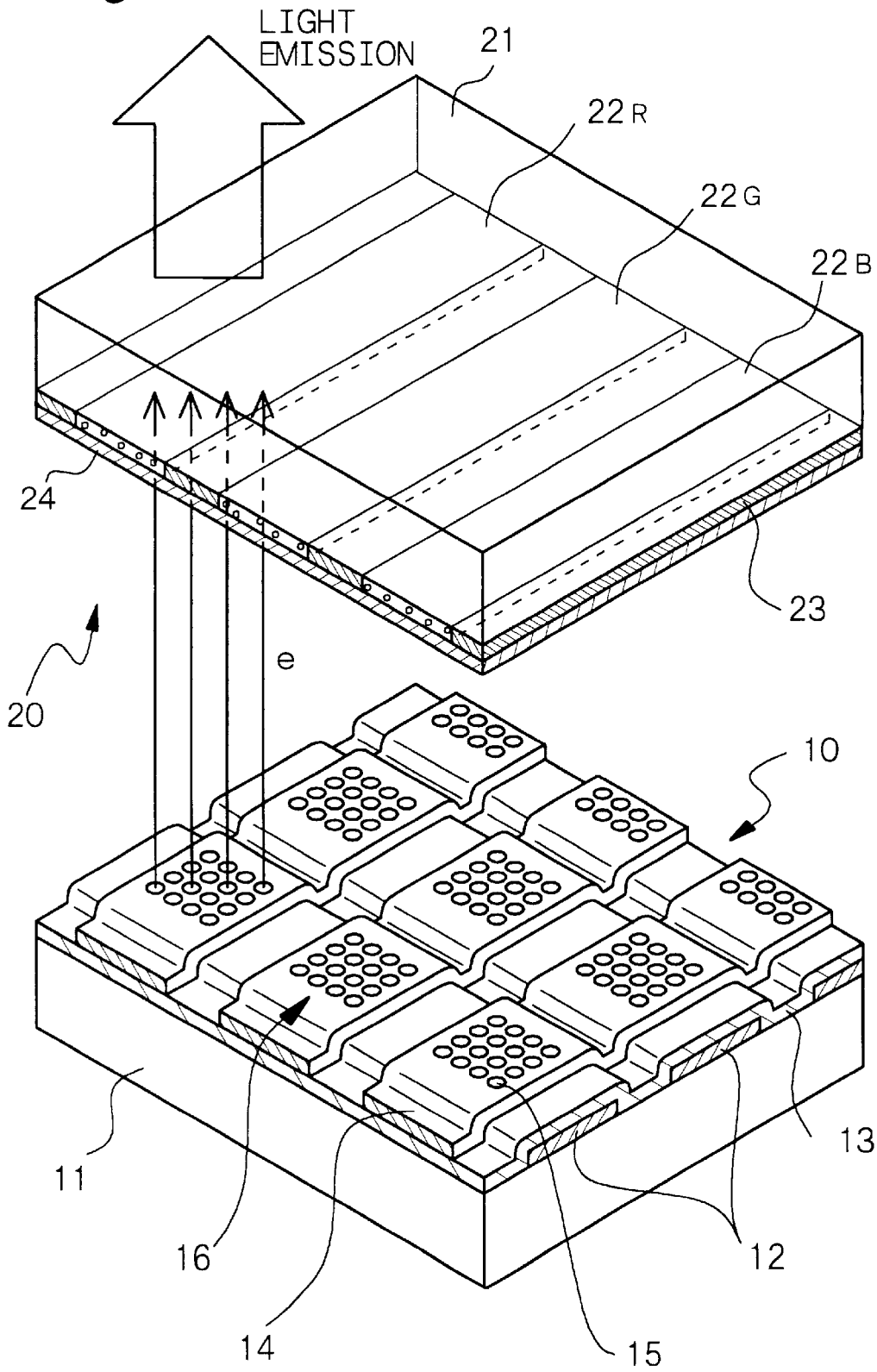

FIG. 83 is a schematic exploded perspective view of parts of a first panel and a second panel.

Figure 84A:
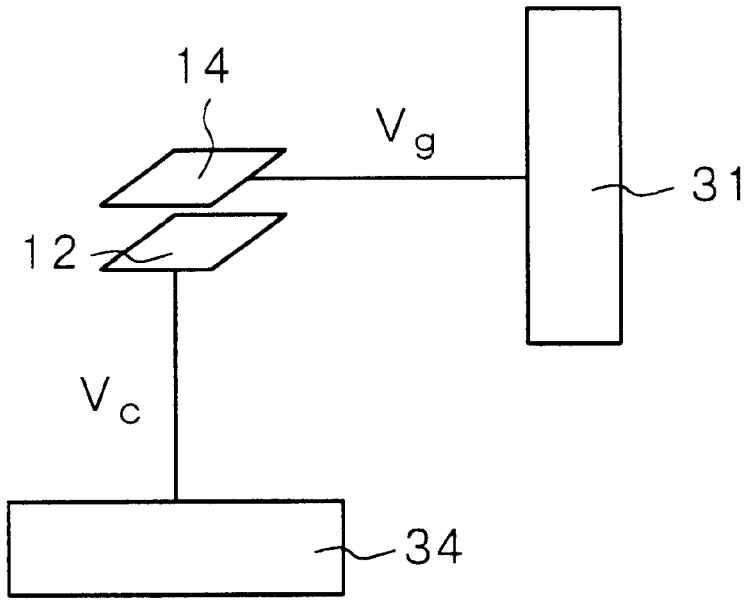
Figure 84B:
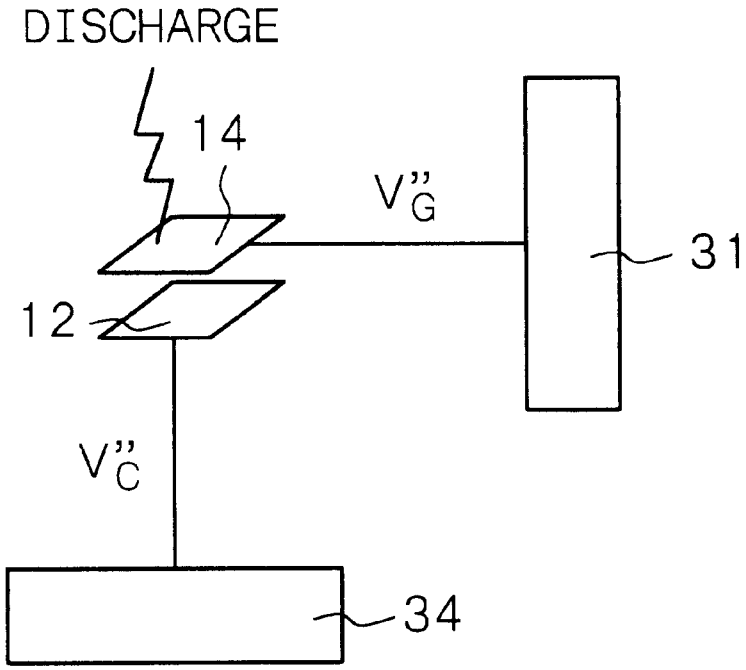

FIGS. 84A and 84B are drawings for explaining a problem of a conventional cold cathode field emission display.

Figure 85A:
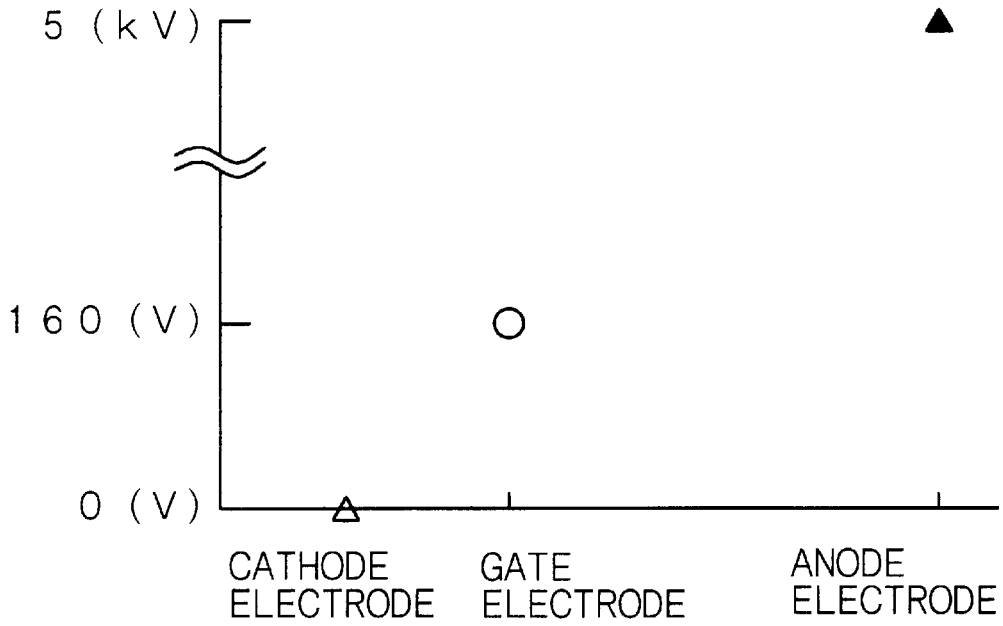
Figure 85B:
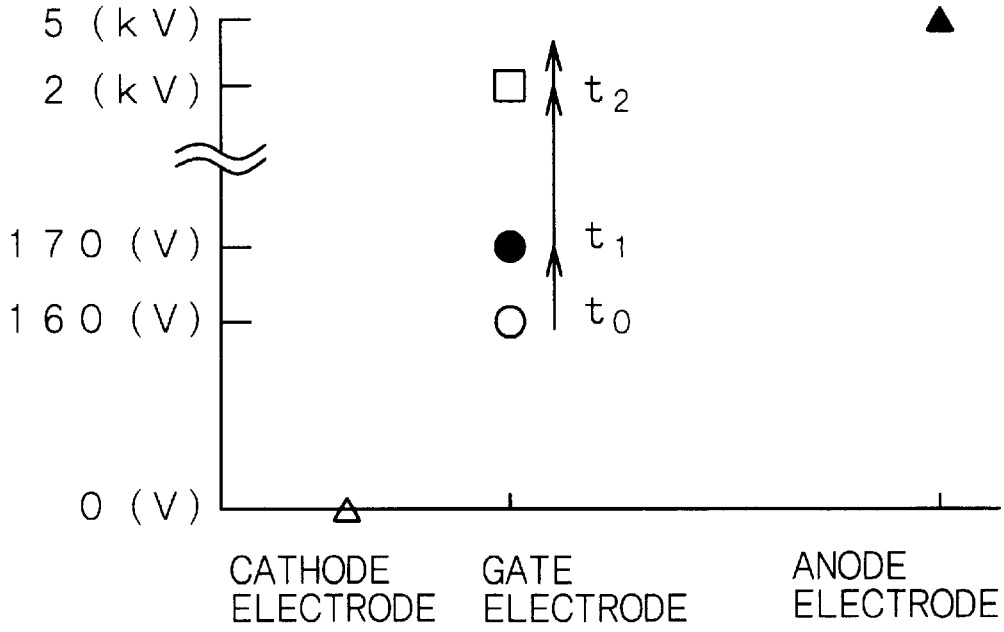

FIGS. 85A and 85B are schematic drawing for showing potentials of a selected gate electrode and a selected cathode electrode.

Figure 86:
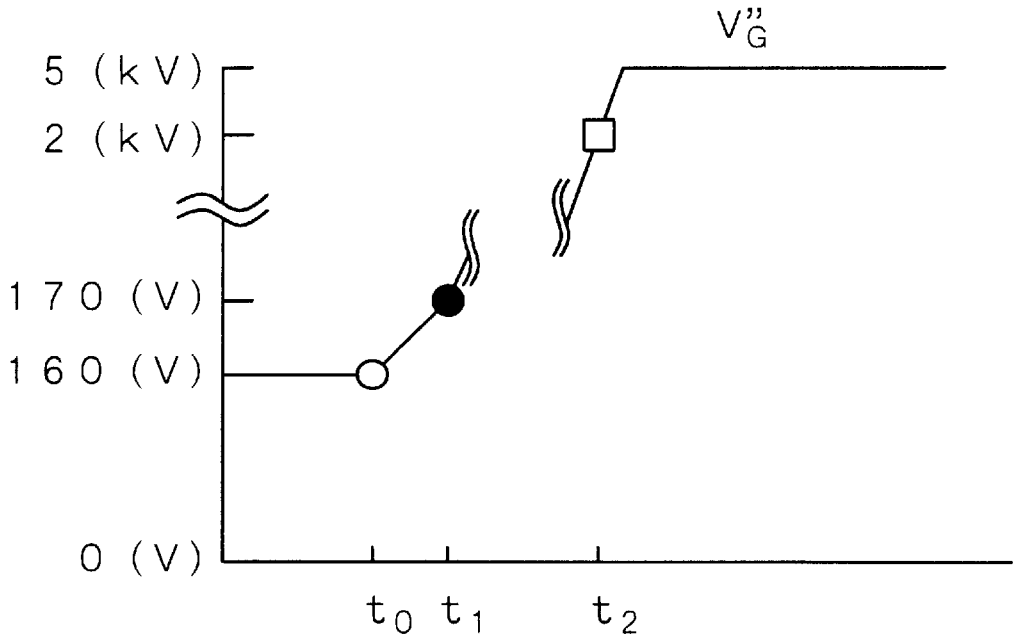

FIG. 86 is a schematic drawing for showing a change in potential in a selected gate electrode when a discharge takes place.

DESCRIPTION OF THE PREFERRED EMBODIMENTS

Examples 1 to 6 will explain the flat-type displays (specifically cold cathode field emission displays) having various constitutions according to the first aspect of the present invention, Example 7 will explain the flat-type display (specifically, cold cathode field emission display) according to the second aspect of the present invention, and Examples 8 and 9 will explain the flat-type displays (specifically, cold cathode field emission displays) according to the third aspect of the present invention. Further, Example 10 will explain structures of various cold cathode field emission devices (to be abbreviated as "field emission devices" hereinafter).

EXAMPLE 1

Example 1 is concerned with the flat-type display (more specifically, a cold cathode field emission display) according to the first aspect of the present invention, and further with the flat-type display according to the first constitution. FIG. 1 shows a conceptual drawing of the flat-type display of Example 1, and FIG. 3 shows a schematic partial end view thereof. The flat-type display comprises a first panel (cathode panel) 10 having electron-emitting portions 16, a second panel (anode panel) 20 having an electron irradiation surface, and electron-emitting-portion driving circuits 31 and 34 for driving the electron-emitting portions 16, and the flat-type display is provided with an electron-emitting-portion cutoff circuit between the electron-emitting portions 16 and the electron-emitting-portion driving circuit for preventing a discharge between the electron-emitting portions 16 and the electron irradiation surface. More specifically, the flat-type display of Example 1 has a stripe-shaped gate electrode 14 and a stripe-shaped cathode electrode 12 extending in the direction different from the extending direction of the gate electrode 14, the electron-emitting portion 16 is positioned in an overlap region where the projection image of the stripe-shaped gate electrode 14 and the projection image of the stripe-shaped cathode electrode 12 overlap. The electron-emitting-portion driving circuit comprises a first driving circuit 31 connected to the gate electrodes 14 and a second driving circuit 34 connected to the cathode electrodes 12. The first driving circuit 31 is connected to the gate electrode 14 through the electron-emitting-portion cutoff circuit 32. The structure of the electron-emitting portions 16 or Spindt-type electron emission electrodes 16A will be explained in detail later.

The second panel 20 comprises a plurality of phosphor layers 22 formed in the form of a matrix or a stripe on a substrate 21 made, for example, of glass, a black matrix 23 filled between the phosphor layers 22, and an anode electrode 24 formed on the entire surface of the phosphor layers 22 and the black matrix 23. A positive voltage higher than a positive voltage to be applied to the gate electrode 14 is applied to the anode electrode 24 from an anode-electrode driving circuit 37, and the anode electrode 24 works to direct electrons emitted into a vacuum from the electron emission electrode 16A toward the phosphor layer 22. Further, the anode electrode 24 not only protects phosphor particles constituting the phosphor layer 22 from sputtering with particles such as ions, but also works to reflect light emitted from the phosphor layers 22 due to electron excitation toward the substrate side to improve a display screen viewed from the outside of the substrate 21 in brightness. The anode electrode 24 is made, for example, of a thin aluminum film.

The electron-emitting-portion cutoff circuit 32 is in a non-operated state when no discharge takes place between the electron-emitting portion 16 and the electron irradiation surface (specifically, the anode electrode 24), and it operates when a discharge takes place between the electron-emitting portion 16 and the electron irradiation surface. Specifically, the electron-emitting-portion cutoff circuit 32 comprises an n-channel type bottom gate type TFT ($TR_1$, $TR_2$, $TR_3$ . . . ), a common line 33 and a resistance element (resistance R). One end of the above resistance R is connected to the common line 33, and the other end is grounded. One source/drain region and the gate region of the TFT ($TR_1$, $TR_2$, $TR_3$ . . . ) constituting the electron-emitting-portion cutoff circuit 32 are connected between the first driving circuit 31 and the gate electrode 14, and the other source/drain region of the TFT ($TR_1$, $TR_2$, $TR_3$ . . . ) is grounded through the common line 33 and the resistance R. The electron-emitting-portion cutoff circuit 32 further comprises a diode ($D_{11}$, $D_{21}$, $D_{31}$ . . . ), and the diode ($D_{11}$, $D_{21}$, $D_{31}$ . . . ) is disposed between the gate region of the TFT ($TR_1$, $TR_2$, $TR_3$ . . . ) and the first driving circuit (gate-electrode driving circuit) 31. The cathode electrode 12 is connected to the second driving circuit (cathode-electrode driving circuit) 34, and a diode ($D_{12}$, $D_{22}$, $D_{32}$ . . . ) is disposed between the cathode electrode 12 and the second driving circuit 34. The TFTs ($TR_1$, $TR_2$, $TR_3$ . . . ) constituting the electron-emitting-portion cutoff circuit 32 are in a complete non-continuity state when the gate regions thereof have a potential of $V_G$ volt or lower (for example, 160 volts or lower), and they come into a complete continuity state at a potential of $V'_G$ volt or higher (for example, 170 volts or higher). At a potential of over $V_G$ volt but less than $V'_G$ volt, they are in an incomplete continuity state.

For displaying images on the flat-type display, a positive voltage $V_{G\text{-}SL}$ (for example, 160 volts) is applied to a selected gate electrode constituting a pixel that is to emit light. On the other hand, a voltage $V_{G\text{-}NSL}$ (for example, 0 volt) is applied to a non-selected gate electrode constituting a pixel that is not to emit light. Further, a voltage $V_{C\text{-}SL}$ (for example, at least 0 volt but less than 30 volts depending upon brightness) is applied to a selected cathode electrode constituting a pixel that is to emit light. On the other hand, a voltage $V_{C\text{-}NSL}$ (for example, 30 volts) is applied to a non-selected cathode electrode constituting a pixel that is not to emit light. FIG. 2A schematically shows the above state. Therefore, the voltage difference between the cathode electrode 12 and the gate electrode 14 in the brightest pixel is 160 volts, and the voltage difference between the cathode electrode 12 and the gate electrode 14 in the darkest pixel is 130 volts. In FIG. 2, the TFT ($TR_1$, $TR_2$, $TR_3$ . . . ) is simply shown as "TR", and the diode ($D_{11}$, $D_{21}$, $D_{31}$ . . . ) and the diode ($D_{12}$, $D_{22}$, $D_{32}$ . . . ) are simply shown as "$D_1$" and "$D_2$", respectively. Further, the voltages applied to the gate electrode 14 and the cathode electrode 12 are shown as "$V_g$" and "$V_C$", respectively.

When a discharge starts between the anode electrode 24 and the gate electrode 14, the potential of the gate electrode 14 increases with the elapse of time. And, when the potential of the gate electrode 14 comes to be $V'_G$ or higher, the TFT ($TR_1$, $TR_2$, $TR_3$ . . . ) constituting the electron-emitting-portion cutoff circuit 32 connected to such a gate electrode 14 comes into a complete continuity state, and such a gate electrode 14 is grounded through the resistance R. FIG. 2B schematically shows the above state. The above operation is completed in several microseconds. As a result, image display on a screen is partly not made in the flat-type display, but damage of the first driving circuit (gate-electrode driving circuit) 31 can be reliably avoided. Further, the voltage difference between the cathode electrode 12 and the gate electrode 14 decreases, so that no permanent damage is caused on the gate electrode 14 and the electron-emitting portion 16. When the potential of the gate electrode 14 decreases to be $V_G$ or lower, the TFT ($TR_1$, $TR_2$, $TR_3$ . . . )

constituting the electron-emitting-portion cutoff circuit 32 comes into a complete non-continuity state. As a result, the flat-type display automatically restores the operation of image display on a screen. The above operation is repeated until the discharge between the anode electrode 24 and the gate electrode 14 disappears. If timers are connected to the TFTs ($TR_{1,\ TR2}$, $TR_3$ . . . ) constituting the electron-emitting-portion cutoff circuit 32, the TFTs ($TR_1$, $TR_2$, $TR_3$ . . . ) are inhibited for a certain time period from coming into a complete non-continuity state, so that the discharge between the anode electrode 24 and the cathode electrode 14 can be more reliably removed.

FIG. 4 shows a variant of the flat-type display of Example 1. The flat-type display of this variant differs from the flat-type display shown in FIG. 1 in that the other source/drain region of the TFT ($TR_1$, $TR_2$, $TR_3$ . . . ) constituting the electron-emitting-portion cutoff circuit 32 is grounded through a resistance ($R_1$, $R_2$, $R_3$ . . . ). The flat-type display of the variant has the same constitution and structure in other points.

FIG. 5 shows a variant of the flat-type display of Example 1 shown in FIG. 1. The flat-type display of this variant differs from the flat-type display shown in FIG. 1 in that a diode ($D_{13}$, $D_{23}$, $D_{33}$ . . . ) is disposed between the other source/drain region of the TFT ($TR_1$, $TR_2$, $TR_3$ . . . ) constituting the electron-emitting-portion cutoff circuit 32 and the gate electrodes 14. The variant has the same constitution and structure in other points. When the diode ($D_{13}$, $D_{23}$, $D_{33}$ . . . ) is disposed as described above, the potential of gate electrodes 14 causing no discharge increases to $V'_G$, and the occurrence of a discharge between neighboring gate electrodes 14 due to a voltage difference between the neighboring gate electrodes 14 can be prevented.

The TFTs ($TR_1$, $TR_2$, $TR_3$ . . . ), the diodes ($D_{11}$, $D_{21}$, $D_{31}$ . . . ), etc., for constituting the electron-emitting-portion cutoff circuit 32 can be formed in the ineffective field by a known TFT production method and a known diode production method. The TFT may be not only of a bottom gate type, but also it may be of a top gate type. Preferably, field emission devices to be described later are formed after the TFTs ($TR_1$, $TR_2$, $TR_3$ . . . ), diodes ($D_{11}$, $D_{21}$, $D_{31}$ . . . ), etc., are formed on the first panel. The TFTs ($TR_1$, $TR_2$, $TR_3$ . . . ), the diodes ($D_{11}$, $D_{21}$, $D_{31}$ . . . ), etc., for constituting the electron-emitting-portion cutoff circuit 32 may be disposed in a region on the first panel outside portions in which the first panel 10 and the second panel 20 are bonded (the region will be referred to as "circumferential region") or they may be disposed in the ineffective field and the circumferential region. Alternatively, transistors constituting the electron-emitting-portion cutoff circuit 32 may comprise MOS-type FETs. Further, the electron-emitting-portion cutoff circuit 32 may be incorporated into the first driving circuit 31. An electron-emitting-portion cutoff circuit, a first cutoff circuit and a second cutoff circuit in Examples 2 and 3 to be described hereinafter can be also constituted as described above.

EXAMPLE 2

Example 2 is concerned with the flat-type display according to the first aspect of the present invention and further with the flat-type display according to the second constitution. FIG. 6 shows a conceptual drawing of the flat-type display of Example 2, and FIG. 8 shows a schematic partial end view thereof. The flat-type display comprises a stripe-shaped gate electrode 14 and a stripe-shaped cathode electrode 12 extending in a direction different from the extending direction of the stripe-shaped gate electrode 14, and the electron-emitting portion 16 is positioned in an overlap region where the projection image of the stripe-shaped gate electrode 14 and the projection image of the stripe-shaped cathode electrode 12 overlap. An electron-emitting-portion driving circuit comprises a first driving circuit 31 connected to the gate electrodes 14 and a second driving circuit 34 connected to the cathode electrodes 12. And, the second driving circuit 34 is connected to the cathode electrode 12 through an electron-emitting-portion cutoff circuit 35.

The structure of a second panel 20 can be the same as the structure of the second panel 20 explained in Example 1, so that a detailed explanation thereof is omitted.

The electron-emitting-portion cutoff circuit 35 is in a non-operated state when no discharge takes place between the electron-emitting portion 16 and the electron irradiation surface (specifically, the anode electrode 24), and it operates when a discharge takes place between the electron-emitting portion 16 and the electron irradiation surface. Specifically, the electron-emitting-portion cutoff circuit 35 comprises an n-channel type bottom gate type TFT ($TR_1$, $TR_2$, $TR_3$ . . . ). One source/drain region and a gate region of the TFT ($TR_1$, $TR_2$, $TR_3$ . . . ) constituting the electron-emitting-portion cutoff circuit 35 are connected between the second driving circuit 34 and the cathode electrode 12, and other source/drain region is connected to a power source $V_d$ having a predetermined potential through a common line 36. The electron-emitting-portion cutoff circuit 35 further comprises a diode ($D_{12}$, $D_{22}$, $D_{32}$ . . . ), and the diode ($D_{12}$, $D_{22}$, $D_{32}$ . . . ) is disposed between the TFT ($TR_1$, $TR_2$, $TR_3$ . . . ) constituting the electron-emitting-portion cutoff circuit 35 and the second driving circuit (cathode-electrode driving circuit) 34. The gate electrodes 14 are connected to the first driving circuit (gate-electrode driving circuit) 31, and a diode ($D_{11}$, $D_{21}$, $D_{31}$ . . . ) is disposed between the gate electrode 14 and the first driving circuit 31. The TFTs ($TR_1$, $TR_2$, $TR_3$ . . . ) constituting the electron-emitting-portion cutoff circuit 35 are in a complete non-continuity state when the gate regions thereof have a potential of $V_C$ bolt or lower ($V_C > V_{C\text{-}NSL}$), and they come into a complete continuity state when they have a potential of $V'_C$ volt or higher ($V'_C > V_C$). At a potential of over $V_C$ volt but less than $V'_C$ volt, the TFTs ($TR_1$, $TR_2$, $TR_3$ . . . ) are in an incomplete continuity state.

For displaying images on the flat-type display, a positive voltage $V_{G\text{-}SL}$ (for example, 160 volts) is applied to a selected gate electrode constituting a pixel that is to emit light. On the other hand, a voltage $V_{G\text{-}NSL}$ (for example, 0 volt) is applied to a non-selected gate electrode constituting a pixel that is not to emit light. Further, a voltage $V_{C\text{-}SL}$ (for example, at least 0 volt but less than 30 volts depending upon brightness) is applied to a selected cathode electrode constituting a pixel that is to emit light. On the other hand, a voltage $V_{C\text{-}NSL}$ (for example, 30 volts) is applied to a non-selected cathode electrode constituting a pixel that is not to emit light. FIG. 7A schematically shows the above state. Therefore, the voltage difference between the cathode electrode 12 and the gate electrode 14 in the brightest pixel is 160 volts, and the voltage difference between the cathode electrode 12 and the gate electrode 14 in the darkest pixel is 130 volts. In FIG. 7, the TFT ($TR_1$, $TR_2$, $TR_3$ . . . ) is simply shown as "TR", and the diode ($D_{11}$, $D_{21}$, $D_{31}$ . . . ) and the diode ($D_{12}$, $D_{22}$, $D_{32}$ . . . ) are simply shown as "$D_1$" and "$D_2$", respectively. Further, the voltages applied to the gate electrodes 14 and the cathode electrodes 12 are shown as "$V_g$" and "$V_C$", respectively.

When a discharge starts between the anode electrode 24 and the gate electrode 14, the potential of the gate electrode 14 increases with the elapse of time. Since, however, the diode ($D_{11}$, $D_{21}$, $D_{31}$ . . . ) is disposed between the gate electrode 14 and the first driving circuit (gate-electrode driving circuit) 31, damage on the first driving circuit 31 can be prevented. As a result of an increase in the potential of the gate electrode 14 with the elapse of time, a discharge takes place in a cathode electrode 12, and the potential of the cathode electrode 12 also increases. And, when the potential of the cathode electrode 12 comes to be $V'_C$ or higher, the TFT ($TR_1$, $TR_2$, $TR_3$ . . . ) constituting the electron-emitting-portion cutoff circuit 35 connected to the cathode electrode 12 comes into a complete continuity state, and the cathode electrode 12 comes to have a potential of $V_d$ volt. FIG. 7B schematically shows the above state. The above operation is completed in several microseconds. As a result, image display on a screen is partly not made in the flat-type display, but damage of the second driving circuit (cathode-electrode driving circuit) 34 can be reliably avoided. Further, permanent damage of the electron-emitting portions 16 can be prevented. When the potential of the cathode electrode 12 decreases to be $V_C$ or lower, the TFT ($TR_1$, $TR_2$, $TR_3$ . . . ) constituting the electron-emitting-portion cutoff circuit 35 comes into a complete non-continuity state. As a result, the flat-type display automatically restores the operation of image display on a screen. The above operation is repeated until the discharge between the anode electrode 24 and the cathode electrode 12 disappears. If timers are connected to the TFTs ($TR_1$, $TR_2$, $TR_3$ . . . ) constituting the electron-emitting-portion cutoff circuit 35, the TFTs ($TR_1$, $TR_2$, $TR_3$ . . . ) are inhibited for a certain time period from coming into a complete non-continuity state, so that the discharge between the anode electrode 24 and the gate electrode 12 can be more reliably removed.

EXAMPLE 3

Example 3 is concerned with the flat-type display according to the first aspect of the present invention and further with the flat-type display according to the third constitution. FIG. 9 shows a conceptual drawing of the flat-type display of Example 3, and FIG. 11 shows a schematic partial end view thereof. The flat-type display of Example 3 comprises a stripe-shaped gate electrode 14 and a stripe-shaped cathode electrode 12 extending in a direction different from the extending direction of the stripe-shaped gate electrode 14, and the electron-emitting portion 16 is positioned in an overlap region where the projection image of the stripe-shaped gate electrode 14 and the projection image of the stripe-shaped cathode electrode 12 overlap. An electron-emitting-portion driving circuit comprises a first driving circuit (gate-electrode driving circuit) 31 connected to the gate electrodes 14 and a second driving circuit (cathode-electrode driving circuit) 34 connected to the cathode electrodes 12. An electron-emitting-portion cutoff circuit comprises a first cutoff circuit 32A provided between the gate electrode 14 and the first driving circuit 31 and a second cutoff circuit 35A provided between the cathode electrode 12 and the second driving circuit 34.

The structure of a second panel 20 can be the same as the structure of the second panel 20 explained in Example 1, so that a detailed explanation thereof is omitted.

When no discharge takes place between the electron-emitting portion 16 and the electron irradiation surface, the first and second cutoff circuits 32A and 35A are in a non-operated state. When a discharge takes place between the electron-emitting portion 16 and the electron irradiation surface, the first cutoff circuit 32A operates, and on the basis of the operation of the first cutoff circuit 32A, the second cutoff circuit 35A operates. Specifically, the first cutoff circuit 32A comprises an n-channel type bottom type TFT ($TR_{11}$, $TR_{21}$, $TR_{31}$ . . . ). The above TFT will be referred to as "first TFT". One source/drain region and the gate electrode of the first TFT ($TR_{11}$, $TR_{21}$, $TR_{31}$ . . . ) constituting the first cutoff circuit 32A are connected between the first driving circuit 31 and the gate electrode 14, and the other source/drain region thereof is connected to a common line 33 constituting the electron-emitting-portion cutoff circuit. The first cutoff circuit 32A further comprises a diode ($D_{11}$, $D_{21}$, $D_{31}$ . . . ), and the diode ($D_{11}$, $D_{21}$, $D_{31}$ . . . ) is disposed between the gate region of the first TFT ($TR_{11}$, $TR_{21}$, $TR_{31}$ . . . ) and the first driving circuit (gate-electrode driving circuit) 31.

The second cutoff circuit 35A comprises a p-channel type bottom gate type TFT ($TR_{12}$, $TR_{22}$, $TR_{32}$ . . . ) and an n-channel type bottom gate type TFT ($TR_{13}$, $TR_{23}$, $TR_{33}$ . . . ). The p-channel type bottom gate type TFT ($TR_{12}$, $TR_{22}$, $TR_{32}$ . . . ) will be referred to as "second TFT", and the n-channel type bottom gate type TFT ($TR_{13}$, $TR_{23}$, $TR_{33}$ . . . ) will be referred to as "third TFT". One of source/drain regions of the second TFT ($TR_{12}$, $TR_{22}$, $TR_{32}$ . . . ) constituting the second cutoff circuit 35A is connected between the second driving circuit 34 and the cathode electrode 12, and the other source/drain region and gate region thereof are connected to a common line 33 and grounded through a resistance ($R_1$, $R_2$, $R_3$ . . . ) constituting the electron-emitting-portion cutoff circuit. Further, one of source/drain regions of the third TFT ($TR_{13}$, $TR_{23}$, $TR_{33}$ . . . ) constituting the second cutoff circuit 35A is connected to one of the source/drain regions of the second TFT ($TR_{12}$, $TR_{22}$, $TR_{32}$ . . . ), other source/drain region is connected to the second driving circuit 34, and the gate region of the third TFT ($TR_{13}$, $TR_{23}$, $TR_{33}$ . . . ) is connected to other source/drain region of the second TFT ($TR_{12}$, $TR_{22}$, $TR_{32}$ . . . ).

The first TFTs ($TR_{11}$, $TR_{21}$, $TR_{31}$ . . . ) constituting the first cutoff circuits 32A and the second TFTs ($TR_{12}$, $TR_{22}$, $TR_{32}$ . . . ) constituting the second cutoff circuits 35A are in a complete non-continuity state when the gate regions thereof have a potential of $V_G$ volt or lower (for example, 160 volts or lower), and they come to be in a complete continuity state at a potential of $V'_G$ volt or higher (for example, 170 volts or higher). At a potential of over $V_G$ volt but lower than $V'_G$ volt, they are in an incomplete continuity state. The third TFTs ($TR_{13}$, $TR_{23}$, $TR_{33}$ . . . ) constituting the second cutoff circuits 35A are in a complete continuity state when the gate regions thereof have a potential of $V_C$ volt or lower ($V_G \geqq V_C$, and for example, 150 volts or lower), and at a potential of $V'_C$ volt or higher ($V'_G \geqq V'_C$, and for example, 160 volts or higher), they come to be in a complete non-continuity state. At a potential of over $V_C$ volt but lower than $V'_C$ volt, the are in an incomplete continuity state.

For displaying images on the flat-type display, a positive voltage $V_{G\text{-}SL}$ (for example, 160 volts) is applied to a selected gate electrode constituting a pixel that is to emit light. On the other hand, a voltage $V_{G\text{-}NSL}$ (for example, 0 volt) is applied to a non-selected gate electrode constituting a pixel that is not to emit light. Further, a voltage $V_{C\text{-}SL}$ (for example, at least 0 volt but less than 30 volts depending upon brightness) is applied to a selected cathode electrode constituting a pixel that is to emit light. On the other hand, a voltage $V_{C\text{-}NSL}$ (for example, 30 volts) is applied to a non-selected cathode electrode constituting a pixel that is not to emit light. FIG. 10A schematically shows the above state. Therefore, the voltage difference between the cathode electrode 12 and the gate electrode 14 in the brightest pixel is 160 volts, and the voltage difference between the cathode electrode 12 and the gate electrode 14 in the darkest pixel is 130 volts. In FIG. 10, the first TFT ($TR_{11}$, $TR_{21}$, $TR_{31}$ . . . ), the second TFT ($TR_{12}$, $TR_{22}$, $TR_{32}$ . . . ) and the third TFT ($TR_{13}$, $TR_{23}$, $TR_{33}$ . . . ) are simply shown as "$TR_1$", "$TR_2$" and "$TR_3$", the diode ($D_1$, $D_2$, $D_3$ . . . ) is simply shown as "D", and the resistance ($R_1$, $R_2$, $R_3$ . . . ) is simply shown as "R". Further, the voltages applied to the gate electrode 14 and the cathode electrode 12 are shown as "$V_g$" and "$V_C$".

When a discharge starts between the anode electrode 24 and the gate electrode 14, the potential of the gate electrode 14 increases with the elapse of time. And, when the potential of the gate electrode 14 comes to be $V'_G$ volt or higher, the first TFT ($TR_{11}$, $TR_{21}$, $TR_{31}$ . . . ) constituting the first cutoff circuit 32A connected to such a gate electrode 14 comes to be in a complete continuity state, and the potential of the common line 33 also comes to be $V'_G$ volt. As a result, all of the second TFTs ($TR_{12}$, $TR_{22}$, $TR_{32}$ . . . ) constituting the second cutoff circuits 35A connected to the common line 33 also come to be in a complete continuity state. On the other hand, the third TFTs ($TR_{13}$, $TR_{23}$, $TR_{33}$ . . . ) constituting the second cutoff circuits 35A come to be in a complete non-continuity state. FIG. 10B schematically shows the above state. The above operation is completed in several micro-seconds. As a result, image display on a screen is not made in the flat-type display, but damage of the first driving circuit (gate-electrode driving circuit) 31 and the second driving circuit (cathode-electrode driving circuit) 34 can be reliably avoided. Further, the voltage difference between the cathode electrode 12 and the gate electrode 14 does not increase, nor is permanent damage caused on the electron-emitting portions 16. When the potential of the gate electrode 14 decreases to be $V_G$ or lower, the first TFT ($TR_{11}$, $TR_{21}$, $TR_{31}$ . . . ) constituting the first cutoff circuit 35A comes into a complete non-continuity state. As a result, the second TFTs ($TR_{12}$, $TR_{22}$, $TR_{32}$ . . . ) constituting the second cutoff circuits 35A come into a complete non-continuity state as well, and the third TFTs ($TR_{13}$, $TR_{23}$, $TR_{33}$ . . . ) come into a complete continuity state. As a result, the flat-type display automatically restores the operation of image display on a screen. The above operation is repeated until the discharge between the anode electrode 24 and the gate electrode 14 disappears. If timers are connected to the first TFTs ($TR_{11}$, $TR_{21}$, $TR_{31}$ . . . ) constituting the first cutoff circuits 32A, the first TFTs ($TR_{11}$, $TR_{21}$, $TR_{31}$ . . . ) constituting the first cutoff circuits 32A are inhibited for a certain time period from coming into a complete non-continuity state, so that the discharge between the anode electrode 24 and the gate electrode 14 can be more reliably removed.

FIG. 12 shows a variant of the flat-type display of Example 3. The flat-type display of this variant differs from the flat-type display shown in FIG. 9 in that a diode ($D_{12}$, $D_{22}$, $D_{32}$ . . . ) is disposed between the other source/drain region of the first TFT ($TR_{31}$, $TR_{32}$, $TR_{33}$ . . . ) constituting the first cutoff circuit 32A and the gate electrode 14. The variant has the same constitution and structure in other points. When the diode ($D_{12}$, $D_{22}$, $D_{32}$ . . . ) is disposed as described above, the potential of gate electrodes 14 causing no discharge increases to $V'_G$, and the occurrence of a discharge between neighboring gate electrodes 14 due to a voltage difference between the neighboring gate electrodes 14 can be prevented.

FIG. 13 shows another variant of the flat-type display of Example 3. In this variant, the second cutoff circuit 35A comprises a second TFT ($TR_{12}$, $TR_{22}$, $TR_{32}$ . . . ) and a diode ($D_{12}$, $D_{22}$, $D_{32}$ . . . ). One source/drain region of the second TFT ($TR_{12}$, $TR_{22}$, $TR_{32}$ . . . ) is connected to the cathode electrode 12, and other source/drain region thereof is connected to one end of the diode ($D_{12}$, $D_{22}$, $D_{32}$ . . . ). The gate region of the second TFT ($TR_{12}$, $TR_{22}$, $TR_{32}$ . . . ) is connected to the common line 33. The other end of the diode ($D_{12}$, $D_{22}$, $D_{32}$ . . . ) is connected to the second driving circuit 34.

The first TFTs ($TR_{11}$, $TR_{21}$, $TR_{31}$ . . . ) constituting the first cutoff circuits 32A are in a complete non-continuity state when the gate regions thereof have a potential of $V_G$ volt or lower (for example, 160 volts or lower), and at a potential of $V'_G$ volt or higher (for example, 170 volts or higher), they come into a complete continuity state. At a potential of over $V_G$ volt but lower than $V'_G$ volt, they are in an incomplete continuity state. The second TFTs ($TR_{12}$, $TR_{22}$, $TR_{32}$ . . . ) constituting the second cutoff circuits 35A are in a complete continuity state when the gate regions thereof have a potential of $V_C$ bolt or lower ($V_G \geqq V_C$, and for example, 150 volts or lower), and at a potential of $V'_C$ volt or higher ($V'_G \geqq V'_C$, and for example, 160 volts or higher), they come into a complete non-continuity state. At a potential of over $V_C$ volt but lower than $V'_C$, they are in an incomplete continuity state.

When a discharge starts between the anode electrode 24 and the gate electrode 14, the potential of the gate electrode 14 increases with the elapse of time. And, when the potential of the gate electrode 14 comes to be $V'_G$ volt or higher, the first TFT ($TR_{11}$, $TR_{21}$, $TR_{31}$ . . . ) constituting the first cutoff circuit 32A connected to such a gate electrode 14 comes to be in a complete continuity state, and the potential of the common line 33 also comes to be $V'_G$ volt. As a result, all of the second TFTs ($TR_{12}$, $TR_{22}$, $TR_{32}$ . . . ) constituting the second cutoff circuits 35A connected to the common line 33 also come to be in a complete continuity state. As a result, image display on a screen is not made in the flat-type display, but damage of the first driving circuit (gate-electrode driving circuit) 31 and the second driving circuit (cathode-electrode driving circuit) 34 can be reliably avoided. Further, the voltage difference between the cathode electrode 12 and the gate electrode 14 does not increase much, nor is permanent damage caused on the gate electrode and the electron-emitting portion 16. When the potential of the gate electrode 14 decreases to be $V_G$ or lower, the first TFT ($TR_{11}$, $TR_{21}$, $TR_{31}$ . . . ) constituting the first cutoff circuit 35A comes into a complete non-continuity state, and the second TFTs ($TR_{12}$, $TR_{22}$, $TR_{32}$ . . . ) constituting the second cutoff circuits 35A come into a complete continuity state. As a result, the flat-type display automatically restores the operation of image display on a screen. The above operation is repeated until the discharge between the anode electrode 24 and the gate electrode 14 disappears. If timers are connected to the first TFTs ($TR_{11}$, $TR_{21}$, $TR_{31}$ . . . ) constituting the first cutoff circuits 32A, the first TFTs ($TR_{11}$, $TR_{21}$, $TR_{31}$ . . . ) constituting the first cutoff circuits 32A are inhibited for a certain time period from coming into a complete non-continuity state, so that the discharge between the anode electrode 24 and the gate electrode 14 can be more reliably removed.

FIG. 14 shows a variant of the flat-type display of Example 3 shown in FIG. 13. The flat-type display of this variant differs from the flat-type display shown in FIG. 13 in that a diode ($D_{13}$, $D_{23}$, $D_{33}$ . . . ) is disposed between the other source/drain region of the first TFT ($TR_{11}$, $TR_{21}$, $TR_{31}$ . . . ) constituting the first cutoff circuit 32A and the gate electrode 14. The variant has the same constitution and structure in other points. When the diode ($D_{13}$, $D_{23}$, $D_{33}$ . . . ) is disposed as described above, the potential of gate electrodes 14 causing no discharge increases to $V'_G$ , and the occurrence of a discharge between neighboring gate electrodes 14 due to a voltage difference between the neighboring gate electrodes 14 can be prevented.

EXAMPLE 4

Example 4 is concerned with a variant of the flat-type display of Example 1.

In Examples 1 to 3, the various transistors constituting the electron-emitting-portion cutoff circuit are required to operate at a sufficiently high rate for greatly decreasing the time period that passes from the start of a discharge to the operation of the electron-emitting-portion cutoff circuit. Further, it is required to use transistors having sufficiently high breakdown resistance depending upon positions where the transistors are arranged.

In Example 4 or Examples 5 and 6 to be described later, the electron-emitting-portion cutoff circuit comprises a discharge tube or a Zener diode, whereby the high response and high breakdown resistance of the electron-emitting-portion cutoff circuit can be easily realized.

FIG. 15 shows a conceptual drawing of the flat-type display of Example 4. This flat-type display is a variant of the flat-type display of Example 1 shown in FIG. 1. The flat-type display has a schematic partial end view similar to that shown in FIG. 3.

Specifically, an electron-emitting-portion cutoff circuit 32B comprises a discharge tube DC ($DC_1$, $DC_2$, $DC_3$ . . . ) and a common line 33. One end of the discharge tube DC is connected between the first driving circuit 31 and the gate electrode 14, and the other end of the discharge tube DC is connected to the common line 33. A first predetermined voltage $V_{PD1}$ is applied to the discharge tubes DC constituting the electron-emitting-portion cutoff circuits 32B through the common line 33. When a portion of the electron-emitting portion (gate electrode 14) connected to the electron-emitting-portion cutoff circuit 32B comes have a potential of a second predetermined voltage $V_{PD2}$ due to a discharge that takes place between the electron-emitting portion and the electron irradiation surface, the discharge tube DC constituting the electron-emitting-portion cutoff circuit 32B operates depending upon a voltage difference ($V_{PD2}-V_{PD1}$) between the first predetermined voltage and the second predetermined voltage. Specifically, the first predetermined voltage ($V_{PD1}$=80 volts) is applied to the common line 33. The discharge tubes DC having an operation voltage of 90 volts were used. Therefore, when the portion of the electron-emitting portion (gate electrode 14) connected to the electron-emitting-portion cutoff circuit 32B comes to have a potential of over a second predetermined voltage ($V_{PD2}$, over 160 volts, and for example, 170 volts) due to a discharge that takes place between the electron-emitting portion and the electron irradiation surface, the discharge tube DC constituting the electron-emitting-portion cutoff circuit 32B operates. From the viewpoint of preventing a malfunction of the discharge tube DC, preferably, the voltage difference for bringing the discharge tube DC into a continuity state is greater than a voltage difference between the maximum value of output voltage of the first driving circuit 31 to which the discharge tube DC is connected and the first predetermined voltage $V_{PD1}$ and is greater than a voltage difference between the minimum value of output voltage of the first driving circuit 31 to which the discharge tube DC is connected and the first predetermined voltage $V_{PD1}$.

When a breakdown voltage of the first driving circuit (gate-electrode driving circuit) 31 which is the electron-emitting-portion driving circuit is taken as $V_{COLAPSE}$ and when the maximum value of the output voltage of the first driving circuit (gate-electrode driving circuit) 31 is taken as $V_{OUT\text{-}MAX}$, $|V_{OUT\text{-}MAX}-V_{PD1}|<V_{COLAPSE}$ is satisfied. Otherwise, when the a breakdown current of the first driving circuit (gate-electrode driving circuit) 31 which is the electron-emitting-portion driving circuit is taken as $I_{COLAPSE}$ and when the resistance value between the first driving circuit (gate-electrode driving circuit) 31 and the gate electrode 14 is taken as $R_{EMISSION}$, $|V_{OUT\text{-}MAX}-V_{PD1}|<R_{EMISSION}\cdot I_{COLAPSE}$ is satisfied. When the above expressions are satisfied, the destruction of the first driving circuit (gate-electrode driving circuit) 31 by the first predetermined voltage $V_{PD1}$ can be prevented.

When a discharge starts between the anode electrode 24 and the gate electrode 14, the potential of the gate electrode 14 increases with the elapse of time. And, when the potential of the gate electrode 14 comes to be the second predetermined voltage $V_{PD2}$ or higher, the discharge tube DC ($DC_1$, $DC_2$, $DC_3$. . . ) constituting the electron-emitting-portion cutoff circuit 32B connected to such a gate electrode 14 comes to be in a complete continuity state, and the first predetermined voltage $V_{PD1}$ is applied to the gate electrode 14 through the common line 33. As a result, image display on a screen is partly not made in the flat-type display, but damage of the first driving circuit (gate-electrode driving circuit) 31 can be reliably avoided. Further, the voltage difference between the cathode electrode 12 and the gate electrode 14 decreases, so that permanent damage is not caused on the gate electrode 14 and the electron-emitting portion 16. When the potential of the gate electrode 14 decreases to be $V_{PD2}$ or lower, the discharge tube DC ($DC_1$, $DC_2$, $DC_3$ . . . ) constituting the electron-emitting-portion cutoff circuit 32B comes into a complete non-continuity state. As a result, the flat-type display automatically restores the operation of image display on a screen. The above operation is repeated until the discharge between the anode electrode 24 and the gate electrode 14 disappears. If timers are connected to the discharge tubes DC ($DC_1$, $DC_2$, $DC_3$ . . . ) constituting the electron-emitting-portion cutoff circuits 23B, the discharge tubes DC ($DC_1$, $DC_2$, $DC_3$ . . . ) are inhibited for a certain time period from coming into a complete non-continuity state, so that the discharge between the anode electrode 24 and the gate electrode 14 can be more reliably removed.

FIG. 16 shows a constitution example in which the electron-emitting-portion cutoff circuit 32B comprises a Zener diode TD ($TD_1$, $TD_2$, $TD_3$ . . . ) instead of the discharge tube. From the viewpoint of preventing a malfunction of the Zener diodes TD, preferably, the voltage difference for bringing the Zener diode TD into a continuity state is greater than a voltage difference between the maximum value of output voltage of the first driving circuit 31 to which the Zener diode TD is connected and the first predetermined voltage $V_{PD1}$ and is greater than a voltage difference between the minimum value of output voltage of the first driving circuit 31 to which the Zener diode TD is connected and the first predetermined voltage $V_{PD1}$. Further, as shown in the flat-type display shown in FIG. 5 as a variant of the flat-type display of Example 1, the diode ($D_{13}$, $D_{23}$, $D_{33}$ . . . ) may be disposed between the other end of the discharge tube DC ($DC_1$, $DC_2$, $DC_3$ . . . ) constituting the electron-emitting-portion cutoff circuit 32B and the gate electrode 14. In FIG. 17, the discharge tubes DC may be replaced with Zener diodes TD. When the diode ($D_{13}$, $D_{23}$, $D_{33}$ . . . ) is disposed as described above, the potential of gate electrodes 14 causing no discharge increases to $V_{PD1}$, and the occurrence of a discharge between the neighboring gate electrodes 14 due to a voltage difference between the neighboring gate electrodes 14 can be prevented.

The discharge tubes DC or Zener diodes TD ($TD_1$, $TD_2$, $TD_3$ . . . ) for constituting the electron-emitting-portion cutoff circuits 32B may be disposed in a region (circumferential region) on the first panel outside portions in which the first panel 10 and the second panel 20 are bonded, or they may be disposed in the ineffective field and the circumferential region. Otherwise, the electron-emitting-portion cutoff circuit 32B may be incorporated into the first driving circuit 31. An electron-emitting-portion cutoff circuit, a first cutoff circuit and a second cutoff circuit in Example 5 or 6 to be described hereinafter can be also constituted as described above.

EXAMPLE 5

Example 5 is concerned with a variant of the flat-type display of Example 2. FIG. 18 shows a conceptual drawing of the flat-type display of Example 5. This flat-type display is a variant of the flat-type display of Example 2 shown in FIG. 6 and has a schematic partial end view similar to that shown in FIG. 8.

An electron-emitting-portion cutoff circuit 35B is in a non-operated state when no discharge takes place between the electron-emitting portion 16 and the electron irradiation surface (specifically, the anode electrode 24), and it operates when a discharge takes place between the electron-emitting portion 16 and the electron irradiation surface. Specifically, the electron-emitting-portion cutoff circuit 35B comprises a discharge tube DC ($DC_1$, $DC_2$, $DC_3$ . . . ). One end of the discharge tube DC ($DC_1$, $DC_2$, $DC_3$ . . . ) constituting the electron-emitting-portion cutoff circuit 35B is connected between the second driving circuit 34 and the cathode electrode 12, and the other end thereof is connected to a power source having the first predetermined voltage $V_{PD1}$ through the common line 36. A diode ($D_{12}$, $D_{22}$, $D_{32}$ . . . ) is disposed between one end of the discharge tube DC ($DC_1$, $DC_2$, $DC_3$ . . . ) and the second driving circuit 34. Further, the gate electrode 14 is connected to the first driving circuit (gate-electrode driving circuit) 31, and a diode ($D_{11}$, $D_{21}$, $D_{31}$ . . . ) is disposed between the gate electrode 14 and the first driving circuit 31. When a portion of the electron-emitting portion (cathode electrode 12) connected to the electron-emitting-portion cutoff circuit 35B comes to have a potential of a second predetermined voltage $V_{PD2}$ due to a discharge that takes place between the electron-emitting portion and the electron irradiation surface, the discharge tube DC constituting the electron-emitting-portion cutoff circuit 35B operates depending upon the voltage difference ($V_{PD2}-V_{PD1}$) between the first predetermined voltage and the second predetermined voltage. Specifically, the first predetermined voltage ($V_{PD1}$=40 volts) is applied to the common line 36. The discharge tubes DC having an operation voltage of 80 volts were used. Therefore, when the portion of the electron-emitting portion (cathode electrode 12) connected to the electron-emitting-portion cutoff circuit 35B comes to have a potential of over a second predetermined voltage ($V_{PD2}$, over 120 volts, and for example, 130 volts) due to a discharge that takes place between the electron-emitting portion and the electron irradiation surface, the discharge tube DC constituting the electron-emitting-portion cutoff circuit 35B operates.

When a breakdown voltage of the second driving circuit (cathode-electrode driving circuit) 34 which is the electron-emitting-portion driving circuit is taken as $V_{COLAPSE}$ and when the maximum value of output voltage of the second driving circuit (cathode-electrode driving circuit) 34 is taken as $V_{OUT\text{-}MAX}$, $|V_{OUT\text{-}MAX}-V_{PD1}|<V_{COLAPSE}$ is satisfied. Otherwise, when the a breakdown current of the second driving circuit (cathode-electrode driving circuit) 34 which is the electron-emitting-portion driving circuit is taken as $I_{COLAPSE}$ and when the resistance value between the second driving circuit (cathode-electrode driving circuit) 34 and the cathode electrode 12 is taken as $R_{EMISSION}$, $|V_{OUT\text{-}MAX}-V_{PD1}|<R_{EMISSION}\cdot I_{COLAPSE}$ is satisfied. When the above expressions are satisfied, the destruction of the second driving circuit (cathode-electrode driving circuit) 34 by the first predetermined voltage $V_{PD1}$ can be prevented.

When a discharge starts between the anode electrode 24 and the gate electrode 14, the potential of the gate electrode 14 increases with the elapse of time. Since, however, the diode ($D_{11}$, $D_{21}$, $D_{31}$ . . . ) is disposed between such a gate electrode 14 and the first driving circuit (gate-electrode driving circuit) 34, damage of the first driving circuit 31 can be prevented. The potential of the gate electrode 14 increases with the elapse of time. As a result, the cathode electrode 12 causes discharging, and the cathode electrode 12 increases its potential. When the potential of the cathode electrode 12 comes to be the second predetermined voltage $V_{PD2}$ or higher, the discharge tube DC ($DC_1$, $DC_2$, $DC_3$ . . . ) constituting the electron-emitting-portion cutoff circuit 32B connected to such a cathode electrode 12 comes to be in a complete continuity state, and the cathode electrode 12 comes to have a potential of $V_{PD1}$. As a result, image display on a screen is partly not made in the flat-type display, but damage of the second driving circuit (cathode-electrode driving circuit) 34 can be reliably avoided. Further, permanent damage of the electron-emitting portion 16 can be prevented. When the potential of the cathode electrode 12 decreases to be lower than $V_{PD2}$, the discharge tube DC ($DC_1$, $DC_2$, $DC_3$ . . . ) constituting the electron-emitting-portion cutoff circuit 35B comes into a complete non-continuity state. As a result, the flat-type display automatically restores the operation of image display on a screen. The above operation is repeated until the discharge between the anode electrode 24 and the cathode electrode 12 disappears. If timers are connected to discharge tubes DC ($DC_1$, $DC_2$, $DC_3$ . . . ) constituting the electron-emitting-portion cutoff circuits 35B, the discharge tubes DC ($DC_1$, $DC_2$, $DC_3$ . . . ) are inhibited for a certain time period from coming into a complete non-continuity state, so that the discharge between the anode electrode 24 and the cathode electrode 12 can be more reliably removed.

FIG. 19 shows a constitution example in which the electron-emitting-portion cutoff circuit 35B comprises a Zener diode TD ($TD_1$, $TD_2$, $DC_3$ . . . ) in place of the discharge tube.

EXAMPLE 6

Example 6 is concerned with a variant of the flat-type display of Example 3.

FIG. 20 shows a conceptual drawing of the flat-type display of Example 6. This flat-type display is a variant of the flat-type display of Example 3 shown in FIG. 9. This flat-type display has a schematic partial end view similar to that shown in FIG. 11. In Example 6, an electron-emitting-portion cutoff circuit comprises first cutoff circuits 32C and second cutoff circuits 35C. The first cutoff circuit 32C and the second cutoff circuit 35C can be the same as those of the electron-emitting-portion cutoff circuit 32B in Example 4 and the electron-emitting-portion cutoff circuit 35B in Example 5, so that a detailed explanation thereof is omitted. In this embodiment, a first predetermined voltage is applied to discharge tubes DC constituting the first cutoff circuits 32C, and a first predetermined voltage is applied to discharge tubes DC constituting the second cutoff circuits 35C. Since these first predetermined voltages differ from each other, the first predetermined voltage applied to the discharge tubes DC constituting the first cutoff circuits 32C is shown as $V_{PD1}$, and the first predetermined voltage applied to the discharge tubes DC constituting the second cutoff circuits 35C is shown as $V'_{PD1}$. FIG. 21 schematically shows changes of an anode current and a cathode current when a discharge takes place. FIG. 22 shows a constitution example in which the cutoff circuits 32C and 35C comprise Zener diodes TD ($TD_{11}$, $TD_{21}$, $TD_{31}$ . . . , $TD_{12}$, $TD_{22}$, $TD_{32}$ . . . ) in place of the discharge tubes. Like the variant shown in FIG. 12 as a variant the flat-type display of Example 3, a diode ($D_{13}$, $D_{23}$, $D_{33}$ . . . ) may be disposed between the other end of the discharge tube DC ($DC_1$, $DC_2$, $DC_3$ . . . ) constituting the first cutoff circuit 32C and the gate electrode 14 (see FIG. 23). When the diode ($D_{13}$, $D_{23}$, $D_{33}$ . . . ) is disposed as described above, the gate electrode 14 causing no discharge comes to have a potential of $V_{PD1}$, and the occurrence of a discharge between the neighboring gate electrodes 14 due to a voltage difference between the neighboring gate electrodes 14 can be prevented. In FIG. 23, the discharge tubes DC may be replaced with the Zener diodes TD.

For preventing damage of the first driving circuit 31 caused by the first predetermined voltage $V_{PD1}$ and damage of the second driving circuit 34 caused by the first predetermined voltage $V_{PD1}$, preferably, the value of $|V_{PD1}-V'_{PD1}|$ satisfies the following expression, wherein $V_{G\text{-}SL}$ is a voltage to be applied to a selected gate electrode, $V'_{C\text{-}SL}$ is a minimum value of a voltage to be applied to a selected cathode electrode and $\alpha$ is a kind of safety factor and is any value of over 1, for example, 10 or less.

$$|V_{PD1}-V'_{PD1}|<\alpha<|V_{G\text{-}SL}-V'_{C\text{-}SL}|$$

EXAMPLE 7

Example 7 is concerned with the flat-type display (specifically, cold cathode field emission display) according to the second aspect of the present invention. FIG. 24 shows a conceptual drawing of the flat-type display of Example 7. This flat-type display has a schematic partial end view substantially similar to that of the flat-type display of Example 1 shown in FIG. 3 except that an anode-electrode cutoff circuit 38 is added, so that a detailed explanation thereof is omitted. Further, a first panel 10 can have the same constitution as that of a conventional first panel or the first panel explained in any one of Examples 1 to 6, so that a detailed explanation thereof is omitted.

The flat-type display of Example 7 comprises the first panel (cathode panel) 10 having the electron-emitting portions 16, the second panel (anode panel) 20 having the electron irradiation surface composed of the phosphor layers 22 and the anode electrode 24, and an anode-electrode driving circuit 37 for driving the anode electrode 24, and an anode-electrode cutoff circuit 38 is provided between the anode electrode 24 and the anode-electrode driving circuit 37 for preventing a discharge between the electron-emitting portion 16 and the electron irradiation surface.

In Example 7, the anode-electrode driving circuit 37 can have a known circuit constitution. When the flat-type display operates, a voltage $V_a$, for example, of DC 5 kV is applied to the anode electrode 24 from the anode-electrode driving circuit 37. The anode electrode 24 shown in FIG. 24 has a constitution in which an effective field is covered with an electrically conductive material having the form of one sheet.

An anode-electrode cutoff circuit 38 comprises an n-channel type MOS-type FET $TR_A$, a first resistance element $R_{A1}$ and a second resistance element $R_{A2}$. One source/drain region of the MOS-type FET $TR_A$ is connected to the anode electrode 24 through the first resistance element $R_{A1}$, and the other source/drain region is connected to the anode-electrode driving circuit 37. One end of the second resistance element $R_{A2}$ is connected to the anode electrode 24, and the other end is grounded. In Example 7, the first resistance element $R_{A1}$ had a resistance value of 100 Ω, and the second resistance element $R_{A2}$ had a resistance value of 5 MΩ. The gate region of the MOS-type FET $TR_A$ is connected to one end of a MOS-type FET driving power source $V_0$ (for example, 2 volts), and the other end thereof is connected to the anode electrode 24. There is used the MOS-type FET $TR_A$ that comes to be in a continuity state when a voltage of 2 volts or higher is applied to the gate region and comes to be in a non-continuity state when a voltage of 1 volt or lower is applied. A high-resistance element (not shown) for preventing the flow of an overcurrent may be disposed between the anode-electrode driving circuit 37 and the anode-electrode cutoff circuit 38.

It is supposed that an anode current is 1 mA when the flat-type display operates normally. In this case, there is only a voltage difference of 0.1 volt between the two ends of the first resistance element $R_{A1}$, and there is a voltage difference of 1.9 volts between the gate region and one source/drain region, and the MOS-type FET $TR_A$ is in a continuity state. That is, the anode electrode 24 and the anode-electrode driving circuit 37 are electrically connected through the anode-electrode cutoff circuit 38.

It is supposed that the anode electrode 24 causes a discharge to give a discharge current of 10 mA. In this case, the voltage difference between the two ends of the first resistance element $R_{A1}$ comes to be 1 volt, and the voltage difference between the gate region and one source/drain region comes to be 1.0 volt. As a result, the MOS-type FET $TR_A$ comes into a non-continuity state. That is, the anode-electrode cutoff circuit 38 operates to bring the anode electrode 24 and the anode-electrode driving circuit 37 into an electrically non-contact state. Further, the anode-electrode cutoff circuit 38 is allowed to operate by a current that flows between the anode electrode 24 and the anode-electrode driving circuit 37 due to a discharge that takes place between the electron-emitting portion 16 and the electron irradiation surface (specifically, anode electrode 24). Since the anode electrode 24 is grounded through the second resistance element $R_{A2}$, the potential of the anode electrode 24 decreases from 5 kV toward 0 volt, for example, several hundreds volts. As a result, the voltage difference between the anode electrode 24 and the electron-emitting portion 16 decreases, to terminate the discharge. The above operation is repeated until the discharge between the anode electrode 24 and the electron-emitting portion 16 is removed.

There are some cases where the second resistance element $R_{A2}$ can be omitted. The MOS-type FET $TR_A$ does not completely come into a non-continuity state, and in a practical case, a leak current exists even in a non-continuity state. When the MOS-type FET $TR_A$ comes into a non-continuity state, therefore, the potential of the anode electrode 24 decreases from 5 kV to 2 or 3 kV due to an influence of the leak current. Such a decrease in the potential of the anode electrode 24 is a sufficient potential decrease for the termination of the discharge.

Further, the anode electrode may be composed of a set of anode electrode units ($24_1$, $24_2$, $24_3$ . . . ) corresponding to one or a plurality of electron-emitting portions or one or a plurality of pixels, and all of the anode electrode units ($24_1$, $24_2$, $24_3$ . . . ) may be connected to the anode-electrode cutoff circuit 38 through one wiring.

FIG. 25 shows a variant of the flat-type display shown in FIG. 24. In this flat-type display, the anode electrode has a constitution in which it is composed of a set of anode electrode units ($24_1$, $24_2$, $24_3$ . . . ) corresponding to one or a plurality of electron-emitting portions or one or a plurality of pixels. The number of the anode-electrode cutoff circuits 38A that are provided is the same as the number of the anode electrode units ($24_1$, $24_2$, $24_3$ . . . ). The constitution of the anode-electrode cutoff circuit 38A can be the same as that of the anode-electrode cutoff circuit 38 shown in FIG. 24, so that a detailed explanation thereof is omitted.

FIG. 26 shows a variant of the flat-type display shown in FIG. 25. In this variant, the MOS-type FET driving power sources $V_0$ constituting the anode-electrode cutoff circuits 38A are formed as common elements. That is, the gate regions of the MOS-type FETs $TR_A$ constituting the anode-electrode cutoff circuits 38A are connected to one wiring. In this constitution, when a discharge takes place in one anode electrode unit to operate the anode-electrode cutoff circuit 38A connected to the anode electrode unit, all the other anode-electrode cutoff circuits 38A start operation, and the anode electrode as a whole is electrically cut off from the anode-electrode driving circuit 37.

FIG. 27 shows a variant of the flat-type display shown in FIG. 24. In this variant, a timer 39 constituted of a non-retriggerable-monostable multivibrater is connected to an anode-electrode cutoff circuit 38B. When the time 39 is connected as described above, the anode-electrode cutoff circuit 38B can be inhibited for a certain time period (for example, 1 to several milliseconds) from coming into a continuity state, so that a discharge between the anode electrode 24 and the electron-emitting portion 16 can be more reliably removed. FIG. 28A shows changes of potential of the anode electrode and an anode current when a discharge takes place when the timer 39 is provided, and FIG. 28B shows changes of potential of the anode electrode and an anode current when a discharge takes place when no timer 39 is provided.

EXAMPLE 8

Example 8 is concerned with the flat-type display (specifically, cold cathode field emission display) according to the third aspect of the present invention. FIG. 29 shows a conceptual drawing of the flat-type display of Example 8. This flat-type display has a schematic partial end view substantially similar to that of the flat-type display of Example 1 shown in FIG. 3 except that a shield member 40, a shield-member voltage-applying means 41 and a shield-member cutoff circuit 42 are added, so that a detailed explanation thereof is omitted. Further, a first panel 10 can have the same constitution as that of a conventional first panel or the first panel explained in any one of Examples 1 to 6, so that a detailed explanation thereof is omitted. Further, a second panel 20 can have the same constitution as that of a conventional second panel or any one of various second panels explained in Example 7 (constitution in which the anode-electrode cutoff circuit 38, 38A or 38B is provided between the anode electrode 24 and the anode-electrode driving circuit 37 for preventing a discharge between the shield member 40 and the electron irradiation surface), so that a detailed explanation thereof is omitted.

The flat-type display of Example 8 comprises a first panel 10 having electron-emitting portions 16; a second panel having an electron irradiation surface; electron-emitting-portion driving circuits 31 and 34 for driving the electron-emitting portions 16; a shield member 40 disposed between the electron-emitting portions 16 and the electron irradiation surface (specifically, anode electrode 24); and a shield-member voltage-applying means 41 (potential: $V_{CONV}$) for applying a voltage to the shield member 40. And, a shield-member cutoff circuit 42 is provided between the shield member 40 and the shield-member voltage-applying means 41 for preventing a discharge between the shield member 40 and the electron irradiation surface. Specifically, the second panel 20 comprises a substrate 21, phosphor layers 22 and the anode electrode 24.

In Example 8, the shield member 40 also works as a focus electrode. The shield member 40 may have a constitution in which an electrically conductive material having the form of one sheet is covered on an effective field or a constitution in which shield member units each of which corresponds to one or a plurality of electron-emitting portions or one or a plurality of pixels are collected. When the shield member has the former constitution, it is sufficient to provide one shield-member cutoff circuit. When the shield member has the latter constitution, it is sufficient to employ a constitution in which the number of shield-member cutoff circuits is the same as the number of the shield member units, or a constitution in which the shield member units are connected with one wiring and one shield-member cutoff circuit is connected to the wiring. The shield-member voltage-applying means 41 may be constituted of a known circuit. The shield member 40 is required to have opening portions through which electrons emitted from the electron-emitting portions 16 pass. Concerning these opening portions, one opening portion is made per electron-emitting portion 16, or one opening portion is made for a plurality of the electron-emitting portions 16.

In Example 8, the shield-member cutoff circuit 42 can be the same as the electron-emitting-portion cutoff circuit 32B explained in Example 4 or the electron-emitting-portion cutoff circuit 32 explained in Example 1. Specifically, the shield-member cutoff circuit 42 is constituted, for example, of a discharge tube DC as shown in FIG. 29. One end of the discharge tube DC is connected between the shield member 40 and the shield-member voltage-applying means 41, and a first predetermined voltage $V_{PD1}$ is applied to the other end thereof. When the potential of the shield member 40 comes to be a second predetermined voltage $V_{PD2}$ due to a discharge that takes place between the shield member 40 and the electron irradiation surface (specifically, anode electrode 24), the discharge tube DC constituting the shield-member cutoff circuit 42 operates on the basis of a voltage difference ($V_{PD2}-V_{PD1}$) between the first predetermined voltage and the second predetermined voltage. That is, when the potential of the shield member 40 comes to be the second predetermined voltage $V_{PD2}$ due to a discharge that takes place between the electron-emitting portion and the electron irradiation surface, the discharge tube DC constituting the shield-member cutoff circuit 42 operates.

When a breakdown voltage of the shield-member voltage-applying means 41 is taken as $V_{COLAPSE}$ and when the maximum value of output voltage of the shield-member voltage-applying means 41 is taken as $V_{OUT\text{-}MAX}$, $|V_{OUT\text{-}MAX}-V_{PD1}|<V_{COLAPSE}$ is satisfied. Otherwise, when the a breakdown current of the shield-member voltage-applying means 41 is taken as $I_{COLAPSE}$ and when the resistance value between the shield-member voltage-applying means 41 and the shield member 40 is taken as $R_{EMISSION}$, $|V_{OUT\text{-}MAX}-V_{PD1}|<R_{EMISSION}\ I_{COLAPSE}$ is satisfied. When the above expressions are satisfied, the destruction of the shield-member voltage-applying means 41 by the first predetermined voltage VPD1 can be prevented.

When a discharge starts between the anode electrode 24 and the shield member 40, the potential of the shield member 40 increases with the elapse of time. And, when the potential of the shield member 40 comes to be the second predetermined voltage $V_{PD2}$ or higher, the discharge tube DC constituting the shield-member cutoff circuit 42 connected to the shield member 40 comes into a continuity state, and the first predetermined voltage $V_{PD1}$ is applied to the shield member 40. As a result, damage of the shield-member voltage-applying means 41 can be reliably avoided. Further, no permanent damage is caused on the gate electrode 14 and the electron-emitting portion 16. When the potential of the shield-member cutoff circuit 42 decreases to be lower than VPD2, the discharge tube DC constituting the shield-member cutoff circuit 42 comes into a complete non-continuity state. The above operation is repeated until the discharge between the anode electrode 24 and the shield member 40 disappears. If a timer is connected to discharge tube DC constituting the shield-member cutoff circuit 42, the discharge tube DC constituting the shield-member cutoff circuit 42 can be inhibited for a certain time period from coming into a complete non-continuity state, so that the discharge between the anode electrode 24 and the shield member 40 can be more reliably removed.

FIG. 30 shows a constitution example in which the shield-member cutoff circuit 42 is constituted of a Zener diode TD in place of the discharge tube DC. As shown in FIG. 31, further, the discharge tube DC may be replaced with an n-channel type transistor $TR_{CONV}$ and a resistance element (Resistance $R_{CONV}$) as explained in Example 1. One source/drain region and a gate region of the transistor $TR_{CONV}$ are connected between the shield member 40 and the shield-member voltage-applying means 41, and the other source/drain region is grounded through the Resistance $R_{CONV}$. The operation of the transistor $TR_{CONV}$ is substantially the same as that of the transistor explained in Example 1 except that the relationship of operating voltage and potential differs, so that a detailed explanation thereof is omitted.

EXAMPLE 9

Example 9 uses a variant of the shield-member cutoff circuit 42 explained in Example 8. FIG. 32 shows a conceptual drawing of a flat-type display of Example 9. FIG. 33 schematically shows changes of potentials of the anode electrode 24 and the shield member 40 or a point X (see FIG. 32) on the basis of the occurrence of a discharge.

This flat-type display has a schematic partial end view substantially similar to that of the flat-type display of Example 1 shown in FIG. 3 except that the shield member 40, the shield-member voltage-applying means 41 and the shield-member cutoff circuit 42 are added, so that a detailed explanation thereof is omitted. Further, the constitution of a first panel 10 can be the same as that of a conventional first panel or any one of those various first panels explained in Examples 1 to 6, so that a detailed explanation thereof is omitted. Furthermore, the constitution of a second panel 20 can be the same as that of a conventional second panel or any one of those various second panels explained in Example 7 (constitution in which the anode-electrode cutoff circuit 38, 38A or 38B is provided between the anode electrode 24 and the anode-electrode driving circuit 37 for preventing a discharge between the shield member 40 and the electron irradiation surface), so that a detailed explanation thereof is omitted.

In Example 9, the shield member 40 also works as a focus electrode. The shield member 40 may have a constitution in which an electrically conductive material having the form of one sheet is covered on an effective field or a constitution in which shield member units each of which corresponds to one or a plurality of electron-emitting portions or one or a plurality of pixels are collected. When the shield member has the former constitution, it is sufficient to provide one shield-member cutoff circuit. When the shield member has the latter constitution, it is sufficient to employ a constitution in which the number of the shield-member cutoff circuits is the same as the number of the shield member units, or a constitution in which the shield member units are connected with one wiring and one shield-member cutoff circuit is connected to the wiring. The shield-member voltage-applying means 41 may be constituted of a known circuit. The shield member 40 is required to have opening portions through which electrons emitted from the electron-emitting portions 16 pass. Concerning these opening portions, one opening portion is made per electron-emitting portion 16, or one opening portion is made for a plurality of the electron-emitting portions 16.

In Example 9, the shield-member cutoff circuit 42A is constituted of a first discharge tube $DC_A$ one end of which is connected to the shield member 40 and the other end of which is connected to a first predetermined voltage $V_{PD1}$ and a second discharge tube $DC_B$ one end of which is connected to the shield member 40 and the other end of which is connected to the anode electrode 24. And, when the shield member 40 comes to have a potential of the second predetermined voltage $V_{PD2}$ due to a discharge that takes place between the shield member 40 and the electron irradiation surface (specifically, anode electrode 24), the discharge tubes $DC_A$ and $DC_B$ constituting the shield-member cutoff circuit 42A operate depending upon a voltage difference ($V_{PD2}-V_{PD1}$) between the first predetermined voltage and the second predetermined voltage. That is, when the potential of the shield member 40 comes to be the second predetermined voltage $V_{PD2}$ due to a discharge that takes place between the electron-emitting portion and the electron irradiation surface, the first discharge tube $DC_A$ and the second discharge tube $DC_B$ constituting the shield-member cutoff circuit 42 operate.

Specifically, there is employed, for example, a constitution in which the potential $V_{CONV}$ to be applied to the shield member 40 from the shield-member voltage-applying means 41 is −5 volts, the first predetermined voltage $V_{PD1}$ is −250 volts, the operation voltage of the first discharge tube $DC_A$ (voltage difference between the two ends of the discharge tube for bringing the discharge tube into a continuity state) is 300 volts, the operation voltage of the second discharge tube $DC_B$ is 5.1 kV, and the potential to be applied to the anode electrode 24 from the anode-electrode driving circuit 37 is 5 kV.

When a discharge starts between the anode electrode 24 and the shield member 40, the potential of the shield member 40 increases with the elapse of time. And, when the potential of the shield member 40 comes to be the second predetermined voltage $V_{PD2}$ [$V_{PD2}$ is a value that satisfies ($V_{PD2}-V_{PD1}$)≧(the operation voltage of the first discharge tube $DC_A$), and (300−250)=50 volts in this Example] or higher, the first discharge tube $DC_A$ constituting the shield-member cutoff circuit 42A connected to the shield member 40 comes into a continuity state, and the first predetermined voltage ($V_{PD1}$=−250 volts) is applied to the shield member 40. At the same time, the voltage difference between the two ends of the second discharge tube $DC_B$ comes to be (5000+250) volts, the second discharge tube $DC_B$ also comes into a continuity state, and the anode electrode 24 comes to have a potential of −250 volts. As a result, damage of the shield-member voltage-applying means 41 can be reliably avoided, and permanent damage is not caused on the gate electrode 14 and the electron-emitting portion 16. When the potential of the shield-member cutoff circuit 42A decreases to be lower than $V_{PD2}$, the first discharge tube $DC_A$ constituting the shield-member cutoff circuit 42A comes into a complete non-continuity state, and further, the second discharge tube $DC_B$ also comes into a complete non-continuity state. The above operation is repeated until the discharge between the anode electrode 24 and the shield member 40 is removed. If a timer is connected to the first discharge tube $DC_A$ constituting the shield-member cutoff circuit 42A, the first discharge tube $DC_A$ constituting the shield-member cutoff circuit 42A can be inhibited for a certain time period from coming into a complete non-continuity state, so that the discharge between the anode electrode 24 and the shield member 40 can be more reliably removed.

FIG. 34 shows a conceptual drawing of a flat-type display having a variant of the shield-member cutoff circuit 42A shown in FIG. 32. In the shield-member cutoff circuit 42A shown in FIG. 32, the discharge tube $DC_B$ is disposed at one step between the shield member 40 and the anode electrode 24. In the shield-member cutoff circuit 42B shown in FIG. 34, discharge tubes (second discharge tube $DC_B$ and third discharge tube $DC_C$) are disposed at two steps between the shield member 40 and the anode electrode 24.

That is, the shield-member cutoff circuit 42B is constituted of a first discharge tube $DC_A$ one end of which is connected to the shield member 40 and the other end of which is connected to the first predetermined voltage $V_{PD1}$; a second discharge tube $DC_B$ one end of which is connected to the shield member 40 and the other end of which is connected to one end of a third discharge tube $DC_C$ and further connected to a third predetermined voltage $V_{PD3}$; and the third discharge tube $DC_C$ the other end of which is connected to the anode electrode 24. And, when the shield member 40 comes to have a potential of the second predetermined voltage $V_{PD2}$ due to a discharge that takes place between the shield member 40 and the electron irradiation surface (specifically, anode electrode 24), the discharge tubes $DC_A$, $DC_B$ and $DC_C$ constituting the shield-member cutoff circuit 42B operate depending upon a voltage difference ($V_{PD2}-V_{PD1}$) between the first predetermined voltage and the second predetermined voltage. That is, when the shield member 40 comes to have a potential of the second predetermined voltage $V_{PD2}$ due to a discharge between the electron-emitting portion and the electron irradiation surface, the first discharge tube $DC_A$, the second discharge tube $DC_B$ and the third discharge tube $DC_C$ constituting the shield-member cutoff circuit 42B operate.

Specifically, there is employed, for example, a constitution in which the potential $V_{CONV}$ to be applied to the shield member 40 from the shield-member voltage-applying means 41 is −5 volts, the first predetermined voltage $V_{PD1}$ is −250 volts, the third predetermined voltage $V_{PD3}$ is 4 kV, the operation voltage of the first discharge tube $DC_A$ is 300 volts, the operation voltage of each of the second discharge tube $DC_B$ and the third discharge tube $DC_C$ is 4.1 kV, and the potential to be applied to the anode electrode 24 from the anode-electrode driving circuit 37 is 8 kV.

When a discharge starts between the anode electrode 24 and the shield member 40, the potential of the shield member 40 increases with the elapse of time. And, when the potential of the shield member 40 comes to be the second predetermined voltage $V_{PD2}$ [$V_{PD2}$ is a value that satisfies ($V_{PD2}-V_{PD1}$)≧(the operation voltage of the first discharge tube $DC_A$), and (300−250)=50 volts in this Example] or higher, the first discharge tube $DC_A$ constituting the shield-member cutoff circuit 42B connected to the shield member 40 comes into a continuity state, and the first predetermined voltage ($V_{PD1}$=−250 volts) is applied to the shield member 40. At the same time, the voltage difference between the two ends of the second discharge tube $DC_B$ comes to be (4000+250) volts, the second discharge tube $DC_B$ also comes into a continuity state, and the other end of the second discharge tube $DC_B$ comes to have a potential of −250 volts. Further, the voltage difference between the two ends of the third discharge tube $DC_C$ exceeds the operation voltage, so that the third discharge tube $DC_C$ comes into a continuity state and the anode electrode 24 also comes to have a potential of −250 volts. As a result, damage of the shield-member voltage-applying means 41 can be reliably avoided, and permanent damage is not caused on the gate electrode 14 and the electron-emitting portion 16. When the potential of the shield-member cutoff circuit 42B decreases to be lower than $V_{PD2}$, the first discharge tube $DC_A$ constituting the shield-member cutoff circuit 42B comes into a complete non-continuity state, and further, the second discharge tube $DC_B$ and the third discharge tube $DC_C$ also come into a complete non-continuity state. The above operation is repeated until the discharge between the anode electrode 24 and the shield member 40 is removed. If a timer is connected to the first discharge tube $DC_A$ constituting the shield-member cutoff circuit 42B, the first discharge tube $DC_A$ constituting the shield-member cutoff circuit 42B can be inhibited for a certain time period from coming into a complete non-continuity state, so that the discharge between the anode electrode 24 and the shield member 40 can be more reliably removed.

In the shield-member cutoff circuits 42A and 42B shown in FIGS. 32 and 34, start of a discharge is detected as an increase in potential. Alternatively, it can be also detected as an increase in leak current that flows between the anode electrode 24 and the shield member 40. FIG. 35 shows a conceptual drawing of a flat-type display having a shield-member cutoff circuit 42C having such a constitution.

The shield-member cutoff circuit 42C is constituted of a first discharge tube $DC_D$ one end of which is connected to the shield member 40 and the other end of which is connected to the first predetermined voltage $V_{PD1}$; and a second discharge tube $DC_E$ one end of which is connected to the anode electrode 24 and the other end of which is connected to one end of the first discharge tube $DC_D$. A resistance $R_4$ is disposed between the shield-member voltage-applying means 41 and the shield member 40, and a resistance $R_5$ is disposed between the anode-electrode driving circuit 37 and the anode electrode 24. And, when the shield member 40 has a potential of the second predetermined voltage $V_{PD2}$ due to a discharge that takes place between the shield member 40 and the electron irradiation surface (specifically, anode electrode 24), the discharge tubes $DC_D$ and $DC_E$ constituting the shield-member cutoff circuit 42C operate depending upon a voltage difference ($V_{PD2}-V_{PD1}$) between the first predetermined voltage and the second predetermined voltage. That is, when the shield member 40 has a potential of the second predetermined voltage $V_{PD2}$ due to a discharge that takes place between the electron-emitting portion and the electron irradiation surface, the first discharge tube $DC_D$ and the second discharge tube $DC_E$ constituting the shield-member cutoff circuit 42C operate.

Specifically, there is employed, for example, a constitution in which the potential $V_{CONV}$ to be applied to the shield member 40 from the shield-member voltage-applying means 41 is 0 volt, the first predetermined voltage $V_{PD1}$ is −100 volts, the operation voltage of the first discharge tube $DC_D$ is 200 volts, the operation voltage of the second discharge tube $DC_E$ is 7.1 kV, the potential to be applied to the anode electrode 24 from the anode-electrode driving circuit 37 is 7 kV and the resistance value of each of the resistances $R_4$ and $R_5$ is 1 MΩ.

When a discharge starts between the anode electrode 24 and the shield member 40 to allow current (leak current) of 0.1 mA to flow between the anode electrode 24 and the shield member 40, the potential of the shield member 40 comes to be the second predetermined voltage $V_{PD2}$ [$V_{PD2}$ is a value that satisfies $(V_{PD2}-V_{PD1})\geqq$(the operation voltage of the first discharge tube $DC_D$), and (200−100)=100 volts in this Example]. As a result, the voltage difference between the two ends of the first discharge tube $DC_D$ comes to be 200 volts, the first discharge tube $DC_D$ constituting the shield-member cutoff circuit 42C connected to the shield member 40 comes into a continuity state, and the first predetermined voltage ($V_{PD1}$=−100 volts) is applied to the shield member 40. At the same time, the voltage difference between the two ends of the second discharge tube $DC_E$ comes to be 7.1 kV, and the second discharge tube $DC_E$ also comes into a continuity state. As a result, damage of the shield-member voltage-applying means 41 can be reliably avoided, and permanent damage is not caused on the gate electrode 14 and the electron-emitting portion 16. Then, when a voltage drop is caused with the resistance $R_5$ to bring the voltage difference between the two ends of the second discharge tube $DC_E$ into less than 7.1 kV, the second discharge tube $DC_E$ constituting the shield-member cutoff circuit 42C comes into a complete non-continuity state, and further, the first discharge tube $DC_D$ also comes into a complete non-continuity state. The above operation is repeated until the discharge between the anode electrode 24 and the shield member 40 is removed. If a timer is connected to the second discharge tube $DC_E$ constituting the shield-member cutoff circuit 42C, the second discharge tube $DC_E$ constituting the shield-member cutoff circuit 42C can be inhibited for a certain time period from coming into a complete non-continuity state, so that the discharge between the anode electrode 24 and the shield member 40 can be more reliably removed.

EXAMPLE 10

Various field emission devices will be explained hereinafter. A flat-type display using any one of these field emission devices can be any one of the flat-type displays according to the first to third aspects of the present invention including the various variants thereof or any one of the flat-type displays according to the first to third constitutions including the various variants.

[Spindt-Type Field Emission Device]

FIG. 37B shows a schematic partial end view of a field emission device having the first structure formed of a Spindt-type field emission device. The Spindt-type field emission device comprises a cathode electrode 12 formed on a support member 11; an insulating layer 13 formed on the support member 11 and the cathode electrode 12; a gate electrode 14 formed on the insulating layer 13; an opening portion 15 formed through the gate electrode 14 and the insulating layer 13; and a conical electron emission electrode 16A formed on the cathode electrode 12 positioned in a bottom portion of the opening portion 15. The conical electron emission electrode 16A exposed in the bottom portion of the opening portion 15 corresponds to the electron-emitting portion 16.

The method of producing the Spindt-type field emission device is basically a method in which the conical electron emission electrode 16A is formed by vertical deposition of a metal material. That is, vaporized particles enter perpendicularly to the opening portion 15. The vaporized particles which reach the bottom portion of the opening portion 15 are gradually decreased in amount by utilizing a shielding effect of an overhanging deposit formed in the vicinity of edge portion of the opening portion 15, whereby the electron emission electrode 16A as a conical deposit is formed in a self-aligned manner. The method in which a peel layer 17 is formed on the insulating layer 13 and the gate electrode 14 beforehand for making it easy to remove the unnecessary overhanging deposit will be outlined with reference to FIGS. 36A, 36B, 37A and 37B showing schematic partial end views of the support member, etc., hereinafter.

[Step-100]

First, a stripe-shaped cathode electrode 12 made of niobium (Nb) is formed on a support member 11 which is made, for example, of glass, and an insulating layer 13 made of $SiO_2$ is formed on the entire surface. Further, a gate electrode 14 is formed on the insulating layer 13. The gate electrode 14 can be formed, for example, by a sputtering method, lithography and a dry etching method. Then, an opening portion 15 is formed in the gate electrode 14 and the insulating layer 13 by an RIE (reactive ion-etching) method, to expose the cathode electrode 12 in a bottom portion of the opening portion 15 (see FIG. 36A). The cathode electrode 12 may be a single material layer, or it may be a stack of a plurality of material layers. For suppressing the fluctuation of electron emission characteristics of the electron emission electrodes to be formed at a step to come later, the surface layer portion of the cathode electrode 12 can be made of a material having a higher electric resistivity than a material forming a remaining portion.

[Step-110]

Then, the electron emission electrode 16A is formed on the cathode electrode 12 exposed in the bottom of the opening portion 15. Specifically, aluminum is obliquely deposited, to form a peel layer 17. In this case, a sufficiently large incidence angle of vaporized particles with regard to a normal of the support member 11 is set, whereby the peel layer 17 can be formed on the gate electrode 14 and the insulating layer 13 almost without depositing aluminum in the bottom portion of the opening portion 15. The peel layer 17 extends from the opening edge portion of the opening portion 15 like eaves, whereby the opening portion 15 is substantially decreased in diameter (see FIG. 36B).

[Step-120]

Then, for example, molybdenum (Mo) is vertically deposited on the entire surface. In this case, as shown in FIG. 37A, with the growth of an electrically conductive material layer 18 having an overhanging form on the peel layer 17, the substantial diameter of the opening portion 15 is gradually decreased, so that vaporized particles which serve to deposition on the bottom portion of the opening portion 15 gradually come to be limited to particles which pass by the center of the opening portion 15. As a result, a conical deposit is formed on the bottom portion of the opening portion 15, and the conical deposit made of molybdenum constitutes the electron emission electrode 16A.

Then, the peel layer 17 is peeled off the surfaces of the insulating layer 13 and the gate electrode 14 by an electrochemical process and a wet process, and the electrically conductive material layer 18 on the insulating layer 13 and the gate electrode 14 is selectively removed. As a result, the conical electron emission electrode 16A can be retained on the cathode electrode 12 positioned in the bottom portion of the opening portion 15 as shown in FIG. 37B.

The first panel (cathode panel) 10 having a large number of the above field emission devices and the second panel (anode panel) 20 are combined, whereby the flat-type display shown in FIG. 3 can be obtained. Specifically, an approximately 1 mm high frame made, for example, of a ceramic or glass is provided, the frame, the first panel 10 and the second panel 20 are bonded, for example, with a frit glass, and the frit glass is dried, then followed by calcining or sintering the frit glass at approximately 450° C. for 10 to 30 minutes. Then, the inner space of the flat-type display is vacuumed until it has a vacuum degree of approximately $10^{-4}$ Pa, and then the space is sealed by a proper method. Otherwise, the frame, the first panel 10 and the second panel 20 may be bonded in a high-vacuum atmosphere. Otherwise, for some structure of the flat-type display, the first panel 10 and the second panel 20 may be bonded to each other without the frame.

One example of the method of producing the second panel 20 will be explained below with reference to FIGS. 38A to 38D. First, a composition of luminescence crystal particles is prepared. For this purpose, for example, a dispersing agent is dispersed in pure water, and the dispersion is stirred with a homomixer at 3000 rpm for 1 minute. Then, luminescence crystal particles are poured into a dispersion of the dispersing agent in the pure water, and the mixture is stirred with a homomixer at 5000 rpm for 5 minutes. Then, for example, polyvinyl alcohol and ammonium bichromate are added, and the mixture is fully stirred and filtered.

In the production of the second panel 20, a photosensitive film 50 is formed (applied) on the entire surface of the substrate 21 made, for example, of glass. The photosensitive film 50 is exposed to light which comes from a light source (not shown) and passes through an opening 54 formed in a mask 53, to form an exposed region 51 (see FIG. 38A). Then, the photosensitive film 50 is selectively removed by development, to retain a remaining portion 52 of the photosensitive film (exposed and developed photosensitive film) on the substrate 21 (see FIG. 38B). Then, a carbon agent (carbon slurry) is applied onto the entire surface, and the applied carbon agent is dried and calcined. Then, the remaining portion 52 of the photosensitive film and the carbon agent thereon are removed by a lift-off method, to form a black matrix 23 made of the carbon agent on the exposed substrate 21 and the remaining portion 52 of the photosensitive film is removed (see FIG. 38C). Then, red, green and blue phosphor layers 22 (22R, 22G, 22B) are formed on the exposed substrate 21 (see FIG. 38D). Specifically, compositions of luminescence crystal particles are prepared from the luminescence crystal particles (phosphor particles). For example, a photosensitive composition of red luminescence crystal particles (phosphor slurry) is applied onto the entire surface, followed by exposure and development. A photosensitive composition of green luminescence crystal particles (phosphor slurry) is applied onto the entire surface, followed by exposure and development. Further, a photosensitive composition of blue luminescence crystal particles (phosphor slurry) is applied onto the entire surface, followed by exposure and development. Then, an anode electrode 24 made of a thin aluminum film having a thickness of approximately 0.07 $\mu$m is formed on the phosphor layers 22 and the black matrix 23 by a sputtering method. Alternatively, each phosphor layer 22 can be formed by a screen-printing method, or the like.

The anode electrode may have a constitution in which an electrically conductive material having the form of one sheet is covered on an effective field or a constitution in which anode electrode units each of which corresponds to one or a plurality of the electron-emitting portions or one or a plurality of the pixels are collected. In the flat-type display according to the first or third aspect of the present invention, when the anode electrode has the former constitution, it is sufficient to connect the anode-electrode driving circuit to the anode electrode. When the anode electrode has the latter constitution, it is sufficient to connect the anode-electrode driving circuit to each of the anode electrode units. In the flat-type display according to the second aspect of the present invention, when the anode electrode has the former constitution, it is sufficient to provide one anode-electrode cutoff circuit, and when the anode electrode has the latter constitution, it is sufficient to employ a constitution in which the number of anode-electrode cutoff circuits is the same as the number of the anode electrode units.

[Crown-Type Field Emission Device]

FIG. 41A shows a schematic partial end view of the field emission device having the first structure which device is a crown-type field emission device, and FIG. 41B shows a partially cut-out schematic perspective view thereof. The crown-type field emission device comprises a cathode electrode 12 formed on a support member 11; an insulating layer 13 formed on the support member 11 and the cathode electrode 12; a gate electrode 14 formed on the insulating layer 13; an opening portion 15 formed through the gate electrode 14 and the insulating layer 13; and a crown-type electron emission electrode 16B formed on a portion of the cathode electrode 12 which portion is positioned in a bottom portion of the opening portion 15. The crown-type electron emission electrode 16B exposed in the bottom of the opening portion 15 corresponds to the electron-emitting portion 16.

The method of producing the crown-type field emission device will be explained below with reference to FIGS. 39A, 39B, 40A, 40B, 40C, 41A and 41B showing schematic partial end views, etc., of the support member and the like.

[Step-200]

First, the stripe-shaped cathode electrode 12 is formed on the support member 11 made, for example, of glass. The cathode electrode 12 extends leftward and rightward on paper surface of drawings. The stripe-shaped cathode electrode 12 can be formed, for example, by forming an approximately 0.2 $\mu$m thick ITO film on the entire surface of the support member 11 by a sputtering method and then patterning the ITO film. The cathode electrode 12 can be a single material layer or a stacked layer constituted of a plurality of material layers. For example, for suppressing the fluctuation of electron emission characteristics of the electron emission electrodes to be formed at a step to come later, the surface layer portion of the cathode electrode 12 may be made of a material having a higher electric resistivity than a material constituting a remaining portion. Then, the insulating layer 13 is formed on the support member 11 and the cathode electrode 12. In this embodiment, for example, a glass paste is screen-printed on the entire surface to form a layer having a thickness of approximately 3 $\mu$m. Then, for removing water and a solvent contained in the insulating layer 13 and flattening the insulating layer 13, two-stage procedures of calcining such as temporary calcining at 100° C. for 10 minutes and main calcining at 500° C. for 20 minutes are carried out. The above screen-printing using a glass paste may be replaced with the formation of an $SiO_2$ film, for example, by a plasma CVD method.

Then, the stripe-shaped gate electrode 14 is formed on the insulating layer 13 (see FIG. 39A). The gate electrode 14 is extending in the direction perpendicular to the paper surface of drawings. The gate electrode 14 can be formed, for example, by forming an approximately 20 nm thick chromium (Cr) film and a 0.2 $\mu$m thick gold (Au) film on the insulating layer 13 in this order by an electron beam deposition method and then patterning this stacked films. The chromium film is formed for offsetting adhesion deficiency of the gold film to the insulating layer 13. The extending direction of projection image of the gate electrode 14 forms an angle of 90° with the extending direction of projection image of the stripe-shaped cathode electrode 12.

[Step-210]

The gate electrode 14 and the insulating layer 13 are etched through an etching mask made, for example, of a photoresist material according to an RIE method, to form an opening portion 15 through the gate electrode 14 and the insulating layer 13 and to expose the cathode electrode 12 in the bottom portion of the opening portion 15 (see FIG. 39B). The opening portion 15 has a diameter of approximately 2 to 50 $\mu$m.

[Step-220]

Then, the etching mask is removed, and a peel layer 60 is formed on the gate electrode 14, the insulating layer 13 and the side wall surface of the opening portion 15 (see FIG. 40A). The above peel layer 60 is formed, for example, by applying a photoresist material onto the entire surface by a spin coating method and patterning the photoresist material layer such that only part (central part) on the bottom portion of the opening portion 15 is removed. At this stage, the diameter of the opening portion 15 is substantially decreased to approximately 1 to 20 $\mu$m.

[Step-230]

Then, as shown in FIG. 40B, an electrically conductive composition layer 61 composed of composition material is formed on the entire surface. The above composition material contains, for example, 60% by weight of graphite particles having an average particle diameter of approximately 0.1 $\mu$m as electrically conductive particles and 40% by weight of No. 4 water glass as a binder. The composition material is spin-coated on the entire surface, for example, at 1400 rpm for 10 seconds. The surface of the electrically conductive composition layer 61 in the opening portion rises along the side wall surface of the opening portion 15 and dents toward the central portion of the opening portion 15 due to the surface tension of the composition material. Then, temporary calcining for removing water contained in the electrically conductive composition layer 61 is carried out, for example, in atmosphere at 400° C. for 30 minutes.

In the composition material, (1) the binder may be a dispersing medium for forming a dispersion of the electrically conductive particles in itself, or (2) the binder may coat each electrically conductive particle, or (3) the binder may constitute a dispersing medium for the electrically conductive particles when the binder is dispersed or dissolved in a proper solvent. A typical example of the above case (3) is water glass, and the water glass can be selected from Nos. 1 to 4 defined under Japan Industrial Standard (JIS) K1408 or products equivalent thereto. Nos. 1 to 4 refer to four grades based on different molar amounts (approximately 2 to 4 moles) of silicon oxide ($SiO_2$) per mol of sodium oxide ($Na_2O$) which is a component of water glass, and they differ from one another in viscosity. When water glass is used in a lift-off process, therefore, it is preferred to select an optimum water glass while taking into account various conditions such as a kind and a content of the electrically conductive particles to be dispersed in water glass, affinity to the peel layer 60, an aspect ratio of the opening portion 15, and the like, or it is preferred to prepare water glass equivalent to water glass having such a grade before use.

The binder is generally poor in electric conductivity. When the content of the binder is too large relative to the content of the electrically conductive particles in the composition material, therefore, the electron emission electrode 16B formed may show an increase in electric resistance value, and electron emission may not proceed smoothly. For example, in a composition material which is a dispersion of carbon-containing material particles as electrically conductive particles in water glass, the content of the carbon-containing material particles based on the total amount of the composition material is preferably determined to be in the range of approximately 30 to 95% by weight while taking into account properties such as an electric resistance value of the electron emission electrode 16B, a viscosity of the composition material and mutual adhesion of the electrically conductive particles. When the content of the carbon-containing material particles is selected from the above range, the electric resistance value of the electron emission electrode 16B formed can be sufficiently decreased, and the mutual adhesion of the carbon-containing material particles can be maintained under a good condition. However, when a mixture of carbon-containing material particles with alumina particles is used as electrically conductive particels, the mutual adhesion of the electrically conductive particles is liable to decrease, so that it is preferred to increase the content of the carbon-containing material particles depending upon the content of the alumina particles. The content of the carbon-containing material particles is particularly preferably 60% by weight or more. The composition material may contain a dispersing agent for stabilizing the dispersing state of the electrically conductive particles and additives such as a pH adjuster, a desiccant, a curing agent and an antiseptic. There may be used a composition material prepared by coating the electrically conductive particles with a binder to prepare a powder and dispersing the powder in a proper dispersing medium.

For example, when the crown-shaped electron emission electrode 16B has a diameter of approximately 1 to 20 $\mu$m and when carbon-containing material particles are used as electrically conductive particles, preferably, the particle diameter of the carbon-containing material particles is approximately in the range of from 0.1 $\mu$m to 1 $\mu$m. When the particle diameter of the carbon-containing material particles is in the above range, an edge portion of the crown-shaped electron emission electrode 16B is imparted with sufficiently high mechanical strength, and the adhesion of the electron emission electrode 16B to the cathode electrode 12 comes to be excellent.

[Step-240]

Then, as shown in FIG. 40C, the peel layer 60 is removed. The peeling is carried out by immersion in a 2 wt % sodium hydroxide aqueous solution for 30 seconds. The peeling may be carried out under ultrasonic vibration. In this manner, the peel layer 60 and part of the electrically conductive composition layer 61 on the peel layer 60 are removed together, and only that portion of the electrically conductive composition layer 61 which is on the exposed cathode electrode 12 in the bottom portion of the opening portion 15 remains. The above remaining portion constitutes the electron emission electrode 16B. The electron emission electrode 16B has a surface denting toward the central portion of the opening portion 15 and comes to have the form of a crown. FIGS. 41A and 41B show a state after [Step-240] is finished. FIG. 41B is a schematic perspective view of part of the field emission device, and FIG. 41A is a schematic partial end view taken along line A—A in FIG. 41B. In FIG. 41B, part of the insulating layer 13 and part of the gate electrode 14 are cut out for showing the whole of the electron emission electrode 16B. It is sufficient to form approximately 5 to 100 electron emission electrodes 16B in one overlap region. For reliably exposing the electrically conductive particles on the surface of each electron emission electrode 16B, a binder exposed on the surface of each electron emission electrode 16B may be removed by etching.

[Ste-250]

Then, the electron emission electrode 16B is calcined. The calcining is carried out in dry atmosphere at 400° C. for 30 minutes. The calcining temperature can be selected depending upon the binder contained in the composition material. For example, when the binder is inorganic material such as water glass, it is sufficient to carry out heat treatment at a temperature at which the inorganic material can be calcined. When the binder is a thermosetting resin, the heat treatment can be carried out at a temperature at which the thermosetting resin can be cured. For maintaining mutual adhesion of the electrically conductive particles, however, the heat treatment is preferably carried out at a temperature at which the thermosetting resin is neither decomposed to excess nor carbonized. In either case, the heat treatment temperature is required to be a temperature at which neither damage nor a defect is caused on the gate electrode, the cathode electrode and the insulating layer. The heat treatment atmosphere is preferably an inert gas atmosphere for preventing an oxidation from causing an increase in the electric resistivity of the gate electrode and the cathode electrode and for preventing the gate electrode and the cathode electrode from suffering damage or defects. When a thermoplastic resin is used as a binder, no heat treatment may be required in some case.

[Plane-Type Field Emission Device (No. 1)

FIG. 42C shows a schematic partial cross-sectional view of a field emission device having the first structure which device is a plane-type field emission device. The plane-type field emission device comprises a cathode electrode 12 formed on a support member 11 made, for example, of glass; an insulating layer 13 formed on the support member 11 and the cathode electrode 12; a gate electrode 14 formed on the insulating layer 13; an opening portion 15 formed through through the gate electrode 14 and the insulating layer 13; and a flat electron emission electrode 16C formed on a portion of the cathode electrode 12 which portion is positioned in the bottom portion of the opening portion 15. The electron emission electrode 16C is formed on the stripe-shaped cathode electrode 12 extending in the direction perpendicular to the paper surface of FIG. 42C. Further, the gate electrode 14 is extending leftward and rightward on the paper surface of FIG. 42C. The cathode electrode 12 and the gate electrode 14 are made of chromium (Cr). Specifically, the electron emission electrode 16C is constituted of a thin layer made of a graphite powder. A resistance layer 62 made of SiC is formed between the cathode electrode 12 and the electron emission electrode 16C for stabilizing the performance of the field emission device and attaining uniform electron emission characteristics. In the plane-type field emission device shown in FIG. 42C, the resistance layer 60 and the electron emission electrode 16C are formed all over the surface of the cathode electrode 12. However, the present invention shall not be limited to such a structure, and it is sufficient to form the electron emission electrode 16C at least in the bottom portion of the opening portion 15.

The method of producing the plane-type field emission device will be explained hereinafter with reference to FIGS. 42A, 42B and 42C showing the schematic partial cross-sectional views of the support member, etc.

[Step-300]

An electrically conductive material layer made of chromium (Cr) for a cathode electrode is formed on the support member 11 by a sputtering method and patterned by lithography and a dry etching method, whereby the stripe-shaped cathode electrode 12 can be formed on the support member 11 (see FIG. 42A). The cathode electrode 12 is extending in the direction perpendicular to the paper surface of FIG. 42A.

[Step-310]

Then, the electron emission electrode 16C is formed on the cathode electrode 12. Specifically, the resistance layer 62 made of SiC is formed on the entire surface by a sputtering method. Then, the electron emission electrode 16C made of a graphite powder coating is formed on the resistance layer 62 by a spin coating method and is dried. Then, the electron emission electrode 16C and the resistance layer 62 are patterned by a known method (see FIG. 42B). The electron-emitting portion is formed of the electron emission electrode 16C.

[Step-320]

Then, the insulating layer 13 is formed on the entire surface. Specifically, the insulating layer 13 made of $SiO_2$ is formed on the electron emission electrode 16C and the support member 11, for example, by a sputtering method. Alternatively, the insulating layer 13 may be formed by a method in which a glass paste is screen-printed or by a method in which a layer of $SiO_2$ is formed by a CVD method. Then, the stripe-shaped gate electrode 14 is formed on the insulating layer 13.

[Step-330]

Then, after an etching mask is formed, the opening portion 15 is formed through the gate electrode 14 and the insulating layer 13 to expose the electron emission electrode 16C in the bottom portion of the opening portion 15. Then, the etching mask is removed and heat treatment is carried out at 400° C. for 30 minutes for removing an organic solvent in the electron emission electrode 16C, whereby the field emission device shown in FIG. 42C can be obtained.

[Plane-Type Field Emission Device (No. 2)]

FIG. 43C shows a schematic partial cross-sectional view of a variant of the field emission device having the first structure which device is a plane-type field emission device. The plane-type field emission device shown in FIG. 43C differs from the plane-type field emission device shown in FIG. 42C in the structure of the electron emission electrode 16C to some extent. The method of producing such a field emission device will be explained below with reference to FIGS. 43A, 43B and 43C showing schematic partial cross-sectional views of a support member, etc.

[Step-400]

First, the electrically conductive material layer for a cathode electrode is formed on the support member 11. Specifically, a resist material layer (not shown) is formed on the entire surface of the support member 11, and the resist material layer is removed from a portion where the cathode electrode is to be formed. Then, the electrically conductive material layer made of chromium (Cr) for a cathode electrode is formed on the entire surface by a sputtering method. Further, the resistance layer 62 made of SiC is formed on the entire surface by a sputtering method, and a graphite powder coating layer is formed on the resistance layer 62 by a spin coating method and is dried. Then, the resist material layer is removed with a peeling solution. In this case, the electrically conductive material layer for a cathode electrode, the resistance layer 62 and the graphite powder coating layer, which are formed on the resist material layer, are also removed. In this manner, a structure in which the cathode electrode 12, the resistance layer 62 and the electron emission electrode 16C are stacked can be obtained according to a so-called lift-off method (see FIG. 43A).

[Step-410]

Then, the insulating layer 13 is formed on the entire surface, and the stripe-shaped gate electrode 14 is formed on the insulating layer 13 (see FIG. 43B). Then, the opening portion 15 is formed through the gate electrode 14 and the insulating layer 13 to expose the electron emission electrode 16C in the bottom portion of the opening portion 15 (see FIG. 43C). The electron emission electrode 16C formed on the surface of the cathode electrode 12 which surface is exposed in the bottom portion of the opening portion 15 corresponds to the electron-emitting portion.

[Plane-Type Field Emission Device (No. 3)]

FIG. 45B shows a schematic partial end view of another variant of the field emission device having the first structure formed of a plane-type field emission device. In the plane-type field emission device, the electron emission electrode 16D is constituted of a thin carbon film formed by a CVD method.

It is preferred to use a thin carbon film to constitute the electron-emitting portion, since carbon (C) has a low work function and can serve to attain a high current of emitted electrons. For allowing the thin carbon film to emit electrons, it is sufficient to bring the thin carbon film into a state where the thin carbon film is placed in a proper electric field (for example, an electric field having an intensity of approximately $10^6$ volts/m).

When a thin carbon film such as a thin diamond film is plasma-etched with oxygen gas with using a resist layer as an etching mask, a deposition product of a $(CH_x)$- or $(CF_x)$-based carbon polymer is generated as a reaction byproduct in the etching reaction system. When a deposition product is generated in the etching reaction system in the plasma etching, generally, the deposition product is formed on a side wall surface of a resist layer which side wall surface has a low ion incidence probability or is formed on a processed end surface of a material being etched, to form a so-called side wall protective film, and it contributes to accomplishment of the form obtained by anisotropic processing of a material being etched. When oxygen gas is used as an etching gas, however, the side wall protective film made of the carbon polymer is removed by oxygen gas upon the formation thereof. Further, when oxygen gas is used as an etching gas, the resist layer is worn to a great extent. For these reasons, in the conventional oxygen plasma process of a diamond thin film, the pattern transfer difference of the diamond thin film from the mask is large, and an anisotropic processing is also difficult in many cases.

For overcoming the above problems, for example, it is sufficient to employ a constitution in which a thin-carbon-film selective-growth region is formed in the surface of the cathode electrode and an electron-emitting portion made of a thin carbon film is formed on the thin-carbon-film selective-growth region. That is, in the production of the above field emission device, the cathode electrode is formed on the support member, then, the thin-carbon-film selective-growth region is formed in the surface of the cathode electrode and then the thin carbon film (corresponding to the electron-emitting portion) is formed on the thin-carbon-film selective-growth region. The step of forming the thin-carbon-film selective-growth region in the surface of the cathode electrode will be referred to as a thin-carbon-film selective-growth region formation step.

The above thin-carbon-film selective-growth region is preferably that portion of the surface of the cathode electrode onto which metal particles adhere or that portion of the surface of the cathode electrode on which a thin metal film is formed. For more reliable selective growth of the thin carbon film on the thin-carbon-film selective-growth region, desirably, sulfur (S), boron (B) or phosphorus (P) adheres to the surface of the thin-carbon-film selective-growth region. It is thought that the above materials work as a kind of catalyst, and any one of these materials can improve the thin carbon film in the property of selective growth. It is sufficient that the thin-carbon-film selective-growth region should be formed on the surface of that portion of the cathode electrode which is positioned in the bottom portion of the opening portion. The thin-carbon-film selective-growth region may be formed so as to extend from that portion of the cathode electrode which is positioned in the bottom portion of the opening portion to a surface of a portion other than (different from) the bottom portion of the opening portion. Further, the thin-carbon-film selective-growth region may be formed on the entirety of the surface of that portion of the cathode electrode which is positioned in the bottom portion of the opening portion or may be formed in part of the above portion.

The step of the thin-carbon-film selective-growth region formation preferably comprises the step of allowing metal particles to adhere onto, or forming a thin metal layer on, the surface of the portion of the cathode electrode in which portion the thin-carbon-film selective-growth region is to be formed (to be sometimes simply referred to as "cathode electrode surface" hereinafter), whereby there is formed the thin-carbon-film selective-growth region constituted of the portion of the cathode electrode which portion has the surface onto which the metal particles adhere or on which the thin metal layer is formed. In this case, for making more reliable the selective growth of the thin carbon film on the thin-carbon-film selective-growth region, desirably, sulfur (S), boron (B) or phosphorus (P) is allowed to adhere onto the surface of the thin-carbon-film selective-growth region, whereby the thin carbon film can be more improved in the property of selective growth. The method for allowing sulfur, boron or phosphorus to adhere onto the surface of the thin-carbon-film selective-growth region includes, for example, a method in which a compound layer made of a compound containing sulfur, boron or phosphorus is formed on the surface of the thin-carbon-film selective-growth region, and then, the compound layer is heat-treated to decompose the compound constituting the compound layer, whereby sulfur, boron or phosphorus is retained on the surface of the thin-carbon-film selective-growth region. The sulfur-containing compound includes thionaphthene, thiophthene and thiophene. The boron-containing compound includes triphenylboron. The phosphorus-containing compound includes triphenylphosphine.

Otherwise, for making more reliable the selective growth of the thin carbon film on the thin-carbon-film selective-growth region, after the metal particles are allowed to adhere onto, or the thin metal layer is formed on, the cathode electrode surface, it is preferred to remove a metal oxide (so-called natural oxide film) on the surface of each metal particle or on the surface of the thin metal layer. The metal oxide on the surface of each metal particle or on the surface of the thin metal layer is preferably removed, for example, by plasma reduction treatment in a hydrogen gas atmosphere according to a microwave plasma method, a transformer-coupled plasma method, an inductively coupled plasma method, an electron cyclotron resonance plasma method or an RF plasma method; by sputtering in an argon gas atmosphere; or by washing, for example, with an acid such as hydrofluoric acid or a base. When the step of allowing sulfur, boron or phosphorus to adhere onto the surface of the thin-carbon-film selective-growth region, and the step of removing the metal oxide on the surface of each metal particle or on the surface of the thin metal layer are included, preferably, these steps are carried out after the formation of the opening portion in the insulating layer and before the formation of the thin carbon film on the thin-carbon-film selective-growth region.

The method for allowing the metal particles to adhere onto the cathode electrode surface for forming the thin-carbon-film selective-growth region includes, for example, a method in which, in a state where a region other than the region where the thin-carbon-film selective-growth region is to be formed on the cathode electrode is covered with a proper material (for example, a mask layer), a layer composed of a solvent and the metal particles is formed on the surface of the portion of the cathode electrode on which portion the thin-carbon-film selective-growth region is to be formed, and then, the solvent is removed while retaining the metal particles. Alternatively, the step of allowing the metal particles to adhere onto the cathode electrode surface includes, for example, a method in which, in a state where a region other than the region where the thin-carbon-film selective-growth region is to be formed on the cathode electrode is covered with a proper material (for example, a mask layer), metal compound particles containing metal atoms constituting the metal particles are allowed to adhere onto the cathode electrode surface, and then the metal compound particles are heated to decompose them, whereby there is obtained the thin-carbon-film selective-growth region constituted of the portion of the cathode electrode on which portion the metal particles adhere. In the above method, specifically, a layer composed of a solvent and metal compound particles is formed on the surface of the portion of the cathode electrode on which portion the thin-carbon-film selective-growth region is to be formed, and the solvent is removed while retaining the metal compound particles. The above metal compound particles are preferably made of at least one material selected from the group consisting of halides (for example, iodides, chlorides, bromides, etc.), oxides and hydroxides of the metal for constituting the metal particles. In the above methods, the material (for example, mask layer) covering the region other than the region where the thin-carbon-film selective-growth region is to be formed on the cathode electrode is removed at a proper stage.

The method for forming the thin metal layer on the cathode electrode surface for forming the thin-carbon-film selective-growth region is selected, for example, from known methods such as an electroplating method, an electroless plating method, a chemical vapor deposition method (CVD method) including an MOCVD method, a physical vapor deposition method (PVD method) and a method of pyrolyzing an organometallic compound, and the above method is carried out in a state where a region other than the region where the thin-carbon-film selective-growth region is to be formed on the cathode electrode is covered with a proper material. The physical vapor deposition method includes (a) vacuum deposition methods such as an electron beam heating method, a resistance heating method and a flash deposition method, (b) a plasma deposition method, (c) sputtering methods such as a bipolar sputtering method, a DC sputtering method, a DC magnetron sputtering method, a high-frequency sputtering method, a magnetron sputtering method, an ion beam sputtering method and a bias sputtering method, and (d) ion plating methods such as a DC (direct current) method, an RF method, a multi-cathode method, an activating reaction method, an electric field deposition method, a high-frequency ion plating method and a reactive ion-plating method.

Preferably, the above metal particles or the thin metal layer are/is formed of at least one metal selected from the group consisting of molybdenum (Mo), nickel (Ni), titanium (Ti), chromium (Cr), cobalt (Co), tungsten (W), zirconium (Zr), tantalum (Ta), iron (Fe), copper (Cu), platinum (Pt) and zinc (Zn).

The above thin carbon film includes a thin graphite film, a thin amorphous carbon film, a thin diamond-like carbon film and a thin fullerene film. The method for forming the thin carbon film includes CVD methods based on a microwave plasma method, a transformer-coupled plasma method, an inductively coupled plasma method, an electron cyclotron resonance plasma method and an RF plasma method and a CVD method using a diode parallel plate plasma enhanced CVD system. The form of the thin carbon film not only includes the form of a thin film but also includes the form of a carbon whisker and the form of a nano-tube (including hollow and solid tubes).

The cathode electrode may have any structure such as a single layer structure of an electrically conductive material layer or a three-layered structure having a lower electrically conductive material layer, a resistance layer formed on the lower electrically conductive material layer and an upper electrically conductive material layer formed on the resistance layer. In the latter case, the thin-carbon-film selective-growth region is formed on a surface of the upper electrically conductive material layer. The above-formed resistance layer works to attain uniform electron emission properties of the electron emission electrodes.

One example of the method for producing the plane-type field emission device will be explained with reference to FIGS. 44A, 44B, 45A and 45B hereinafter.

[Step-500]

First, an electrically conductive material layer for a cathode electrode is formed on the support member 11 made, for example, of glass, and the electrically conductive material layer is then patterned by known lithography and a known RIE method, to form the stripe-shaped cathode electrode 12 on the support member 11. The stripe-shaped cathode electrode 12 extends leftward and rightward on the paper surface of the drawing. The cathode electrode 12 is made, for example, of an approximately 0.2 $\mu$m thick chromium (Cr) layer formed by a sputtering method.

[Step-510]

Then, an insulating layer 13 is formed on the entire surface, specifically on the support member 11 and the cathode electrode 12.

[Step-520]

Then, a stripe-shaped gate electrode 14 is formed on the insulating layer 13, and an opening portion 15 is formed in the gate electrode 14 and the insulating layer 13, to expose the cathode electrode 12 in a bottom portion of the opening portion 15 (see FIG. 44A). The gate electrode 14 extends in the direction perpendicular to the paper surface of the drawing. The opening portion 15 has a plan form, for example, of a circle having a diameter of 1 to 30 μm. It is sufficient that one to approximately 3000 such opening portions 15 should be formed per a region for one pixel (overlap region).

[Step-530]

An electron emission electrode 16D is formed on the cathode electrode 12 exposed in the bottom portion of the opening portion 15. Specifically, first, a thin-carbon-film selective-growth region 63 is formed on the surface of the cathode electrode 12 which surface is positioned in the bottom portion of the opening portion 15. For this purpose, first, a mask layer 64 is formed such that the surface of the cathode electrode 12 is exposed in the central portion of the bottom portion of the opening portion 15 (see FIG. 44B). Specifically, a resist material layer is formed on the entire surface including an inner surface of the opening portion 15 by a spin coating method, and then a hole is formed in the resist material layer positioned in the central portion of the bottom portion of the opening portion 15 by lithography, whereby the mask layer 64 can be obtained. The mask layer 64 covers part of the cathode electrode 12 which part is positioned in the bottom portion of the opening portion 15, a side wall of the opening portion 15, the gate electrode 14 and the insulating layer 13. In a step that follows, the thin-carbon-film selective-growth region is formed on the surface of the cathode electrode 12 which surface is positioned in the central portion of the bottom portion of the opening portion 15. The above procedure makes it possible to reliably prevent short-circuiting of the cathode electrode 12 and the gate electrode 14 with metal particles.

Then, metal particles are allowed to adhere onto the mask layer 64 and the exposed surface of the cathode electrode 12. Specifically, a dispersion prepared by dispersing fine nickel (Ni) particles in a polysiloxane solution (using isopropyl alcohol as a solvent) is applied to the entire surface by a spin coating method, to form a layer composed of the solvent and the metal particles on the surface of the portion of the cathode electrode 12 on which portion the thin-carbon-film selective-growth region 63 is to be formed. Then, the mask layer 64 is removed, and the solvent is removed by heating the above layer up to approximately 400° C., to retain the metal particles 65 on the exposed surface of the cathode electrode 12, whereby the thin-carbon-film selective-growth region 63 can be obtained (see FIG. 45A). The above polysiloxane works to fix the metal particles 65 to the exposed surface of the cathode electrode 12 (so-called adhesive function).

[Step-540]

Then, a thin carbon film 66 having a thickness of approximately 0.2 μm is formed on the thin-carbon-film selective-growth region 63, to form the electron emission electrode 16D. FIG. 45B shows the thus-obtained state. Table 1 shows a condition of forming the thin carbon film 66 on the basis of a microwave plasma CVD method.

TABLE 1

| Conditions of forming thin carbon film | |
|---|---|
| Gas used | $CH_4/H_2$ = 100/10 SCCM |
| Pressure | $1.3 \times 10^3$ Pa |
| Microwave power | 500 W (13.56 MHz) |
| Film-forming temperature | 500° C. |

[Flat-Type Field Emission Device (No. 1)]

FIG. 46C shows a schematic partial cross-sectional view of a field emission device having the second structure formed of a flat-type field emission device. The flat-type field emission device comprises a stripe-shaped cathode electrode 12 formed on a support member 11 made, for example, of glass; an insulating layer 13 formed on the support member 11 and the cathode electrode 12; a stripe-shaped gate electrode 14 formed on the insulating layer 13; and an opening portion 15 which is formed through the gate electrode 14 and the insulating layer 13 and has a bottom portion where the cathode electrode 12 is exposed. The cathode electrode 12 extends in the direction perpendicular to the paper surface of FIG. 46C, and the gate electrode 14 extends leftward and rightward on the paper surface of the FIG. 46C. The cathode electrode 12 and the gate electrode 14 are made of chromium (Cr), and the insulating layer 13 is made of $SiO_2$. That portion of the cathode electrode which portion is exposed in the bottom portion of the opening portion 15 corresponds to the electron-emitting portion 16.

The method for producing the flat-type field emission device will be explained with reference to FIGS. 46A to 46C showing schematic partial cross-sectional views of the support member and the like.

[Step-600]

First, the cathode electrode 12 which works as an electron-emitting portion 16 is formed on the support member 11. Specifically, an electrically conductive material layer made of chromium (Cr) for a cathode electrode is formed on the support member 11 by a sputtering method, and the electrically conductive material layer is patterned by lithography and a dry etching method, whereby the stripe-shaped cathode electrode 12 can be formed on the support member 11 (see FIG. 46A). The cathode electrode 12 extends in the direction perpendicular to the paper surface of the drawing.

[Step-610]

Then, the insulating layer 13 made of $SiO_2$ is formed on the support member 11 and the cathode electrode 12, for example, by a CVD method. Alternatively, the insulating layer 13 may be formed from a glass paste by a screen-printing method.

[Step-620]

Then, the stripe-shaped gate electrode 14 is formed on the insulating layer 13. Specifically, an electrically conductive material layer made of chromium is first formed on the entire surface, and the electrically conductive material layer is patterned by lithography and a dry etching method, whereby the stripe-shaped gate electrode 14 can be formed (see FIG. 46B). The gate electrode 14 extends leftward and rightward on the paper surface of the drawing. The stripe-shaped gate electrode 14 can be also formed on the insulating layer 13, for example, by a screen printing method.

[Step-630]

Then, the opening portion 15 is formed in the gate electrode 14 and the insulating layer 13, and the cathode electrode 12 that is to work as the electron-emitting portion 16 is exposed in the bottom portion of the opening portion 15 (see FIG. 46C).

[Flat-Type Field Emission Device (No. 2)]

The flat-type field emission device of which the schematic partial cross-sectional view is shown in FIG. 47A differs from the flat-type field emission device shown in FIG. 46C in that a fine convexo-concave portion 12A is formed on that surface (corresponding to an electron-emitting portion 16) of the cathode electrode 12 which is exposed in the bottom portion of the opening portion 15. Such a flat-type field emission device can be produced by the following production method.

[Step-700]

In the same manner as in [Step-600] to [Step-620], the stripe-shaped cathode electrode 12 is formed on the support member 11, the insulating layer 13 is formed on the entire surface, and the stripe-shaped gate electrode 14 is formed on the insulating layer 13. That is, a tungsten layer having a thickness of approximately 0.2 $\mu$m is formed on the support member 11 made, for example, of a glass substrate by a sputtering method, and the tungsten layer is patterned in the form of a stripe according to general procedures, to form the cathode electrode 12. Then, the insulating layer 13 is formed on the support member 11 and the cathode electrode 12. The insulating layer 13 is formed by a CVD method using TEOS (tetraethoxysilane) as a source gas. Further, an electrically conductive material layer made, for example, of a chromium layer having a thickness of 0.2 $\mu$m is formed on the insulating layer 13 and patterned in the form of a stripe, to form the gate electrode 14. A state where the above process has been completed is substantially as shown in FIG. 46B.

[Step-710]

Then, the opening portion 15 is formed in the gate electrode 14 and the insulating layer 13 to expose the cathode electrode 12 in the bottom portion of the opening portion 15 in the same manner as in [Step-630]. Then, a fine convexo-concave portion 12A is formed on a portion of the cathode electrode 12 which portion is exposed in the bottom portion of the opening portion 15. When the fine convexo-concave portion 12A is formed, a drying etching using $SF_6$ as an etching gas is carried out by an RIE method under a condition where an etching rate of grain boundaries comes to be greater than that of tungsten crystal particles constituting the cathode electrode 12. As a result, the fine convexo-concave portion 12A having dimensions nearly reflecting grain diameters of the tungsten crystals can be formed.

In the above flat-type field emission device, an intense electric field from the gate electrode 14 is applied to the fine convexo-concave portion 12A of the cathode electrode 12, more specifically to convex portions of the fine convexo-concave portion 12A. In this case, the electric filed applied on the convex portions is intense as compared with a case where the surface of the cathode electrode 12 is flat and smooth, so that electrons are efficiently emitted from the convex portions due to a quantum tunnel effect. It can be therefore expected that the flat-type display into which the above flat-type field emission devices are incorporated is improved in brightness as compared with the flat-type field emission device having a simply flat and smooth cathode electrode 12 exposed in the bottom portion of the opening portion 15. In the flat-type field emission device shown in FIG. 47A, therefore, a sufficient current density of emitted electrons can be obtained even if the potential difference between the gate electrode 14 and the cathode electrode 12 is relatively small, and a higher brightness of the flat-type display can be achieved. In other words, the gate voltage required can be decreased if the levels of the brightness are the same, and the power consumption can be lowered.

In the above-explained embodiment, the opening portion 15 is formed by etching the insulating layer 13 and then the fine convexo-concave portion 12A is formed in the cathode electrode 12 by an anisotropic etching method. However, the fine convexo-concave portion 12A can be also simultaneously formed by the etching which is carried out for forming the opening portion 15. That is, when the insulating layer 13 is etched, an anisotropic etching condition which is expected to have ion-sputtering functions to some extent is employed, and the etching is continued until after the opening portion 15 having a perpendicular wall is formed, whereby the fine convexo-concave portion 12A can be formed in that portion of the cathode electrode 12 which is exposed in the bottom portion of the opening portion 15. Then, the insulating layer 13 can be isotropically etched.

In a step similar to [Step-600], an electrically conductive material layer made of tungsten for a cathode electrode is formed on the support member 11 by a sputtering method, and then, the above electrically conductive material layer is patterned by lithography and a dry etching method. Then, the fine convexo-concave portion 12A is formed on a surface of the cathode electrode, and steps similar to [Step-610] to [Step-630] are carried out, whereby a field emission device similar to one shown in FIG. 47A can be produced.

Otherwise, in a step similar to [Step-600], the electrically conductive material layer made of tungsten for a cathode electrode is formed on the support member 11 by a sputtering method, and then, the fine convexo-concave portion 12A is formed in a surface of the cathode electrode. Then, the above electrically conductive material layer is patterned by lithography and a dry etching method, and steps similar to [Step-610] to [Step-630] are carried out, whereby a field emission device similar to one shown in FIG. 47A can be produced.

FIG. 47B shows a variant of the field emission device shown in FIG. 47A. In the field emission device shown in FIG. 47B, the average height position of peaks of the fine convexo-concave portion 12A is present at a level lower than the lower surface of the insulating layer 13 on the support member 11 side (that is, lowered). For producing such a field emission device, the dry etching in a step similar to [Step-710] can be continued for a longer period of time. In such a constitution, the electric field intensity near the central portion of the opening portion 15 can be further increased.

FIG. 48 shows a flat-type field emission device in which a coating layer 12B is formed on the surface of the cathode electrode 12 corresponding to the electron-emitting portion 16 (more specifically, at least on the fine convexo-concave portion 12A).

Preferably, the above coating layer 12B is made of a material having a smaller work function $\Phi$ than a material constituting the cathode electrode 12. The material for the coating layer 12B can be determined depending upon the work function of a material constituting the cathode electrode 12, a voltage difference between the gate electrode 14 and the cathode electrode 12 and the current density of emitted electrons to be required. The material for the coating layer 12B includes amorphous diamond. When the coating layer 12B is made of amorphous diamond, the current density of emitted electrons required for a flat-type display can be obtained at an electric field of $5\times10^7$ V/m or less.

The thickness of the coating layer 12B is determined to such an extent that the coating layer 12B can reflect the fine convexo-concave portion 12A. That is because it is meaningless to form the fine convexo-concave portion 12A if the concave portions of the fine convexo-concave portion 12A are filled with the coating layer 12B to flatten the surface of the electron-emitting portion. Therefore, when, for example, the fine convexo-concave portion 12A is formed while reflecting crystal grain diameters of the electron-emitting portion, the thickness of the coating layer 12B is approximately 30 to 100 nm, although the thickness differs depending upon dimensions of the fine convexo-concave portion 12A. When the average height position of peaks of the fine convexo-concave portion 12A is lowered to a level below the lower surface position of the insulating layer 13, to be exact, it is more preferred to lower the average height position of peaks of the coating layer 12B to a level below the lower surface position of the insulating layer 13.

Specifically, after [Step-710], the coating layer 12B made of amorphous diamond can be formed on the entire surface, for example, by a CVD method. The coating layer 12B is also deposited on an etching mask (not shown) formed on the gate electrode 14 and the insulating layer 13. This deposit portion is removed concurrently with the removal of the etching mask. The coating layer 12B can be formed by a CVD method using, for example, $CH_4/H_2$ mixed gases or $CO/H_2$ mixed gases as a source gas, and the coating layer 12B made of amorphous diamond is formed by thermal decomposition of the compound containing carbon.

Otherwise, the field emission device shown in FIG. 48 can be formed as follows. In a step similar to [Step-600], an electrically conductive material layer made of tungsten for a cathode electrode is formed on the support member 11 by a sputtering method, then, the above electrically conductive material layer is patterned by lithography and a dry etching method, and then, the fine convexo-concave portion 12A is formed on a surface of the electrically conductive material layer. Then, the coating layer 12B is formed, and then, steps similar to [Step-610] to [Step-630] are carried out.

Otherwise, the field emission device shown in FIG. 48 can be produced as follows. In a step similar to [Step-600], an electrically conductive material layer made of tungsten for a cathode electrode is formed on the support member 11 by a sputtering method, then, the fine convexo-concave portion 12A is formed on a surface of the above electrically conductive material layer, and then, the coating layer 12B is formed. Then, the coating layer 12B and the electrically conductive material layer are patterned by lithography and a dry etching method, and steps similar to [Step-610] to [Step-630] are carried out.

Otherwise, the material for the coating layer can be properly selected from materials having a larger secondary electron gain δ than an electrically conductive material which is to constitute the cathode electrode.

A coating layer may be formed on the electron-emitting portion 16 (on the surface of the cathode electrode 12) of the flat-type field emission device shown in FIG. 46C. In this case, after [Step-630], the coating layer 12B can be formed on the surface of the cathode electrode 12 which surface is exposed in the bottom portion of the opening portion 15. Otherwise, in [Step-600], for example, an cathode electrode is formed on the support member 11, the coating layer 12B is formed on the electrically conductive material layer, and these layers are patterned by lithography and a dry etching method.

[Crater-Type Field Emission Device (No. 1)]

FIG. 52B shows a schematic partial cross-sectional view of the crater-type field emission device. In the crater-type field emission device, a cathode electrode 112 having a plurality of projection portions 112A for emitting electrons and concave portions 112B each of which is surrounded by the projection portion 112A is provided on the support member 11. FIG. 51B shows a schematic perspective view of the crater-type field emission device from which an insulating layer 13 and a gate electrode 14 are removed.

While the form of each concave portion is not specially limited, each concave portion typically has a nearly spherical surface, which is related to the following fact. In the production of the above crater-type field emission device, spheres are used, and part of each sphere is reflected when each concave portion 112B is formed. When each concave portion 112B has a nearly spherical surface, the projection portion 112A surrounding the concave portion 112B is ringed or circular, and in this case, the concave portion 112B and the projection portion 112A as a whole have a crater-like or caldera-like form. The projection portion 112A is for emitting electrons, so that a top end portion 112C of each is particularly preferably sharp in view of improving electron emission efficiency. The profile of top end portion 112C of each projection portion 112A may have an irregular convexo-concave form or may be flat. The layout of the projection portions 112A per pixel may be regular or at random. Each concave portion 112B may be surrounded by the projection portion 112A continued along the circumferential direction of the concave portion 112B, and in some cases, each concave portion 112B may be surrounded by the projection portion 112A discontinuous along the circumferential direction of the concave portion 112B.

In the method of producing the above crater-type field emission device, more specifically, the step of forming the stripe-shaped cathode electrode on the support member comprises the steps of;

forming a stripe-shaped cathode electrode covering a plurality of spheres on the support member; and removing the spheres to remove a portion of the cathode electrode which portion covers the spheres and thereby forming a cathode electrode having a plurality of projection portions for emitting electrons and concave portions each of which is surrounded by the projection portion and reflects part of the sphere.

Preferably, the spheres are removed by state change and/or chemical change of the spheres. The term "state change and/or chemical change" of the sphere refers to changes such as expansion, sublimation, foaming, gas generation, decomposition, combustion and carbonization and combinations of these. For example, when the spheres are made of an organic material, more preferably, the spheres are removed by combustion. The removal of the spheres and the removal of portion of the cathode electrode which portion covers the sphere are not necessarily required to take place concurrently, or the removal of the spheres and the removal of portions of the cathode electrode, the insulating layer and the gate electrode which portions cover the sphere are not necessarily required to take place concurrently. For example, when part of the spheres remains after the portion of the cathode electrode which portion covers the sphere is removed, or when part of the spheres remains after the above portion and the portions of the insulating layer and the gate electrode are removed, the remaining spheres can be removed later.

In particular, when the spheres are made of an organic material and when the spheres are combusted, for example, carbon monoxide, carbon dioxide and vapor steam are generated to increase a pressure in a closed space near the sphere, and the cathode electrode near the sphere bursts when a pressure durability limit is exceeded. The portion of the cathode electrode which portion covers the sphere is dissipated by the force of the burst, to form the projection portion and the concave portion, and the sphere is also removed. Otherwise, when the spheres are, for example, combusted, the cathode electrode, the insulating layer and the gate electrode burst according to a similar mechanism when a pressure durability limit is exceeded. Portions of the cathode electrode, the insulating layer and the gate electrode which portions cover the sphere are dissipated by the force of the burst, to form the projection portion and the concave portion and to form the opening portion at the same time, and the sphere is also removed. That is, no opening portion exists in the insulating layer and the gate electrode before the removal of the spheres, and the opening portion is formed together with the removal of the sphere. In this case, the initial process of combustion proceeds in a closed space, so that part of each sphere may be carbonized. Preferably, the thickness of portion of the cathode electrode which portion covers the sphere is decreased to such an extent that said portion can be dissipated by the burst. Further, preferably, the thickness of each of portions of the cathode electrode, the insulating layer and the gate electrode which portions cover the sphere is decreased to such an extent that said portions can be dissipated by the burst. In the insulating layer, particularly preferably, its portion covering no spheres has a thickness nearly equal to a diameter of each sphere.

In [crater-type field emission device (No. 3)] to be described later, the spheres can be removed by state change and/or chemical change of the spheres. Since, however, the bursting of the cathode electrode is not involved, the spheres can be easily removed by exerting an external force in some cases. In a [crater-type field emission device (No. 4)] to be described later, the formation of the opening portion is completed prior to the removal of the sphere. When the opening portion has a larger diameter than the sphere, the sphere can be removed with an external force. The external force includes physical forces such as a pressure caused by blowing with air or an inert gas, a pressure caused by blowing a wash liquid, a magnetic suction force, an electrostatic force and a centrifugal force. Unlike [crater-type field emission device (No. 1)], in [crater-type field emission device (No. 3)] and [crater-type field emission device (No. 4)], it is not required to dissipate the portion of the cathode electrode which covers the sphere, or, in some cases, it is not required to dissipate not only the above portion but also portions of the insulating layer and the gate electrode, so that there is an advantage that no residue arises from the cathode electrode, the insulating layer or the gate electrode.

In [crater-type field emission device (No. 3)] or [crater-type field emission device (No. 4)] to be described later, preferably, at least the surface of the sphere used therefor is made of a material having a larger interfacial tension (surface tension) than a material constituting the cathode electrode, or in some cases, than materials constituting the insulating layer and the gate-electrode. In [crater-type field emission device (No. 4)], the cathode electrode, the insulating layer and the gate electrode thereby do not cover at least top portions of the spheres, and there can be obtained a state where the opening portion is formed in the insulating layer and the gate electrode from the beginning. The diameter of the opening portion differs depending, for example, upon a relationship between the thickness of a material for each of the cathode electrode, the insulating layer and the gate electrode and the diameter of each sphere; methods of forming the cathode electrode, the insulating layer and the gate electrode; and the interfacial tension (surface tension) of a material for each of the cathode electrode, the insulating layer and the gate electrode.

In [crater-type field emission device (No. 3)] or [crater-type field emission device (No. 4)] to be described later, it is sufficient that the spheres have the surfaces which satisfy the above condition concerning the interfacial tension. That is, the portion having a larger interfacial tension than any one of the cathode electrode, the insulating layer and the gate electrode may be only a surface of the sphere or may be the entirety of the sphere. The material for the surface and/or the entirety of the sphere may be an inorganic material, an organic material or a combination of an inorganic material with an organic material. In [crater-type field emission device (No. 3)] or [crater-type field emission device (No. 4)], when the cathode electrode and/or the gate electrode are (is) made of a general metal material and when the insulating layer is made of a silicon oxide material such as glass, generally, a highly hydrophilic state is formed since hydroxyl groups derived from adsorbed water are present on the metal material surface and since dangling bonds of Si—O bonds and hydroxyl groups derived from adsorbed water are present on the surface of the insulating layer. It is therefore particularly effective to use spheres having hydrophobic surface-treatment layers. The material for the hydrophobic surface-treatment layer includes fluorine resins such as polytetrafluoroethylene. When the sphere has a hydrophobic surface-treatment layer, and, if a portion inside the hydrophobic surface-treatment layer is considered a core, the material for the core may be glass, ceramic or a polymer material other than the fluorine resin.

Although not specially limited, the organic material for the spheres is preferably a general-purpose polymer material. When the polymer material has an extremely high polymerization degree or has an extremely large content of double and triple bonds, too high a combustion temperature is required, and when the spheres are removed by combustion, a detrimental effect may be caused on the cathode electrode, the insulating layer and the gate electrode. It is therefore preferred to select a polymer material which is combustible or carbonizable at a temperature at which no detrimental effect is caused on the above layers. When the insulating layer is made of a material which requires combustion at a post step, such as a glass paste, it is preferred to select a polymer material which is combustible or carbonizable at a calcining temperature of the glass paste, in order to decrease the number of the manufacturing steps. Since a glass paste has a typical calcining temperature of approximately 530° C., the combustion temperature of the polymer material is preferably approximately 350 to 500° C. Typical examples of the polymer material include styrene, urethane, acryl, vinyl, divinylbenzene, melamine, formaldehyde and polymethylene homopolymers or copolymers. For securing a reliable layout on the support member, there may be used fixable spheres capable of adhering. As fixable spheres, spheres made of an acryl resin are used.

Otherwise, thermally expandable microspheres having a vinylidene chloride-acrylonitrile copolymer as outer shells and encapsulating isobutane as a foaming agent can be used as spheres. In [crater-type field emission device (No. 1)], for example, the above thermally expandable microspheres are employed and heated. In this case, a polymer constituting the outer shells is softened, and the encapsulated isobutane is gasified to undergo expansion. As a result, there are formed hollow true spheres having a diameter approximately 4 times as large as a diameter found before the expansion. As a result, in [crater-type field emission device (No. 1)], the projection portions for emitting electrons and the concave portions each of which is surrounded by the projection portion and reflects part of form of the sphere can be formed in the cathode electrode. In addition to the above concave portions and the above projection portions, further, the opening portions can be also formed through the gate electrode and the insulating layer. In the present specification, the expansion of thermally expandable microspheres by heating is also included in the concept of the removal of the spheres. Then, thermally expandable microspheres can be removed with a proper solvent.

In [crater-type field emission device (No. 1)], the cathode electrode covering the spheres can be formed after a plurality of the spheres are arranged on the support member. In this case, or in [crater-type field emission device (No. 3)] or [crater-type field emission device (No. 4)] to be described later, the method of arranging a plurality of the spheres on the support member includes a dry method in which the spheres are sprayed onto the support member. For spraying the spheres, there can be applied a method in which spacers are sprayed for maintaining a panel distance at a constant distance in the field of producing liquid crystal displays. Specifically, a so-called spray gun for ejecting the spheres through a nozzle with a compressed gas can be used. When the spheres are ejected through the nozzle, the spheres may be in a state in which they are dispersed in a volatile solvent. Otherwise, the spheres can be sprayed by means of an apparatus or a method generally used in the field of an electrostatic powder application or coating. For example, the spheres negatively charged can be sprayed to the support member grounded, with an electrostatic spray gun, using a corona discharge. Since the spheres used are very small as will be described later, the spheres sprayed onto the support member adhere to the surface of the support member, for example, with an electrostatic force, and the adhering spheres do not easily fall off from the support member in procedures to come thereafter. When the spheres are pressed after a plurality of the spheres are arranged on the support member, overlapping of a plurality of the spheres on the support member can be overcome, and the spheres can be densely arranged on the support member so as to form a single layer.

Otherwise, there may be employed a constitution in which, like [crater-type field emission device (No. 2)] to be described later, a composition layer composed of a dispersion of the spheres and a cathode electrode material in a dispersing agent is formed on the support member, thereby to arrange a plurality of the spheres on the support member and to cover each sphere with the cathode electrode made of the cathode electrode material, and thereafter, the dispersing agent is removed. The composition can have the property of a slurry or paste, and the component and viscosity of the dispersing agent can be selected as required depending upon the above properties desired. Preferably, the method of forming the composition layer on the support member includes a screen-printing method. Typically, the cathode electrode material is preferably formed of fine particles having a lower precipitation rate than the sphere in the dispersing agent. The material for the above fine particles includes carbon, barium, strontium and iron. After the dispersing agent is removed, the cathode electrode is calcined as required. The method of forming the composition layer on the support member includes a spraying method, a dropping method, a spin coating method and a screen-printing method. When the spheres are arranged, each sphere is concurrently covered with the cathode electrode made of a cathode electrode material. In some method of forming the above composition layer, it is required to pattern the cathode electrode.

In [crater-type field emission device (No. 3)] or [crater-type field emission device (No. 4)] to be described later, there may be employed a constitution in which a composition layer made of a dispersion of the spheres in a dispersing agent is formed on the support member, thereby to arrange a plurality of the spheres on the support member, and then the dispersing agent is removed. The composition can have the property of a slurry or paste, and the component and viscosity of the dispersing agent can be selected as required depending upon the above properties desired. Typically, an organic solvent such as isopropyl alcohol is used as a dispersing agent, and the dispersing agent can be removed by volatilization. The method of forming the composition layer on the support member includes a spraying method, a dropping method, a spin coating method and a screen-printing method.

The gate electrode and the cathode electrode extend in directions different from each other (for example, a projection image of the stripe-shaped gate electrode and a projection image of the stripe-shaped cathode electrode make an angle of 90°), and, for example, they are patterned in the form of stripes. Electrons are emitted from the projection portions positioned in overlap regions. It is therefore functionally sufficient that the projection portions are present in the overlap regions alone. Even if the projection portions and the concave portions exist in regions different from the overlap regions, however, such projection portions and concave portions remain covered with the insulating layer and do not work to emit electrons. It is therefore no problem if the spheres are arranged in the entire surface.

In contrast, when portions of the cathode electrode, the insulating layer and the gate electrode which portions cover the sphere are removed, arrangement positions of individual spheres and formation positions of the opening portions have one-to-one correspondence, so that the opening portions are formed in regions different from the overlap regions. The opening portion formed in a region different from the overlap region will be referred to as "ineffective opening portion" and distinguished from the original opening portion which works for electron emission. Meanwhile, even if ineffective opening portions are formed in regions other than the overlap regions, the ineffective opening portions do not at all work as field emission devices, nor do they cause any detrimental effect on the performance of the field emission devices formed in the overlap regions. The reason therefor is as follows. Even if the projection portion and the concave portion are exposed in the bottom portion of the ineffective opening portion, no gate electrode is formed on the upper end portion of the ineffective opening portion. Otherwise, even if the gate electrode is formed in the upper end portion of the ineffective opening portion, neither the projection portion nor the concave portion is exposed in the bottom portion; or neither the projection portion nor the concave portion is exposed in the bottom portion of the ineffective opening portion and no gate electrode is formed in the upper end portion and the surface of the support member is merely exposed. It is therefore no problem even if the spheres are arranged in the entire surface. A hole formed in a boundary between the overlap region and other region is included in the opening portion.

The diameter of the sphere can be selected depending upon the diameter of a desired opening portion, the diameter of the concave portion, display screen dimensions of a flat-type display constituted using the field emission devices, the number of pixels, dimensions of the overlap region and the number of the field emission devices per pixel. The diameter of the sphere is preferably in the range of from 0.1 to 10 $\mu$m. For example, spheres commercially available as spacers for liquid crystal displays are preferred since they have a particle diameter distribution of 1 to 3%. While the form of the sphere is ideally truly spherical, it is not necessarily required to be truly spherical. In some method of producing the field emission devices, opening portions or ineffective opening portions can be formed in portions where the spheres are arranged, and it is preferred to arrange the spheres on the support member in a density of approximately 100 to 5000 spheres/mm$^2$. For example, when the spheres are arranged on the support member in a density of approximately 1000 spheres/mm$^2$, and for example, if the overlap region has dimensions of 0.5 mm×0.2 mm, approximately 100 spheres are present per overlap region, and approximately 100 projection portions are formed. When the projection portions approximately in such a number are formed per overlap region, the fluctuation of diameters of the concave portions, caused by the fluctuation in the particle diameter distribution and the sphericity of the spheres, is nearly averaged, and the current density of emitted electrons per pixel (or per subpixel) and the brightness come to be uniform.

In [crater-type field emission device (No. 1)] or [crater-type field emission device (No. 2)] to [crater-type field emission device (No. 4)] to be described later, part of the form of the sphere is reflected in the form of concave portion constituting the electron-emitting portion. The profile of top end portion of each projection portion may have an irregular convexo-concave form or may be flat. In [crater-type field emission device (No. 1)] or [crater-type field emission device (No. 2)] in particular, the above top end portion is formed by fracture of the cathode electrode, so that the top end portion of each projection portion is liable to have an irregular form. When the top end portion is sharpened by fracture, advantageously, the top end portion can function as a highly efficient electron-emitting portion. In any one of [crater-type field emission device (No. 1)] to [crater-type field emission device (No. 4)], the projection portion surrounding the concave portion comes to be ringed or circular, and in this case, the concave portion and the projection portion as a whole have the form of crater or caldera.

The layout of the projection portions on the support member may be regular or at random, and depends upon the method of arranging the spheres. When the above dry method or a wet method is employed, the layout of the projection portions on the support member comes to be at random.

In any one of [crater-type field emission device (No. 1)] to [crater-type field emission device (No. 4)], when the opening portion is formed in the insulating layer after the formation of the insulating layer, there may be employed a constitution in which a protective layer is formed for avoiding damage of top end portions of the projection portions after the formation of the projection portions, and the protective layer is removed after the opening portion is formed. The material for the protective layer includes chromium.

The method of producing the field emission device of [crater-type field emission device (No. 1)] will be explained with reference to FIGS. 49A, 49B, 50A, 50B, 51A, 51B, 52A and 52B. FIGS. 49A, 50A and 50B are schematic partial end views, FIGS. 52A and 52B are schematic partial cross-sectional views, and FIGS. 49B, 50B and 51B are schematic partial perspective views showing wider ranges than those in FIGS. 49A, 50A and 51A.

[Step-800]

First, a cathode electrode 112 covering a plurality of spheres 70 is formed on the support member 11. Specifically, the spheres 70 are arranged on the entire surface of the support member 11 made, for example, of glass. The spheres 70 are made, for example, of a polymethylene-based polymer material, and they have an average particle diameter of approximately 5 $\mu$m and a particle diameter distribution of less than 1%. The spheres 70 are arranged on the support member 11 at random at a density of approximately 1000 spheres/mm$^2$ with a spray gun. The method of spraying the spheres with a spray gun includes a method of spraying a mixture of the sphere with a volatile solvent and a method of ejecting the spheres in a powder state from a nozzle. The arranged spheres 70 are held on the support member 11 by an electrostatic force. FIGS. 49A and 49B show such a state.

[Step-810]

A cathode electrode 112 is formed on the spheres 70 and the support member 11. FIGS. 50A and 50B show a state where the cathode electrode 112 is formed. The cathode electrode 112 can be formed, for example, by screen-printing a carbon paste in the form of a stripe. In this case, the spheres 70 are arranged on the entire surface of the support member 11, so that some of the spheres 70 are naturally not covered with the cathode electrode 112 as shown in FIG. 50B. Then, the cathode electrode 112 is dried, for example, at 150° C. for removing water and a solvent contained in the cathode electrode 112 and flattening the cathode electrode 112. At this temperature, the spheres 70 does not undergo any state change and/or chemical change. The above screen-printing using a carbon paste may be replaced with a method in which an electrically conductive material layer for the cathode electrode 112 is formed on the entire surface and the electrically conductive material layer for the cathode electrode 112 is patterned by general lithography and a general dry etching method to form the cathode electrode 112 in the form of a stripe. When the lithography is applied, generally, a resist layer is formed by a spin coating method. In the spinning, if the number of spinning of the support member 11 is 500 rpm and if the spinning time period is approximately several seconds long, the spheres 70 are held on the support member 11 without dropping off or shifting in position.

[Step-820]

A portions of the cathode electrode 112 which portion covers the spheres 70 is removed by removing the spheres 70, whereby there is formed the cathode electrode 112 having a plurality of projection portions 112A for emitting electrons and concave portions 112B each of which is surrounded by the projection portion 112A and reflects part of form of each sphere 70. FIGS. 52A and 52B show the thus-obtained state. Specifically, the spheres 70 are combusted by heating around 530° C, while the cathode electrode 112 is also calcined. The pressure in each closed space in which each sphere 70 is captured increases together with the combustion of the sphere 70, and a portion of the cathode electrode 112 which portion covers the sphere 70 bursts when a certain pressure durability limit is exceeded, and such a portion is removed. As a result, the projection portions 112A and the concave portions 112B are formed in part of the cathode electrode 112 formed on the support member 11. When some portions of each sphere remain as a residue after the removal of the spheres, the residue can be removed with a proper wash liquid depending upon a material constituting the spheres used.

[Step-830]

Then, the insulating layer 13 is formed on the cathode electrode 112 and the support member 11. Specifically, for example, a glass paste is screen-printed on the entire surface to form a layer having a thickness of approximately 5 $\mu$m. Then, the insulating layer 13 is dried, for example, at 150° C. to remove water and a solvent contained in the insulating layer 13 and to flatten the insulating layer 13. The above screen-printing using a glass paste may be replaced, for example, with the formation of an $SiO_2$ layer by a plasma CVD method.

[Step-840]

Then, the stripe-shaped gate electrode 14 is formed on the insulating layer 13 (see FIG. 52A). The gate electrode 14 can be formed, for example, by screen-printing a carbon paste in the form of a stripe. The extending direction of a projection image of the stripe-shaped gate electrode 14 makes an angle of 90° with the extending direction of a projection image of the stripe-shaped cathode electrode 112. Then, for removing water and a solvent contained in the gate electrode 14 and for flattening the gate electrode 14, the gate electrode 14 is dried, for example, at 150° C. and the materials constituting the gate electrode 14 and the insulating layer 13 are calcined. The screen-printing method using a carbon paste may be replaced with the method of forming a gate electrode material layer for the gate electrode 14 on the entire surface of the insulating layer 13 and then patterning the gate electrode material layer by general lithograhpy and a dry etching method.

[Step-850]

Then, in the overlap region where the projection image of the gate electrode 14 and the projection image of the cathode electrode 112 overlap, the opening portion 15 is formed through the gate electrode 14 and the insulating layer 13, thereby to expose a plurality of the projection portions 112A and the concave portions 112B in the bottom portion of the opening portion 15. The opening portion 15 can be made by forming a resist mask according to general lithography and etching through the resist mask. Preferably, the etching is carried out under a condition where sufficiently high etching selectivity to the cathode electrode 112 is secured. Otherwise, after the formation of the projection portions 112A, preferably, a protective layer made of chromium is formed in advance, and after the opening portion 15 is formed, the protective layer is removed. Then, the resist mask is removed. In this manner, the field emission device shown in FIG. 52B can be obtained.

As a variant of the method of producing [crater-type field emission device (No. 1)], there may be employed a constitution in which [Step-830] to [Step-850] are carried out after [Step-810] and then [Step-820] is carried out. In this case, the combustion of the spheres and the calcining of the materials for the gate electrode 14 and the insulating layer 13 can be carried out concurrently.

Otherwise, [Step-830] is carried out after [Step-810], and in a step similar to [Step-840], further, a stripe-shaped gate electrode free of the opening portion is formed on the insulating layer. Then, [step-820] is carried out. In this manner, portions of the cathode electrode 112, the insulating layer 13 and the gate electrode 14 which portions cover the sphere 70 are removed, whereby the opening portion can be formed through the gate electrode 14 and the insulating layer 13, and the electron-emitting portion having the projection portion 112A for emitting electrons and the concave portion 112B which is surrounded by the projection portion 112A and reflects part of the form of each sphere 70 can be formed in the cathode electrode 112 which is positioned in the bottom portion of the opening portion. That is, the pressure in each closed space in which each sphere 70 is captured increases together with the combustion of the sphere 70, and portions of the cathode electrode 112, the insulating layer 13 and the gate electrode 14 which portions cover the sphere are burst when a certain pressure durability limit is exceeded, and the opening portion is formed together with the projection portion 112A and the concave portion 112B. Further, the sphere 70 is removed. The opening portion is formed through the gate electrode 14 and the insulating layer 13 and reflects part of the sphere 70. In the bottom portion of the opening portion, there remains the projection portion 112A for emitting electrons and the concave portion 112B which is surrounded by the projection portion 112A and reflects part of the form of the sphere 70.

[Crater-Type Field Emission Device (No. 2)]

The method of producing [crater-type field emission device (No. 2)] will be explained with reference to FIGS. 53A, 53B and 53C. This method differs from the method of producing [crater-type field emission device (No. 1)] in that the step of arranging a plurality of the spheres 70 on the support member 11 includes the steps of forming a composition layer 71 made of a composition which is a dispersion of the spheres 70 and the cathode electrode material in a dispersing agent on the support member 11, thereby to arrange a plurality of the spheres 70 on the support member 11, covering the spheres 70 with the cathode electrode 112 made of the cathode electrode material, and then, removing the dispersing agent, that is, the above step is a wet method.

[Step-900]

First, a plurality of the spheres 70 are arranged on the support member 11. Specifically, the composition layer 71 made of a composition which is a dispersion of the spheres 70 and the cathode electrode material 71B in a dispersing agent 71A is formed on the support member 11. That is, for example, isopropyl alcohol is used as a dispersing agent 71A, and a composition is prepared by dispersing the spheres 70 which are made of a polymethylene polymer material and have an average particle diameter of approximately 5 $\mu$m and carbon particles having an average particle diameter of 0.05 $\mu$m as the cathode electrode material 71B in the dispersing agent 71A. The composition is screen-printed on the support member 11 in the form of a stripe, to form the composition layer 71. FIG. 53A shows a state found immediately after the formation of the composition layer 71.

[Step-910]

In the composition layer 71 held on the support member 11, the spheres 70 soon precipitates to be arranged on the support member 11 and the cathode electrode material 71B also precipitates to form a cathode electrode 112, whereby a plurality of the spheres 70 can be arranged on the support member 11 and the spheres 70 can be covered with the cathode electrode 112 made of the cathode electrode material. FIG. 53B shows the thus-obtained state.

[Step-920]

Then, the dispersing agent 71A is evaporated off. FIG. 53C shows the thus-obtained state.

[Step-930]

Then, steps similar to [Step-820] to [Step-850] in [crater-type field emission device (No. 1)] or the variant of the method of producing [crater-type field emission device (No. 1)] is carried out, whereby a field emission device similar to the field emission device shown in FIG. 52B can be completed.

[Crater-Type Field Emission Device (No. 3)]

The method of producing [crater-type field emission device (No. 3)] will be explained below, and the step of forming the stripe-shaped cathode electrode on the support member comprises the steps of;

arranging a plurality of the spheres on the support member;

forming a cathode electrode which has a plurality of the projection portions for emitting electrons and the concave portions each of which is surrounded by the projection portion and reflects part of the sphere, on the support member; and removing the spheres.

A plurality of the spheres are arranged on the support member by spraying. The spheres have a hydrophobic surface-treatment layer. The [crater-type field emission device (No. 3)] will be explained with reference to FIGS. 54A, 54B and 54C hereinafter.

[Step-1000]

First, a plurality of the spheres 170 are arranged on the support member 11. Specifically, a plurality of the spheres 170 are arranged on the entire surface of the support member 11 made, for example, of glass. The spheres 170 are formed by providing a core material 170A made, for example, of a divinylbenzene polymer material and coating the core material 170A with a surface-treatment layer 170B made of a polytetrafluoroethylene resin, and the spheres 170 have an average diameter of approximately 5 μm and a particle diameter distribution of less than 1%. The spheres 170 are arranged on the support member 11 in a density of approximately 1000 spheres/mm$^2$ at random with a spray gun. The arranged spheres 170 are held on the support member 11 by an electrostatic force. FIG. 54A shows the thus-obtained state.

[Step-1010]

Then, on the support member 11 is formed a cathode electrode 112 having a plurality of projection portions 112A for emitting electrons and concave portion 112B each of which is surrounded by the projection portion 112A and reflects part of form of the sphere 170, the projection portions 112A being formed around the spheres 170. Specifically, as described with regard to [crater-type field emission device (No. 1)], for example, a carbon paste is screen-printed in the form of a stripe. In [crater-type field emission device (No. 3)], the surface of each sphere 170 has hydrophobic nature due to the surface-treatment layer 170B, so that the carbon paste screen-printed on the sphere 170 is immediately repelled and dropped off and is deposited around the sphere 170 to form the projection portion 112A. The top end of each projection portion 112A is not so sharpened as that in [crater-type field emission device (No. 1)]. A portion of the cathode electrode 112 which portion enters between the sphere 170 and the support member 11 constitutes the concave portion 112B. While FIG. 54B shows a state where a gap is present between the cathode electrode 112 and the sphere 170, the cathode electrode 112 and the sphere 170 are in contact with each other in some cases. Then, the cathode electrode 112 is dried, for example, at 150° C. FIG. 54B shows the thus-obtained state.

[Step-1020]

Then, an external force is exerted on the spheres 170 to remove the spheres 170 from the support member 11. Specifically, the method of removal includes a washing method and a method of blowing a compressed gas. FIG. 54C shows the thus-obtained state. The spheres can be also removed by the state change and/or the chemical change of the spheres, more specifically, for example, by combustion, which is also applicable to [crater-type field emission device (No. 4)] to be described later.

[Step-1030]

Then, [Step-830] to [Step-850] in [crater-type field emission device (No. 1)] are carried out, whereby there can be obtained a field emission device which is almost the same as the field emission device shown in FIG. 52B.

In a variant of the method of producing [crater-type field emission device (No. 3)], there may be employed a constitution in which [Step-830] to [Step-850] in [crater-type field emission device (No. 1)] are carried out after [Step-1010] and then [Step-1020] is carried out.

[Crater-Type Field Emission Device (No. 4)]

The method of producing [crater-type field emission device (No. 4)] will be explained. In this method, more specifically, the step of forming the stripe-shaped cathode electrode on the support member comprises the steps of;

arranging a plurality of the spheres on the support member; and forming a cathode electrode which has a plurality of the projection portions for emitting electrons and the concave portions each of which is surrounded by the projection portion and reflects part of the form of the sphere, on the support member, each projection portion being formed in a circumference of each sphere.

When an insulating layer is formed on the entire surface, the insulating layer having opening portions above the spheres is formed on the cathode electrode and the support member. The spheres are removed after the opening portions are formed. In the method of producing the field emission device in [crater-type field emission device (No. 4)], a plurality of the spheres are arranged on the support member by spraying the spheres. Each sphere has a hydrophobic surface-treatment layer. The [crater-type field emission device (No. 4)] will be explained with reference to FIGS. 55A, 55B, 56A and 56B.

[Step-1100]

First, a plurality of the spheres 170 are arranged on the support member 11. Specifically, a step similar to [Step-1000] in [crater-type field emission device (No. 3)] is carried out.

[Step-1110]

Then, formed on the support member 11 is a cathode electrode 112 having a plurality of projection portions 112A for emitting electrons and concave portions each of which is surrounded by the projection portion 112A and reflects part of the form of the sphere 170, each projection portion 112A being formed in a circumference of each sphere 170. Specifically, a step similar to [Step-1010] in [crater-type field emission device (No. 3)] is carried out.

[Step-1120]

An insulating layer 113 having opening portions 15A above the spheres is formed on the cathode electrode 112 and the support member 11. Specifically, a glass paste is screen-printed on the entire surface to form a layer having a thickness of approximately 5 μm. The screen-printing of a glass paste can be carried out in the same manner as in [crater-type field emission device (No. 1)]. The surface of each sphere 170 has hydrophobic nature due to the surface-treatment layer 170B, so that the screen-printed glass paste is immediately repelled and dropped off and that portion of the insulating layer 113 which portion is on each sphere 170 shrinks due to its surface tension. As a result, the top portion of each sphere 170 is exposed into the opening portion 15A without being covered with the insulating layer 113. FIG. 55A shows the thus-obtained state. In a shown embodiment, the top end portion of the opening portion 15A has a larger diameter than the sphere 170. When the surface-treatment layer 170B has a smaller interfacial tension (surface tension) than the glass paste, the opening portion 15A tends to have a smaller diameter. When the surface-treatment layer 170B has an extremely larger interfacial tension than the glass paste, the opening portion 15A tends to have a larger diameter. Then, the insulating layer 113 is dried, for example, at 150° C.

[Step-1130]

Then, a gate electrode 114 having an opening portion 15B communicating with the opening portion 15A is formed on the insulating layer 113. Specifically, a carbon paste is screen-printed in the form of a stripe. The screen-printing of a carbon paste can be carried out in the same manner as in [crater-type field emission device (No. 1)]. Since, however, the surface of the sphere 170 has higher hydrophobic nature due to the surface-treatment layer 170B, the carbon paste screen-printed on the sphere 170 is immediately repelled and shrinks due to its own surface tension to form a state where it adheres to the surface of the insulating layer 113 alone. In this case, the gate electrode 114 may be formed so as to droop from the opening end portion of the insulating layer 113 into the opening portion 15A to some extent. Then, the gate electrode 114 is dried, for example, at 150° C. FIG. 55B shows the thus-completed state. When the surface-treatment layer 170B has a smaller interfacial tension than the carbon paste, the opening portion 15A tends to have a smaller diameter. When the surface-treatment layer 170B has an extremely larger interfacial tension than the carbon paste, the opening portion 15A tends to have a larger diameter.

[Step-1140]

Then, the sphere 170 exposed in the opening portion 15A and 15B is removed. Specifically, the sphere 170 is combusted by heating the sphere at approximately 530° C., a typical temperature for calcining a glass paste, which heating also works to calcine the cathode electrode 112, the insulating layer 113 and the gate electrode 114. In this case, the insulating layer 113 and the gate electrode 114 have the opening portions 15A and 15B from the beginning unlike [crater-type field emission device (No. 1)], so that part of the cathode electrode 112, the insulating layer 113 or the gate electrode 114 is not dissipated in any case, and the sphere 170 is readily removed. When the upper end portion of the opening portions 15A and 15B has a larger diameter than the sphere 170, the sphere 170 can be removed by an external force such as washing or blowing with a compressed gas without combusting the sphere 170. FIG. 56A shows the thus-completed state.

[Step-1150]

Part of the insulating layer 113 which part corresponds to the side wall surface of the opening portion 15A is isotropically etched, whereby a field emission device shown in FIG. 56B can be completed. In this embodiment, the lower end of the gate electrode 114 faces downward, which is preferred for increasing the electric field intensity in the opening portion 15.

[Edge-Type Field Emission Device]

FIG. 57A shows a schematic partial cross-sectional view of an edge-type field emission device. The edge-type field emission device has a stripe-shaped cathode electrode 212 formed on the support member 11; an insulating layer 13 formed on the support member 11 and the cathode electrode 212; and a stripe-shaped gate electrode 14 formed on the insulating layer 13. An opening portion 15 is formed through the gate electrode 14 and the insulating layer 13. An edge portion 212A of the cathode electrode 212 is exposed in the bottom portion of the opening portion 15. A voltage is applied to the cathode electrode 212 and the gate electrode 14, whereby electrons are emitted from the edge portion 212A of the cathode electrode 212.

As shown in FIG. 57B, a concave portion 11A may be formed in the support member 11 below the cathode electrode 212 inside the opening portion 15. Otherwise, as FIG. 57C shows a schematic partial cross-sectional view, the edge-type field emission device may have a first gate electrode 14A formed on the support member 11; a first insulating layer 13A formed on the support member 11 and the first gate electrode 14A; a cathode electrode 212 formed on the first insulating layer 13A; a second insulating layer 13B formed on the first insulating layer 13A and the cathode electrode 212; and a second gate electrode 14B formed on the second insulating layer 13B. And, an opening portion 15 is formed through the second gate electrode 14B, the second insulating layer 13B, the cathode electrode 212 and the first insulating layer 13A. An edge portion 212A of the cathode electrode 212 is exposed on a side wall surface of the opening portion 15. A voltage is applied to the cathode electrode 212 and the first and second gate electrodes 14A and 14B, whereby electrons are emitted from the edge portion 212A of the cathode electrode 212.

The method of producing the edge-type field emission device shown, for example, in FIG. 57C will be explained with reference to FIGS. 58A, 58B and 58C showing schematic partial cross-sectional views of the support member and the like.

[Step-1200]

First, an approximately 0.2 $\mu$m thick tungsten layer is formed on the support member 11 made, for example, of a glass substrate by a sputtering method, and the tungsten layer is patterned by photolithography and a dry etching method, to form the first gate electrode 14A. Then, the first insulating layer 13A, which is made of $SiO_2$ and has a thickness of approximately 0.3 $\mu$m, is formed on the entire surface, and then the stripe-shaped cathode electrode 212 made of tungsten is formed on the first insulating layer 13A (see FIG. 58A).

[Step-1210]

Then, the second insulating layer 13B, which, for example, is made of $SiO_2$ and has a thickness of 0.7 $\mu$m, is formed on the entire surface, and then the stripe-shaped second gate electrode 14B is formed on the second insulating layer 13B (see FIG. 58B). The material for, and the thickness of, the second gate electrode 14B may be the same as, or different from, those for/of the first gate electrode 14A.

[Step-1220]

Then, a resist layer 67 is formed on the entire surface, and a resist opening portion 67A is formed in the resist layer 67 such that part of the surface of the second gate electrode 14B is exposed. The resist opening portion 67A has a rectangular form in a plan view. The rectangular form has a major side length of approximately 100 $\mu$m and a minor side length of several to 10 $\mu$m. Then, the second gate electrode 14B exposed in the bottom portion of the resist opening portion 67A is anisotropically etched, for example, by an RIE method, to form an opening portion. Then, the second insulating layer 13B exposed in the bottom portion of the opening portion is isotropically etched to form an opening portion (see FIG. 58C). Since the second insulating layer 13B is made of $SiO_2$, wet etching is carried out using a buffered hydrofluoric acid aqueous solution. The side wall surface of the opening portion in the second insulating layer 13B recedes from the opening end portion of the opening portion formed in the second gate electrode 14B. In this case, the recess amount can be controlled by adjusting the etching time period. In this embodiment, the wet etching is carried out until the lower end of the opening portion formed in the second insulating layer 13B recedes from the opening end portion of the opening portion formed in the second gate electrode 14B.

The cathode electrode 212 exposed in the bottom portion of the opening portion is dry-etched under a condition where ions are used as main etching species. In the dry-etching using ions as main etching species, ions as charged particles can be accelerated by applying a biased voltage to an object to be etched or utilizing interaction of plasma and an electric field, and generally, anisotropic etching proceeds, so that the etched object has a perpendicular wall as a processed surface. In this step, however, the main etching species in plasma contain incidence components having angles different from the perpendicularity, and obliquely entering components are also generated due to scattering on the end portion of the opening portion, so that, at some probability, main etching species enter regions which ion originally should not reach in the exposed surface of the cathode electrode 212 since the regions are shielded by the opening portion. In this case, main etching species having a smaller incidence angle with regard to the normal of the support member 11 show a higher entering probability, and main etching species having a larger incidence angle show a lower entering probability.

Therefore, while the position of upper end portion of the opening portion formed in the cathode electrode 212 is nearly lined up with the lower end portion of the opening portion formed in the second insulating layer 13B, the position of the lower end portion of the opening portion formed in the cathode electrode 212 is projected from the upper end portion thereof. That is, the thickness of the edge portion 212A of the cathode electrode 212 decreases toward the leading end portion in the projection direction, and the edge portion 212A is sharpened. For example, when $SF_6$ is used as an etching gas, the cathode electrode 212 can be excellently processed.

The first insulating layer 13A exposed in a bottom portion of the opening portion formed in the cathode electrode 212 is isotropically etched, to form an opening portion in the first insulating layer 13A, whereby the opening portion 15 is completed. In this embodiment, wet etching is carried out using a buffered hydrofluoric acid aqueous solution. The side wall surface of the opening portion formed in the first insulating layer 13A recedes from the lower end portion of the opening portion formed in the cathode electrode 212. In this case, the recess amount can be controlled by adjusting the etching time period. After the completion of the opening portion 15, the resist layer 67 is removed, whereby the constitution shown in FIG. 57C can be obtained.

[Spindt-Type Field Emission Device: Variant-1 of Production Method]

A variant of the method of producing the Spindt-type field emission device, explained in [Spindt-type field emission device], will be explained hereinafter with reference to FIGS. 59A, 59B, 60A, 60B, 61A, 61B and 62 showing schematic partial end views of a support member, etc. This Spindt-type field emission device (see FIG. 62) is produced basically according to the steps of;

(a) forming a cathode electrode 12 on a support member 11, (b) forming an insulating layer 13 on the cathode electrode 12 and the support member 11, (c) forming a gate electrode 14 on the insulating layer 13, (d) forming an opening portion 15 having the cathode electrode 12 exposed in a bottom portion thereof, at least in the insulating layer 13, (e) forming an electrically conductive material layer 81 for an electron-emitting portion on the entire surface including the inside of the opening portion 15, (f) forming a mask material layer 82 on the electrically conductive material layer 81 so as to mask a region of the electrically conductive material layer 81 which region is positioned in a central portion of the opening portion 15, and (g) etching the electrically conductive material layer 81 and the mask material layer 82 under an anisotropic etching condition where an etching rate of the electrically conductive material layer 81 in the direction perpendicular to the support member 11 is higher than an etching rate of the mask material layer 82 in the direction perpendicular to the support member 11, to form an electron emission electrode 16E which is constituted of the electrically conductive material layer 81 and has a top end portion having a conical form, on the cathode electrode 12 exposed in the opening portion 15.

[Step-1300]

The cathode electrode 12 made of chromium (Cr) is formed on the support member 11 prepared, for example, by forming an approximately 0.6 $\mu$m thick $SiO_2$ layer on a glass substrate. Specifically, an electrically conductive material layer made of chromium for a cathode electrode is deposited on the support member 11, for example, by a sputtering method or a CVD method, and the electrically conductive material layer is patterned, whereby there can be formed a plurality of cathode electrodes 12. Each cathode electrode 12 has a width, for example, of 50 $\mu$m and one cathode electrode 12 is spaced from another cathode electrode 12 at a distance, for example, of 30 $\mu$m. Then, the insulating layer 13 made of $SiO_2$ is formed on the entire surface, specifically, on the cathode electrode 12 and the support member 11 by a plasma CVD method using TEOS (tetraethoxysilane) as a source gas. The insulating layer 13 has a thickness of approximately 1 $\mu$m. Then, the stripe-shaped gate electrode 14 is formed on the entire surface on the insulating layer 13, the gate electrode 14 extending in the direction at right angles with the cathode electrode 12.

Then, in an overlap region where the stripe-shaped cathode electrode 12 and the stripe-shaped gate electrode 14 overlap, that is, in a one-pixel region, the opening portion 15 is formed through the gate electrode 14 and the insulating layer 13. The opening portion 15 has, for example, the plan form of a circle having a diameter of 0.3 $\mu$m. Generally, hundreds to thousands of opening portions 15 are formed per one-pixel region (one overlap region). For forming the opening portions 15, while a resist layer formed by general photolithography is used as a mask, first, the opening portions 15 are formed in the gate electrode 14, and then, the opening portions 15 are formed in the insulating layer 13. After RIE, the resist layer is removed by ashing (see FIG. 59A).

[Step-1310]

Then, an adhesion layer 80 is formed on the entire surface by a sputtering method (see FIG. 59B). The adhesion layer 80 is provided for improving the adhesion of an electrically conductive material layer 81 to be formed in a step to follow to the insulating layer 13 exposed in a non-formed regions of the gate electrode and to the side wall surfaces of the opening portions 15. On condition that tungsten is used to form the electrically conductive material layer 81, the adhesion layer 80, which is made of tungsten, is formed as a 0.07 $\mu$m thick layer by a DC sputtering method.

[Step-1320]

The electrically conductive material layer 81 for an electron-emitting portion is formed on the entire surface including the inside of the opening portion 15 by a hydrogen reduction pressure reduced CVD method, the electrically conductive material layer 81 having a thickness of approximately 0.6 $\mu$m and being made of tungsten (see FIG. 60A). In the surface of the formed electrically conductive material layer 81, formed is a recess 81A reflecting a step between the top end surface and the surface of bottom portion of the opening portion 15.

[Step-1330]

A mask material layer 82 is formed so as to cover a region (specifically, the recess 81A) of the electrically conductive material layer 81 which region is positioned in the central portion of the opening portion 15. Specifically, a 0.35 $\mu$m thick resist layer as the mask material layer 82 is formed on the electrically conductive material layer 81 by a spin coating method (see FIG. 60B). The mask material layer 82 absorbs the recess 81A of the electrically conductive material layer 81 to form a nearly flat surface. Then, the mask material layer 82 is etched by an RIE method using oxygen-containing gas. The etching is terminated when a flat surface of the electrically conductive material layer 81 is exposed, whereby the mask material layer 82 remains so as to form a flat surface by filling itself in the recess 81A of the electrically conductive material layer 81 (see FIG. 61A).

[Step-1340]

Then, the electrically conductive material layer 81, the mask material layer 82 and the adhesion layer 80 are etched to form a conical electron emission electrode 16E (see FIG. 61B). These layers are etched under an anisotropic etching condition where an etching rate of the electrically conductive material 81 is higher than an etching rate of the mask material layer 82. The following Table 2 shows the etching condition.

TABLE 2

[Etching condition of electrically conductive material layer 81, etc.]

| | |
|---|---|
| $SF_6$ low rate | 150 SCCM |
| $O_2$ flow rate | 30 SCCM |
| Ar flow rate | 90 SCCM |
| Pressure | 35 Pa |
| RF power | 0.7 kW (13.56 MHz) |

[Step-1350]

Inside the opening portion 15, the side wall surface of the opening portion 15 formed in the insulating layer 13 is receded under an isotropic etching condition, whereby a field emission device shown in FIG. 62 is completed. The isotropic etching can be carried out by a dry etching method using radical as main etching species such as chemical dry etching, or by a wet etching method using an etching solution. As an etching solution, for example, there may be used a mixture containing a 49% hydrofluoric acid aqueous solution and pure water in a 49% hydrofluoric acid aqueous solution/pure water volume ratio of 1/100.

The mechanism of forming the electron emission device 16E in [Step-1340] will be explained with reference to FIGS. 63A and 63B. FIG. 63A schematically shows how the surface profile of a material being etched changes at constant time intervals as the etching proceeds, and FIG. 63B is a graph showing a relationship between an etching time and a thickness of the material being etched in the center of the opening portion 15. The mask material layer has a thickness $h_p$ in the center of the opening portion 15, and the electron emission electrode 16E has a height he in the center of the opening portion 15.

Under the etching condition shown in Table 2, the etching rate of the electrically conductive material layer 81 is naturally higher than the etching rate of the mask material layer 82 made of a resist material. In a region where no mask material layer 82 is present, the electrically conductive material layer 81 immediately begins to be etched, and the surface of the material being etched readily goes down. In contrast, in a region where the mask material layer 82 is present, the electrically conductive material layer 81 begins to be etched only after the mask material layer 82 is removed first. While the mask material layer 82 is etched, therefore, the decremental rate of thickness of the material being etched is low ($h_p$ decremental interval), and the decremental rate of thickness of the material being etched comes to be as high as the etching rate in the region where no mask material layer 82 is present only when the mask material layer 82 disappears ($h_e$ decremental interval). The time at which the $h_p$ decremental interval begins comes the last in the center of the opening portion 15 where the mask material layer 82 has a largest thickness, and comes earlier in a region nearer to the circumference of the opening portion 15 where the mask material layer 82 has a smaller thickness. In the above manner, the electron emission electrode 16E having a conical form is formed.

The ratio of the etching rate of the electrically conductive material layer 81 to the etching rate of the mask material layer 82 made of a resist material will be referred to as "selective ratio to a resist". The selective ratio to a resist is an important factor for determining the height and the form of the electron emission electrode 16E. This point will be explained with reference to FIGS. 64A, 64B and 64C. FIG. 64A shows a form of the electron emission electrode 16E formed when the selective ratio to a resist is relatively small. FIG. 64C shows a form of the electron emission electrode 16E formed when the selective ratio to a resist is relatively large. FIG. 64B shows a form of the electron emission electrode 16E formed when the selective ratio to a resist is intermediate. It is seen that with an increase in the selective ratio to a resist, the film decrease of the electrically conductive material layer 81 is sharp as compared with the film decrease of the mask material layer 82, so that the electron emission electrode 16E has a larger height and a sharper form. The selective ratio to a resist decreases with an increase in the $O_2$ flow rate relative to the $SF_6$ flow rate. When an etching apparatus which makes it possible to change the incidence energy of ion by co-using substrate bias is used, the selective ratio to a resist can be decreased by increasing the RF bias power or decreasing the frequency of AC power source for bias application. When the selective ratio to a resist is selected, it is at least 1.5, preferably at least 2, more preferably at least 3.

In the above etching, naturally, it is required to secure a high selective etching ratio to the gate electrode 14 and the cathode electrode 12. Under the condition shown in Table 2, no problem is caused. The reason therefor is as below. The material constituting the gate electrode 14 or the cathode electrode 12 is hardly etched with fluorine-containing etching species, and under the above condition, a selective etching ratio of approximately 10 or more can be obtained.

[Spindt-Type Field Emission Device: Variant-2 of Production Method]

The variant-2 of the method of producing the Spindt-type field emission device is a variant of the variant-1 of the method of producing the Spindt-type field emission device. In the variant-2 of the production method, the region of the electrically conductive material layer which region is covered with the mask material layer can be narrowed as compared with the variant-1 of the production method. In the variant-2 of the production method, a nearly funnel-like recess having a columnar portion and a widened portion communicating with the upper end of the columnar portion is formed in a surface of the conductive material layer by utilizing a step between the upper end surface and the surface of bottom portion of the opening portion, and in the step (f), the mask material layer is formed on the entire surface of the electrically conductive material layer. Then, the mask material layer and the electrically conductive material layer are removed in a plane in parallel with the surface of the support member, whereby the mask material layer is retained in the columnar portion.

The variant-2 of the method of producing the Spindt-type field emission device will be explained hereinafter with reference to FIGS. 65A, 65B, 66A, 66B, 67A and 67B showing schematic partial end views of a support member, etc.

[Step-1400]

First, the cathode electrode 12 is formed on the support member 11. That is, an electrically conductive material layer for an cathode electrode is formed by stacking a TiN layer (thickness 0.1 $\mu$m), a Ti layer (thickness 5 nm), an Al—Cu layer (thickness 0.4 $\mu$m), a Ti layer (thickness 5 nm), a TiN layer (thickness 0.02 $\mu$m) and a Ti layer (thickness 0.02 $\mu$m) in this order, for example, by a DC sputtering method to form a stacked layer and patterning the stacked layer in the form of a stripe. The drawings show the cathode electrode 12 as a single layer. Then, a 0.7 μm thick insulating layer 13 is formed on the entire surface, specifically, on the support member 11 and the cathode electrode 12 by a plasma CVD method using TEOS (tetraethoxysilane) as a source gas. Then, a stripe-shaped gate electrode 14 is formed on the insulating layer 13.

Further, a 0.2 μm thick etching-stop layer 83 made of $SiO_2$ is formed on the entire surface. The etching-stop layer 83 is not essential for the function of the field emission device but works to protect the gate electrode 14 when the electrically conductive material layer 81 is etched in a step to come later. When the gate electrode 14 has sufficiently high etching durability against an etching condition of the electrically conductive material layer 81, the etching-stop layer 83 may be omitted. Then, an opening portion 15 is formed through the etching stop layer 83, the gate electrode 14 and the insulating layer 13 by an RIE method. The cathode electrode 12 is exposed in a bottom portion of the opening portion 15. In this manner, a state shown in FIG. 65A is obtained.

[Step-1410]

Then, a 0.03 μm thick adhesion layer 80 made, for example, of tungsten is formed on the entire surface including the inside of the opening portion 15 (see FIG. 65B). Then, an electrically conductive material layer 81 for an electron-emitting portion is formed on the entire surface including the inside of the opening portion 15. In the variant-2 of the production method, the thickness of the electrically conductive material layer 81 is determined such that a recess 81A having a larger depth than the recess 81 described in the variant-1 of the production method is formed in the surface. That is, the thickness of the electrically conductive material layer 81 is properly determined, whereby there can be formed a nearly funnel-like recess 81A having a columnar portion 81B and a widened portion 81C communicating with the upper end of the columnar portion 81B in the surface of the conductive material layer 81 by utilizing a step between the upper end surface and the surface of bottom portion of the opening portion 15.

[Step-1420]

Then, an approximately 0.5 μm thick mask material layer 82 made of copper (Cu) is formed on the entire surface of the electrically conductive material layer 81 by an electroless plating method (see FIG. 66A). Table 3 shows a condition of the electroless plating.

TABLE 3

| | | |
|---|---|---|
| Plating solution | Copper sulfate ($CuSO_4.5H_2O$) | 7 g/liter |
| | Formalin (37% HCHO) | 20 ml/liter |
| | Sodium hydroxide (NaOH) | 10 g/liter |
| | Potassium sodium tartarate | 20 g/liter |
| Plating bath temperature | 50° C. | |

[Step-1430]

Then, the mask material layer 82 and the electrically conductive material layer 81 are removed in a plane in parallel with the surface of the support member 11, to retain the mask material layer 82 in the columnar portion 81B (see FIG. 66B). The above removal can be carried out, for example, by a chemical/mechanical polishing (CMP) method.

[Step-1440]

Then, the electrically conductive material layer 81, the mask material layer 82 and the adhesion layer 80 are etched under an anisotropic condition where etching rates of the electrically conductive material layer 81 and the adhesion layer 80 are higher than an etching rate of the mask material layer 82. As a result, an electron emission electrode 16E having a conical form is formed in the opening portion 15 (see FIG. 67A). When the top end portion of the electron emission electrode 16E has a residual mask material layer 82, the residual mask material layer 82 can be removed by a wet etching method using a diluted hydrofluoric acid aqueous solution.

[Step-1450]

Inside the opening portion 15 formed in the insulating layer 13, the side wall surface of the opening portion 15 is receded under an isotropic etching condition, whereby a field emission device shown in FIG. 67B is completed. In this case, the etching-stop layer 83 is also removed. For the isotropic etching, there can be employed those explained in the variant-1 of the production method.

Meanwhile, in the electron emission electrode 16E formed in the variant-2 of the production method, a sharper conical form is formed than the counterpart of the electron emission electrode 16E formed in the variant-1 of the production method. This difference is caused by differences in form of the mask material layer 82 and the ratio of the etching rate of electrically conductive material layer 81 to the etching rate of the mask material layer 82. The above differences will be explained with reference to FIGS. 68A and 68B. FIGS. 68A and 68B show how the surface profile of a material being etched changes at constant intervals of time. FIG. 68A shows a case using a mask material layer 82 made of copper, and FIG. 68B shows a case using a mask material layer 82 made of a resist material. For simplification, it is assumed that the etching rate of the electrically conductive material layer 81 and the etching rate of the adhesion layer 80 are the same, and showing of the adhesion layer 80 is omitted.

When the mask material layer 82 made of copper is used (see FIG. 68A), the mask material layer 82 disappears in no case during etching since the etching rate of the mask material layer 82 is sufficiently low as compared with the etching rate of the electrically conductive material layer 81, so that an electron emission electrode 16E having a sharp top end portion can be formed. In contrast, when a mask material layer 82 made of a resist material is used (see FIG. 68B), the mask material layer 82 is liable to disappear during the etching since the etching rate of the mask material layer 82 is not low as compared with the etching rate of the electrically conductive material layer 81. After the mask material layer disappears, therefore, the conical form of the electron emission electrode 16E tends to become obtuse.

Further, the mask material layer 82 remaining in the columnar portion 81B has a merit that the form of the electron emission electrode 16E does not much change even if the depth of the columnar portion 81B changes to some extent. That is, the depth of the columnar portion 81B can vary depending upon the thickness of the electrically conductive material layer 81 and the fluctuation of the step coverage. Since, however, the width of the columnar portion 81B is nearly constant regardless of the depth, the width of the mask material layer 82 comes to be nearly constant, so that there is not much difference in the form of the electron emission electrode 16E finally formed. In contrast, in the mask material layer 82 retained in the recess 81A, the width of the mask material layer changes depending upon whether the recess 81A has a large depth or a small depth, so that the conical form of the electron emission electrode 16E begins to become obtuse earlier when the recess 81A is shallower and when the mask material layer 82 has s smaller thickness. The electron emission efficiency of the field emission device changes depending upon a potential difference between the gate electrode and the cathode electrode, a distance between the gate electrode and the cathode electrode and a work function of a material constituting the electron-emitting portion, and it also changes depending upon the form of top end portion of the electron emitting portion. It is therefore preferred to make the above selection of the form and the etching rate of the mask material layer as required.

[Spindt-Type Field Emission Device: Variant-3 of Production Method]

The variant-3 of the production method is a variant of the variant-2 of the production method. In the variant-3 of the production method, a nearly funnel-like recess having a columnar portion and a widened portion communicating with the upper end portion of the columnar portion is formed in a surface of the electrically conductive material layer in step (e), the columnar portion reflecting a step between the upper end surface and the surface of bottom portion of the opening portion, and in step (f), the mask material layer is formed on the entire surface of the electrically conductive material layer, and the mask material layer on the electrically conductive material layer and inside the widened portion is removed, whereby the mask material layer is retained in the columnar portion. The variant-3 of the method of producing the Spindt-type field emission device will be explained hereinafter with reference to FIGS. 69A, 69B and 70 showing schematic partial end views of the support member, etc.

[Step-1500]

Procedures up to the formation of the mask material layer 82 shown in FIG. 66A are carried out in the same manner as in [Step-1400] to [Step-1420] in the variant-2 of the production method, and then the mask material layer 82 only on the electrically conductive material layer 81 and inside the widened portion 81C is removed, to retain the mask material layer 82 in the columnar portion 81B (see FIG. 69A). In this case, wet etching is carried out, for example, with a diluted hydrofluoric acid aqueous solution, whereby only the mask material layer 82 made of copper can be selectively removed without removing the electrically conductive material layer 81 made of tungsten. The height of the mask material layer 82 remaining in the columnar portion 81B differs depending upon the etching time period. However, the etching time period is not so strict so long as the mask material layer 82 filled in the widened portion 81C is fully removed. The reason therefore is as follows. A discussion on the height of the mask material layer 82 is substantially the same as the above discussion made on the depth of the columnar portion 81B with reference to FIG. 68A, and the height of the mask material layer 82 has no major effect on the form of the electron emission electrode 16E to be finally formed.

[Step-1510]

Then, the electrically conductive material layer 81, the mask material layer 82 and the adhesion layer 80 are etched in the same manner as in the variant-2 of the production method, to form the electron emission electrode 16E shown in FIG. 69B. While the entire electron emission electrode 16E may naturally have a conical form as shown in FIG. 67A, FIG. 69B shows a variant in which a top portion alone has a conical form. Such a form is produced when the height of the mask material layer 82 filled in the columnar portion 81B is small or when the etching rate of the mask material layer 82 is relatively high. Such a form does not at all affect the function of the electron emission electrode 16E.

[Step-1520]

In the opening portion 15 formed in the insulating layer 13, the side wall surface of the opening portion 15 is receded under an isotropic etching condition, whereby the field emission device shown in FIG. 70 is completed. The isotropic etching can be carried out in the same manner as in the variant-1 of the production method.

[Spindt-Type Field Emission Device: Variant-4 of Production Method]

The variant-4 of the production method is a variant of the variant-1 of the production method. FIG. 71 shows a schematic partial end view of a Spindt-type field emission device produced in the variant-4 of the production method. The variant-4 of the production method differs from the variant-1 of the production method in that the electron-emitting portion has a base 84 and a conical electron emission electrode 16E stacked on the base 84. The base 84 is made of one material, and the electron emission electrode 16E is made of another material. Specifically, the base 84 is a member for adjusting a distance between the electron emission electrode 16E and the opening end portion of the gate electrode 14, has a function as a resistance layer and is constituted of a polysilicon layer containing an impurity. The electron emission electrode 16E is made of tungsten, and has a conical form, more specifically, the form of a circular cone. An adhesion layer 80 made of TiN is formed between the base 84 and the electron emission electrode 16E. The adhesion layer 80 is not a component essential for the function of the electron-emitting portion but is provided for a production-related reason. The insulating layer 13 is scraped from immediately below the gate electrode 14 toward the upper end portion of the base 84, to form an opening portion 15.

The variant-4 of the production method will be explained hereinafter with reference to FIGS. 72A, 72B, 73A, 73B, 74A and 74B showing schematic partial end views of the support member, etc.

[Step-1600]

First, procedures up to the formation of the opening portion 15 are carried out in the same manner as in [Step-1300] in the variant-1 of the production method. Then, an electrically conductive material layer 84A for forming the base is formed on the entire surface including the inside of the opening portion 15. The electrically conductive material layer 84A also works as a resistance layer, is constituted of a polysilicon layer and can be formed by a plasma CVD method. Then, a flattening layer 85 constituted of a resist layer is formed on the entire surface by a spin coating method so as to form a nearly flat surface (see FIG. 72A). Then, the flattening layer 85 and the electrically conductive material layer 84A are etched under a condition where etching rates of these layers are nearly the same, to fill the bottom portion of the opening portion 15 with the base portion 84 having a flat upper surface (see FIG. 72B). The etching can be carried out by an RIE method using an etching gas containing a chlorine-containing gas and an oxygen-containing gas. Since the surface of the electrically conductive material layer 84A is flattened with the flattening layer 85, the base 84 comes to have a flat upper surface.

[Step-1610]

Then, an adhesion layer 80 is formed on the entire surface including the inside of rest of the opening portion 15, and an electrically conductive material layer 81 for an electron-emitting portion is formed on the entire surface including the inside of rest of the opening portion 15, to fill the rest of the opening portion 15 with the electrically conductive material layer 81 (see FIG. 73A). The adhesion layer 80 is a 0.07 $\mu$m thick TiN layer formed by a sputtering method, and the electrically conductive material layer 81 is a 0.6 $\mu$m thick tungsten layer formed by a reduced pressure CVD method. A recess 81A reflecting a step between the upper end surface and the surface of bottom portion of the opening portion 15 is formed in the surface of the electrically conductive material layer 81.

[Step-1620]

Then, a mask material layer 82 constituted of a resist layer is formed on the entire surface of the electrically conductive material layer 81 by a spin coating method to form a nearly flat surface (FIG. 73B). The mask material layer 82 absorbs the recess 81A in the surface of the electrically conductive material layer 81 and forms a nearly flat surface. Then, the mask material layer 82 is etched by an RIE method using an oxygen gas (see FIG. 74A). The etching is terminated when a flat surface of the electrically conductive material layer 81 is exposed. In this manner, the mask material layer 82 is retained in the recess 81A of the electrically conductive material 81 to form a flat surface, and the mask material layer 82 is formed so as to cover a region of the electrically conductive material layer 81 which region is positioned in the center of the opening portion 15.

[Step-1630]

Then, the electrically conductive material layer 81, the mask material layer 82 and the adhesion layer 80 are etched together in the same manner as in [Step-1340] in the variant-1 of the production method, whereby the electron emission electrode 16E having a conical form depending upon the selective ratio to a resist based on the above-described mechanism and the adhesion layer 80 are formed, and the electron-emitting portion is completed (see FIG. 74B). Then, inside the opening portion 15 formed in the insulating layer 13, the side wall surface of the opening portion 15 is receded, whereby a field emission device shown in FIG. 71 can be obtained.

[Spindt-Type Field Emission Device: Variant-5 of Production Method]

The variant-5 of the production method is a variant of the variant-2 of the production method. FIG. 76B shows a schematic partial end view of a Spindt-type field emission device produced in the variant-5 of the production method. The variant-5 of the production method differs from the variant-2 of the production method in that the electron-emitting portion has a base 84 and a conical electron emission electrode 16E formed on the base 84 like the electron-emitting portion in the variant-4 of the production method. The base 84 is made of one material, and the electron emission electrode 16E is made of another material. Specifically, the base 84 is a member for adjusting a distance between the electron emission electrode 16E and the opening end portion of the gate electrode 14, has a function as a resistance layer and is constituted of a polysilicon layer containing an impurity. The electron emission electrode 16E is made of tungsten, and has a conical form, more specifically, the form of a circular cone. An adhesion layer 80 made of TiN is formed between the base 84 and the electron emission electrode 16E. The adhesion layer 80 is not a component essential for the function of the electron-emitting portion but is provided for a production-related reason. The insulating layer 13 is scraped from immediately below the gate electrode 14 toward the upper end portion of the base 84, to form an opening portion 15.

The variant-5 of the production method will be explained hereinafter with reference to FIGS. 75A, 75B, 76A and 76B showing schematic partial end views of a support member, etc.

[Step-1700]

First, procedures up to the formation of the opening portion 15 are carried out in the same manner as in [Step-1300] in the variant-1 of the production method. Then, an electrically conductive material layer for forming the base is formed on the entire surface including the inside of the opening portion 15, and the electrically conductive material layer is etched, whereby the base 84 filling the bottom portion of the opening portion 15 can be formed. While the base 84 shown in the drawings has a flat surface, the surface may be dented. The base 84 having a flat surface can be formed in the same manner as in [Step-1600] in the variant-4 of the production method. Further, the adhesion layer 80 and the electrically conductive material layer 81 for an electron-emitting portion are consecutively formed on the entire surface including the inside of rest of the opening portion 15. In this case, the thickness of the electrically conductive material layer 81 is determined such that a nearly funnel-like recess 81A having a columnar portion 81B and a widened portion 81C communicating with the upper end portion of the columnar portion 81B is formed in a surface of the electrically conductive material layer 81, the columnar portion 81B reflecting a step between the upper end surface of the rest of the opening portion 15 and the surface of the bottom portion thereof. Then, the mask material layer 82 is formed on the electrically conductive material layer 81. The mask material layer 82 is composed, for example, of copper. FIG. 75A shows the thus-completed state.

[Step-1710]

The mask material layer 82 and the electrically conductive material layer 81 are removed in a plane in parallel with the surface of the support member 11, to retain the mask material layer 82 in the columnar portion 81B (see FIG. 75B). The above removal can be carried out by a chemical mechanical/polishing method (CMP method) in the same manner as in [Step-1430] in the variant-2 of the production method.

[Step-1720]

Then, the electrically conductive material layer 81, the mask material layer 82 and the adhesion layer 80 are etched, to form an electron emission electrode 16E having a conical form depending upon the selective ratio to a resist based on the above-described mechanism. These layers can be etched in the same manner as in [Step-1440] in the variant-2 of the production method. The electron-emitting portion comprises the electron emission electrode 16E, the base 84 and the adhesion layer 80 remaining between the electron emission electrode 16E and the base 84. While the entire electron-emitting portion may naturally have a conical form, FIG. 76A shows a state where part of the base 84 is filled in the bottom portion of the opening portion 15. Such a form is produced when the mask material layer 82 filled in the columnar portion 81 has a small height or when the etching rate of the mask material layer 82 is relatively high. However, the above form does not at all affect the function of the electron-emitting portion.

[Step-1730]

Then, inside the opening portion 15, the side wall surface of the insulating layer 13 is receded under an isotropic etching condition, whereby a field emission device shown in FIG. 76B is completed. The isotropic etching condition can be the same as those explained in the variant-1 of the production method.

[Spindt-Type Field Emission Device: Variant-6 of Production Method]

The variant-6 of the production method is a variant of the variant-3 of the production method. The variant-6 of the production method differs from the variant-3 of the production method in that the electron-emitting portion has a base 84 and a conical electron emission electrode 16E formed on the base 84 like the variant-4 of the production method. The variant-6 of the production method will be explained hereinafter with reference to FIG. 77 showing a schematic partial end view of a support member, etc.

[Step-1800]

Procedures up to the formation of the mask material layer 82 are carried out in the same manner as in [Step-1700] in the variant-5 of the production method. Then, only the mask material layer 82 on the electrically conductive material layer 81 and in the widened portion 81C is removed, thereby to retain the mask material layer 82 in the columnar portion 81B (see FIG. 77). The mask material layer 82 made of copper can be selectively removed without removing the electrically conductive material layer 81 made of tungsten, for example, by wet etching with a diluted hydrofluoric acid aqueous solution. Thereafter, all the steps of etching the electrically conductive material layer 81 and the mask material layer 82, isotropically etching the insulating layer 13, etc., can be carried out in the same manner as in the variant-5 of the production method.

[Flat-Type Field Emission Device (No. 3)]

The flat-type field emission device (No. 3) is a variant of the flat-type field emission device (No. 1) explained already. The flat-type field emission device (No. 3) differs from the flat-type field emission device (No. 1) in that it has the fourth structure. That is, the flat-type field emission device (No. 3) comprises;

(A) a stripe-shaped spacer made of an insulating material and formed on a support member 11, (B) a gate electrode 314 made of a stripe-shaped material layer 314A having a plurality of opening portions 315, and (C) an electron-emitting portion, wherein the stripe-shaped material layer 314A is arranged to come in contact with the top surface of the spacer and to position the opening portion above the electron-emitting portion.

The stripe-shaped material layer 314A is fixed to the top surface of the spacer with a thermosetting adhesive (for example, an epoxy adhesive).

Alternatively, the stripe-shaped material layer 314A has a structure in which the two end portions thereof are fixed to circumferential portions of the support member 11 as shown in FIG. 78 showing a schematic partial cross-sectional view of an end portion of the support member 11 and a vicinity thereof. More specifically, for example, protrusions 316 are formed in the circumferential portion of the support member 11 in advance, and a thin film 317 made of the same material as a material for forming the stripe-shaped material layer 314A is formed on the top surface of the protrusion 316. And, the stripe-shaped material layer 314A is welded to the above thin film 317 with a laser in a state where the material layer is spread. The protrusions 316 can be formed concurrently with the formation of the spacer.

The method for producing the flat-type field emission device (No. 3) will be explained below.

[Step-1900]

A stripe-shaped cathode electrode 12 made of an electrically conductive material layer (Cr) for a cathode electrode, extending in a first direction, is formed on a support member 11 in the same manner as in [Step-600] in the flat-type field emission device (No. 1).

[Step-1910]

Then, an insulating layer 13 is formed in the same manner as in [Step-610] in the flat-type field emission device (No. 1). Then, an opening portion 15 is formed in the insulating layer 13 by lithography and an etching method. Otherwise, the opening portion 15 may be formed by a screen printing method together with the insulating layer 13. In this manner, the surface of the cathode electrode 12 which surface corresponds to the electron-emitting portion can be exposed in the bottom portion of the opening portion 15. The above insulating layer 13 corresponds to the spacer.

[Step-1320]

The stripe-shaped material layer 314A having a plurality of the opening portions 315 is arranged in a state in which it is supported on the insulating layer 13 that is a gate electrode supporting portion or a spacer so that the opening portion 315 is positioned above the electron-emitting portion, and that the stripe-shaped material layer 314A is arranged in a second direction different from the first direction, whereby the gate electrode 314 which is made of the stripe-shaped material layer 314A and has a plurality of opening portions 315 is positioned above the electron-emitting portions.

The above method of forming the gate electrode can be applied to the production of the above various field emission devices.

[Flat-Type Field Emission Device (No. 4)]

The flat-type field emission device (No. 4) is a variant of the flat-type field emission device (No. 3). Unlike the flat-type field emission device (No. 3), the flat-type field emission device (No. 4) has a separation wall 313 (corresponding to the spacer) between one cathode electrode 12 and another cathode electrode 12 as shown in the schematic partial cross-sectional view of FIG. 79A. FIG. 79B shows a schematic layout of the cathode electrode 12, the stripe-shaped material layer 314A, the stripe-shaped gate electrode 314 and the separation wall 313.

The stripe-shaped material layer 314A is fixed to the top surface of the separation wall 313 with a thermosetting adhesive (for example, epoxy adhesive). Alternatively, as shown in the schematic partial cross-sectional view of FIG. 78, two ends of the stripe-shaped material layer 314A may be fixed to a circumferential portion of the support member 11. More specifically, for example, protrusions 316 are formed in the circumferential portion of the support member 11 in advance, and a thin layer 317 made of the same material as that for forming the stripe-shaped material layer 314A is formed on the top surface of the protrusion 316. Then, the stripe-shaped material layer 314A is welded to the thin layer 317 with a laser in a state where it is spread over.

The flat-type field emission device (No. 4) can be produced, for example, by the following method.

[Step-2000]

The separation wall 313 for forming the spacer (gate electrode supporting portion) is formed on the support member 11, for example, by a sand blasting method.

[Step-2010]

Then, the electron-emitting portion is formed on the support member 11. Specifically, a mask layer made of a resist material is formed on the entire surface by a spin coating method, and the mask layer is removed from a region where the cathode electrode is to be formed between one separation wall 313 and another separation wall 313. Then, in the same manner as in [Step-600] in the flat-type field emission device (No. 1), an electrically conductive material layer made of chromium for a cathode electrode is formed on the entire surface by a sputtering method, and the mask layer is removed. In this manner, the electrically conductive material layer for a cathode electrode, formed on the mask layer, is removed, and the cathode electrode 12 which is to work as an electron-emitting portion is retained between one separation wall 313 and another separation wall 313.

[Step-2020]

Then, the stripe-shaped material layer 314A having a plurality of the opening portions 315 is arranged in a state where it is supported on the separation walls 313 which are the spacer so that a plurality of the opening portions 315 are positioned above the electron-emitting portions, whereby the gate electrode 314 which is made of the stripe-shaped material layer 314A and has a plurality of the opening portions 315 is positioned above the electron-emitting portions. The method of arranging the stripe-shaped material layer 314A can be as explained already.

The above method for forming the gate electrode can be applied to the production of any one of the above-explained various field emission devices.

In the flat-type field emission devices (No. 3) and (No. 4), the plan form of each opening portion 315 shall not be limited to a circle. FIGS. 80A, 80B, 80C and 80D show variants of the opening portions 315 formed in the stripe-shaped material layer 314A.

[Combination of Field Emission Device with Shield Member]

FIG. 81 shows a schematic partial end view of the electron-emitting portion 16 with a shield member 40 in the flat-type display according to the third aspect of the present invention. In an embodiment shown in FIG. 81, a second insulating layer 43 is formed on the gate electrode 14 and the insulating layer 13, and the shield member 40 is formed on the second insulating layer 43. The shield member 40 also works as a focus electrode. The shield member 40 and the insulating layer 43 have an opening portion 44 communicating with the opening portion 15. While a Spindt-type field emission device is shown as an example, the field emission device shall not be limited thereto and the above various field emission devices can be used.

The above field emission device combining the shield member 40 can be substantially produced by incorporating into the steps of producing the above various field emission devices, the steps of forming the second insulating layer 43 on the gate electrode 14 and the insulating layer 13, then, forming the shield member 40 on the second insulating layer 43 and then forming the opening portion 44 in the shield member 40 and the second insulating layer 43, so that a detailed explanation thereof is omitted. Depending upon the patterning of the shield member, the shield member may have a constitution in which shield member units each of which corresponds to one or a plurality of the electron-emitting portions or one or a plurality of the pixels are collected, or a constitution in which an electrically conductive material having the form of one sheet is covered on an effective field.

The shield member can be formed not only by the above method but also by a method in which an insulating film of $SiO_2$ is formed on each surface of a metal sheet made, for example, of a 42% Ni—Fe alloy having a thickness of tens $\mu$m and the opening portions 44 are formed in regions corresponding to pixels by punching or etching. Then, the first panel, the metal sheet and the second panel are stacked, a frame is arranged in circumferential portions of the panels, heat treatment is carried out to bond the insulating film formed on one surface of the metal sheet and the insulating layer 13 to each other, the insulating film formed on the other surface of the metal sheet and the second panel are bonded to each other to integrate these members, and a space is vacuumed and sealed, whereby a flat-type display can be completed.

The present invention has been explained with reference to Examples hereinabove, while the present invention shall not be limited thereto. The circuit constitutions of those various electron-emitting-portion cutoff circuits, anode-electrode cutoff circuits and shield-member cutoff circuits and the structures and constitutions of the flat-type displays and the cold cathode field emission devices explained in Examples are shown as examples and can be altered as required. The methods for producing the flat-type displays and the cold cathode field emission devices explained in Examples are also shown as examples and can be altered as required. The flat-type displays include the flat-type display according to the first aspect of the present invention, the flat-type display according to the second aspect of the present invention and the flat-type display according to the third aspect of the present invention and further include a combination of the flat-type display according to the first aspect of the present invention with the flat-type display according to the second aspect of the present invention, a combination of the flat-type display according to the first aspect of the present invention with the flat-type display according to the third aspect of the present invention, a combination of the flat-type display according to the second aspect of the present invention with the flat-type display according to the third aspect of the present invention and a combination of the flat-type display according to the first aspect of the present invention, the flat-type display according to the second aspect of the present invention and the flat-type display according to the third aspect of the present invention.

For example, the diode ($D_{13}$, $D_{23}$, $D_{33}$ . . . ) shown in FIG. 5 may be incorporated into the electron-emitting-portion cutoff circuit in the flat-type display according to the first constitution shown in FIG. 1 or 4. An electron-emitting-portion cutoff circuit in the flat-type display according to the third constitution can be obtained by combining the electron-emitting-portion cutoff circuit in the flat-type display according to the first constitution shown in FIG. 1 or 4 with the electron-emitting-portion cutoff circuit in the flat-type display according to the second constitution shown in FIG. 6.

Further, those various materials used in the production of the cold cathode field emission devices are shown as examples and can be altered as required. The cold cathode field emission devices have been explained as having a structure, generally, in which one electron-emitting portion (electron emission electrode) corresponds to one opening portion. Depending upon structures of the cold cathode field emission devices, the cold cathode field emission devices may have a structure in which a plurality of the electron-emitting portions (electron emission electrodes) correspond to one opening portion or one electron-emitting portion (electron emission electrode) corresponds to a plurality of the opening portions. otherwise, the cold cathode field emission devices may have a structure in which a plurality of the opening portions are formed in the gate electrode, one opening portion communicating with a plurality of the opening portions and one or a plurality of the electron-emitting portions are formed.

The gate electrode may have a constitution in which an electrically conductive material having the form of one sheet (having the opening portions) is covered on an effective field. In this case, a positive voltage $V_{G\text{-}SL}$ (for example, 160 volts) is applied to the above gate electrode. And, a switching element made, for example, of TFT is provided between the electron-emitting portion and the second driving circuit (cathode-electrode driving circuit), and the state of voltage application to the electron-emitting portion constituting a pixel is controlled by operation of the above switching element, whereby the light emission state of the pixel is controlled. There may be employed a constitution in which a plurality of the pixels (for example, one line of the pixels)

are used as one unit and an electron-emitting-portion cutoff circuit is provided between the electron-emitting portions constituting the above pixels as one unit and the second driving circuit (cathode-electrode driving circuit).

Otherwise, the cathode electrode may have a constitution in which an electrically conductive material having the form of one sheet is covered on an effective field. In this case, a voltage $V_{C\text{-}SL}$ (for example, 0 volt) is applied to the above cathode electrode. And, a switching element made, for example, of TFT is provided between the electron-emitting portion and the first driving circuit (gate-electrode driving circuit), and the state of voltage application to the electron-emitting portion constituting a pixel is controlled by operation of the above switching element, whereby the light emission state of the pixel is controlled. There may be employed a constitution in which a plurality of the pixels (for example, one line of the pixels) are used as one unit and an electron-emitting-portion cutoff circuit is provided between the electron-emitting portions constituting the above pixels as one unit and the second driving circuit (gate-electrode driving circuit).

The electron-emitting portion may be constituted of a device called a surface-conduction type electron emission device. The surface-conduction type electron emission device has a support member made, for example, of glass and pairs of electrodes which are formed on the support member and which are made of an electrically conductive material such as tin oxide ($SnO_2$), gold (Au), indium oxide ($In_2O_3$)/($SnO_2$), carbon or palladium oxide (PdO), have a very small area each and are arranged in the form of a matrix at constant intervals (gap). A thin carbon film is formed on each electrode. A wiring in the row direction is connected to one electrode of pair of the electrodes, and a wiring in the column direction is connected to the other electrode of pair of the electrodes. When a voltage is applied to a pair of the electrodes, an electric filed is exerted on the thin carbon films facing each other through the gap, to emit electrons from the thin carbon films. The above electrons are allowed to collide with a phosphor layer on an anode panel, whereby the phosphor layer is excited to emit light, and desired images can be obtained. It is sufficient to provide an electron-emitting-portion cutoff circuit between the wiring in the row direction and the electron-emitting-portion driving circuit and/or between the wiring in the column direction and the electron-emitting-portion driving circuit. Otherwise, it is sufficient to form an electron-emitting-portion cutoff circuit between the gate electrode formed above a pair of the electrodes and the electron-emitting-portion driving circuit.

As is clear from the above explanations, a discharging phenomenon that triggers a large-scale discharge is not prevented, but the growth of a small-scale discharge, if any, to be a large-scale discharge can be effectively prevented by providing the electron-emitting-portion cutoff circuit between the electron-emitting-portion driving circuit and the electron-emitting portion, by providing the anode-electrode cutoff circuit between the anode-electrode driving circuit and the anode electrode or by providing the shield-member cutoff circuit between the shield-member voltage-applying means and the shield member. As a result, damage of the cathode electrode, anode electrode, gate electrode and electron-emitting portion can be effectively prevented, or damage of the electron-emitting-portion driving circuit, the anode-electrode driving circuit and the shield-member voltage-applying means can be effectively prevented, so that the lifetime of the flat-type display can be increased. Further, damage by discharges that often take place at the initial stage of operation of the flat-type display can be prevented, and as a result, aging treatment of the flat-type display can be easily carried out.

What is claimed is:

1. A flat-type display comprising a first panel having electron-emitting portions; a second panel having an electron irradiation surface; and an electron-emitting-portion driving circuit for driving the electron-emitting portions, wherein an electron-emitting-portion cutoff circuit is provided between the electron-emitting portions and the electron-emitting-portion driving circuit for preventing a discharge between the electron-emitting portions and the electron irradiation surface.

2. The flat-type display according to claim 1, wherein a first predetermined voltage $V_{PD1}$ is applied to the electron-emitting-portion cutoff circuit, and when the potential of an electron-emitting portion connected to the electron-emitting-portion cutoff circuit comes to be a second predetermined voltage $V_{PD2}$ due to a discharge between the electron-emitting portion and the electron irradiation surface, the electron-emitting-portion cutoff circuit operates on the basis of a voltage difference ($V_{PD2}-V_{PD1}$) between the first predetermined voltage and the second predetermined voltage.

3. The flat-type display according to claim 2, wherein $|V_{OUT\text{-}MAX}-V_{PD1}|<V_{COLAPSE}$ is satisfied in which $V_{COLAPSE}$ is a breakdown voltage of the electron-emitting-portion driving circuit and $V_{OUT\text{-}MAX}$ is a maximum value of an output voltage of the electron-emitting-portion driving circuit.

4. The flat-type display according to claim 1, wherein a stripe-shaped gate electrode and a stripe-shaped cathode electrode extending in a direction different from the extending direction of the stripe-shaped gate electrode are provided, the electron-emitting portion is formed in an overlap region where a projection image of the stripe-shaped gate electrode and a projection image of the stripe-shaped cathode electrode overlap, the electron-emitting-portion driving circuit comprises a first driving circuit connected to the gate electrode and a second driving circuit connected to the cathode electrode, and the first driving circuit is connected to the gate electrode through the electron-emitting-portion cutoff circuit.

5. The flat-type display according to claim 4, wherein when no discharge takes place between the electron-emitting portion and the electron irradiation surface, the electron-emitting-portion cutoff circuit is in a non-operated state, and when a discharge takes place between the electron-emitting portion and the electron irradiation surface, the electron-emitting-portion cutoff circuit operates.

6. The flat-type display according to claim 4, wherein the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, (e) an opening portion formed through the gate electrode and the insulating layer, and (f) an electron emission electrode formed on a portion of the cathode electrode which portion is positioned in the bottom portion of the opening portion, and the electron emission electrode exposed in the bottom portion of the opening portion corresponds to the electron-emitting portion.

7. The flat-type display according to claim 4, wherein the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, and (e) an opening portion that is formed through the gate electrode and the insulating layer and has a bottom portion where the cathode electrode is exposed, and a portion of the cathode electrode which portion is exposed in the bottom portion of the opening portion corresponds to the electron-emitting portion.

8. The flat-type display according to claim 4, wherein the first panel has a plurality of cold cathode field emission devices, each cold cathode field emission device comprises;

(a) a support member, (b) a cathode electrode which is formed on or above the support member and has an edge portion, (c) an insulating layer formed at least on the cathode electrode, (d) a gate electrode formed on the insulating layer, and (e) an opening portion formed through at least the gate electrode and the insulating layer, and the edge portion of the cathode electrode which edge portion is exposed on the bottom portion or the side wall of the opening portion corresponds to the electron-emitting portion.

9. The flat-type display according to claim 1, wherein a stripe-shaped gate electrode and a stripe-shaped cathode electrode extending in a direction different from the extending direction of the stripe-shaped gate electrode are provided, the electron-emitting portion is formed in an overlap region where a projection image of the stripe-shaped gate electrode and the stripe-shaped cathode electrode overlap, the electron-emitting-portion driving circuit comprises a first driving circuit connected to the gate electrode and a second driving circuit connected to the cathode electrode, and the second driving circuit is connected to the cathode electrode through the electron-emitting-portion cutoff circuit.

10. The flat-type display according to claim 9, wherein when no discharge takes place between the electron-emitting portion and the electron irradiation surface, the electron-emitting-portion cutoff circuit is in a non-operated state, and when a discharge takes place between the electron-emitting portion and the electron irradiation surface, the electron-emitting-portion cutoff circuit operates.

11. The flat-type display according to claim 9, wherein the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, (e) an opening portion formed through the gate electrode and the insulating layer, and (f) an electron emission electrode formed on a portion of the cathode electrode which portion is positioned in the bottom portion of the opening portion, and the electron emission electrode exposed in the bottom portion of the opening portion corresponds to the electron-emitting portion.

12. The flat-type display according to claim 9, wherein the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, and (e) an opening portion that is formed through the gate electrode and the insulating layer and has a bottom portion where the cathode electrode is exposed, and a portion of the cathode electrode which portion is exposed in the bottom portion of the opening portion corresponds to the electron-emitting portion.

13. The flat-type display according to claim 9, wherein the first panel has a plurality of cold cathode field emission devices, each cold cathode field emission device comprises;

(a) a support member, (b) a cathode electrode which is formed on or above the support member and has an edge portion, (c) an insulating layer formed at least on the cathode electrode, (d) a gate electrode formed on the insulating layer, and (e) an opening portion formed through at least the gate electrode and the insulating layer, and the edge portion of the cathode electrode which edge portion is exposed on the bottom portion or the side wall of the opening portion corresponds to the electron-emitting portion.

14. The flat-type display according to claim 1, wherein a stripe-shaped gate electrode and a stripe-shaped cathode electrode extending in a direction different from the extending direction of the stripe-shaped gate electrode are provided, the electron-emitting portion is formed in an overlap region where a projection image of the stripe-shaped gate electrode and a projection image of the stripe-shaped cathode electrode overlap, the electron-emitting-portion driving circuit comprises a first driving circuit connected to the gate electrode and a second driving circuit connected to the cathode, and the electron-emitting-portion cutoff circuit comprises a first cutoff circuit provided between the gate electrode and the first driving circuit and a second cutoff circuit provided between the cathode electrode and the second driving circuit.

15. The flat-type display according to claim 14, wherein when no discharge takes place between the electron-emitting portion and the electron irradiation surface, the first and second cutoff circuits are in a non-operated state, and when a discharge takes place between the electron-emitting portion and the electron irradiation surface, the first cutoff circuit operates, and the second cutoff circuit operates on the basis of operation of the first cutoff circuit.

16. The flat-type display according to claim 14, wherein the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, (e) an opening portion formed through the gate electrode and the insulating layer, and (f) an electron emission electrode formed on a portion of the cathode electrode which portion is positioned in the bottom portion of the opening portion, and the electron emission electrode exposed in the bottom portion of the opening portion corresponds to the electron-emitting portion.

17. The flat-type display according to claim 14, wherein the first panel has a plurality of cold cathode field emission devices, each cold cathode field emission device comprises;

(a) a support member, (b) a cathode electrode formed on the support member, (c) an insulating layer formed on the support member and the cathode electrode, (d) a gate electrode formed on the insulating layer, and (e) an opening portion that is formed through the gate electrode and the insulating layer and has a bottom portion where the cathode electrode is exposed, and a portion of the cathode electrode which portion is exposed in the bottom portion of the opening portion corresponds to the electron-emitting portion.

18. The flat-type display according to claim 14, wherein the first panel has a plurality of cold cathode field emission devices, each cold cathode field emission device comprises;

(a) a support member, (b) a cathode electrode which is formed on or above the support member and has an edge portion, (c) an insulating layer formed at least on the cathode electrode, (d) a gate electrode formed on the insulating layer, and (e) an opening portion formed through at least the gate electrode and the insulating layer, and the edge portion of the cathode electrode which edge portion is exposed on the bottom portion or the side wall of the opening portion corresponds to the electron-emitting portion.

19. The flat-type display according to claim 1, wherein the second panel comprises a substrate, phosphor layers and an anode electrode.

20. The flat-type display according to claim 19, wherein an anode-electrode driving circuit is further provided and an anode-electrode cutoff circuit is provided between the anode electrode and the anode-electrode driving circuit for preventing a discharge between the electron-emitting portion and the electron irradiation surface.

21. A flat-type display comprising a first panel having electron-emitting portions; a second panel having an electron irradiation surface composed of phosphor layers and an anode electrode; and an anode-electrode driving circuit for driving the anode electrode, wherein an anode-electrode cutoff circuit is provided between the anode electrode and the anode-electrode driving circuit for preventing a discharge between the electron-emitting portions and the electron irradiation surface.

22. The flat-type display according to claim 21, wherein when no discharge takes place between the electron-emitting portion and the electron irradiation surface, the anode-electrode cutoff circuit is in a non-operated state, and when a discharge takes place between the electron-emitting portion and the electron irradiation surface, the anode-electrode cutoff circuit operates.

23. The flat-type display according to claim 21, wherein the anode-electrode cutoff circuit operates on the basis of an electric current that flows between the anode electrode and the anode-electrode driving circuit due to a discharge between the electron-emitting portion and the electron irradiation surface.

24. A flat-type display comprising a first panel having electron-emitting portions; a second panel having an electron irradiation surface; an electron-emitting-portion driving circuit for driving the electron-emitting portions; a shield member disposed between the electron-emitting portions and the electron irradiation surface; and a shield-member voltage-applying means for applying a voltage to the shield member, wherein a shield-member cutoff circuit is provided between the shield member and the shield-member voltage-applying means for preventing a discharge between the shield member and the electron irradiation surface.

25. The flat-type display according to claim 24, wherein the second panel comprises a substrate, phosphor layers and an anode electrode.

26. The flat-type display according to claim 24, wherein an anode-electrode driving circuit is further provided and an anode-electrode cutoff circuit is provided between the anode electrode and the anode-electrode driving circuit for preventing a discharge between the shield member and the electron irradiation surface.

* * * * *